US008475226B2

(12) United States Patent
Comfort

(10) Patent No.: US 8,475,226 B2
(45) Date of Patent: Jul. 2, 2013

(54) INTERCONNECTING MODULAR PATHWAY APPARATUS

(75) Inventor: Andrew Comfort, Minneapolis, MN (US)

(73) Assignee: Q-BA-MAZE, Inc., Minneapolis, MN (US)

( * ) Notice: Subject to any disclaimer, the term of this patent is extended or adjusted under 35 U.S.C. 154(b) by 839 days.

(21) Appl. No.: 11/406,824

(22) Filed: Apr. 18, 2006

(65) Prior Publication Data

US 2007/0060012 A1 Mar. 15, 2007

Related U.S. Application Data

(60) Provisional application No. 60/672,286, filed on Apr. 18, 2005, provisional application No. 60/682,146, filed on May 18, 2005, provisional application No. 60/696,611, filed on Jul. 5, 2005, provisional application No. 60/748,684, filed on Dec. 8, 2005.

(51) Int. Cl.
*A63H 33/08* (2006.01)

(52) U.S. Cl.
USPC ..... 446/168

(58) Field of Classification Search
USPC ..... 446/168, 169, 170, 171, 173, 85, 446/120, 121, 124, 444; 463/169; 238/10 A, 238/10 E, 10 F; D21/484, 501
See application file for complete search history.

(56) References Cited

U.S. PATENT DOCUMENTS

| | | | | |
|---|---|---|---|---|
| 1,531,542 | A | 3/1925 | Cogshall | |
| 2,472,363 | A | 6/1949 | Blackinton | |
| 2,619,829 | A * | 12/1952 | Tatum | 52/590.2 |
| 3,028,704 | A * | 4/1962 | Rumbaugh | 446/168 |
| 3,034,254 | A | 5/1962 | Christensen | |
| 3,145,501 | A * | 8/1964 | Grosser | 446/121 |
| 3,405,479 | A | 10/1968 | Paulson | |
| 3,466,044 | A | 9/1969 | Somerville | |
| 3,662,508 | A * | 5/1972 | Slayden | 52/393 |
| 3,696,549 | A | 10/1972 | Zilius | |
| 3,698,149 | A * | 10/1972 | Baker et al. | 52/844 |
| 3,946,516 | A | 3/1976 | Wirth | |
| 3,994,076 | A | 11/1976 | Bertman et al. | |

(Continued)

FOREIGN PATENT DOCUMENTS

| | | |
|---|---|---|
| CH | 519346 | 2/1972 |
| DE | 19938848 | 4/2000 |

(Continued)

OTHER PUBLICATIONS http://www.nikitiki.co.jp/toymakers/13/images/cuboro elements all.gif, Mar. 9, 2006, 2 pgs.

(Continued)

*Primary Examiner* — Gene Kim
*Assistant Examiner* — Amir Klayman
(74) *Attorney, Agent, or Firm* — Winthrop & Weinstine, P.A.

(57) ABSTRACT

The present invention provides for a plurality of interconnectable modular members that may create a pathway system with multiple entrances into the upper portion of each member and at least one exit from the lower portion of each member, thereby providing for a variety of convergence and divergence possibilities. The pathway system is suitable for receiving and transporting marbles and other spherical objects from one member to another. The modular members may be interlinked via male/female connectors to create a variety of configurations.

57 Claims, 109 Drawing Sheets

U.S. PATENT DOCUMENTS

| | | | | |
|---|---|---|---|---|
| 4,274,221 | A | | 6/1981 | Boutet |
| 4,378,116 | A | | 3/1983 | Rubik |
| 4,405,131 | A | | 9/1983 | Horvath |
| 4,553,749 | A | | 11/1985 | Bender et al. |
| 4,650,437 | A | | 3/1987 | Sitkus |
| D290,026 | S | | 5/1987 | Wichman |
| D290,028 | S | | 5/1987 | Wichman |
| D290,143 | S | | 6/1987 | Wichman |
| 4,713,038 | A | | 12/1987 | Wichman et al. |
| 4,808,140 | A | | 2/1989 | Clavet |
| 4,874,342 | A | | 10/1989 | Klitsner |
| 4,932,917 | A | | 6/1990 | Klitsner |
| 4,942,700 | A | | 7/1990 | Hoberman |
| 4,964,833 | A | * | 10/1990 | Suzuki ..... 446/118 |
| 4,971,246 | A | | 11/1990 | Goudis |
| 5,024,031 | A | | 6/1991 | Hoberman |
| 5,061,218 | A | | 10/1991 | Garage et al. |
| 5,267,863 | A | | 12/1993 | Simmons, Jr. |
| 5,312,285 | A | | 5/1994 | Rieber et al. |
| 5,314,367 | A | | 5/1994 | Schaefer |
| 5,332,216 | A | | 7/1994 | Whipple |
| D350,784 | S | | 9/1994 | Nielsen et al. |
| 5,344,143 | A | | 9/1994 | Yule |
| 5,386,994 | A | | 2/1995 | Baranowski |
| 5,451,177 | A | | 9/1995 | Gilman |
| 5,494,292 | A | | 2/1996 | Mileti |
| 5,525,089 | A | * | 6/1996 | Heinz ..... 446/119 |
| 5,826,394 | A | * | 10/1998 | Barton et al. ..... 52/592.1 |
| D403,028 | S | | 12/1998 | Barton, Jr. et al. |
| 5,924,907 | A | | 7/1999 | Tobin |
| 5,928,052 | A | | 7/1999 | Buscher |
| 5,944,575 | A | | 8/1999 | Tolnay |
| D428,912 | S | | 8/2000 | Bolle |
| D430,231 | S | | 8/2000 | Sorensen et al. |
| 6,248,026 | B1 | | 6/2001 | Wanchena |
| 6,273,778 | B1 | | 8/2001 | Kyster |
| 6,293,800 | B1 | | 9/2001 | Robertson |
| 6,340,323 | B1 | | 1/2002 | Glynn |
| D456,463 | S | | 4/2002 | Sorensen |
| 6,427,926 | B1 | * | 8/2002 | Lai ..... 238/10 R |
| D465,247 | S | | 11/2002 | Sorensen |
| 6,536,763 | B1 | | 3/2003 | Braun |
| 6,568,679 | B1 | | 5/2003 | Sommer |
| 6,588,168 | B2 | * | 7/2003 | Walters ..... 52/604 |
| 6,616,499 | B1 | * | 9/2003 | Sorensen ..... 446/85 |
| 6,645,033 | B1 | * | 11/2003 | Thomsen ..... 446/120 |
| D492,736 | S | | 7/2004 | Kato |

FOREIGN PATENT DOCUMENTS

| | | | |
|---|---|---|---|
| FR | 2 646 096 | A | 10/1990 |
| JP | 1094681 | | 4/1998 |
| WO | WO 94/26372 | * | 11/1994 |

OTHER PUBLICATIONS http://www.nikitiki.co.jp/toymakers/16/menu/html, Sep. 14, 2006, 1 pg.

http://www.taurustoy.com/ The Block and Marble Maze Construction System, Block-N-Roll™, Sep. 14, 2006, 2 pgs.

http://www.sommercube.com/index.html, Symmetry Under Transformation, Sommer Cube®, Mar. 9, 2006, 4 pgs.

http://www.klimba.ch/d/produkte/maxi.php, Klimba-die klingende Kugelbahn, Mar. 20, 2006, 4 pgs.

http://www.klimba.ch/klimba2005/suissetoy05/pages/127-2729.html, Klimba-die klingende Kugelbahn, Sep. 14, 2006, 2pgs.

http://www.quercetti.com/construction.htm, *Quercetti* Intelligent Toys—Marble Run, Mar. 11, 2005, 2pgs.

http://www.quercetti.com/new-2001/marblespiral.htm, *Quercetti* Intelligent Toys—Marble Run #6558, Mar. 11, 2005, 1 p.

http://www.quercetti.com/new-2001/marblevortex.htm, *Quercetti* Intelligent Toys—Marble Run #6538, Mar. 11, 2005, 1 p.

http://www.quercetti.com/new-2001/supermarble.htm, *Quercetti* Intelligent Toys—Marble Run #6588, Mar. 11, 2005, 1 p.

http://www.quercetti.com/new-2001/marbletransparent.htm, *Quercetti* Intelligent Toys—Marble Run #6546, Mar. 11, 2005, 1 p.

http://www.quercetti.com/marbles/supermarble.htm, *Quercetti* Intelligent Toys—Marble Run, Mar. 11, 2005, 2 pgs.

http://www.quercetti.com/new-2001/sky6440.htm, *Quercetti* Intelligent Toys—Skyrail™ #6440, Mar. 11, 2005, 1 pg.

http://www.quercetti.com/new-2001/skysuspension.htm, *Quercetti* Intelligent Toys—Suspension #6450, Mar. 11, 2005, 2pgs.

http://www.quercetti.com/new-2001/ skybase.htm, *Quercetti* Intelligent Toys—Roller Coaster #6430, Mar. 11, 2005, 2 pgs.

http://www.quercetti.com/new-2001/ skyroller.htm, *Quercetti* Intelligent Toys—Roller Coaster #6435, Mar. 11, 2005, 2 pgs.

http://www.quercetti.com/new-2001/crazyrun. htm, *Quercetti* Intelligent Toys—Crazyrun Magnetic #6410, Mar. 11, 2005, 1 pg.

http://www.galtloys.com/ind_ products.php?id = A0555K, GALT Marble Run, Mar. 11, 2005, 1 pg.

http://www.galttoys.com/ind_products.php?id=A0560E, Galt Super Marble Run, Mar. 11, 2005, 1pg.

http://www.galttoys.com/ind_products.php?id= A0512, Galt Marble Racer-120, Mar. 11, 2005, 1pg.

http://www.frigits.com, Frigits, Mar. 11, 2005, 2 pgs.

http://www.educationaltoys.co.uk/acatalog/ET_Online_Catalogue_Marble_Runs_18html Mar. 11, 2006, 4pgs.

http://www.scalino.de/site-eur/product/mk-gt-d.htm, Glockenturm, Art, Nr. 641, Mar. 11, 2005, 1 pg.

http://www.scalino.de/site-eur/produkte/gk-st0-d.htm, Stufe 0, Art. Nr. 600, Mar. 11, 2005, 1 pg.

http://www.scalino.de/site-eur/produkte/gk-stl-d.htm, Stufe 1, Art. Nr. 601, Mar. 11, 2005, 1 pg.

http://www.scalino.de/site-eur/produkte/gk-st2-d.htm, Stufe 2 , Art. Nr. 602, Mar. 11, 2005, 1 pg.

http://www.scalino.de/site-eur/produkte/gk-st3-d.htm, Stufe 3, Art. Nr. 603, Mar. 11, 2005, 1 pg.

http://www.haba.de/Kugelbahn.kba.0html?&tx_habaproducts_pi1[showUid]=601&tx_hab . . . , Haba: Erfinder Tur Kinder, Mar. 11, 2005, 2pgs.

http://www.haba.de/Kugelbahn.kba.0html?&tx_habaproducts_pi1[showUid]=5888&tx_hab . . . , Haba: Erfinder fur Kinder, Mar. 11, 2005, 2pgs.

http://www.elc.co.uk/sku-107346/pl-Puzzles/p2-30/Product.do, Marble Madness, Mar. 11, 2005, 1pg.

http://www.mastermindtoys.com/store/product.asp?product%5Fcode=47711&cat=0&brand . . . ,Block-N-Roll Deluxe Set, Mar. 11, 2005, 2pgs.

http://www.cuboro.ch, Cuboro, The marble track for a lifetime, Swiss made, mod. dep., 1986-2005, 10 pgs.

* cited by examiner 330
10
310
310
330

360
720
10
200
910
600
720
200
P
P
200
P
800

10
310
310
330
410
1000

910
600
600
910

310
410

10
310
350
330

1000
700

720
700

P

Q
boh
2005

10

10

310
350
330

PH.

ENTRANCE AREA TO
CIRCLE AREA RATIO:
| | | |
|---|---|---|
| A/A' = 0.3927/0.1963 = 2.00 | Fig. 27A 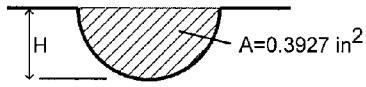  | Fig. 27B 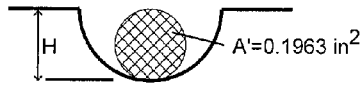  |
| A/A' = 0.5000/0.1963 = 2.55 | Fig. 27C 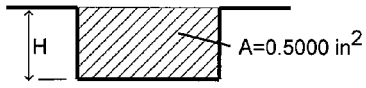  | Fig. 27D 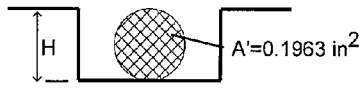  |
| | | |
| A/A' = 0.2387/0.1963 = 1.22 | Fig. 27E 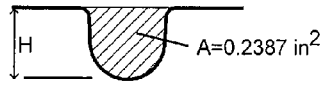  | Fig. 27F 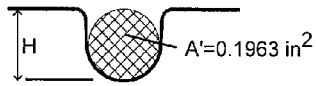  |
| A/A' = 0.2728/0.1963 = 1.39 | Fig. 27G 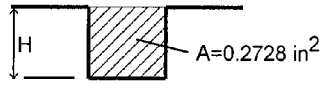  | Fig. 27H 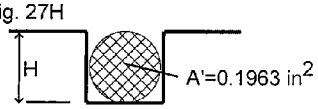  |

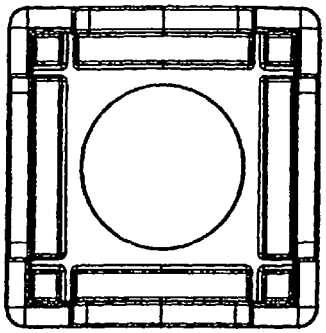
fig A
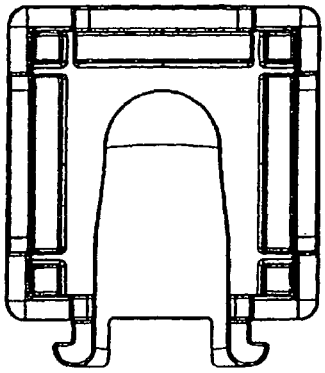
fig B
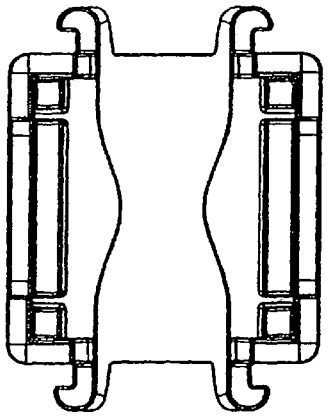
fig C
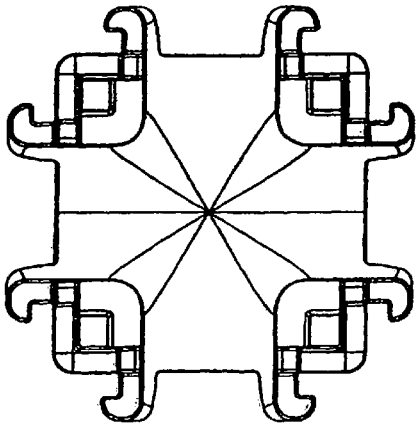
fig D
Fig 49

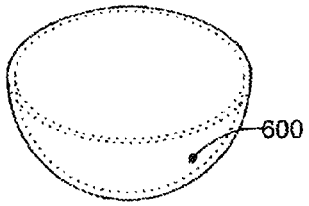
Fig. A-1
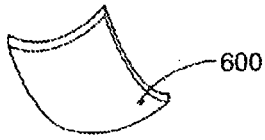
Fig. A-2
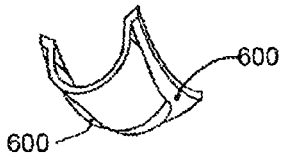
Fig. E-1
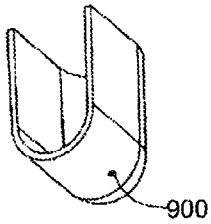
Fig. B-1
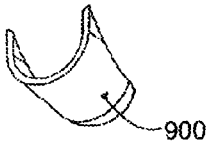
Fig. B-2
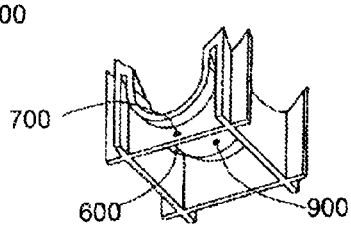
Fig. E-2
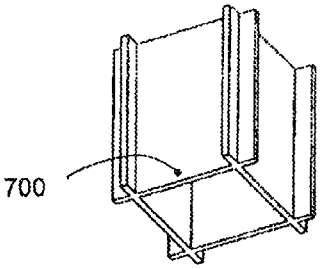
Fig. C-1
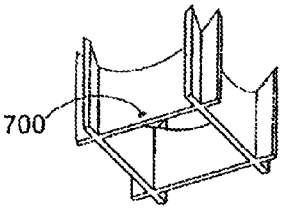
Fig. C-2
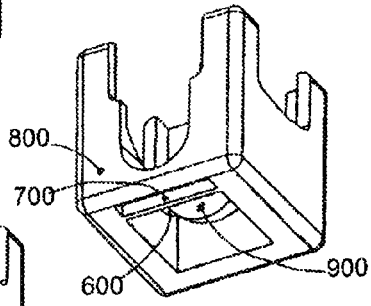
Fig. E-3
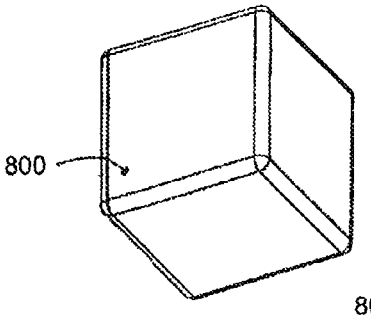
Fig. D-1
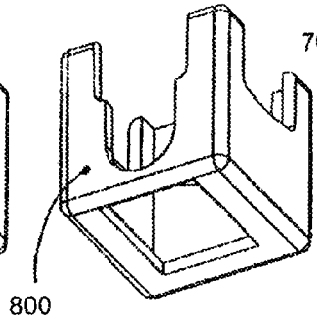
Fig. D-2
Fig. 51

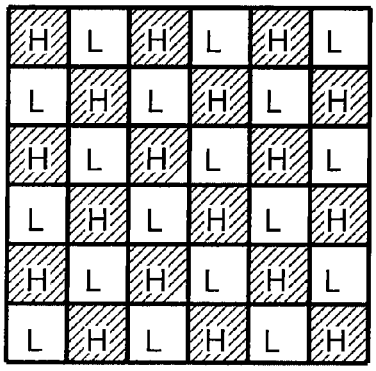
FIG. 64A: CUBIC/ORTHOGONAL VARIATION
KEY
H=high
L=low
high and low members are offsetby a vertical shift
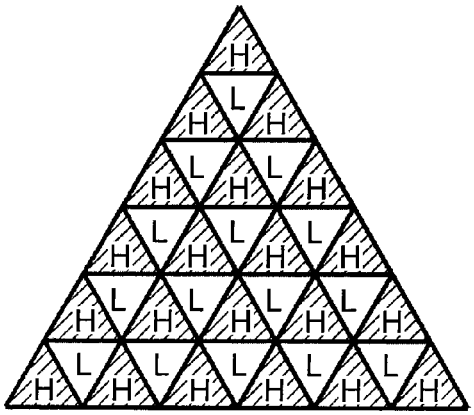
FIG. 64B: TRIANGULAR VARIATION
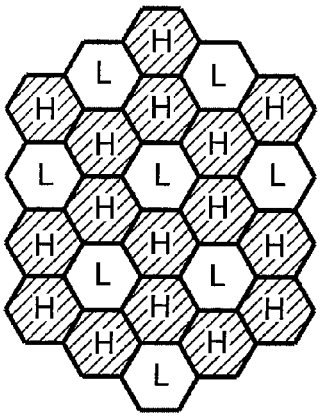
FIG. 64C: HEXAGONAL VARIATION #1
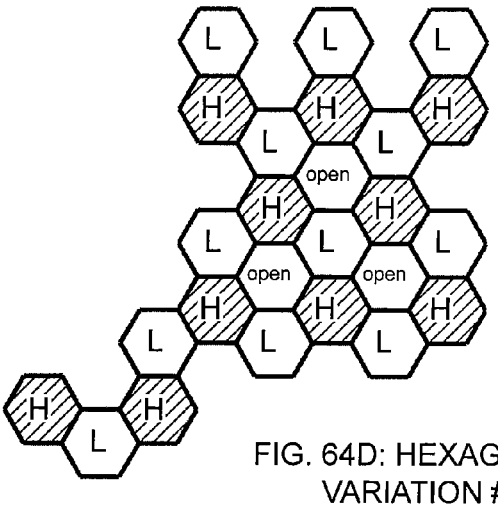
FIG. 64D: HEXAGONAL VARIATION #2

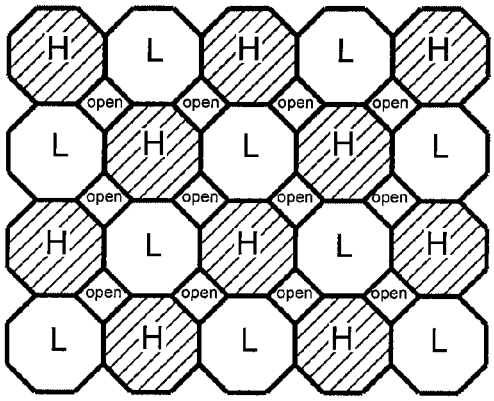
FIG. 64E: OCTAGONAL VARIATION
KEY
H=high
L=low
high and low members are offsetby a vertical shift
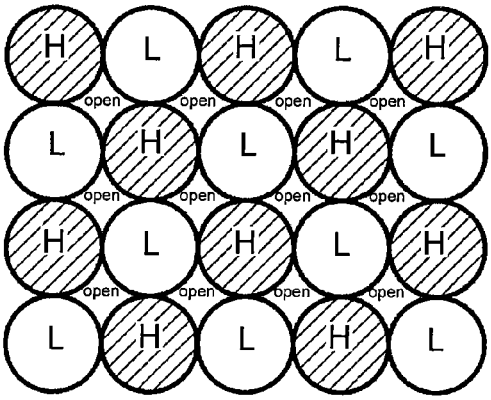
FIG. 64F: CIRCULAR VARIATION #1 (ORTHOGONAL GRID GEOMETRY)
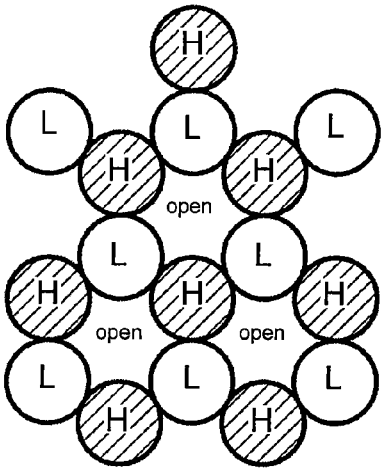
FIG. 64G: CIRCULAR VARIATION #2 (TRIANGULAR/HEXAGONAL GRID GEOMETRY)

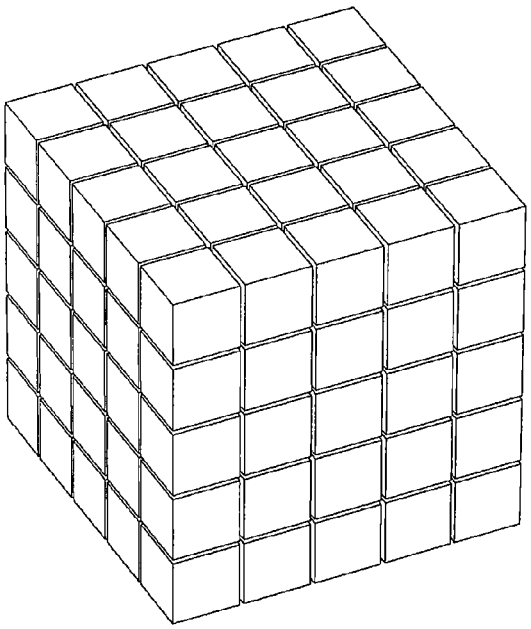
CARTESIAN SPACE
WITH CUBES
FIG. 65A: ISOMETRIC VIEW
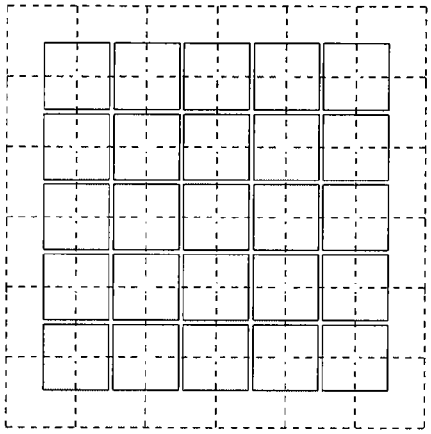
FIG. 65B: PLAN VIEW
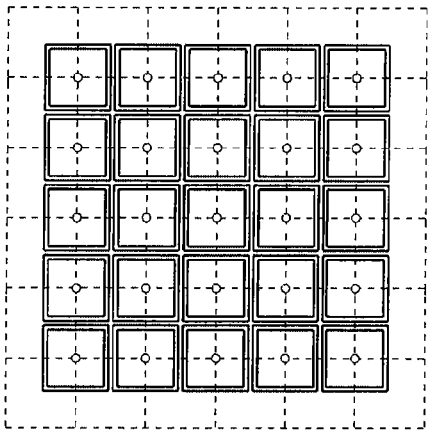
FIG. 65C: SECTION VIEW 1/2 BLOCK
SHIFTED CARTESIAN SPACE
WITH CUBES
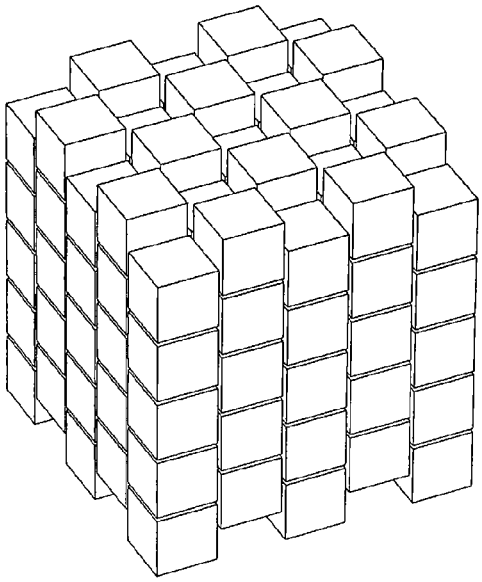
FIG. 65D: ISOMETRIC VIEW
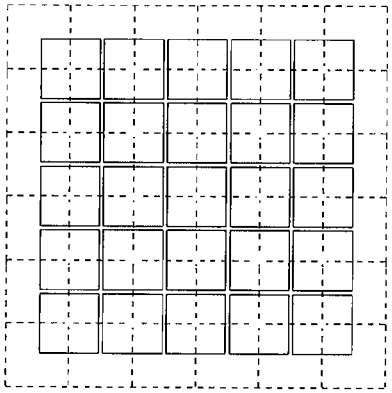
FIG. 65E: PLAN VIEW
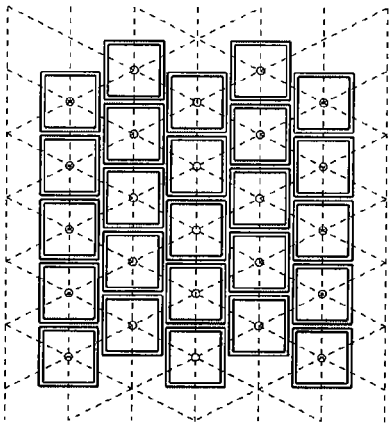
FIG. 65F: SECTION VIEW SHIFTED CUBES
1/3 STEP
BETWEEN MEMBERS
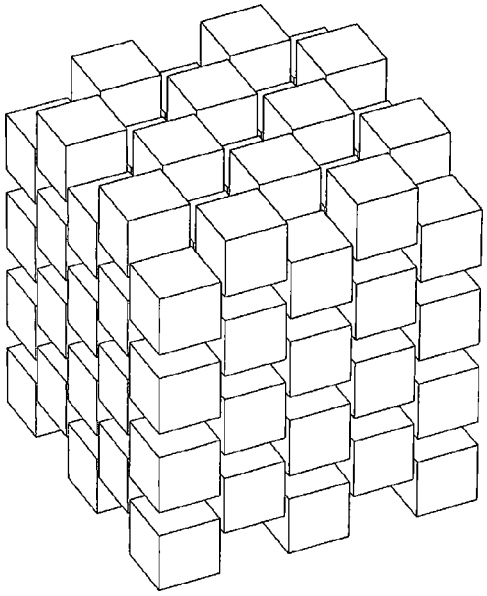
FIG. 65G: ISOMETRIC VIEW
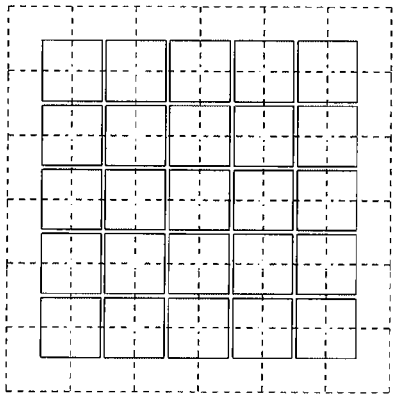
FIG. 65H: PLAN VIEW
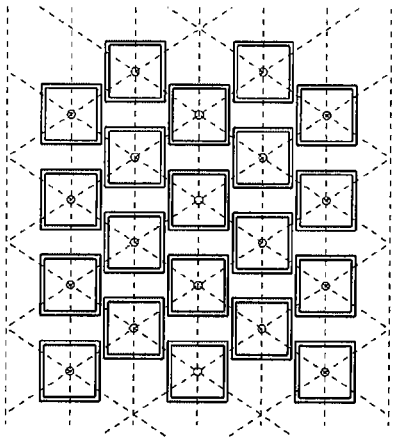
FIG. 65I: SECTION VIEW 1/2 STEP
SHIFTED CARTESIAN SPACE
WITH RECTANGULAR BLOCKS
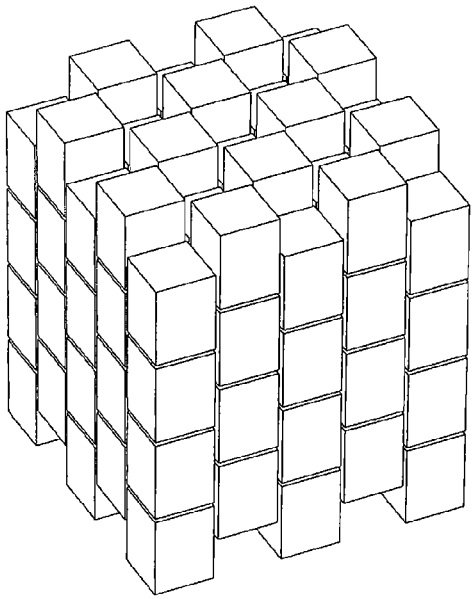
FIG. 65J: ISOMETRIC VIEW
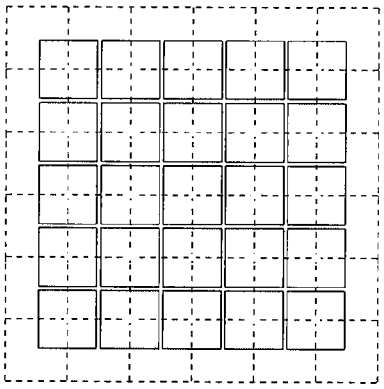
FIG. 65K: PLAN VIEW
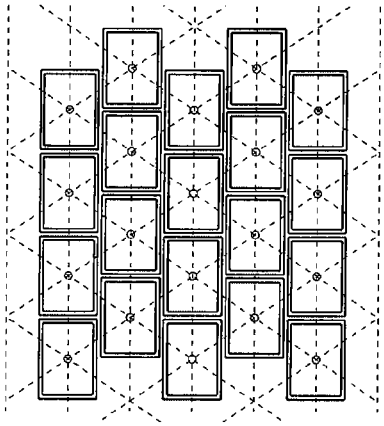
FIG. 65L: SECTION VIEW

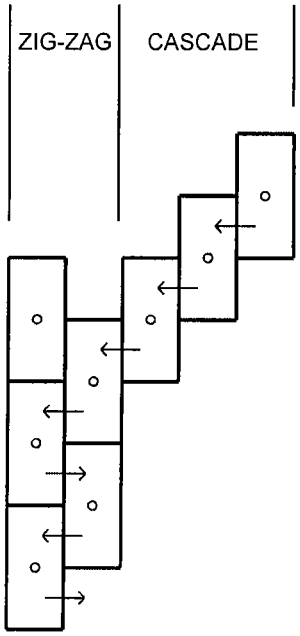
FIG. 65M:VERSION WITH ELONGATED VERTICAL DIMENSION
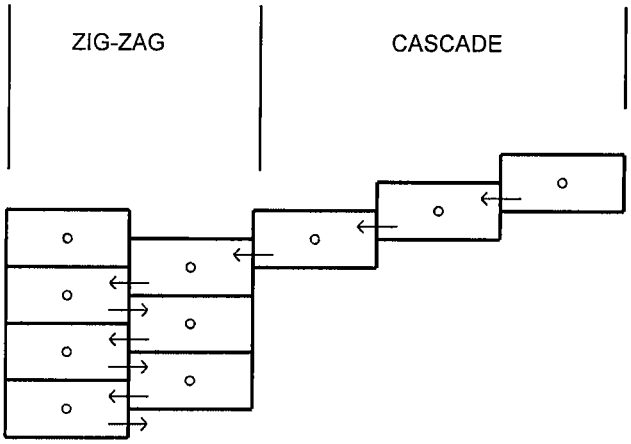
FIG. 65N: VERSION WITH TRUNCATED VERTICAL DIMENSION 00800
HALF STEP
SHIFTED
SPACE ON
A SQUARE,
TRIANGLE,
AND HEXAGONAL
TILING
USING JUST
CUBES AND
TRIANGULAR
SOLIDS

INTERCONNECTING MODULAR PATHWAY APPARATUS

CROSS-REFERENCE TO RELATED APPLICATIONS

This application claims the benefit of U.S. Provisional Application No. 60/672,286 filed Apr. 18, 2005, U.S. Provisional Application No. 60/682,146, filed May 18, 2005, U.S. Provisional Application No. 60/696,611, filed Jul. 5, 2005, and U.S. Provisional Application No. 60/748,684, filed Dec. 8, 2005, the contents of each of which are incorporated herein in their entirety.

BRIEF SUMMARY OF THE INVENTION

The present invention provides for a plurality of interconnectable modular members that may create a pathway system with multiple entrances into the upper portion of each member and at least one exit from the lower portion of each member, thereby providing for a variety of convergence and divergence possibilities. The system of the present invention is appropriate for receiving and transporting a spherical object such as a marble, and the drawings further illustrate various principles and embodiments in accordance with the present invention.

In one embodiment, the modular members have a generally cubical form, but a variety of other member shapes are possible. Each cubical member generally defines at least one exit. For example, a horizontal exit may be defined in a cubical member by an opening in a vertical face of the member. A cubical member may have anywhere from one to four horizontal exists, but as shown in the drawings, other member forms and shapes with varying numbers of exits are also possible. Another form of a cubical member is a vertical exit member, which defines a vertical exit in an underside of the member.

Any of the modular members may be interconnected with other like members via male/female connectors regardless of whether the members have one or more horizontal exits or a single vertical exit. In the case of the cubical members, because each member includes five entrances, every member allows for a convergence of up to five other members' exits. Additionally, each member may allow different levels of divergence, corresponding to the number of exits provided by the member.

A variety of joinery possibilities are suitable for use with the present invention. For example, horizontal exit cubical members may define a male horizontal connector or joint for each horizontal exit, typically comprising two vertically aligned members, optionally with a curved component connecting the vertically aligned members from below thereby creating a U-shape, and protruding outside a vertical face of the member and situated in the lower portion of the member and on either side of the horizontal exit. Each of the modular members, both the horizontal exit members and the vertical exit members, also typically define four female horizontal connectors or joints, situated in an upper portion of the member, for receiving and interconnecting with the male connector of another member. The interconnected members are thereby horizontally coupled.

Two horizontally coupled cubical members are vertically staggered, creating a half-step vertical shift between neighboring members. In other embodiments, this vertical offset may be more or less than a half-block offset. This shift aligns an elevated member's exits with the neighboring members' entrances. A solid mass of blocks can be assembled which automatically results in a checkerboard effect, in which adjacent vertical columns of blocks are staggered one half step. A three dimensional grid of "shifted Cartesian space" (the 3D checkerboard) describes the potential position of any block in a construction. Solid, lattice, linear, planar, intersecting planar and other constructions, are possible; the basic configurations that are used to build particular constructions are cascade, slalom, zig-zag, single helix, and double helix.

In the foregoing description, embodiments of the present invention, including preferred embodiments, have been presented for the purpose of illustration and description. They are not intended to be exhaustive or to limit the invention to the precise form disclosed. For instance, the cubical member is only one embodiment of the present invention; modular members with a variety of other shapes and forms may be consistent with the principles described. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention.

BRIEF DESCRIPTION OF THE DRAWINGS

FIGS. 27A-27D are front views of modular member entrances with groove-on-top configurations.

FIGS. 27E-27H front are views of modular member entrance showing entrance opening cross-sectional areas and marble cross-section areas.

FIGS. 43, 43A, and 43B are perspective and cutaway views of three interlinked cubical modular members with U-shaped joinery.

FIGS. 44, 44A, and 44B are perspective and cutaway views of three interlinked cubical modular members with U-shaped joinery.

FIGS. 45, 45A, and 45B are perspective and cutaway views of two interlinked cubical modular members with U-shaped joinery.

FIGS. 49A-49D are plan views of the four cubic block exit configurations in accordance with one embodiment of the present invention.

FIG. 51 is worm's eye views of the constituent elements of FIG. 50.

FIGS. 64A-64D are schematic plans of cubic, triangular, and hexagonal modular member layout configurations in accordance with the present invention.

FIGS. 64E-64G are schematic plans of cubic layout configurations with octagonal and circular members, and a triangular layout configuration with circular members, in accordance with the present invention.

FIGS. 65A-65C are views of Cartesian arrangement of cubes.

FIGS. 65D-65F are views of shifted-Cartesian arrangement of cubes in a vertical ½-step checkerboard configuration.

FIGS. 65G-65I are views of vertically shifted members with a ⅓-step between vertically adjacent members.

FIGS. 65J-65L are views of vertically shifted elongated members with a ½-step checkerboard configuration.

FIGS. 65M-65N are views of the same configuration achieved with vertically elongated and vertically truncated members.

DETAILED DESCRIPTION OF THE INVENTION

I. Modular Members

The modular members of the present invention may take a variety of shapes and forms that are consistent with the principles disclosed throughout this description. Like-members are interconnectable and may form pathways through a series of exits and entrances from one member to another connected member. These pathways are suitable for receiving and transporting a spherical object, such as a marble, or other appropriate objects or liquids. When several like-members are connected, thereby creating several pathways, the convergence and divergence caused by the pattern of exits and entrances may provide an amount of randomness in determining which pathway will actually be traveled by a sphere set into the assembly.

A. Entrances and Exits

(i) General Attributes of Members

With reference to FIGS. 1A-1L, 2A-2L, 3A-3L, 4A-4L, 5A-5J, 6A-6I, 7A-7J, 8A-8I, 9A-9I, 10A-10I, 11A-11J, 12A-12J, and 13A-13J, each modular member therein defines one or more exits and a plurality of entrances, which are determined by the particular shape of the member.

For instance, in the embodiments where the modular members have a substantially cubical shape, shown in FIGS. 1A-1L, 2A-2L, 3A-3L, 4A-4L, 5A-5J, 7A-7J, 11A-11J, 12A-12J, and 13A-13J, each member has at least one exit and several entrances, which, as described in more detail below, may be considered as four horizontal entrances and one vertical entrance. In the cubical embodiments, a member may have between one and four horizontal exits formed in the vertical faces of the member, or, alternatively, a single vertical exit formed in an underside of the member. Cubical members with two horizontal exits may form the exits in either adjacent or opposing sides of the member. In the cubical embodiment, each member also defines horizontal entrances in each of its four vertical faces as well as a vertical entrance.

Figures 14A, 14B, 14C, 14D, 14E, 14F, 14G, 14H, 14I, 14J, 14K, 14L:
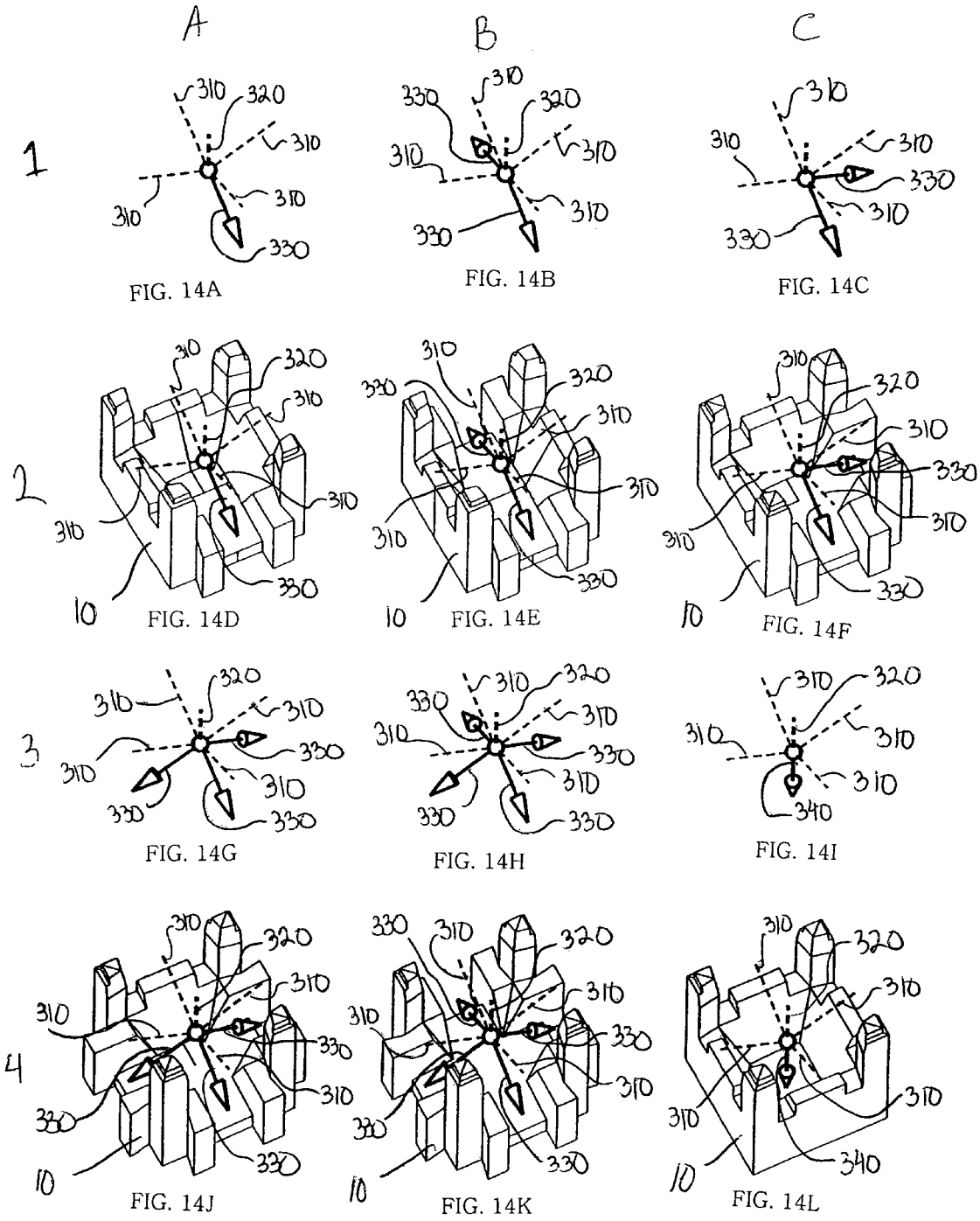
FIGS. 14A-14C are perspective views of entrance/exit configurations for any cubic modular member.
FIGS. 14D-14F are perspective views of example cubical interlinkable modular member corresponding to the entrance/exit configurations of FIGS. 14A-14C.
FIGS. 14G-14I are perspective views of entrance/exit configurations for any cubic modular member.
FIGS. 14J-14L are perspective views of example cubical interlinkable modular members corresponding to the entrance/exit configurations of FIGS. 14G-14I.

The entrances and exits of the cubical members are shown in more detail in FIGS. 14A-14L, where the entrances are denoted by dashed lines and the exits are denoted by solid lines with an arrow. With reference to FIG. 14A, the entrance/exit pathway schematic for five entrances (four "horizontal" entrances 310 and one "vertical" entrance 320) and one horizontal exit 330 are shown, without an actual modular member. The same entrance/exit schematic is shown, with a cubical member 10 defining those entrances 310/320 and exit 330, FIG. 14D. Similarly, the entrance/exit schematic for five entrances 310/320 and two horizontal exits 330 are shown, without the actual members, in FIG. 14B for opposing side exits and FIG. 14C for adjacent side exits. The corresponding entrance/exit schematics are shown, with cubical members 10 defining those entrances and exits, in FIGS. 14E and 14F respectively. The entrance/exit schematics for three horizontal exits 330 is shown in FIGS. 14G and 14J and four horizontal exits 330 is shown in FIGS. 14H and 14K. The entrance/exit schematic for a single vertical exit 340 is shown FIGS. 14I and 14L.

In an alternative embodiment, the modular members have a triangular shape, shown in FIGS. 6A-6I, where each member 20 has at least one exit, three horizontal entrances, and one vertical entrance. A triangular member 20 may have between one and three horizontal exits 330 formed in the vertical faces of the member 20, or, alternatively, a single vertical exit 340 formed in an underside of the member 20. In triangular embodiments, each member 20 also defines horizontal entrances 310 in each of its three vertical faces as well as a vertical entrance 320.

Figures 15A, 15B, 15C, 15D, 15E, 15F, 15G, 15H, 15I, 15J, 15K, 15L:
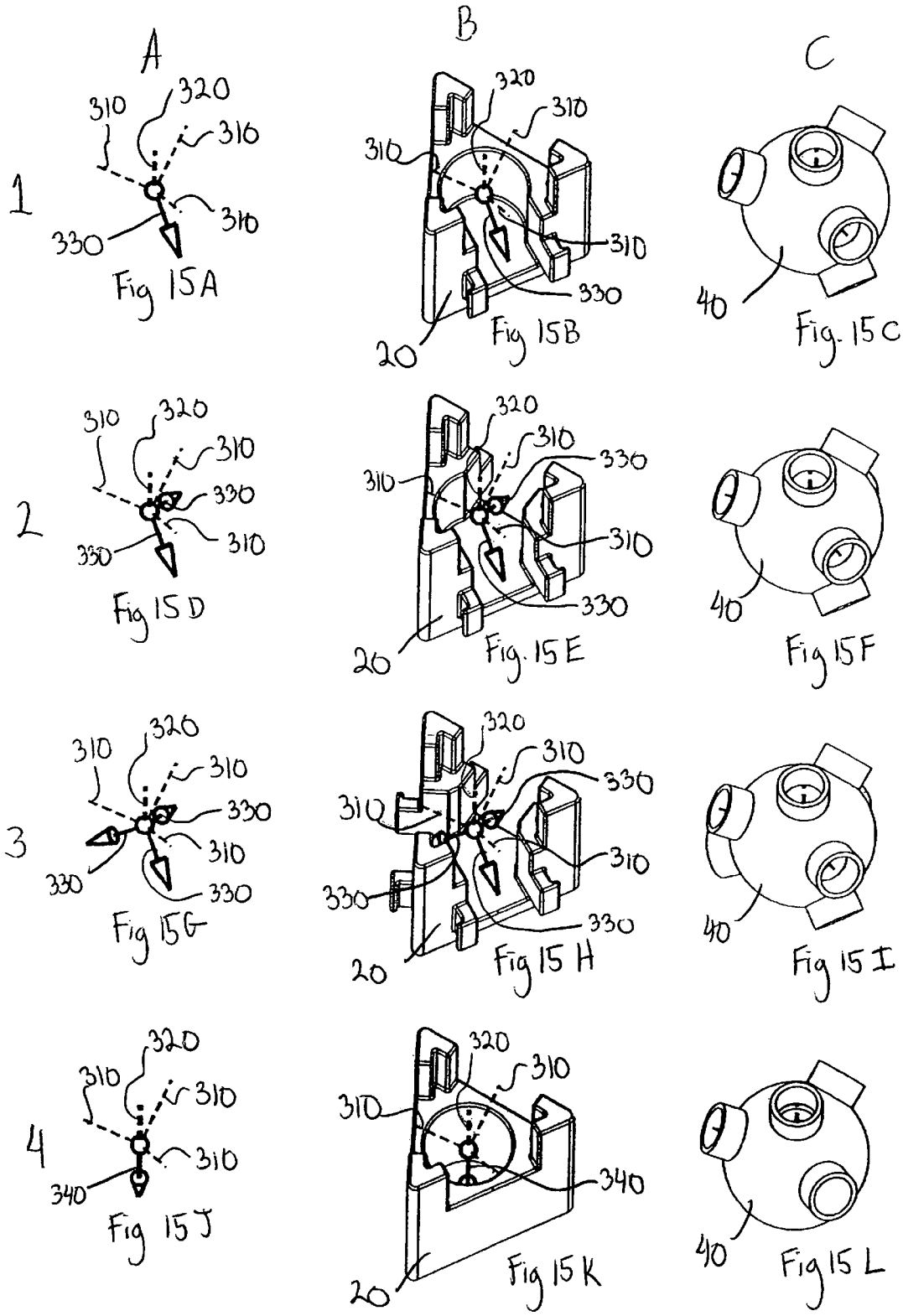
FIGS. 15A, 15D, 15G, and 15J are perspective views of entrance/exit configurations for triangular modular members.
FIGS. 15B, 15C, 15E, 15F, 15H, 15I, 15K, 15L, 16A, 16B, 16C, and 16D are perspective views of example triangular interlinkable modular members corresponding to the entrance/exit configurations of FIGS. 15A, 15D, 15G, and 15J.
Figure 16A:
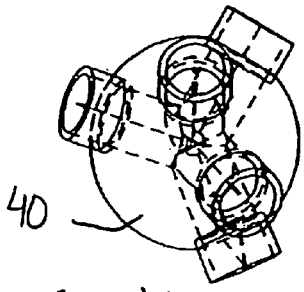
Figure 16B:
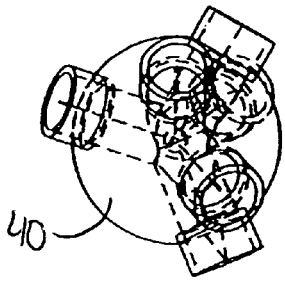
Figure 16C:
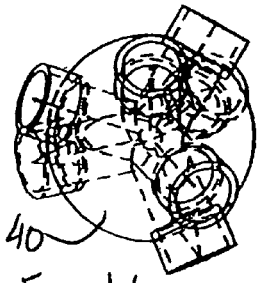
Figure 16D:
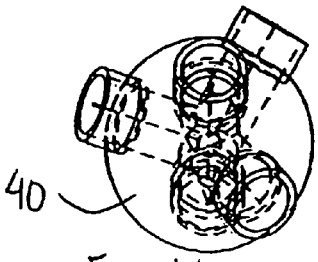

With reference to FIGS. 15A, 15D, 15G, and 15J, the entrance/exit schematics for a triangular member are shown, without the actual member, where each schematic shows four entrances 310/320 and one, two, and three horizontal exits 330 in FIGS. 15A, 15D, and 15G respectively, and a single vertical exit 340 in FIG. 15J. The corresponding entrance/exit schematics are shown with triangular members 20 defining those entrances and exits in FIGS. 15B, 15E, 15H, and 15K.

As described, in cubical embodiments the modular members 10 have five total entrances—four horizontal 310 and one vertical 320—and one to four exits, and in triangular embodiments the modular members 20 have four total entrances—three horizontal 310 and one vertical 320—and one to three exits. In either embodiment, a member with only one exit may include either a horizontal exit 330 or a vertical exit 240. Thus, for cubical, triangular, and other embodiments where the modular members have n sides, each member has n+1 entrances and 1 to n exits. This principle may also apply to other embodiments such as the cruciform, or "T-plan", embodiment shown in FIGS. 8A-8I.

Other embodiments, consistent with the principles of the present invention, may include a number of entrances and exits that do not conform to these entrance/exit equations. For instance, spherical or truncated octahedron members may deviate. In a "cubical-spherical" member, a member 30 defines five entrances and one to four exits; FIGS. 9A-9I show a "cubical-spherical" member 30 with one horizontal exit 330 from different perspectives. The entrance/exit schematics of the "cubical-spherical" member 30 are analogous to that of a cubical member 10 insofar as both may have one to four similarly configured horizontal exits 330. In a "triangular-spherical" member, a member 40 defines four entrances and one to three exits; FIGS. 10A-10I show a "triangular-spherical" member 40 with one horizontal exit from different perspectives. The entrance/exit schematics of the "triangular-spherical" member 40 are analogous to that of a triangular member 20 insofar as both may have one to three similarly configured horizontal exits 330.

An aspect of the present invention is the variety of shapes and forms of the modular members that conform to the same entrance/exit principles. For instance, numerous distinct embodiments of the members may include similar or identical entrance and exit configurations without deviating from the present invention. A triangular member 20 and a triangular-spherical member 40 have unique physical characteristics, but as shown in FIGS. 15B, 15E, 15H, and 15K (triangular member 20) and FIGS. 15C, 15F, 15I, and 15L ("triangular-spherical" member 40) (shown with internal passageways in FIGS. 16A, 16B, 16C, and 16D), they may share the same entrance/exit configuration. The entrance/exit configuration of FIG. 15A is shared by both the triangular member 20 in FIG. 15B and the "triangular-spherical" member 40 in FIG. 15C.

Figure 17A:
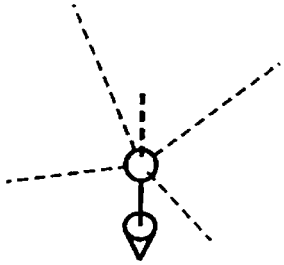
FIG. 17A is a perspective view of entrance/exit configurations for any cubical vertical-exit modular member.
Figure 17B:
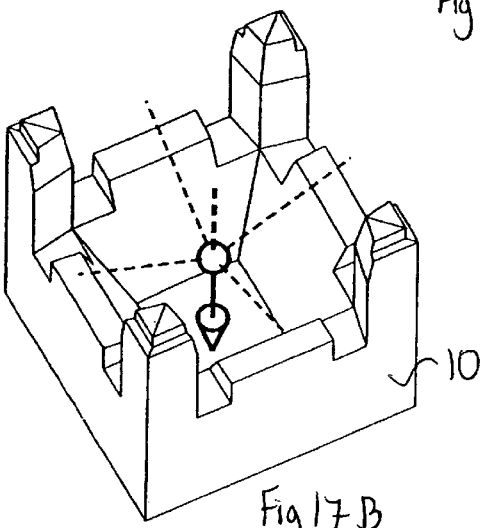
FIGS. 17B-17E are perspective views of example cubical interlinkable modular members with a vertical-exit corresponding to the entrance/exit configuration of FIG. 17A.
Figure 17C:
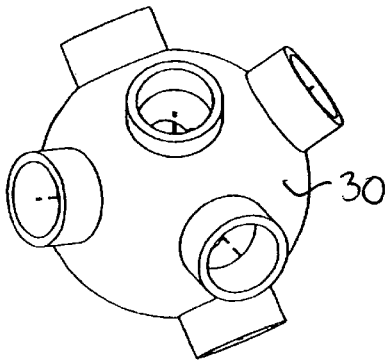
Figure 17D:
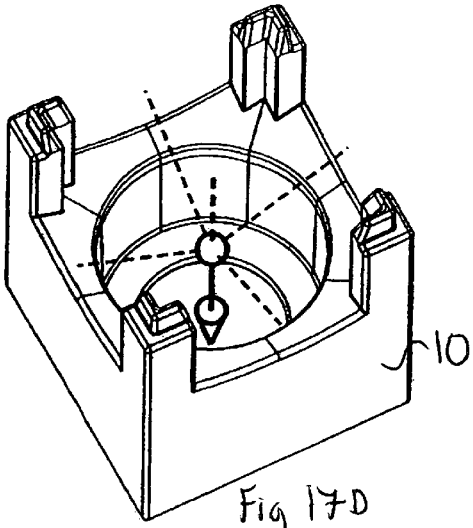
Figure 17E:
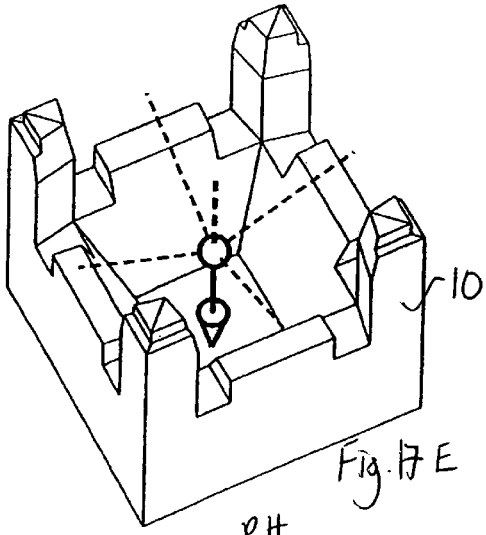

Similarly, the entrance/exit configuration of FIG. 15D is shared by both the triangular member 20 in FIG. 15E and the "triangular-spherical" member 40 in FIG. 15F, and the entrance/exit configuration of FIG. 15G is shared by both the triangular member 20 in FIG. 15H and the "triangular-spherical" member 40 in FIG. 15I. The vertical exit configuration in FIG. 15J is shared by both the triangular member 20 in FIG. 15K and the "triangular-spherical" member 40 in FIG. 15L. In another example, a vertical exit configuration seen in FIG. 17A may be embodied through a variety of different members, such as the cubical members 10 seen in FIGS. 17B, 17D, and 17E, or a "cubical-spherical" member 30 seen in FIG. 17C.

In yet another example of this aspect of the present invention, FIGS. 2A-2L, 5A-5J, 7A-7J, 8A-8I, 9A-9I, 11A-11I, and 12A-12J each show various perspectives of distinctly shaped members, each member having five entrances and one horizontal exit. Although each of these members represents different embodiments, they all share the same entrance/exit configuration of the present invention. Similarly, FIGS. 6A-6I and 10A-10I show various perspectives of distinctly shaped members, each having four entrances and one horizontal exit. This represents another example of different shapes conforming to the same entrance/exit principles of the present invention.

(ii) Pathways Created by Horizontal Members

As described, regardless of their shape or form, most of the modular members may be placed into two general categories: horizontal exit members and vertical exit members. Examples of the former are shown in FIGS. 15B and 15C, and examples of the latter are shown in FIGS. 17B-17E.

Horizontal exit members share the common characteristic of creating a generally horizontal pathway when connected to another adjacent member. The horizontal pathways may or may not be exactly horizontal; the pathways may include a downward slope, generally declining from proximate the center of a member to an exterior side of the member. FIGS. 18A, 19A, 20A, 21A, and 22A show multiple entrance/exit configurations without the actual members, and FIGS. 18B, 19B, 20B, 21B, and 22B, show multiple cubical horizontal-exit members 10 interconnected in basic configurations to achieve the respective entrance/exit configurations, with entrances and exits denoted by dashed and solid lines respectively. Each member is staggered by a vertical ½ step relative to its adjacent members. The vertical offset facilitates the creation of a pathway between the members for marble or other spherical object. Although these drawings show a ½ step vertical offset between members, other offsets may be implemented without departing from the principles of the invention.

Figure 22A:
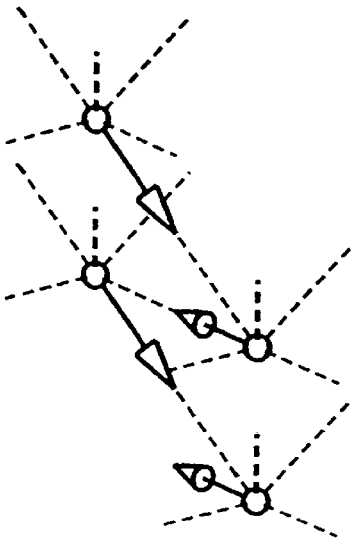
FIG. 22A is a perspective view of an entrance/exit configuration for a zig-zag pattern.
Figure 22B:
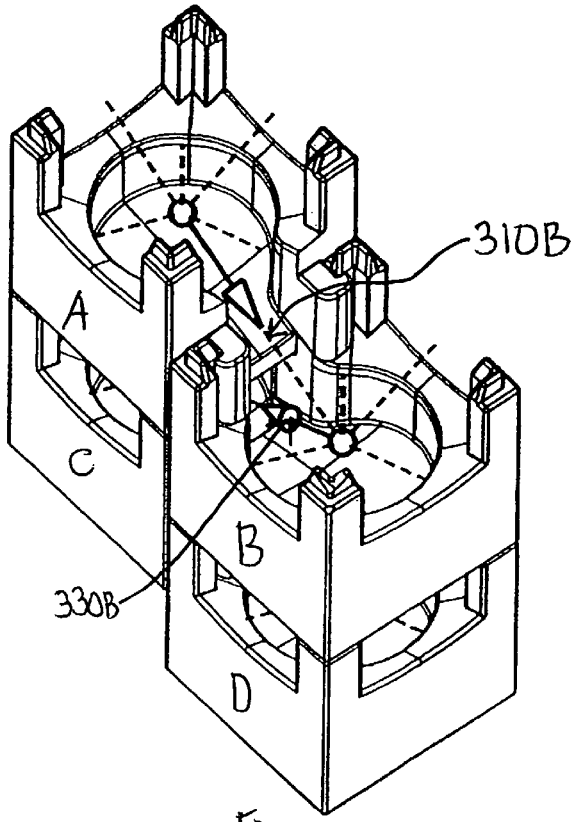
FIG. 22B is a perspective view of cubical interlinkable modular members arranged in the zig-zag pattern of FIG. 22A.
Figure 23A:
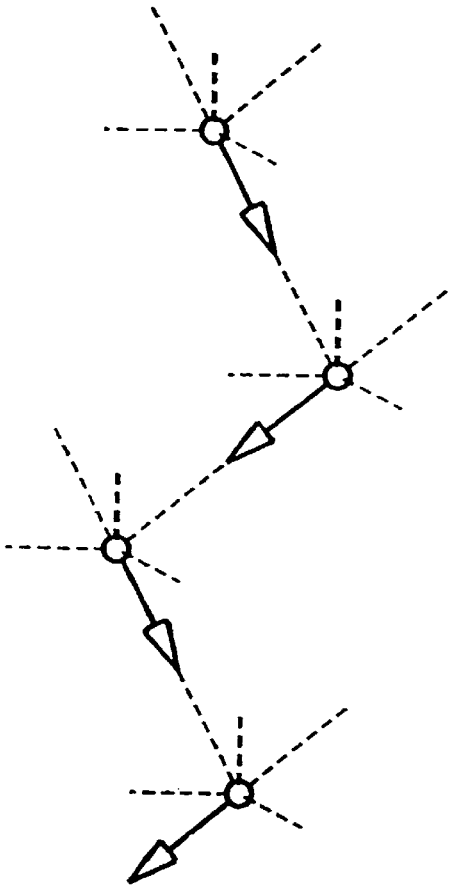
FIG. 23A is a perspective view of an entrance/exit configuration for a slalom pattern.
Figure 23B:
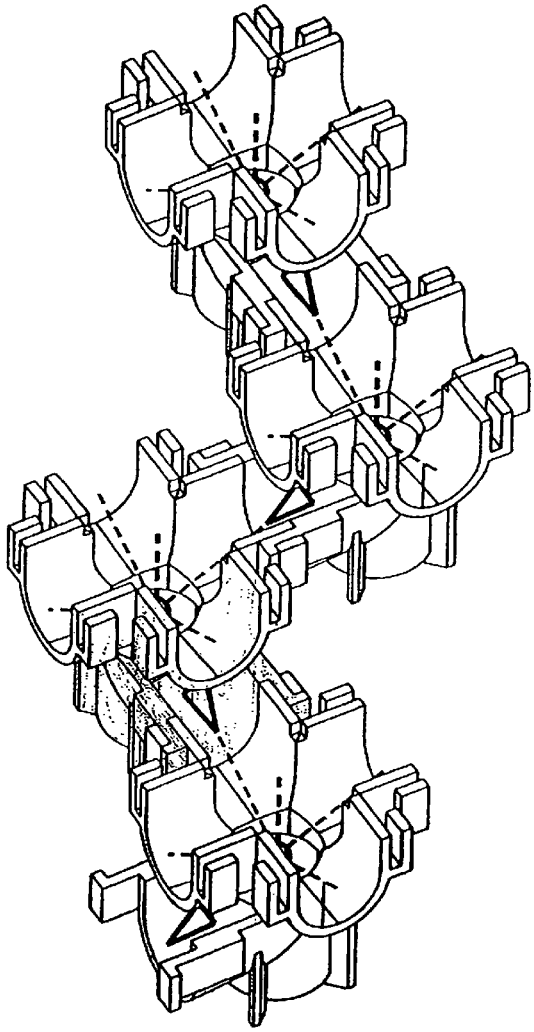
FIG. 23B is a perspective view of cruciform interlinkable modular members arranged in the slalom pattern of FIG. 23A.

Again with reference to FIGS. 18B, 19B, 20B, 21B, and 22B, which are described in more detail below, FIG. 18B shows a cascade configuration of cubical members 10, FIG. 19B shows a slalom configuration of cubical members 20, FIG. 20B shows a helix configuration of cubical members 10, FIG. 21B shows a double helix configuration of cubical members 10, and FIG. 22B shows a zig-zag configuration of cubical members 10. With reference to FIG. 23B, horizontal exit cruciform members 50 are shown in a slalom configuration, similar to that of FIG. 19B; i.e., the members shown in FIGS. 23B and 19B both have the same entrance/exit configuration shown in FIGS. 23A and 19A. This configuration demonstrates the ability to not only create distinctly-shaped members with the same entrance/exit configuration but, also, to connect distinctly-shaped members in the same pathway configuration.

As shown in each of these drawings (FIGS. 18B, 19B, 20B, 21B, 22B, and 23B), where the members are configured with the vertical offset, the horizontal exit of one member meets an entrance of its lower adjacent neighbor member. However, not all lower adjacent members are necessarily engaged with exits from their upper adjacent neighbors; a member only creates a horizontal pathway to a lower neighbor toward which it points a horizontal exit.

Figure 24:
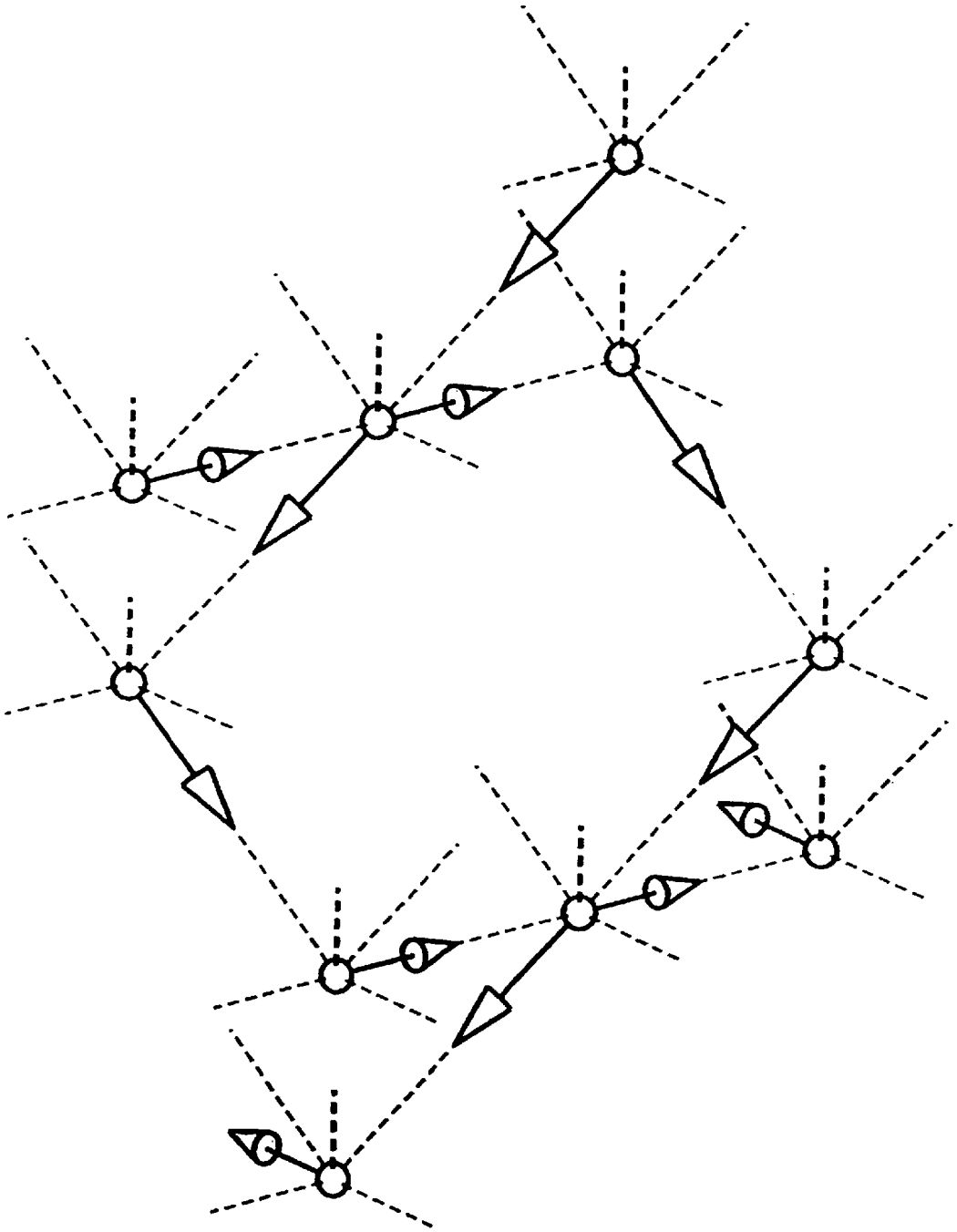
FIG. 24 is a perspective view of an entrance/exit configuration for any ten cubic modular members.
Figure 25A:
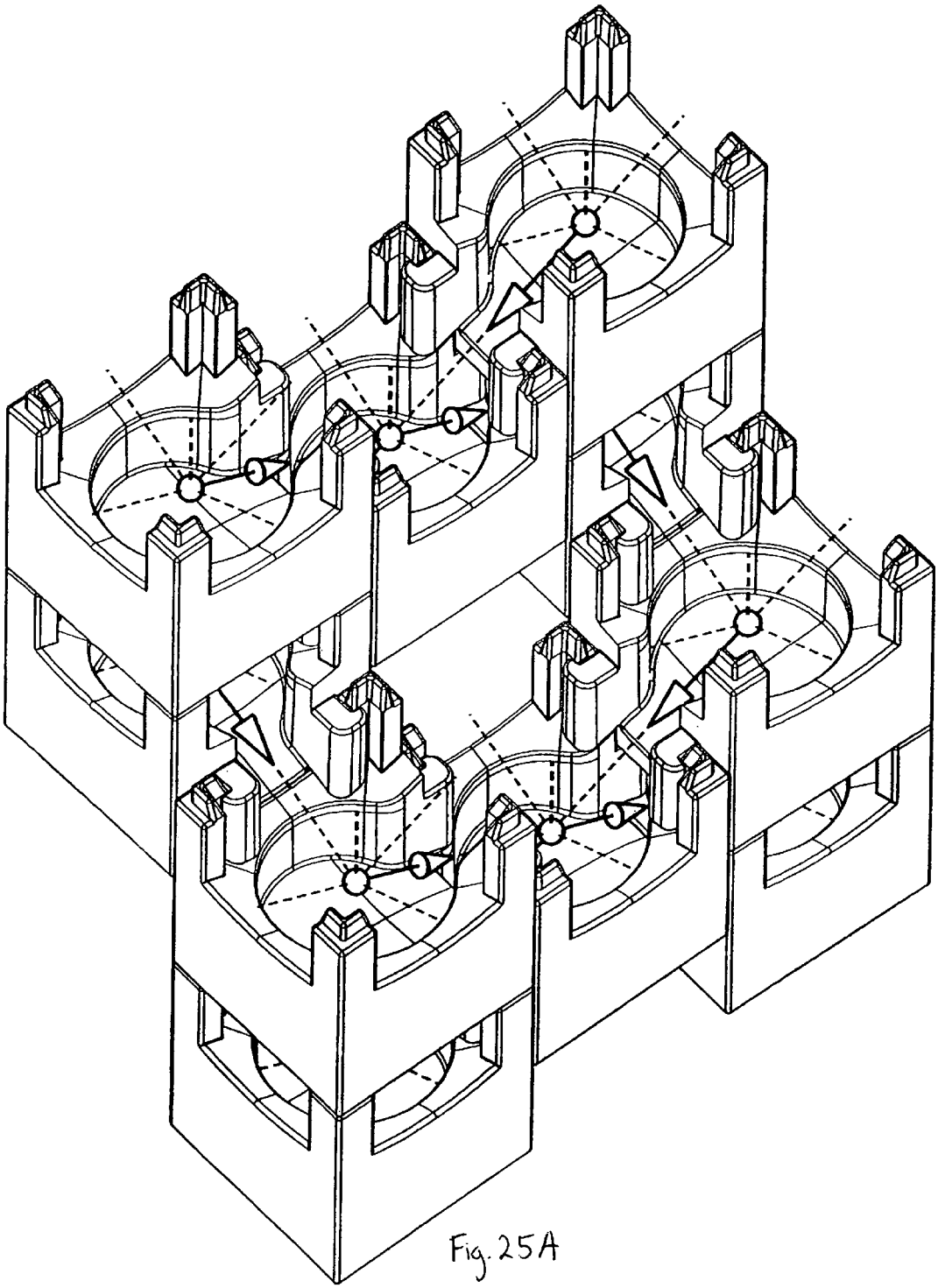
FIG. 25A is a perspective view of cubical modular members arranged in the entrance/exit configuration of FIG. 24.
Figure 25B:
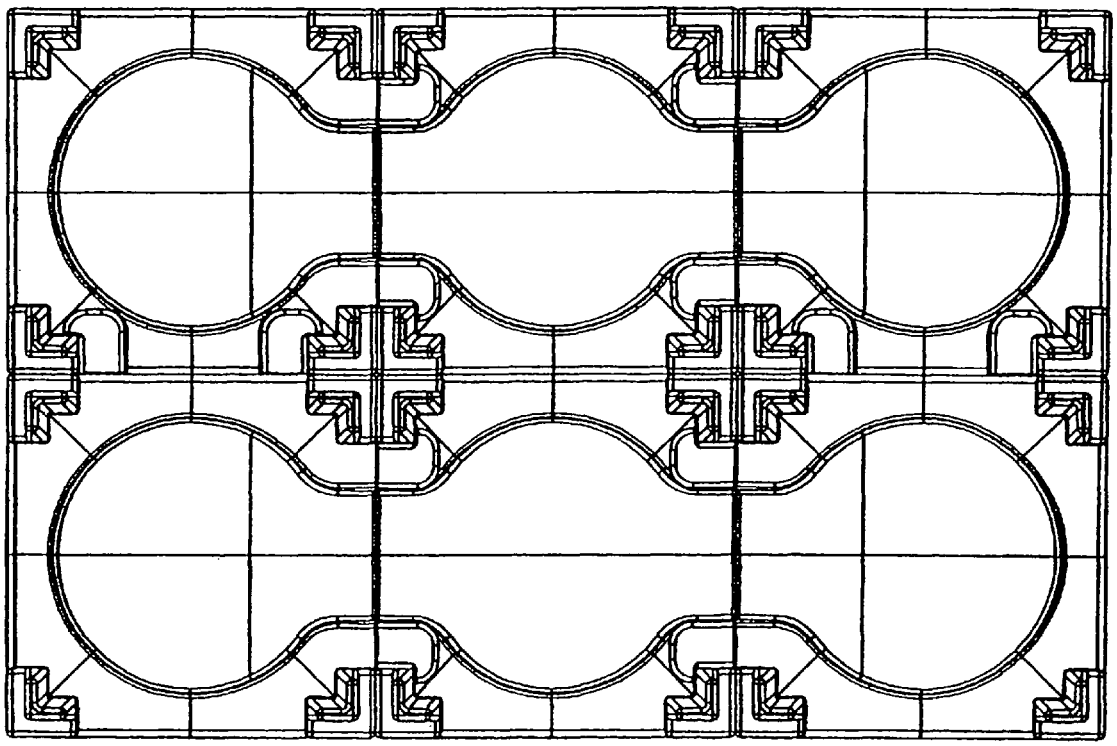
FIG. 25B is a top view of cubical modular members arranged in the entrance/exit configuration of FIG. 24.
Figure 25C:
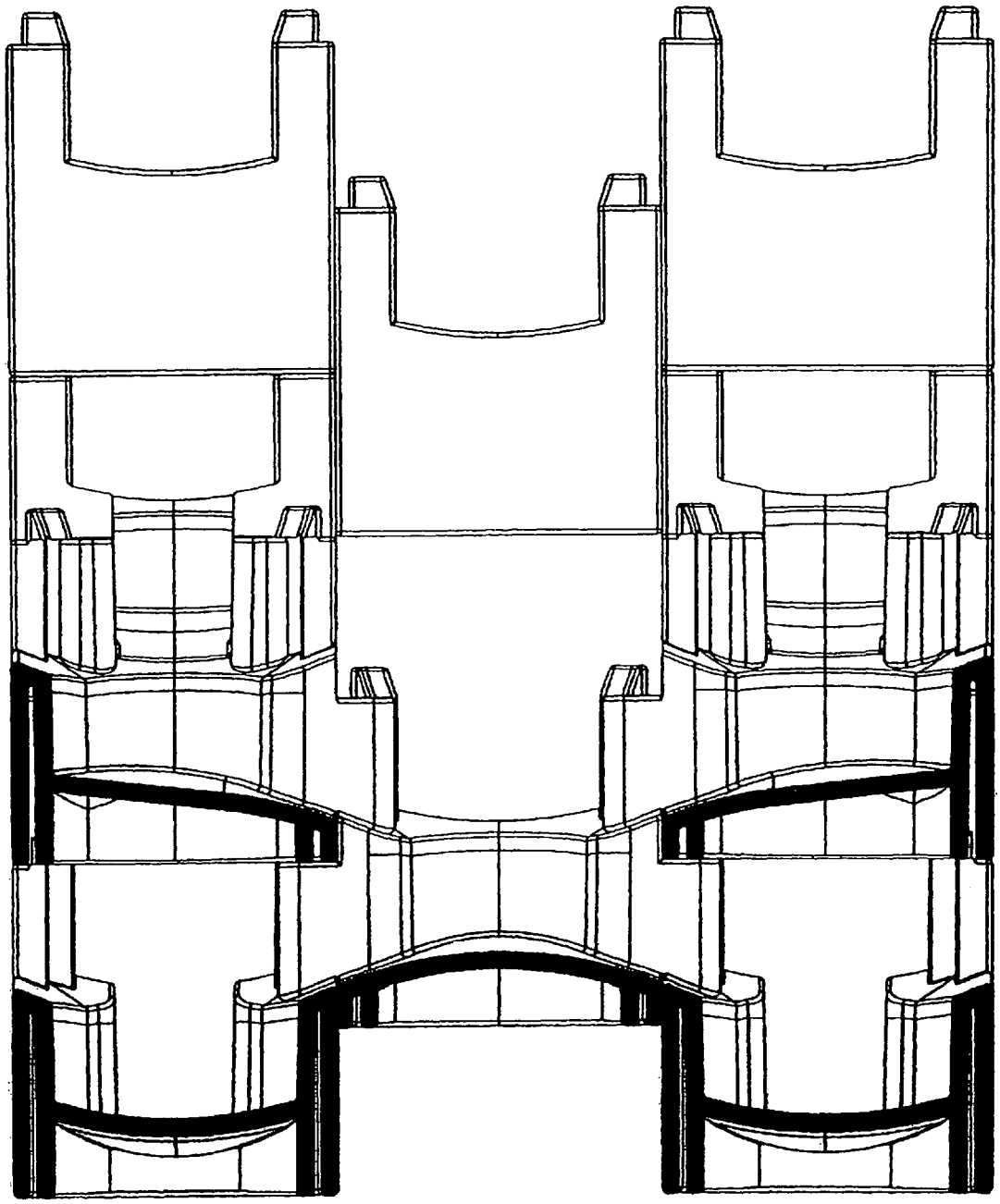
FIG. 25C is a front view of cubical modular members arranged in the entrance/exit configuration of FIG. 24.
Figure 26A:
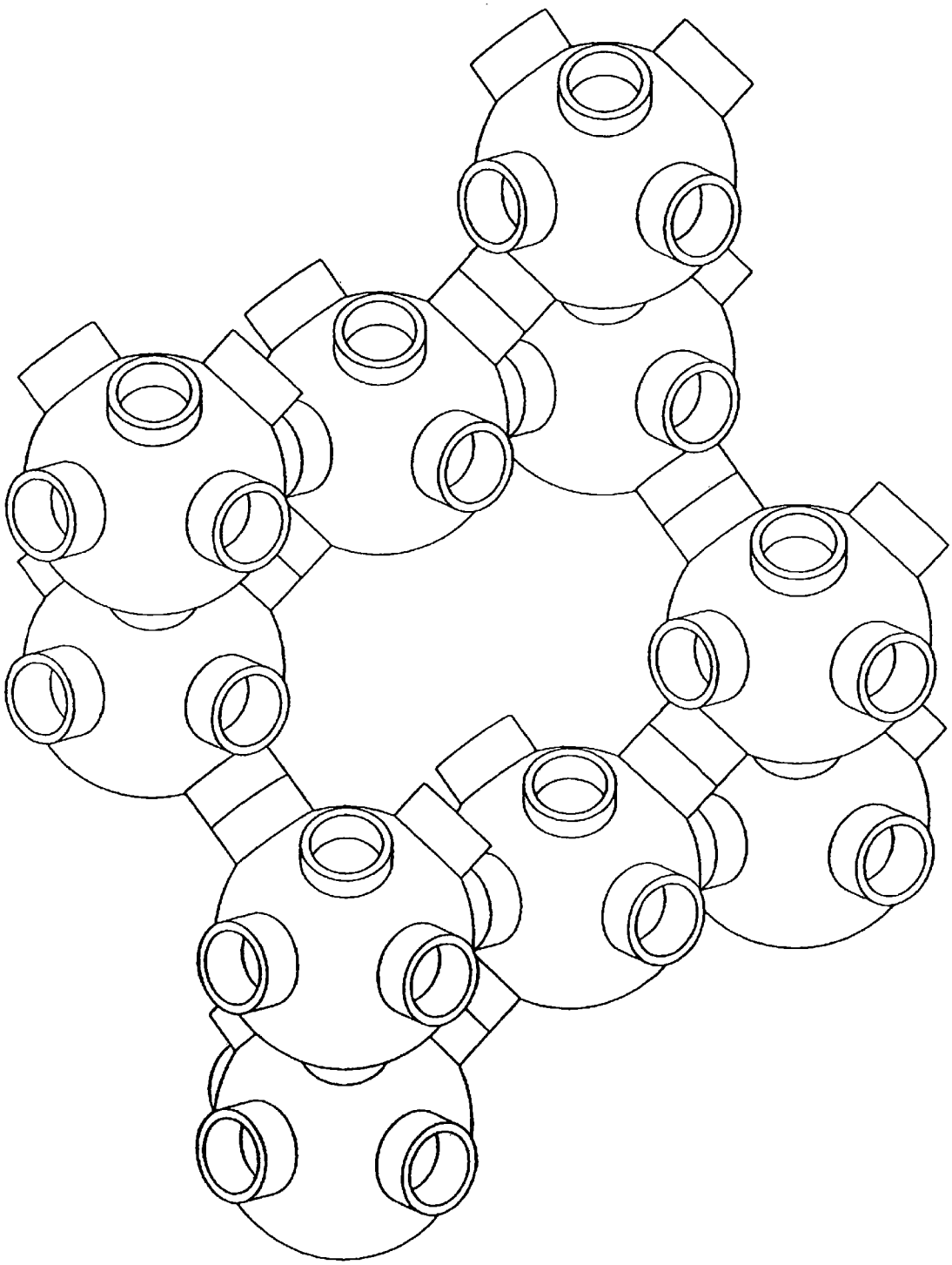
FIG. 26A is a perspective view of spherical modular members arranged in the entrance/exit configuration of FIG. 24.
Figure 26B:
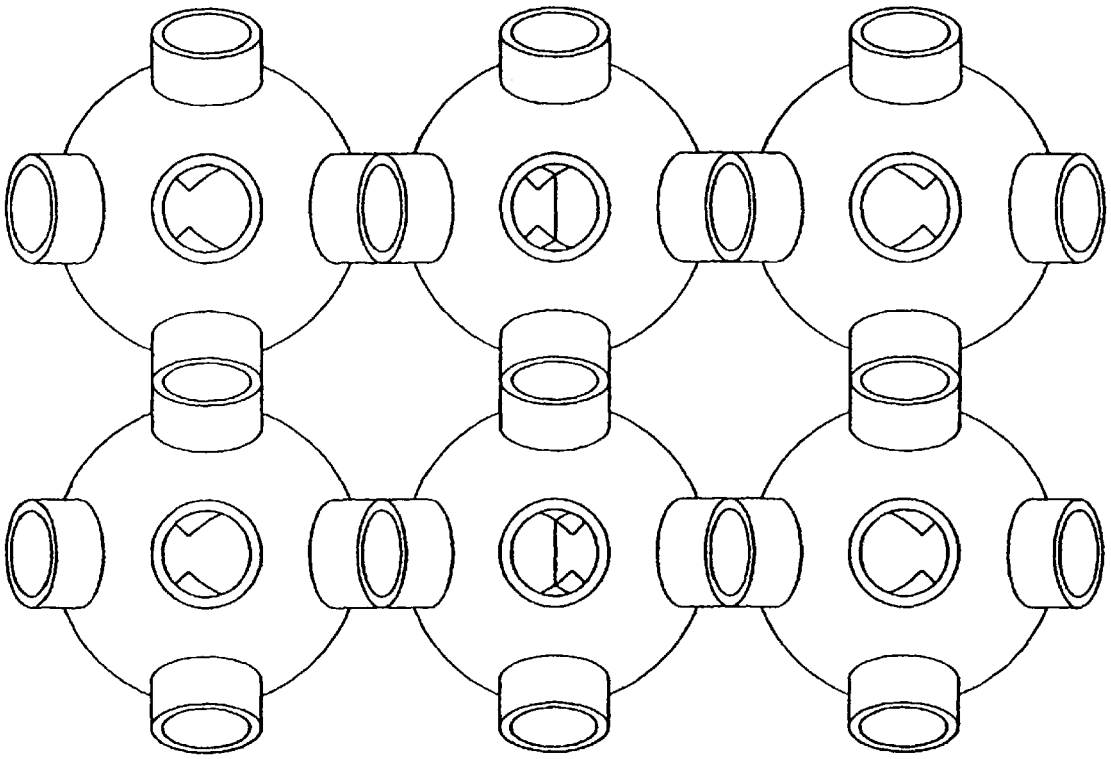
FIG. 26B is a top view of spherical modular members arranged in the entrance/exit configuration of FIG. 24.
Figure 26C:
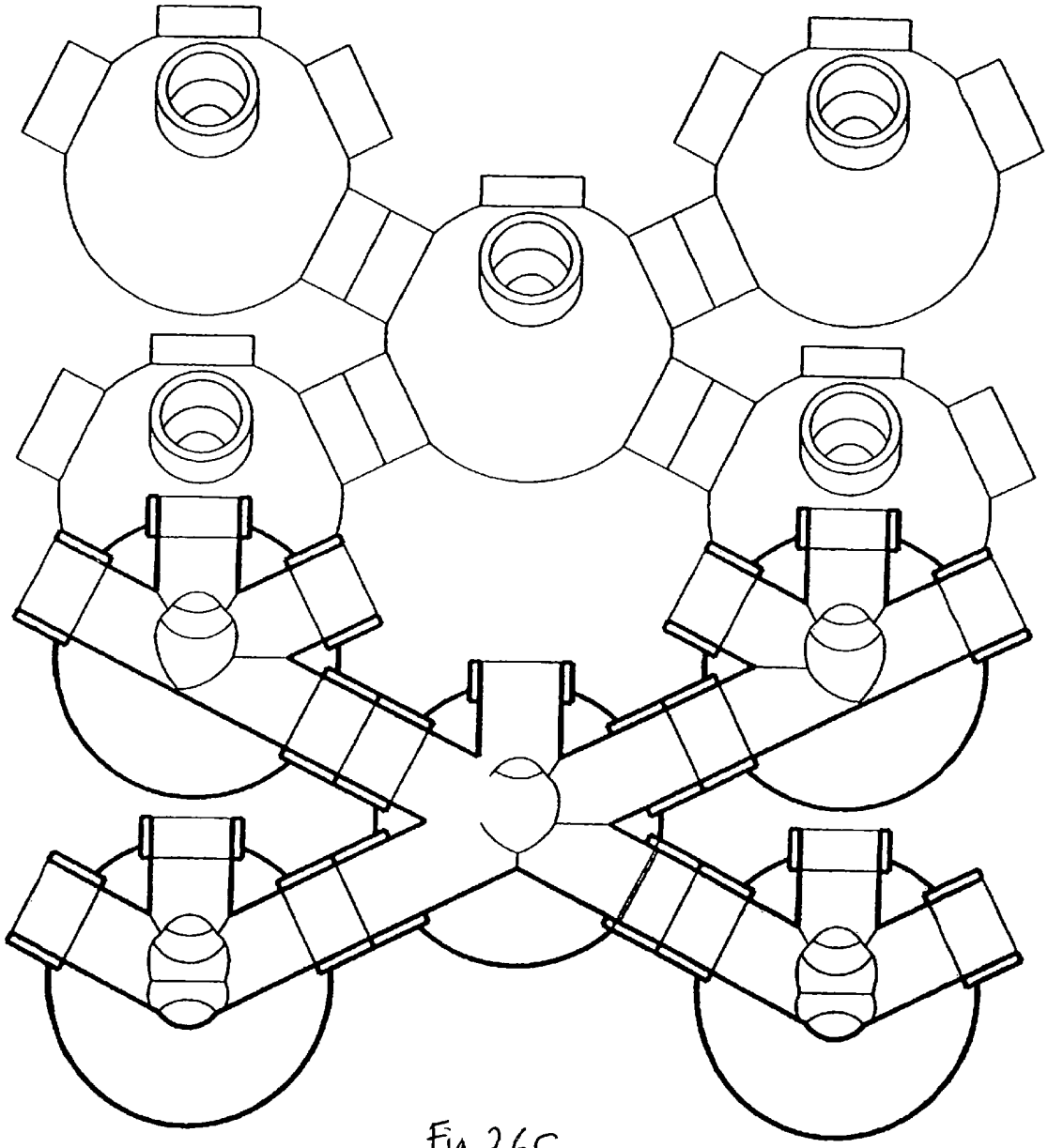
FIG. 26C is a front view of spherical modular members arranged in the entrance/exit configuration of FIG. 24.

As with the entrance/exit configuration of individual members, it is also true members of a variety of shapes and forms may be arranged that conform to the same entrance/exit system. For instance, FIG. 24 shows an entrance/exit system configuration designed for ten members but without showing actual members. FIG. 25A shows ten cubical members arranged in the entrance/exit system configuration shown in FIG. 24, which illustrates one manner of achieving the particular system configuration. FIGS. 25B and 25C show the cubical member implementation of the system configuration from a top view and a front view respectively. FIGS. 26A-26C show the same entrance/exit system configuration shown in FIG. 24 achieved with ten spherical members. Accordingly, it can be appreciated that the entrance/exit system configurations may be implemented with a variety of differently-shaped members and the configurations are independent of the members used to achieve them.

Figures 1A, 1B, 1C, 1D, 1E, 1F, 1G, 1H, 1I, 1J, 1K, 1L:
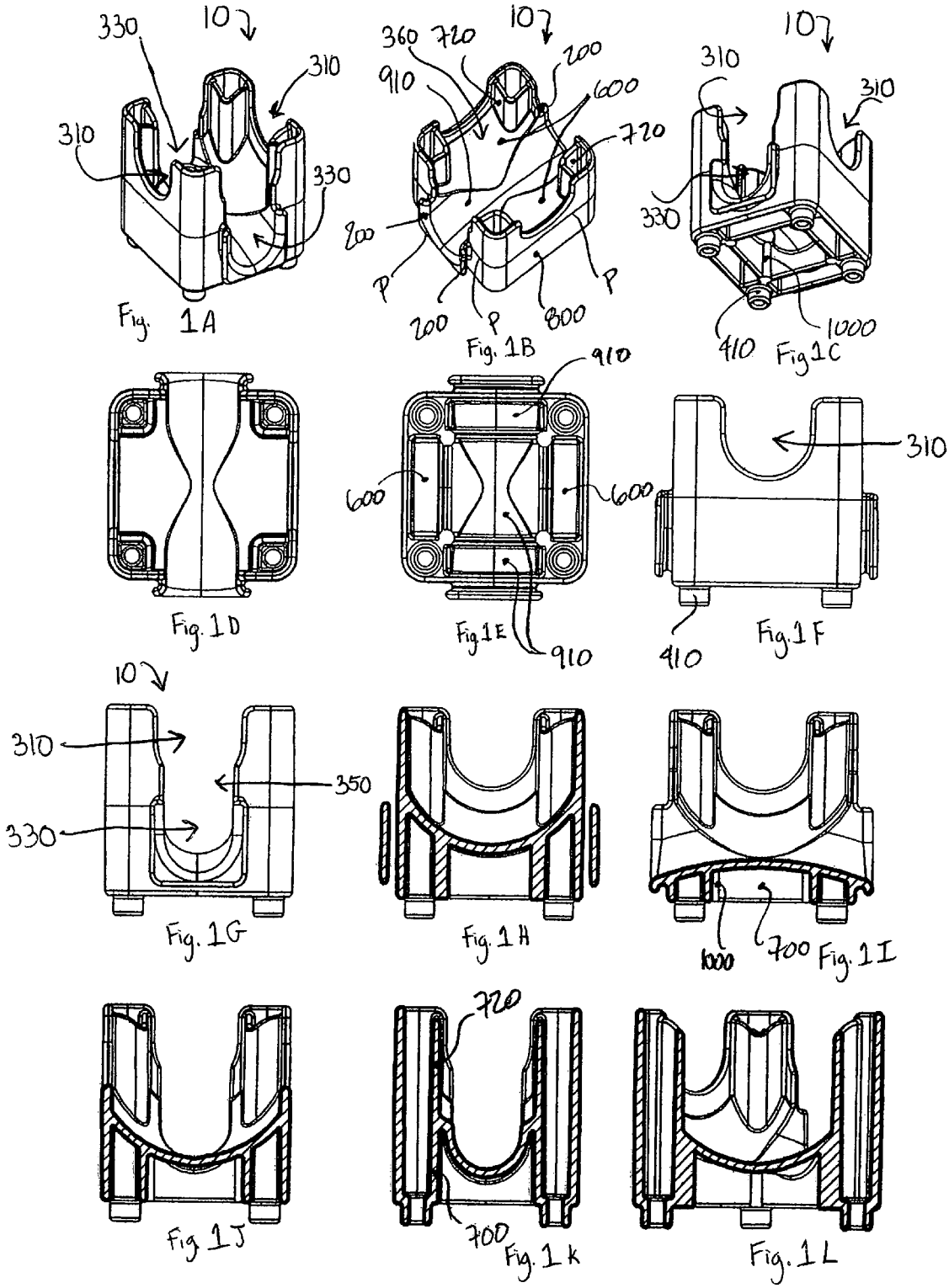
FIGS. 1A-1L are perspective, front, back, top, bottom, and side views of a cubical 2-exit interlinkable modular member in accordance with one embodiment of the present invention.
Figure 2A:
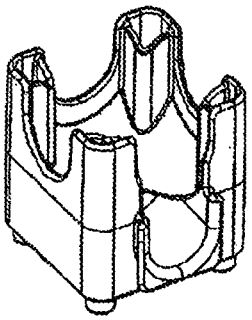
FIGS. 2A-2L are perspective, front, back, top, bottom, and side views of a cubical 1-exit interlinkable modular member in accordance with one embodiment of the present invention.
Figure 2B:
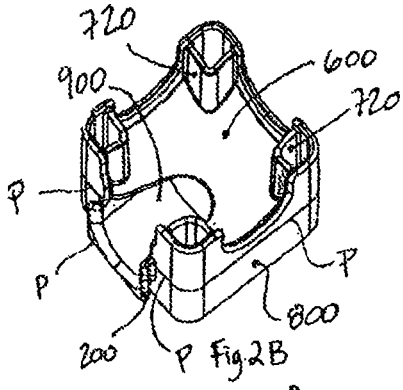
Figure 2C:
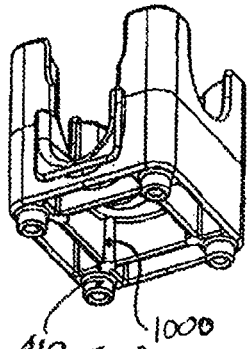
Figure 2D:
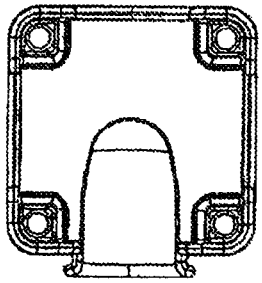
Figure 2E:
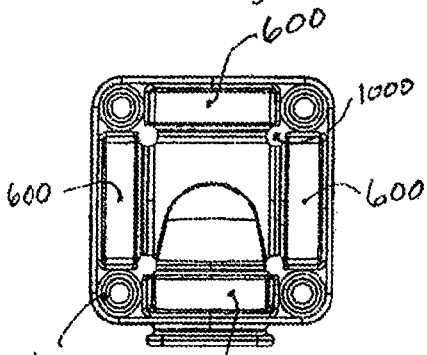
Figure 2F:
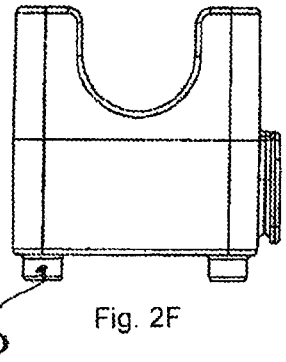
Figure 2G:
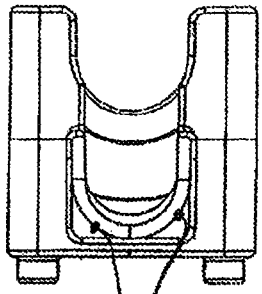
Figure 2H:
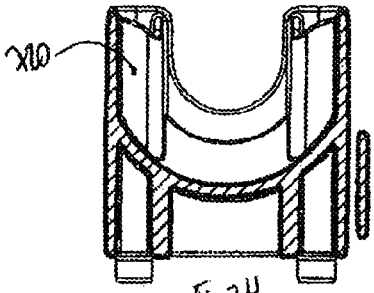
Figure 2I:
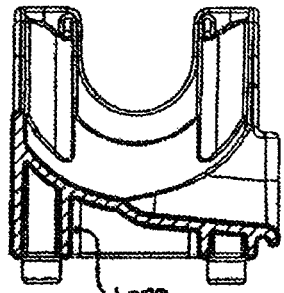
Figure 2J:
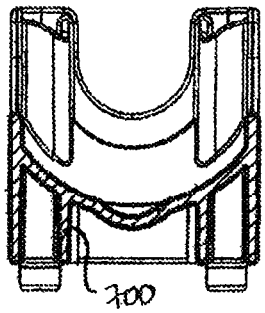
Figure 2K:
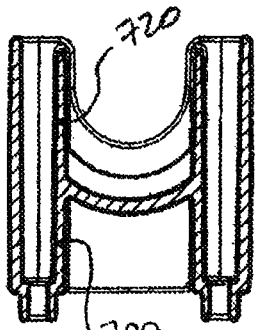
Figure 2L:
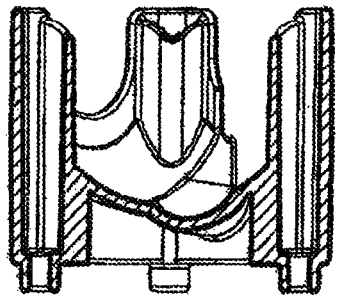
Figure 3A:
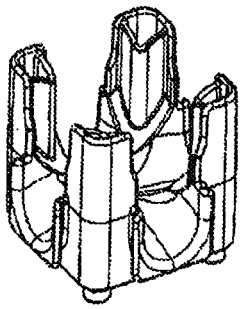
FIGS. 3A-3L are perspective, front, back, top, bottom, and side views of a cubical 4-exit interlinkable modular member in accordance with one embodiment of the present invention.
Figure 3B:
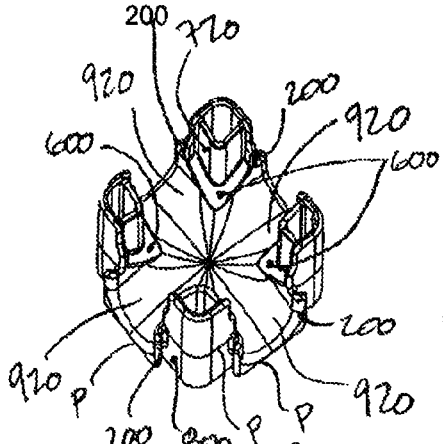
Figure 3C:
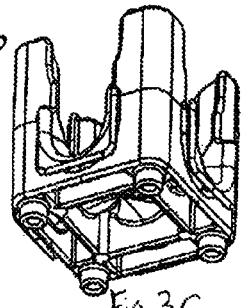
Figure 3D:
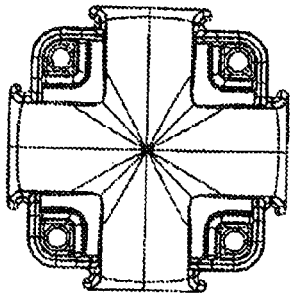
Figure 3E:
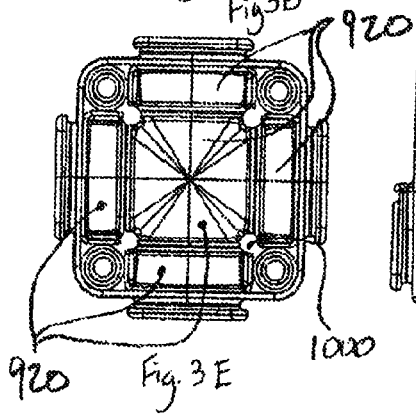
Figure 3F:
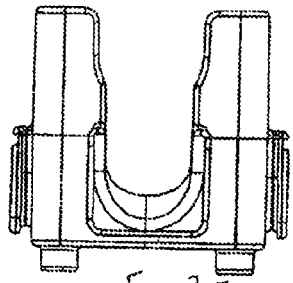
Figure 3G:
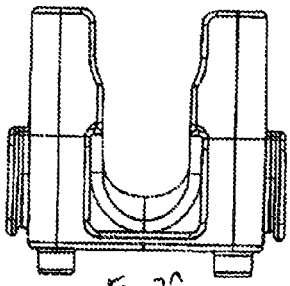
Figure 3H:
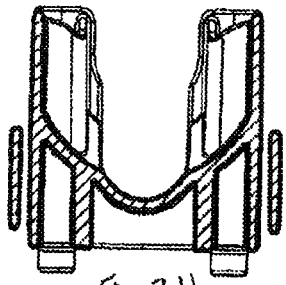
Figure 3I:
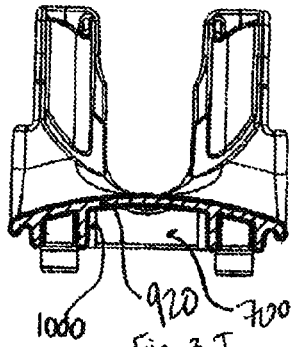
Figure 3J:
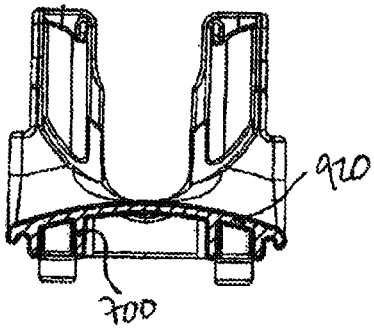
Figure 3K:
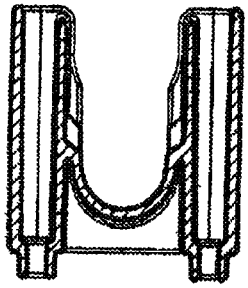
Figure 3L:
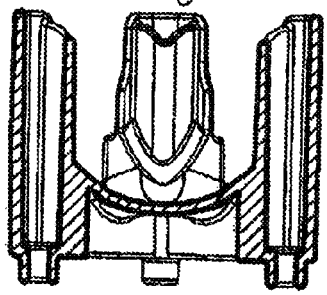

With reference to FIG. 1F, a marble or other spherical object may enter cubical member 10 through a horizontal entrance 310, passing between the vertically aligned components 231 (shown in FIG. 61B) of the female joint in the member's internal chamber 360 (shown in FIG. 1A). In the embodiment of the member 10 shown in FIG. 1F, the entrance 310 at its intersection with the outer vertical face of the member in which the entrance is formed is U-shaped and approximates a square, as seen in FIGS. 27E and 27F. With reference to FIG. 27E, in one embodiment the cross-section area A of the entrance opening at this intersection is 0.2387 in.$^2$, where the height H of the opening is ½ in. A circle with a diameter of ½ in. is shown in the entrance in FIG. F. The circle's area A' is 0.1963 in.$^2$, which is relatively close to the area of the entrance opening itself, and as seen in FIG. 27F, which largely fills the entrance opening. In this scenario, the entrance-to-circle area ratio is 1.22. In one embodiment of the present invention where the shape of the entrance opening at its intersection with the outer vertical face of the member approximates a square, as seen in FIGS. 27G and 27H, the cross-section area A of the entrance opening at the intersection is 0.2728 in.$^2$. In comparison, the circle's area A' is 0.1963 in.$^2$, which is also relatively close to the area of the entrance opening itself, and as seen in FIG. 27H, and in this scenario, the entrance-to-circle area ratio is 1.39. Congruently larger or smaller versions of the present invention may be designed. Other products provide for far greater entrance-to-circle area ratios, such as the design shown in FIGS. 27A and 27B, with a ratio of 2.00, where the opening is semi-circular. Another possible entrance design with a greater entrance-to-circle ratio is seen in FIGS. 27C and 27D, where the ratio is 2.55, where the entrance can be approximated by a rectangle. These arrangements of FIGS. 27A-27D illustrate that a circle with diameter equal to the entrance height has a cross-sectional area significantly less than the area of the entrance opening itself.

With reference to FIG. 1F, a horizontal entrance 310 is formed in a vertical face of the member 10. Because neither of the two horizontal exits is formed in the same vertical face of the member as this horizontal entrance 310, the member's vertical side is solid beneath this horizontal entrance 310. However, with reference to FIG. 1G, wherein a different vertical face of the member is shown, there appears a unified opening 350. The unified opening defines both the horizontal entrance 310 and the horizontal exit 330 in this vertical side of the member. Although the vertical entrance 310 shown in FIG. 1G does not appear to have the same shape as the vertical entrance 310 shown in FIG. 310, both vertical entrances serve the same purpose, namely providing an entry point into the member's internal chamber 360, where the entry point is formed in substantially the upper half of the member. Accordingly, these members define horizontal entrances 310 through their vertical sides, but when there is a horizontal exit 330 in the same vertical side below the horizontal entrance 310, as seen in FIG. 1G, the vertical entrance has a different appearance than when there is no horizontal exit in the same vertical side, as seen in FIG. 1F. Nonetheless, each vertical side defines a horizontal entrance, regardless of the existence or non-existence of a horizontal exit in the same side. The horizontal entrance defined by the unified opening 350 seen in FIG. 1G may be better appreciated when the member is coupled with another member. For example, the cubical member shown in FIG. 13G has a unified opening 350 that forms both a horizontal entrance 310 and horizontal exit 330. The identical members are shown in FIG. 22B in a zig-zag configuration; for example, the unified opening in member B defines both a horizontal entrance 310B (from member A) and a horizontal exit 330B, the horizontal exit 330B leading to member C.

Figure 4A:
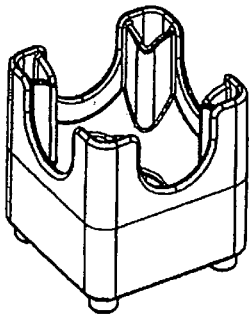
FIGS. 4A-4L are perspective, front, back, top, bottom, and side views of a cubical vertical-exit interlinkable modular member in accordance with one embodiment of the present invention.
Figure 4B:
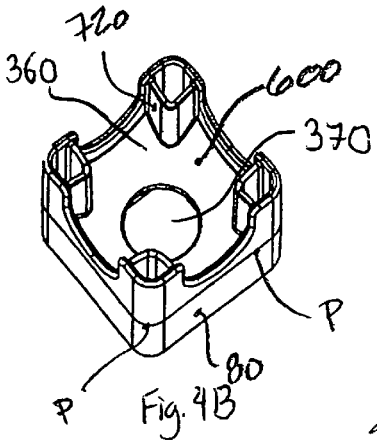
Figure 4C:
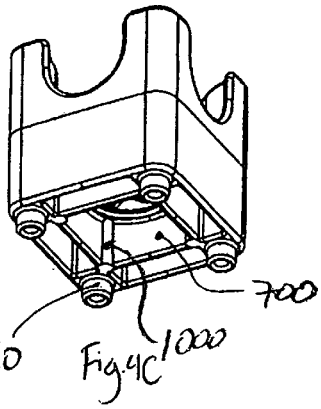
Figure 4D:
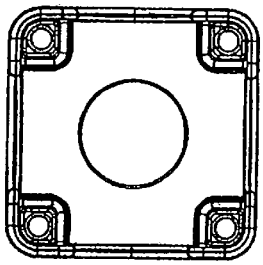
Figure 4E:
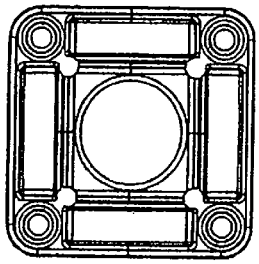
Figure 4F:
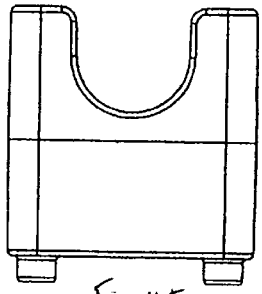
Figure 4G:
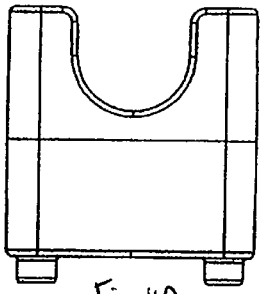
Figure 4H:
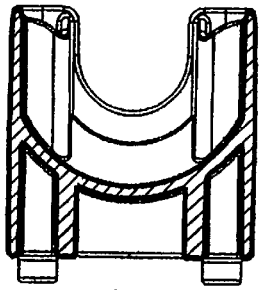
Figure 4I:
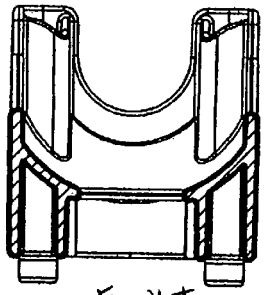
Figure 4J:
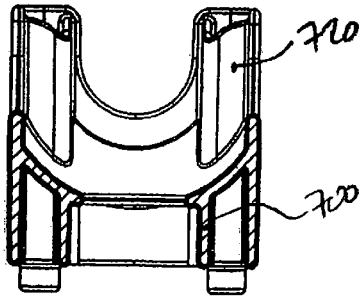
Figure 4K:
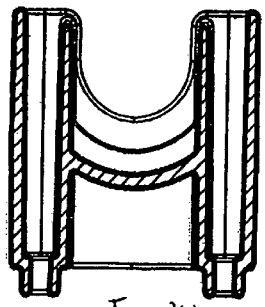
Figure 4L:
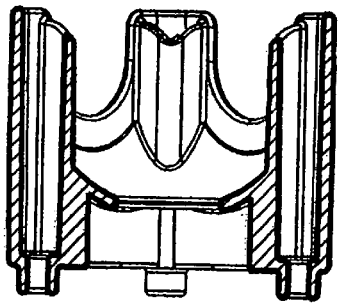
Figures 5A, 5B, 5C, 5D, 5E, 5F, 5G, 5H, 5I, 5J:
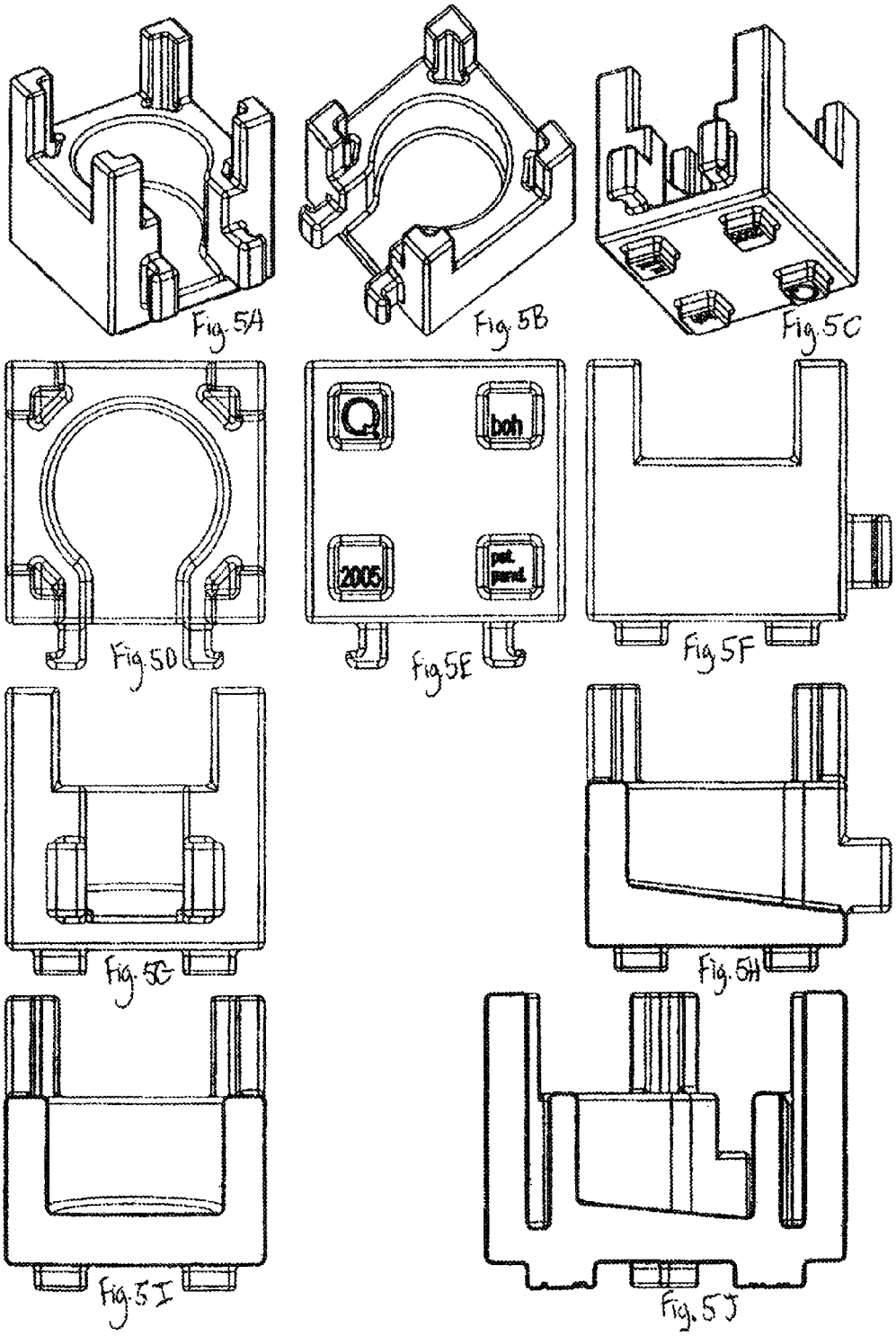
FIGS. 5A-5J are perspective, front, back, top, bottom, and side views of a cubical 1-exit interlinkable modular member with a cylindrical chamber and solid bottom in accordance with one embodiment of the present invention.
Figure 6A:
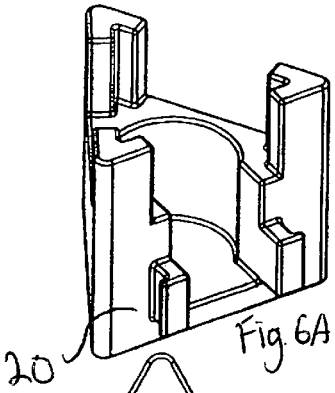
FIGS. 6A-6I are perspective, front, back, top, bottom, and side views of a triangular 1-exit interlinkable modular member with a cylindrical chamber and solid bottom in accordance with one embodiment of the present invention.
Figure 6B:
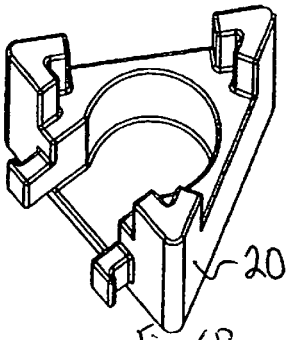
Figure 6C:
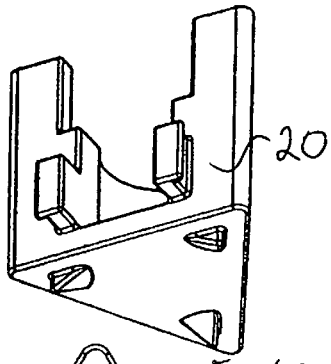
Figure 6D:
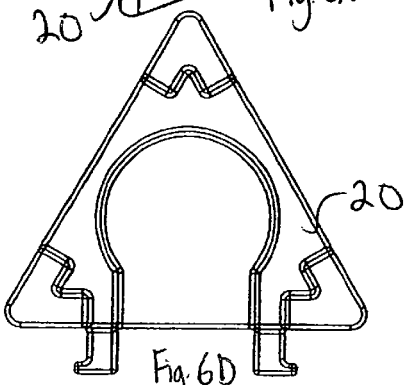
Figure 6E:
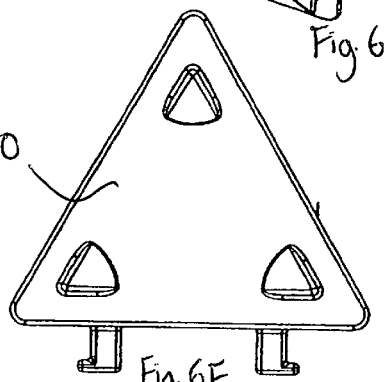
Figure 6F:
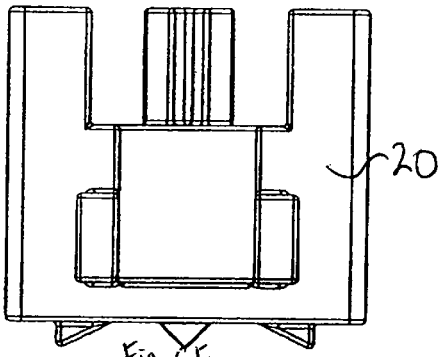
Figure 6G:
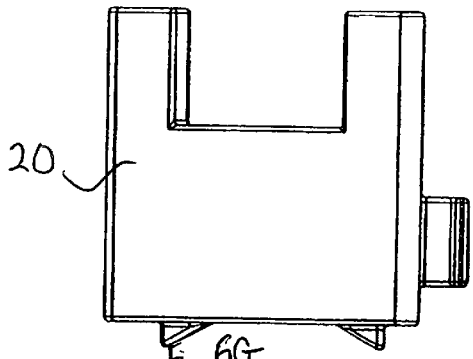
Figure 6H:
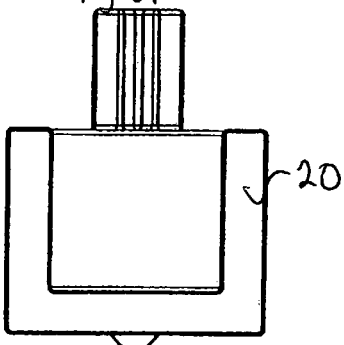
Figure 6I:
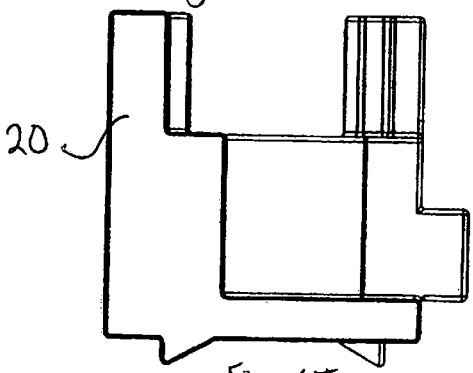
Figures 7A, 7B, 7C, 7D, 7E, 7F, 7G, 7H, 7I, 7J:
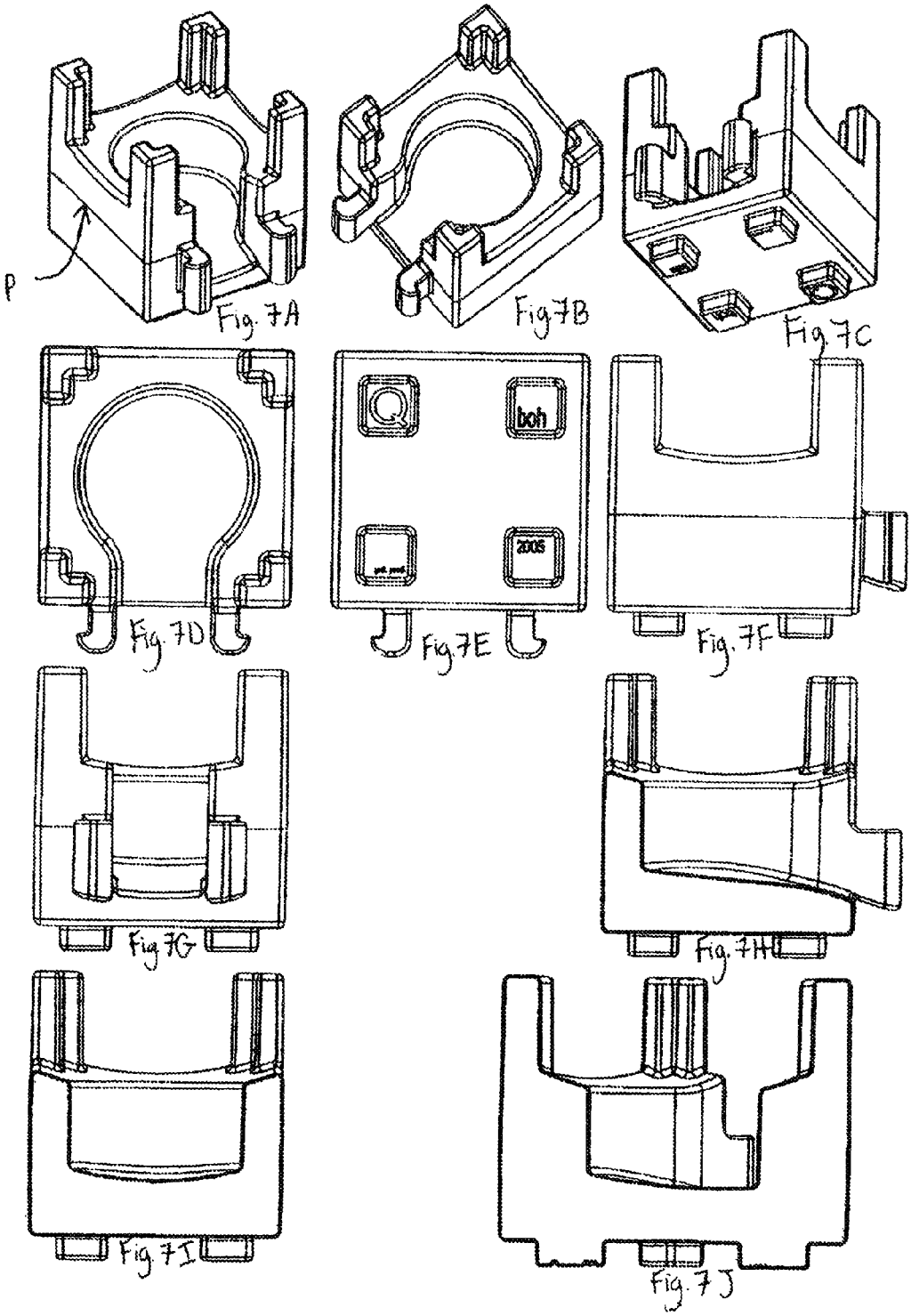
FIGS. 7A-7J are perspective, front, back, top, bottom, and side views of a cubical 1-exit interlinkable modular member with a cylindrical chamber and parting line in accordance with one embodiment of the present invention.
Figure 8A:
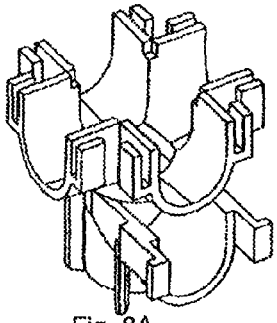
FIGS. 8A-8I are perspective, front, back, top, bottom, and side views of a cruciform 1-exit interlinkable modular member with a split, vertical mating joinery in accordance with one embodiment of the present invention.
Figure 8B:
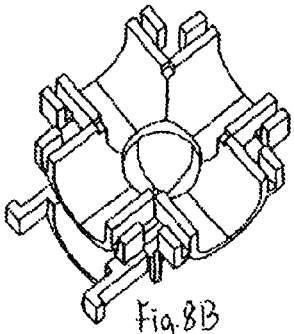
Figure 8C:
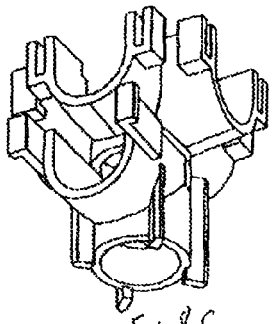
Figure 8D:
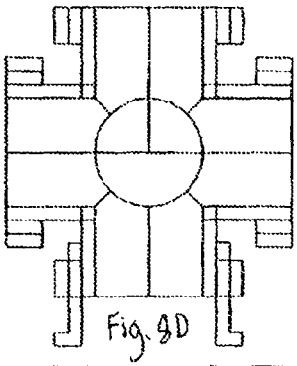
Figure 8E:
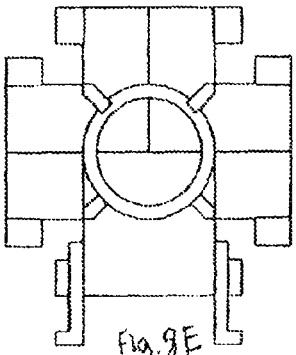
Figure 8F:
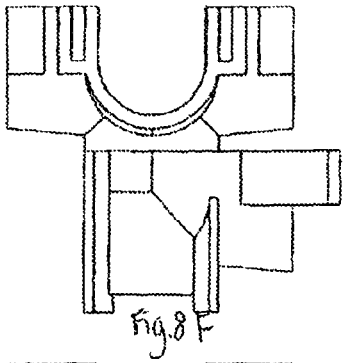
Figure 8G:
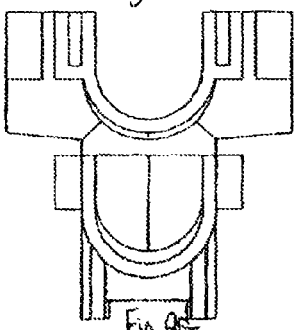
Figure 8H:
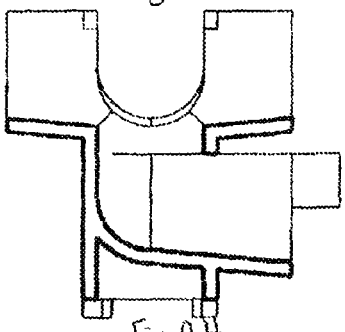
Figure 8I:
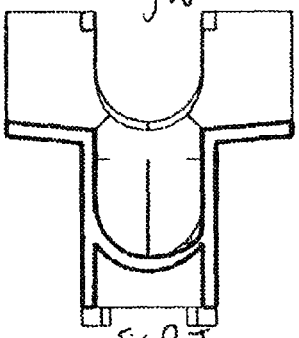
Figure 9A:
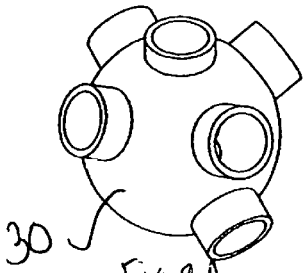
FIGS. 9A-9I are perspective, front, back, top, bottom, and side views of a "cubical-spherical" 1-exit interlinkable modular member in accordance with one embodiment of the present invention.
Figure 9B:
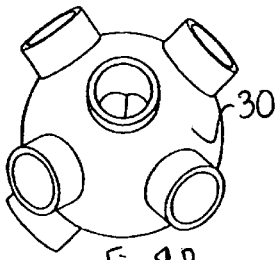
Figure 9C:
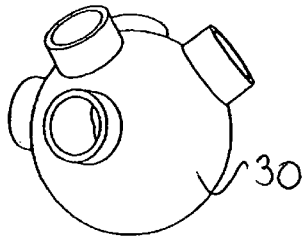
Figure 9D:
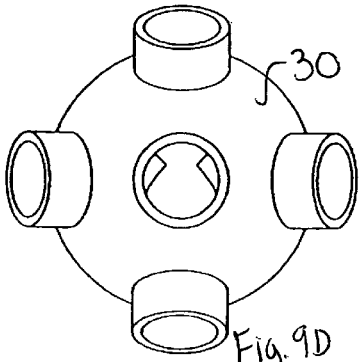
Figure 9E:
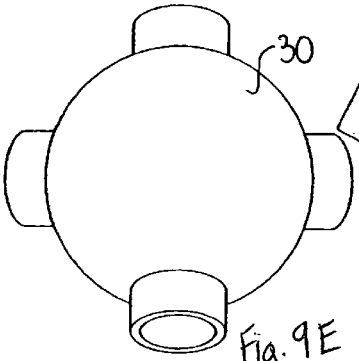
Figure 9F:
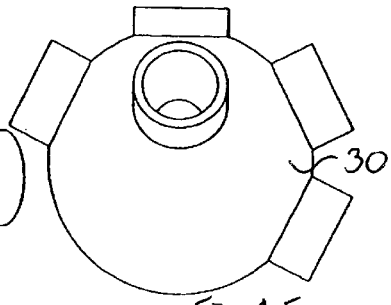
Figure 9G:
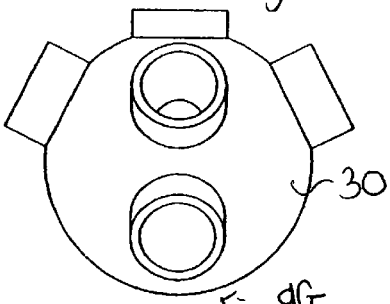
Figure 9H:
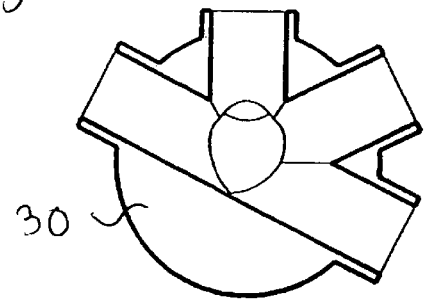
Figure 9I:
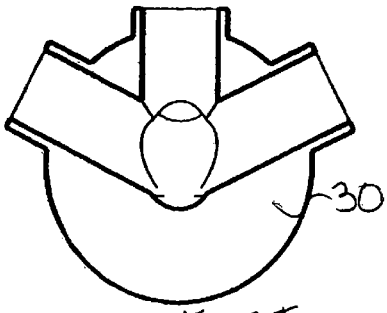
Figure 10A:
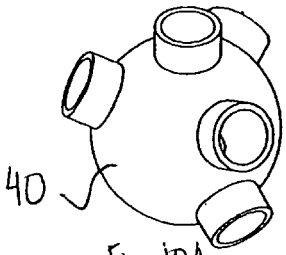
FIGS. 10A-10I are perspective, front, back, top, bottom, and side views of a "triangular-spherical" 1-exit interlinkable modular member in accordance with one embodiment of the present invention.
Figure 10B:
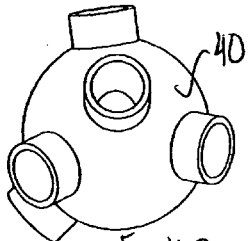
Figure 10C:
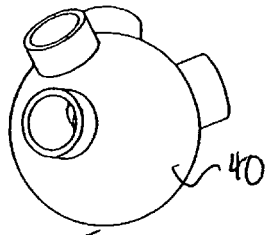
Figure 10D:
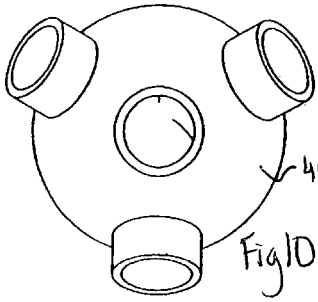
Figure 10E:
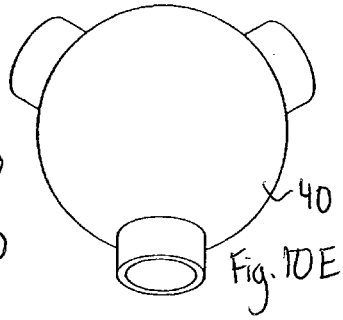
Figure 10F:
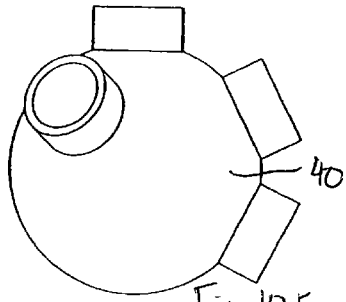
Figure 10G:
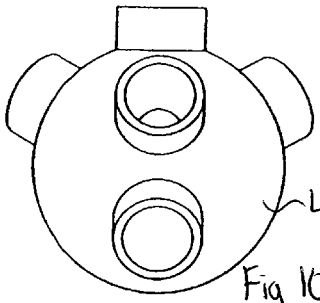
Figure 10H:
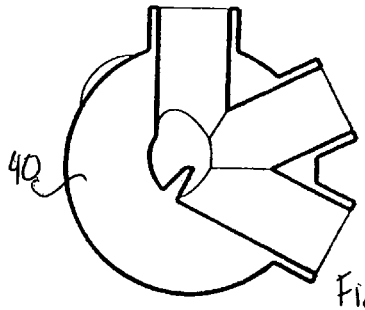
Figure 10I:
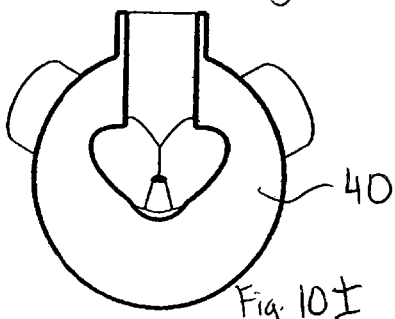
Figures 11A, 11B, 11C, 11D, 11E, 11F, 11G, 11H, 11I, 11J:
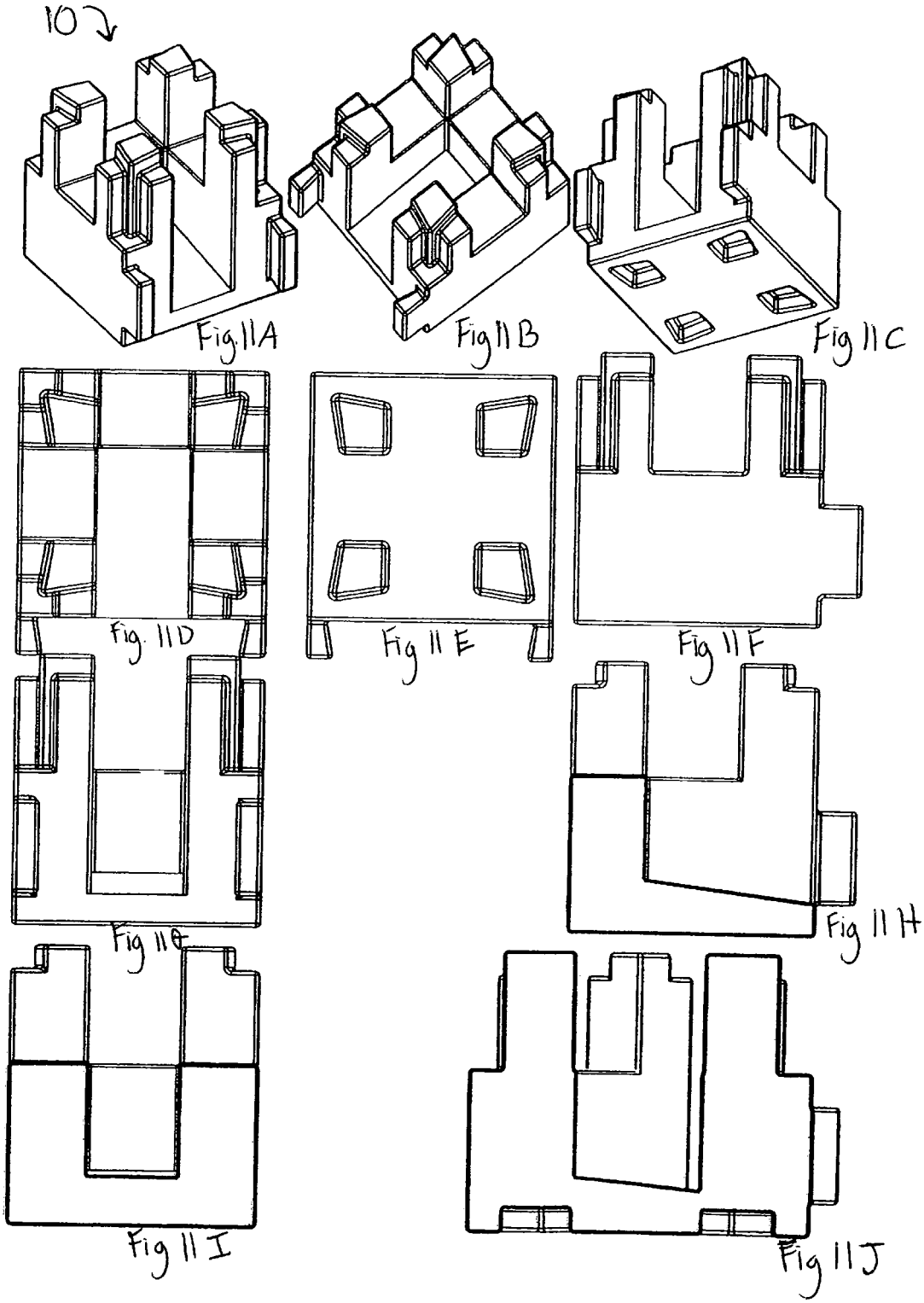
FIGS. 11A-11J are perspective, front, back, top, bottom, and side views of a cubical 1-exit interlinkable modular member with a split joint and non-contiguous exit in accordance with one embodiment of the present invention.
Figure 12A:
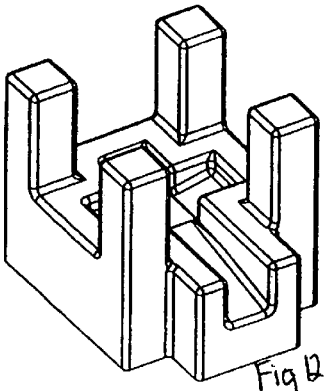
FIGS. 12A-12J are perspective, front, back, top, bottom, and side views of a cubical 1-exit interlinkable modular member with a flat bottom in accordance with one embodiment of the present invention.
Figure 12B:
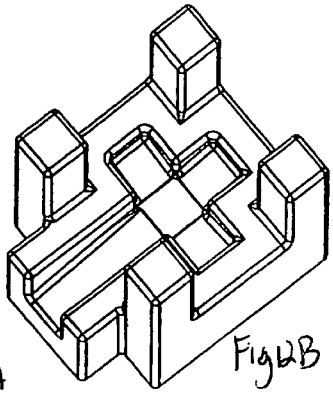
Figure 12C:
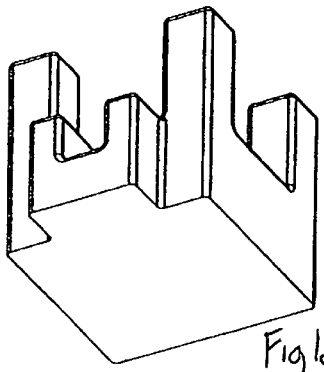
Figure 12D:
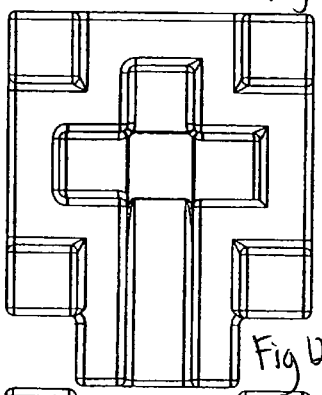
Figure 12E:
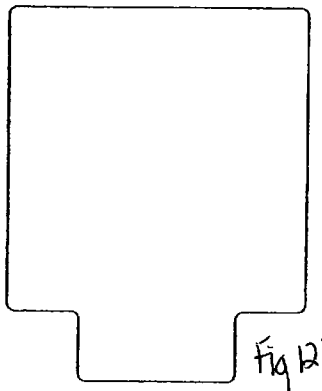
Figure 12F:
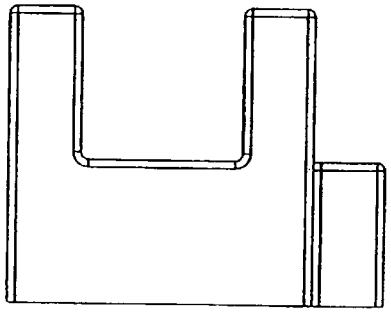
Figure 12G:
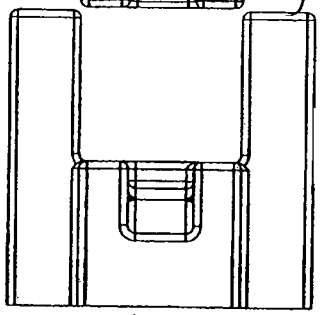
Figure 12H:
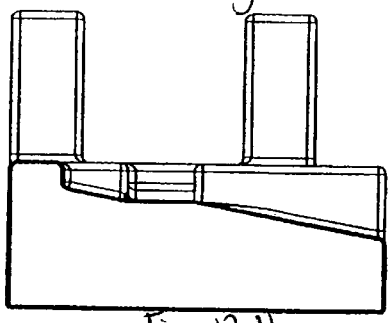
Figure 12I:
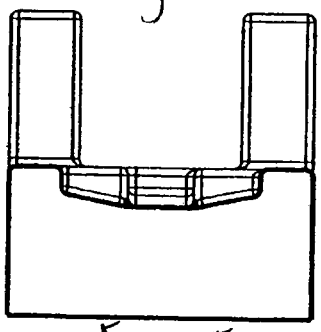
Figure 12J:
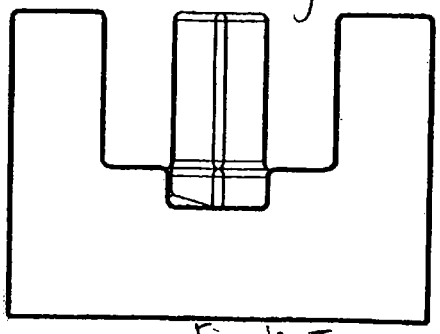

With respect to vertical-exit members, a concave-up floor in these members tends to induce some horizontal motion into falling spheres that contact the floor. As seen in FIG. 4B, a vertical-exit member with a concave-up floor defines a hole 370 in the concave-up floor for allowing vertical exit of a sphere from the member's internal chamber 360. Spheres falling through a column of multiple vertical exit members thus do not have a free-fall but, rather, are partly slowed by the presence of the floors; occasionally a falling sphere will attain a rapid spiraling motion as it gets caught on the concave-up floor associated with a circular bottom exit opening.

(iii) Pathways Created by Vertical Members

In contrast to the horizontal exit members, vertical exit members share the common characteristic of creating a vertical pathway when vertically stacked upon another member. With reference to FIG. 17A-17E, it is again apparent that distinctly-shaped members may share the same entrance/exit configuration, in this case a single vertical exit and five entrances. Where any of these vertical exit members is stacked atop another member, a vertical pathway is created through the underside of the vertical exit member.

(iv) Randomness in Pathway

Where horizontal exit members with more than one horizontal exit are connected with other like-members, the pathway created thereby includes a certain degree of randomness. When an object such as a marble is introduced to the pathway of this pathway configuration, the marble will travel generally downward through the pathway as described in more detail below. Upon reaching a two-, three-, or four-exit member, the marble may exit through any of the exits.

Figure 28:
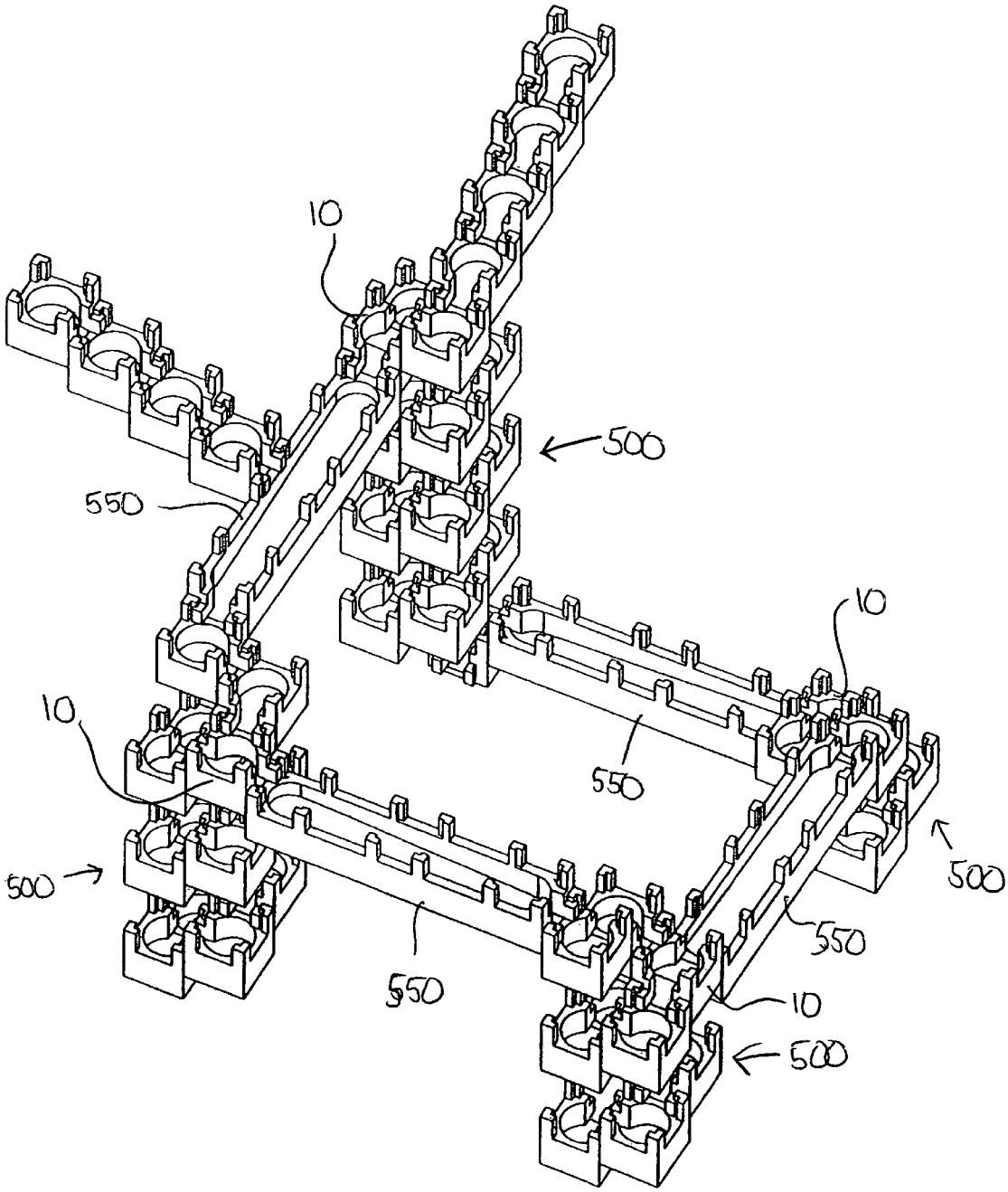
FIG. 28 is a perspective view of rectangular modular members arranged in a helix formation supported by cubical modular members arranged in helix formations.

For example, with reference to FIG. 28, when a marble enters a two-exit cubical member 10 at the top of any of the four helixes 500, there is a 50-50 chance that the marble will enter the helix 500 or travel into the elongated member 550 (described in more detail below). Similarly, with reference to FIG. 29, when a marble enters a two-exit cubical member 10 at the top of any of the four helixes 510 with additional support members, there is a 50-50 chance that the marble will enter the helix 510 or travel into the elongated member 550. As the pathway configurations become more elaborate, such as those shown in FIGS. 5.2, 5.3, 6.1, 6.2, 11.2, 12.4, and 13.3, the level of pathway randomness is inherently increased. Two marbles colliding in a two exit block will tend to result in each marble going out a separate exit.

B. Member Form

As already described, the modular members may take a variety of shapes and forms while still conforming to the principles of the present invention. Non-limiting exemplars of the possible embodiments of the present invention include cubical, triangular, rectangular, cylindrical, spherical, hexagonal, octagonal, truncated octahedral, bicupolar, and cruciform, or "T-plan". Both the entrance/exit principles and the vertical offset principle described above are achievable regardless of the particular shape or form of the modular member. Additionally, as discussed above and described in more detail below, the numerous pathway configurations for assembly of like-modular members are also achievable regardless of the particular shape or form of the modular members.

C. Joiner (i) General Attributes of Joinery

Like-members are generally assembled and coupled to each other through a joinery system. As described herein, a variety of joinery systems and embodiments may be suitable for achieving the desired assembly and coupling effect, each having unique characteristics.

For example, L-joints or U-joints, which are described in more detail below, generally provide for a sliding assembly where members are assembled by vertically sliding one member into its adjacent member. The members are thereby coupled together, at least in part, by the L-shaped portion of the joint. Alternatively, friction joints, which are also described in more detail below, provide for assembling members by vertically or horizontally sliding one member into its adjacent member. The friction joint members are thereby coupled together, at least in part, by the frictional force of the joints. These and other joint types are described further below.

Another aspect of the joinery is their configuration such that where two members are interconnected thereby, the joints ensure the ½ step vertical offset thereby providing for proper pathway alignment between adjacent members.

In the specific example of a first split joint type, described in more detail below, FIGS. 30A-30D show this joint on a cubical modular member 10. As seen in these drawings, the male joints 200 include two vertically aligned members 201 protruding outside a vertical face 210 of the member and are situated in a lower portion of the member on either side of the horizontal exit. Cubical members generally have one male joint for each horizontal exit; thus, in FIGS. 30A-30D the member has one horizontal exit and one male joint.

Vertical exit cubical members generally do not have male joints on their sides. Each of these cubical members also includes four female joints, defined by interior sides 230 of vertical support members 40. These female joints are configured to receive and couple with the male joints.

In one embodiment of the present invention, the modular members do not include any joinery. In this embodiment, the members are assembled by placing modular members on a substantially flat surface in the desired location. A ½ step vertical offset may still be achieved through a number of means, even without a joinery system. For example, a set of offset members (not shown) may be provided. The offset members may have dimensions substantially similar to that of the other modular members except for their height, which is approximately half the height of the other members. By stacking a regularly shaped member on top of an offset member, the regularly shaped member will be situated at an appropriate vertical offset relative to an adjacent member that is not stacked on an offset member. By configuring the offset members in a desired arrangement, such as a checkerboard, the remaining modular members may be positioned and configured to created the pathways described above.

(ii) Joinery Examples

As described, a variety of joints may be used in accordance with the present invention. Non-limiting examples of such suitable joints are shown in FIGS. 33A-33B, 34A-34D, 35A-35C, 36A-36D, 37A-37C, 38A-38C, and 39, each of which illustrates the joinery portions of two modular members. In each of these drawings, the male joint is shown in the upper position and the female joint is shown in the lower position.

The joinery types shown in FIGS. 33A-33B, 35A-35C, and 37A-37C are vertical assembly joints and the joinery types shown in FIGS. 34A-34D, 36A-36D, 38A-38C, and 39 are horizontal/vertical assembly joints. As describe in more detail below, vertical assembly and horizontal/vertical assembly generally describes the manner in which the male and female joints are assembled, thereby coupling modular members. Vertical assembly denotes that the members are coupled by vertically sliding one modular member's male joint down and into another member's female joint. Horizontal/vertical assembly denotes that the members may be coupled either vertically, as with vertical assembly joints, or by horizontally sliding one modular member's male joint into another member's female joint. The assembly process is described in more detail herein.

An advantage to the vertical assembly joints described below is the increased strength and support provided thereby. Members with vertical assembly joints are easily and securely coupled to each other, with the proper pathway alignment and vertical offset ensured. An advantage of the horizontal assembly joints described below is the ability to add and remove members from an array of assembled members; because horizontal/vertical assembly joint members can be coupled and de-coupled horizontally, no disassembly is necessary to remove a member that would otherwise be vertically pinned by adjacent members.

Split Joint Type 1

Figure 33A:
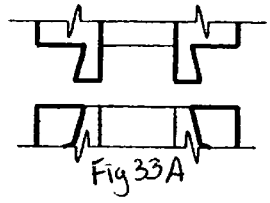
FIGS. 33A-33B are top views of Split Joint Type 1 vertical assembly joints.
Figure 33B:
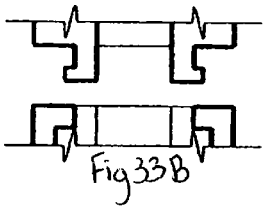
Figure 34A:
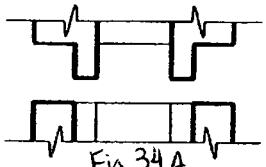
FIGS. 34A34-D are top views of Split Joint Type 1 vertical or horizontal assembly joints.
Figure 34B:
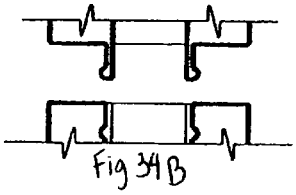
Figure 34C:
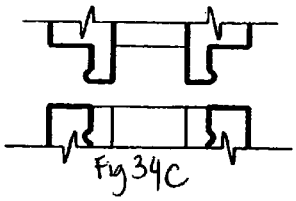
Figure 34D:
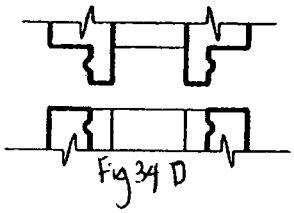

Examples of the first split joint type are shown in FIGS. 33A-33B and 34A-34D. This joinery type is characterized by a male joint forming a portion of its member's horizontal exit pathway; a marble passing through this male joint will travel directly between (or through) the opposing vertically aligned members that form the male joint. FIG. 33A illustrates a dovetail joint and FIG. 33B illustrates an L-joint, both of which are vertical assemblies. The widening configuration of the male dovetail joint and the L-hook of the male L-joint hold the members together. FIG. 34A illustrates a friction joint, where the members are held together by a frictional force. FIGS. 34B and 34C illustrate a snapfit type 1 joint, where a prong situated at the end of the male joint, which bends back during horizontal assembly, and snaps into a receiving recess in the female joint. FIG. 34D illustrates a snapfit type 2 joint, where the prong is situated midway along the male joint and snaps into a receiving recess in the female joint. Both the friction joint and the snapfit joints allow for horizontal/vertical assembly.

Split Joint Type 2

Figure 35A:
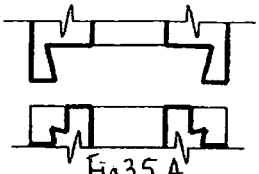
FIGS. 35A-35C are top views of Split Joint Type 2 vertical assembly joints.
Figure 35B:
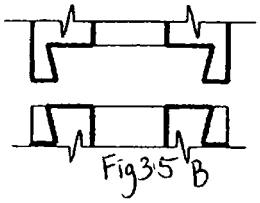
Figure 35C:
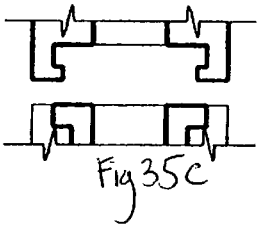
Figure 36A:
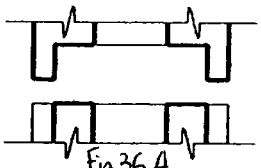
FIGS. 36A-36D are top views of Split Joint Type 2 vertical or horizontal assembly joints.
Figure 36B:
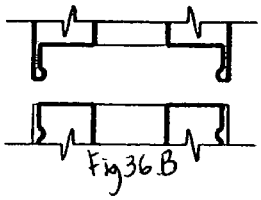
Figure 36C:
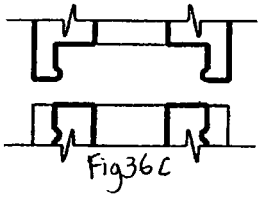
Figure 36D:
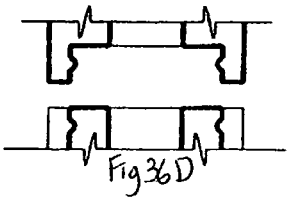

Examples of the second split joint type are shown in FIGS. 35A-35C and 36A-36D. This joinery type is characterized by the male joint being formed on the outside of the modular member and the female joint forming a portion of its member's horizontal exit pathway. FIGS. 35A and 35B illustrate a dovetail joint where the widening configuration of the male dovetail joint holds the members together. The embodiment shown in FIG. 35A includes adjacent female joints, thereby allowing upper neighboring blocks to attach from any side. The embodiment shown in FIG. 35B does not allow for adjacent female joints, and therefore does not allow blocks to attach from any side. FIG. 35C illustrates an L-joint, where the L-hook of the female L-joint holds the members together. Both the dovetail joints and the L-joint are vertical assembly joints. FIG. 36A illustrates a friction joint, where the members are held together by a frictional force. FIGS. 36B and 36C illustrate a snapfit type 1 joint, and FIG. 36D illustrates a snapfit type 2 joint. Both the friction joint and the snapfit joints allow for horizontal/vertical assembly.

Figure 37A:
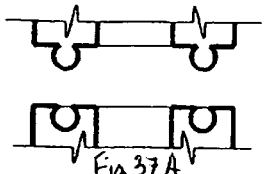
FIGS. 37A-37C are top views of Double Joint vertical assembly joints.
Figure 37B:
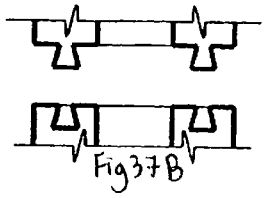
Figure 37C:
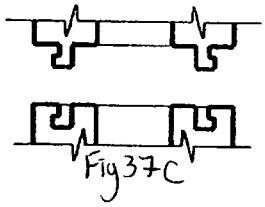
Figure 38A:
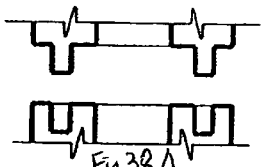
FIGS. 38A-38C are top views of Double Joint vertical or horizontal assembly joints.
Figure 38B:
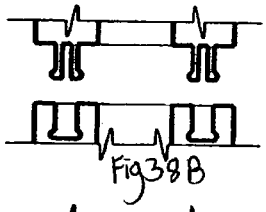
Figure 38C:
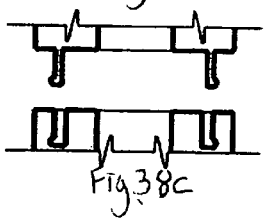

Double Joints:

Examples of the double joint type are shown in FIGS. 37A-37C and 38A-38C. This joinery type is characterized by two distinct joints; each of the two vertically aligned members that form the male joints are situated in the middle of its respective side, as seen in FIGS. 37A-37C and 38A-38C. This configuration is distinguishable from situating the male joint on the inside (split joint type 1) or on the outside (split joint type 2). FIG. 37A illustrates a cylinder embodiment of the double joint, FIG. 37B illustrates a dovetail embodiment of the double joint, and FIG. 37C illustrates an L-joint embodiment of the double joint. Each of these embodiments is a vertical assembly. FIG. 38A illustrates a friction joint embodiment and FIGS. 38B and 38C illustrate snapfit embodiments, all of which are horizontal/vertical assembly.

Figure 39:
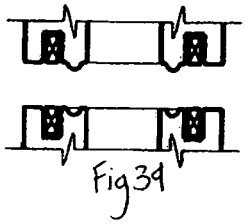
FIG. 39 is a top view of magnetic vertical or horizontal assembly joints.

Magnetic Joint:

FIG. 39 illustrates a magnetic joint, where magnets of opposite polarization or hinged rotating magnets are configured in the male joint and the female joint, as indicated by the X's. The magnetic force couples the members together. A protruding nipple extends from the male joint, which during assembly is received by a corresponding recess in the female joint, thereby indicating that proper alignment has been achieved. The nipple and recess may also supplement the magnetic force in holding the two members together.

Figure 32B:
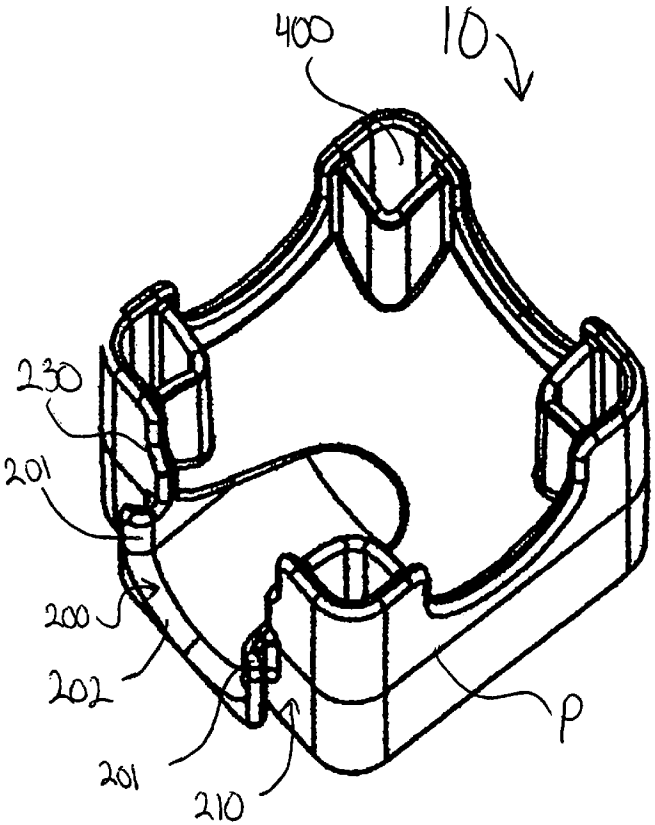
FIGS. 32A-32B are isometric views of a cubical 1-exit interlinkable modular member with a U-joint and concave-up floor in accordance with one embodiment of the present invention.
Figure 32A:
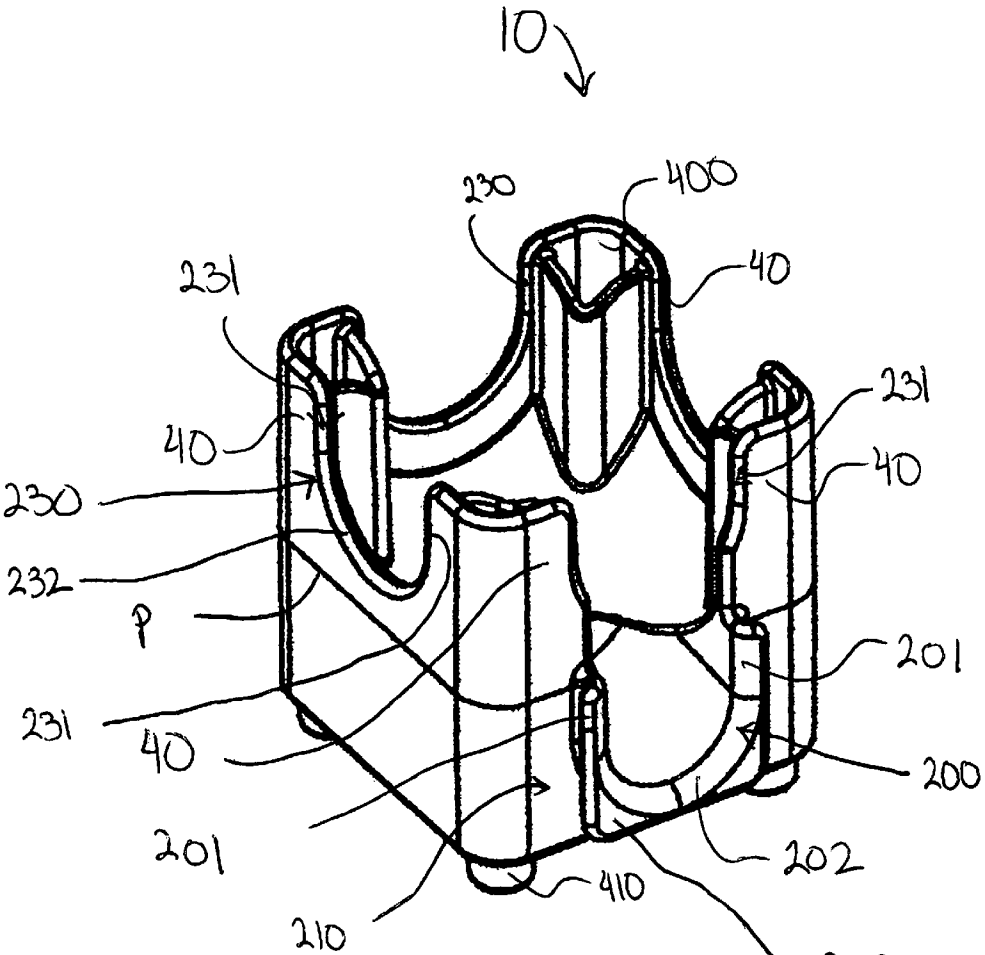
Figure 32D:
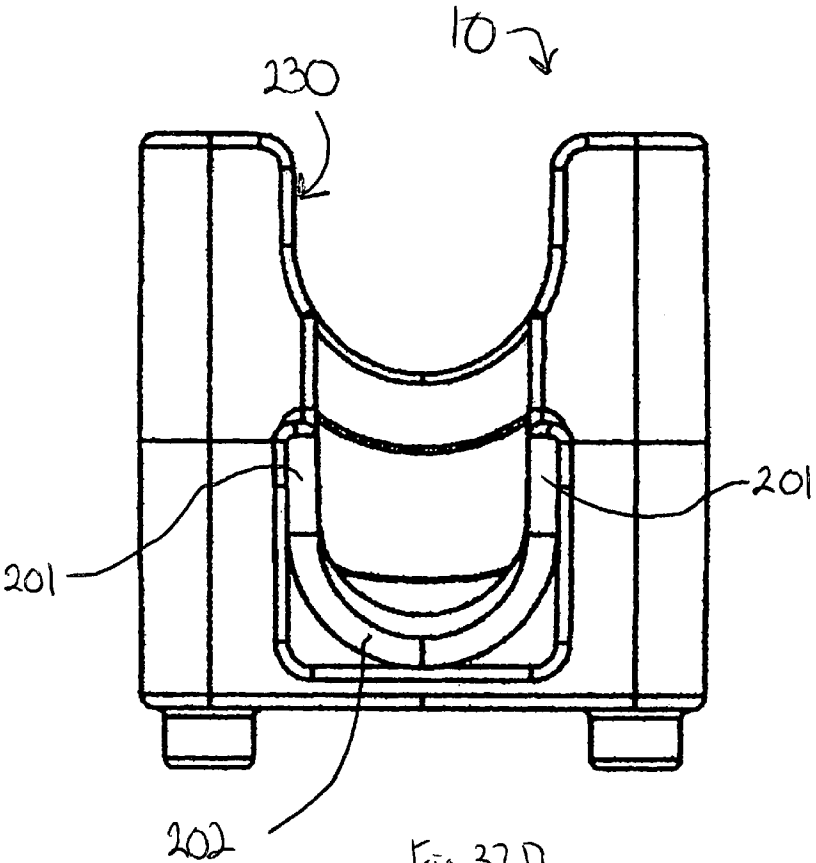
FIGS. 32C-32D are isometric worm's eye and exit elevation views of the modular member of FIGS. 32A-32B.
Figure 32C:
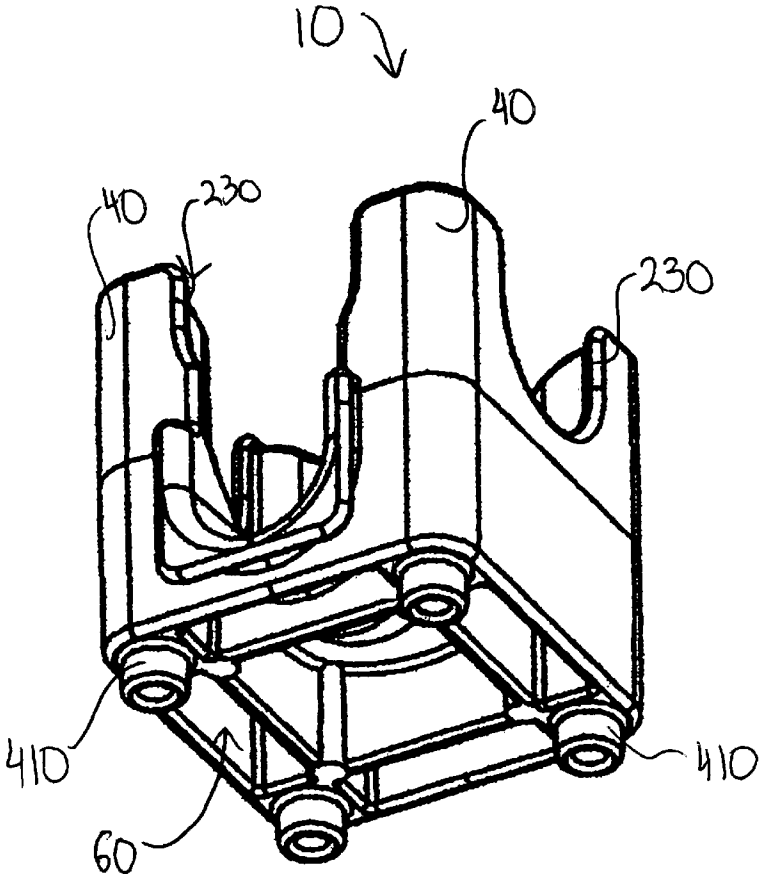
Figure 32F:
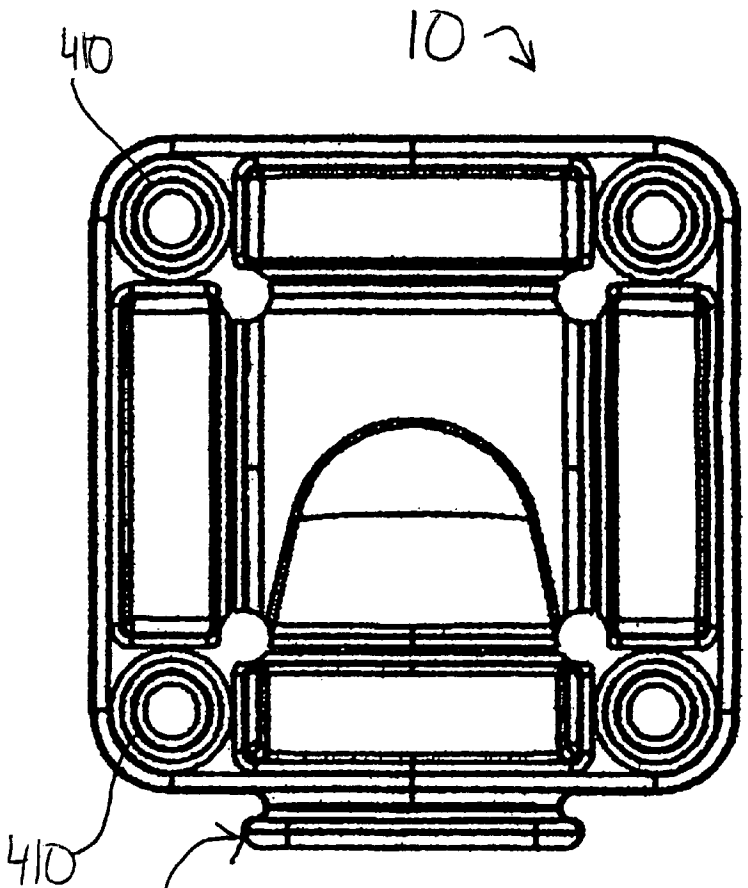
FIGS. 32E-32F top and bottom views of the modular member of FIGS. 32A-32B.
Figure 32E:
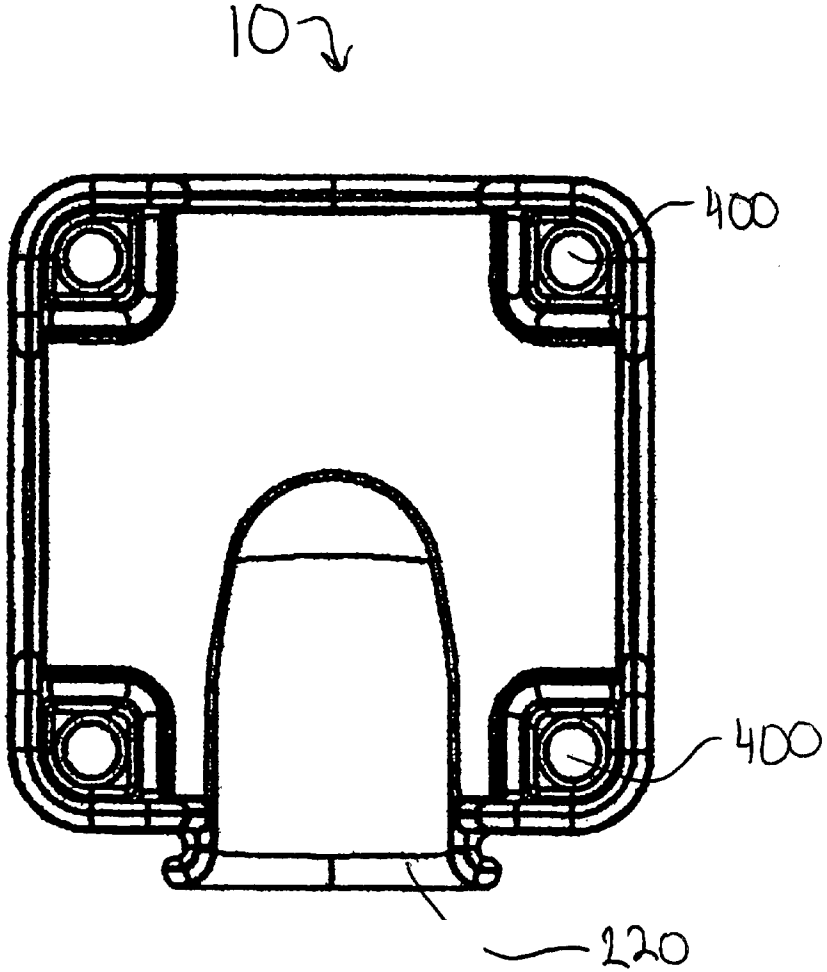
Figure 61A:
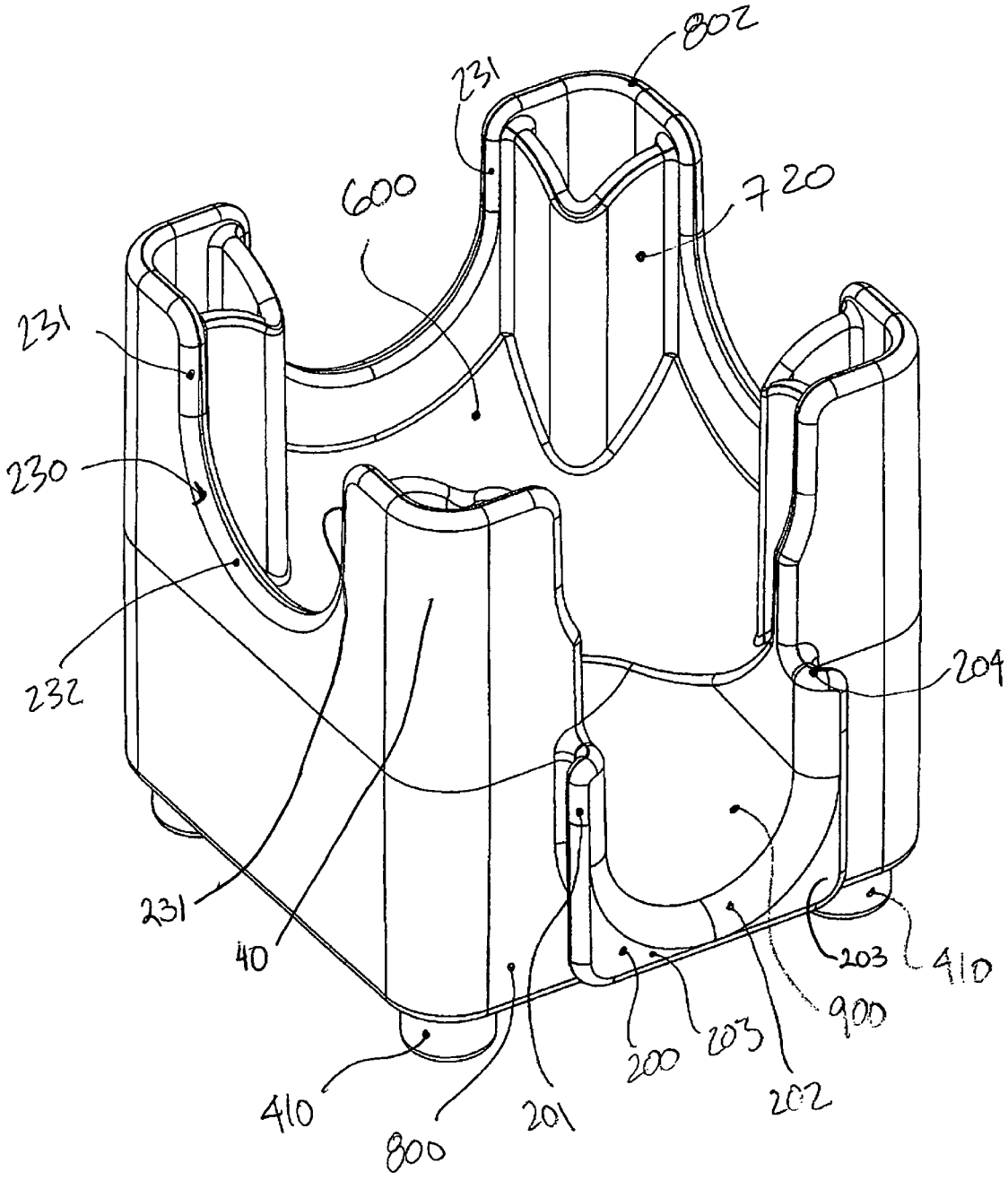

U-Joint:

One embodiment of the U-shaped joint, or "U-joint", is shown on a cubical member 10 in FIGS. 32A-32F. The U-joint comprises a male U-joint 200 and a female U-joint 230. As seen in these drawings, the male U-joints 200 include two vertically aligned members 201 connected by a curved portion 202 (see, FIG. 32A), protrude outside a vertical face 210 of the member (see, FIG. 32F), and are situated in a lower portion of the member wrapping the sides and bottom of the horizontal exit (see, FIG. 32D). As seen in FIGS. 32A and 61A, the male U-joint in this embodiment further defines two extending triangles 203, which result in the lower portion of the male U-joint having a square-like appearance. As shown in FIGS. 32A and 61A, the female U-joints 230 include two vertically aligned members 231, which are defined by interior sides of vertical support members 40, connected by a curved portion 232. The female U-joints 230 are configured to receive and couple with the male U-joints 200. FIGS. 1A, 1C, and 1F show the female joints formed about the horizontal entrance 310 opening, which couples with the male U-joint.

"Hook and Loop" Joint:

The "hook and loop" joint (not shown) implements a hook and loop fastener material, such as Velcro, on opposing sides of the modular members to be coupled. The material may be situated similarly to the magnets in the magnetic joint described above or in any other location appropriate for coupling the members.

Adhesive Joint:

The adhesive joint (not shown) may also be implemented by applying an amount of adhesive at appropriate locations to couple adjacent modular members. A variety of adhesives are suitable for this purpose, including permanent adhesive, semi-adhesive, and impermanent adhesive, such as soluble glue. Additionally, where the modular members are formed of ice, as described in more detail below, the joint may be a slushy substance capable of being manipulated and frozen, thereby adhering two members together.

(iii) Vertical Joints

Figure 40A:
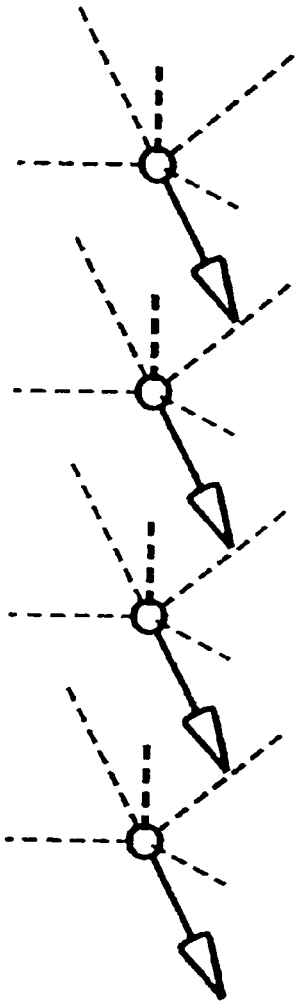
FIG. 40A is a perspective view of an entrance/exit configuration for a column pattern.
Figure 40B:
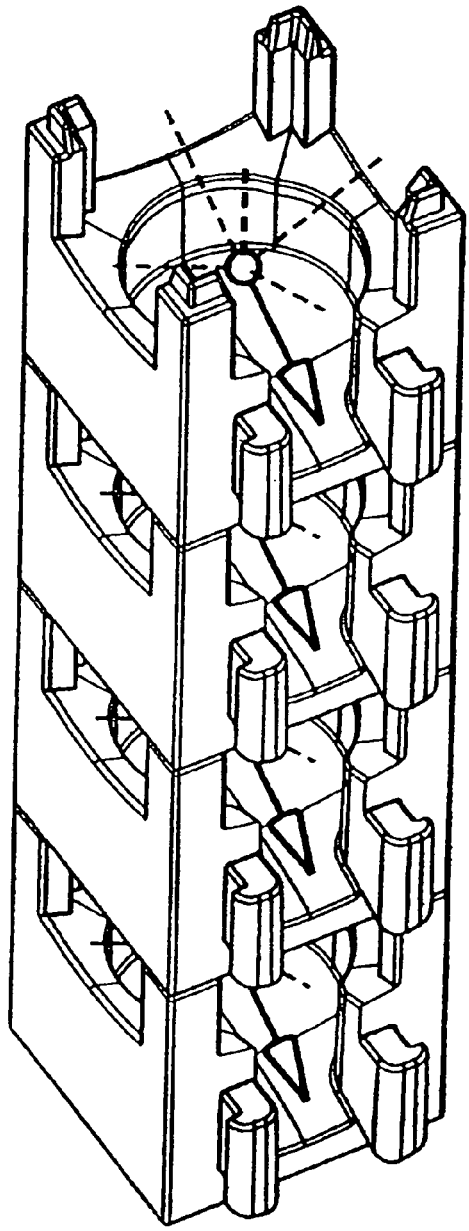
FIG. 40B is a perspective view of cubical interlinkable modular members arranged in the column pattern of FIG. 40A.
Figure 41A:
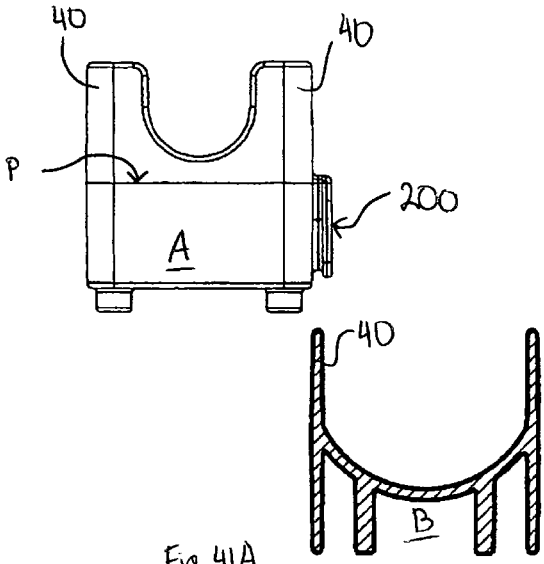
FIGS. 41A-41D are side and cross-sectional views respectively of a first member with a parting line being secured to a second member.
Figure 41B:
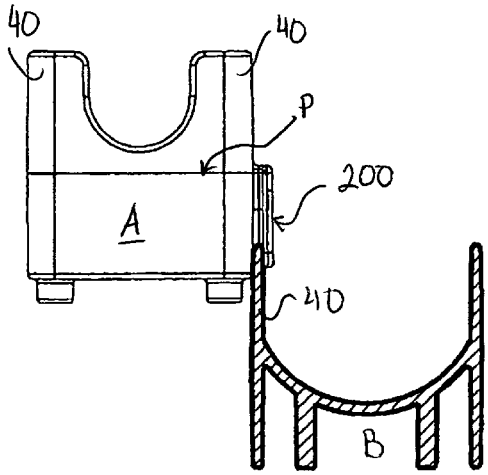
Figure 41C:
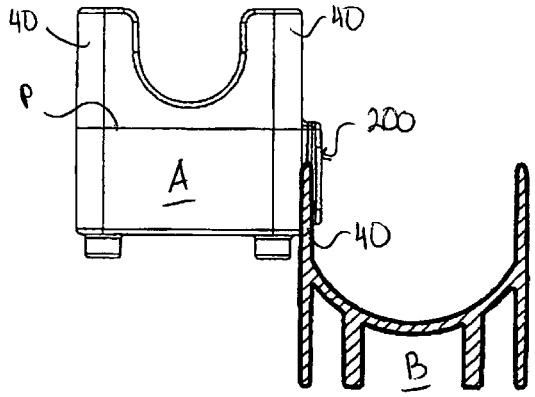
Figure 41D:
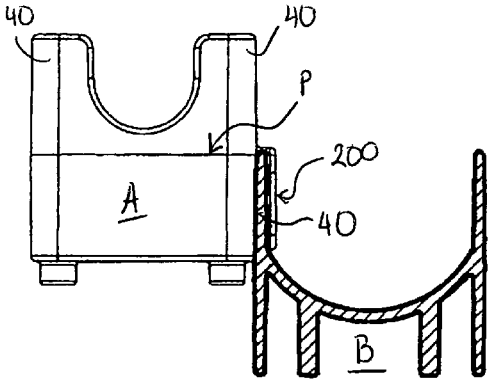

The above description of joinery systems relates to "horizontal joints" that couple like-members horizontally. Additionally, members may also include vertical joints for coupling like-members vertically, where one member is stacked on top of another member is seen in FIG. 40B. The base of any member may have indentations underneath so that the base acts as the female part of a connection. Alternatively, the base of any member may have protrusions so that the base acts as the male part of a connection. A hermaphrodite joint may also utilized, in which the top and bottom of a member each have a mixture of male and female components. These configurations are now described in more detail.

In an embodiment shown in FIGS. 30A-30D, vertical support members 40 of a cubical member 10 each define a vertical female joint 400, which is an L-shaped recess. In this embodiment, the member also comprises four vertical male joints 410 protruding from an underside 60 of the member. Vertical female joints 400 are configured and scaled to receive vertical male joints 410 of another member, thereby allowing the members to securely stack. Vertical female joints 400 and vertical male joints 410 comprise a bevel, as seen in FIGS. 30A-30D, that allows for easy vertical assembly of two members.

Figures 31A, 31B:
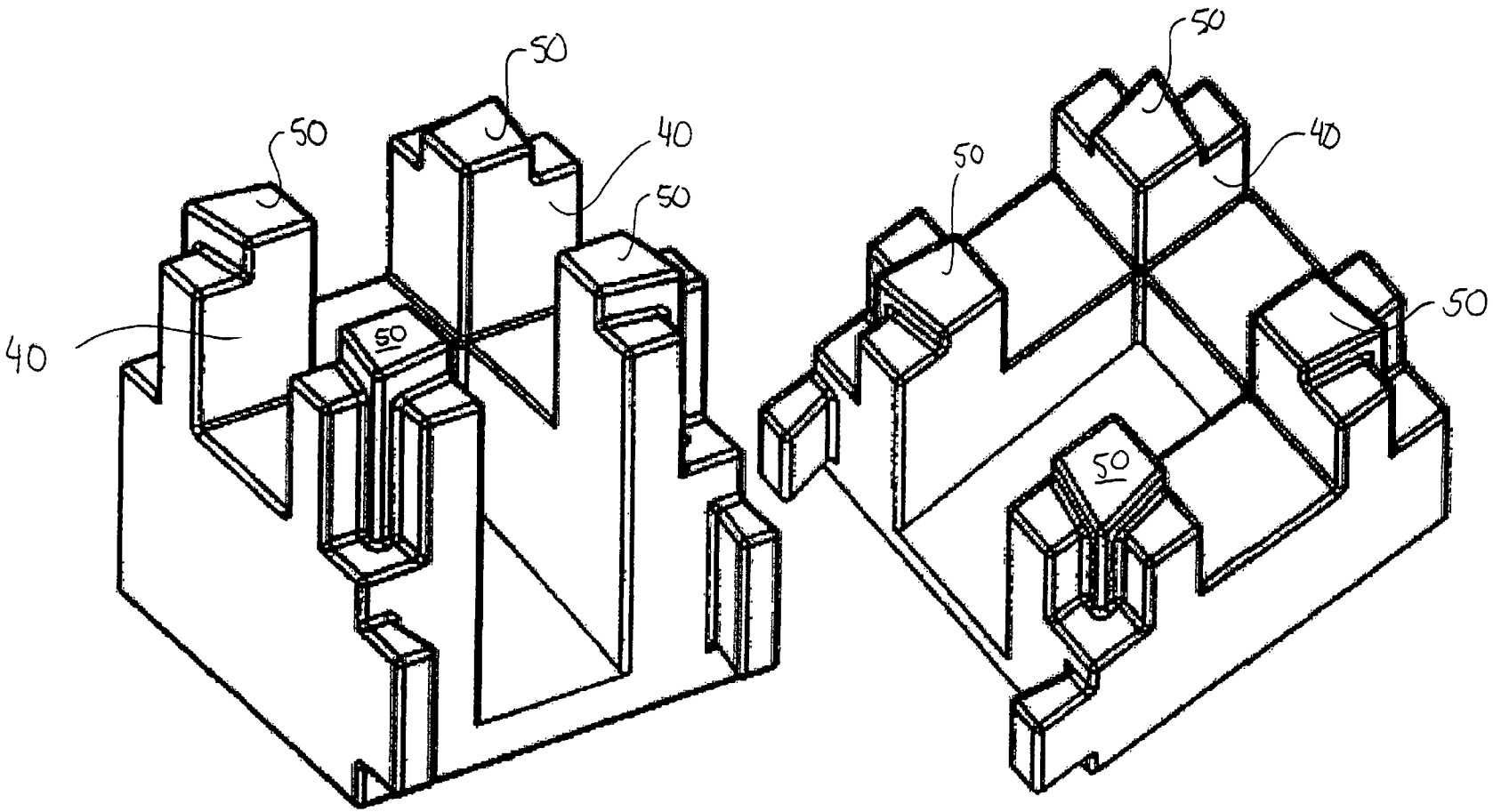
FIGS. 31A-31B are isometric views of a cubical 1-exit interlinkable modular member with a split joint and non-contiguous exit in accordance with one embodiment of the present invention.
Figure 31D:
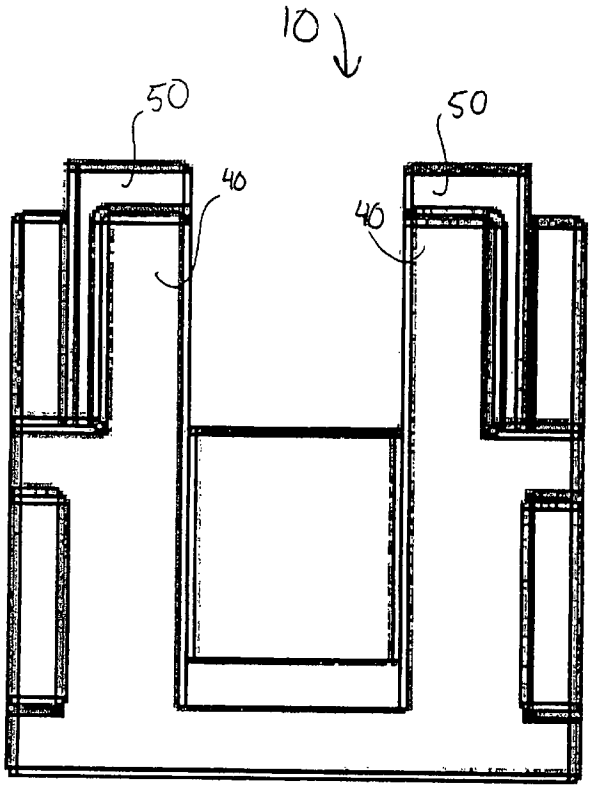
FIGS. 31C-31D are isometric wormseye and exit elevation views of the modular member of FIGS. 31A-31B.
Figure 31C:
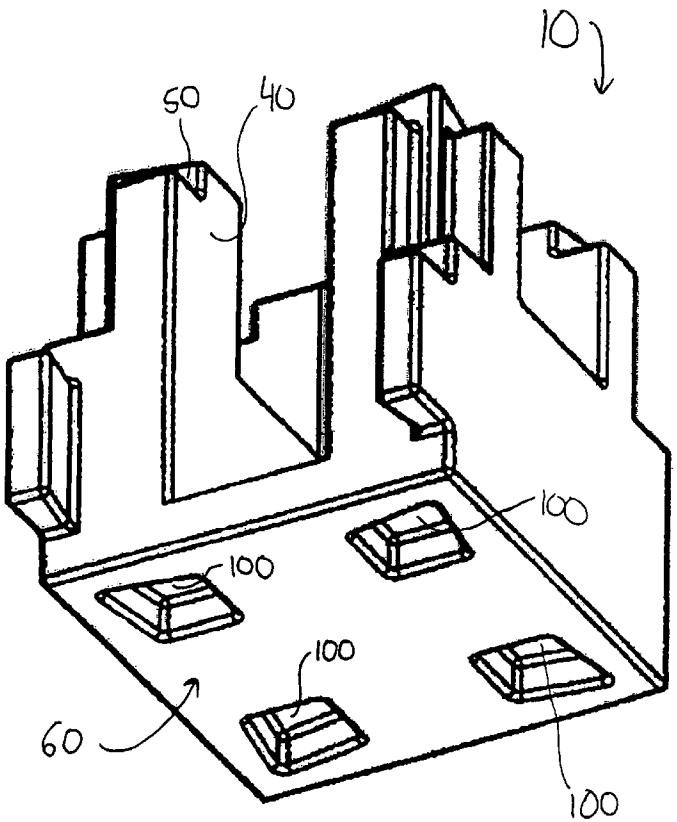

In another embodiment shown in FIGS. 31A-2027D, the vertical male joints are formed at an upper end of vertical support members 40 and the female vertical joints are formed in an underside 60. In this embodiment, each modular member defines a vertical male joint 50, which is a connector protruding above each vertical support member 40. Each modular member further defines four female vertical connectors 100 on underside 60, which are configured and scaled to receive vertical male joints 50 of another member, thereby allowing the members to securely stack. Vertical male joints 50 and vertical female joints 100 comprise a bevel, as seen in FIGS. 31A-2027D, that allows for easy vertical assembly of two members. In the embodiment shown in FIGS. 31A-2027D, which includes a type 2 split joint, vertical male joint 50 is a kite-shaped protrusion and vertical female joints are comparably shaped recesses.

In yet another embodiment shown in FIGS. 32A-32F, vertical support members 40 of a cubical member 10 each define a vertical female joint 400, which is a recess formed therein. In this embodiment, the member also comprises four vertical male joints 410 protruding from an underside 60 of the member. Vertical female joints 400 are configured and scaled to receive vertical male joints 410 of another member, thereby allowing the members to securely stack. Vertical female joints 400 and vertical male joints 410 taper complimentarily, which allows for easy vertical assembly of two members and for secure friction fitting of two members.

In other embodiments, such as that shown in FIGS. 13A-13J, 18B, 19B, 20B, 21B, and 22B, which include a type 1 split joint, the vertical male joint may be a tapered L-shaped protrusion configured above each vertical support member 40. In this embodiment the vertical female joints are formed in underside 60 by a square-shaped perimeter, as is seen in FIGS. 13A-13J. The interior of the corners of this perimeter form vertical female joints, which are configured and scaled to receive the L-shaped vertical male joints of another member. The L-shaped protrusions of the male joints taper at both ends of the L, as seen in FIGS. 13A-13J, which guides the vertical male joints into the vertical female joints of another member. This configuration facilitates vertically stacking two members.

(iv) Assembly

Figure 42A:
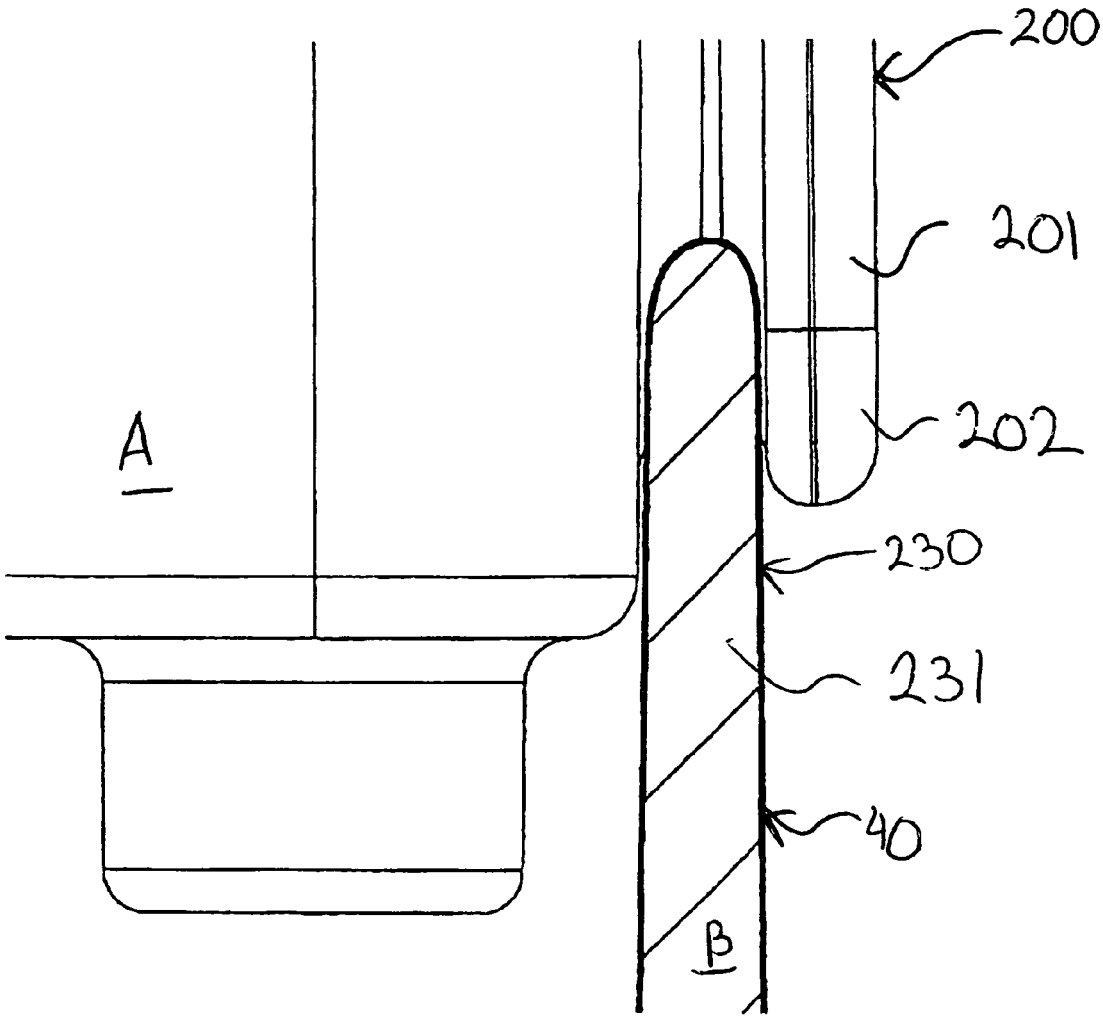
FIG. 42A is a detailed view of FIG. 41B.
Figure 42B:
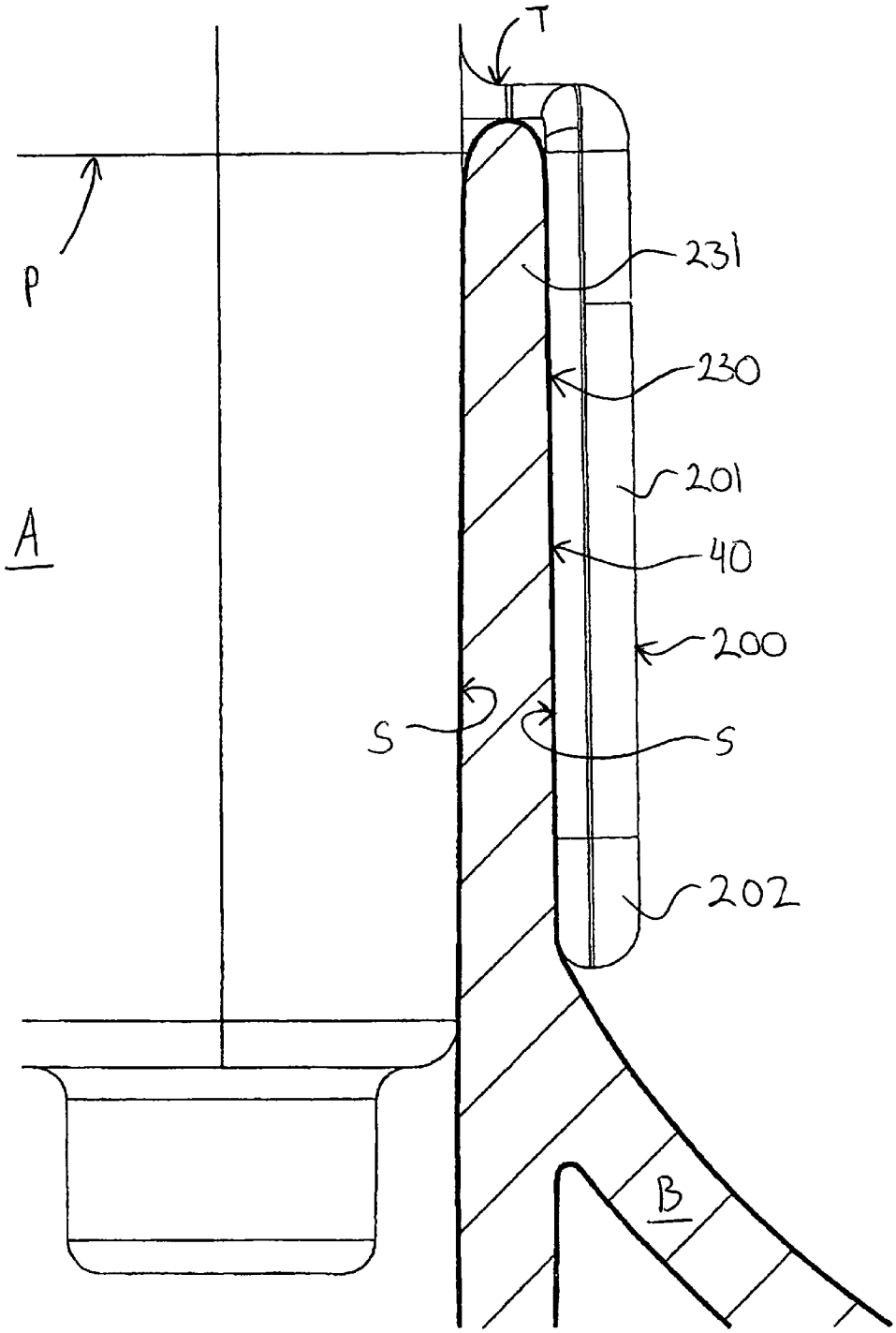
FIG. 42B is a detailed view of FIG. 41D.

With reference to FIGS. 41A-41D, which show the progression of assembling two members A and B, vertical support members 40 form the female joint 230 and are tapered with a draft angle facilitating removal from the mold above the parting line during manufacturing. The male joints 200, which are formed from vertically aligned members 201 and curved portion 202, are also tapered with a draft angle to facilitate removal from the mold below the parting line. This taper allows the male joint to be received by the female joint's vertically aligned members 231. The complimentary draft angles in the male and female parts, above and below the parting line, allow these male and female parts to nest on their coplanar surfaces. The taper feature of the female joint facilitates easy assembly of two or more modular members or even the nesting of a member into four other like members, as is now described in more detail. FIGS. 42A and 42B show detailed versions of FIGS. 41B and 41D respectively.

With reference the embodiment shown FIGS. 30A-30D and 32A-32F, a parting line P shows the parting line between the mold halves used for manufacturing of the member; in this embodiment, the member is formed by injection molding, but a variety of other manufacturing techniques are described in more detail below. The taper results in part due to the technical manufacturing benefits of providing a draft angle to ease release of the part from the mold. The taper also serves to facilitate assembly. With reference to the U-joint embodiment shown in FIGS. 32A-32F, whereas a parting line would typically be placed along a bottom edge of a cubical form, in the embodiment shown in FIGS. 41A-41B and 42A-42B, parting line P is placed approximately at the flat top surface T of the male joints. In this embodiment, this configuration situates parting P line approximately 1/32" to 1/8" below the center line of the cube. The assembly benefits are seen from FIG. 41A to FIG. 41D as members are assembled, which also demonstrates the snug fit achieved once members are fully coupled. The manufacturing technique of strategic parting line placement creates, in part, this functionality of the joinery system.

As is seen in FIGS. 42A and 42B, a cross section of a half female joint 230 in vertical support member 40, is shown. Above the parting line of this member, the sides of vertical support member taper inwards towards the entrance therebetween, becoming thinner with the increasing distance from the parting line. In complementary fashion, the male joint of an adjacent member is shown, the inner sides S of which taper outward at the same angle. The complimentary angles of two staggered blocks meet one another during assembly and thereby maintain an overall vertical and/or orthogonal geometry for multi-block constructions. The slight offset of the parting line from the centerline of the block additionally serves the function of building a slight tolerance into the system, such as in the case of the assembly progression shown in FIGS. 46A-G. This tolerance of a few thousandths of an inch facilitates assembly and disassembly.

The taper provided in the vertical joinery systems, particularly the L-joint, is a further advantage to the particular placement of the parting line. The vertical female members in the upper half of each block have exterior faces which taper inward (¼ to 1½ degrees) and interior faces which taper outward (also ¼ to 1½ degrees). The parting line, when it meets a male joint, continues around the edge of the top of the male joint until it reaches the tip of the L, as seen in FIG. 42A. The parting line then travels down along this tip of the L, traces along the bottom of the male joint, continues across the edge of the exit pathway until it meets the corresponding male joint on the opposite side. The parting line then traces along the bottom of this second male joint to the tip of the L, it continues up the L to the top flat edge of the male joint, and then traces along the male joint edge until rejoining the main body of the block. The result is that the male joint now has a taper that perfectly compliments the taper of the female joint. As two blocks are vertically connected the relatively wide opening in the male joint accepts the relatively narrow tip of the female joint. As the two blocks slide together the inward and outward tapering faces of the male and female joints get progressively closer and tighter until the two blocks are securely attached to one another.

The terms male and female begin to meld because the two parts of the male joint, vertically aligned members 200, act together as a male insertion into a female opening, but when considering just one part of the male joint, it functions also like a female joint which is receiving a tapered male from below. In another aspect of a cubical member, the bottom four corners are tapered and rounded; therefore, the entirety of such a cubical member being vertically assembled into four other cubical members—such as the center topmost member in the structure shown in FIGS. 47A and 47B—functions as a male joint being received by a female joint, i.e., the four receiving members.

Figures 43A, 43B:
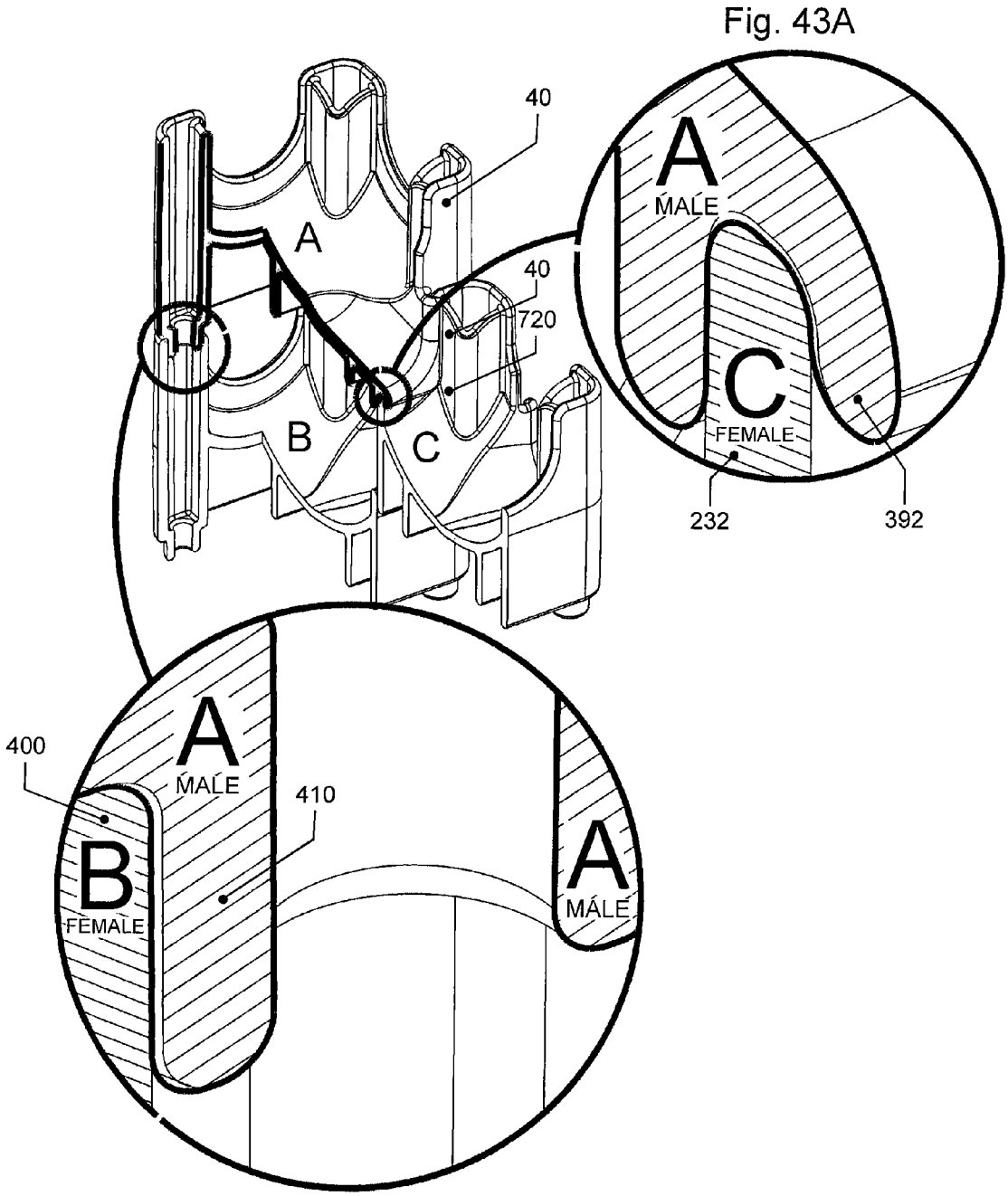
Figures 44A, 44B:
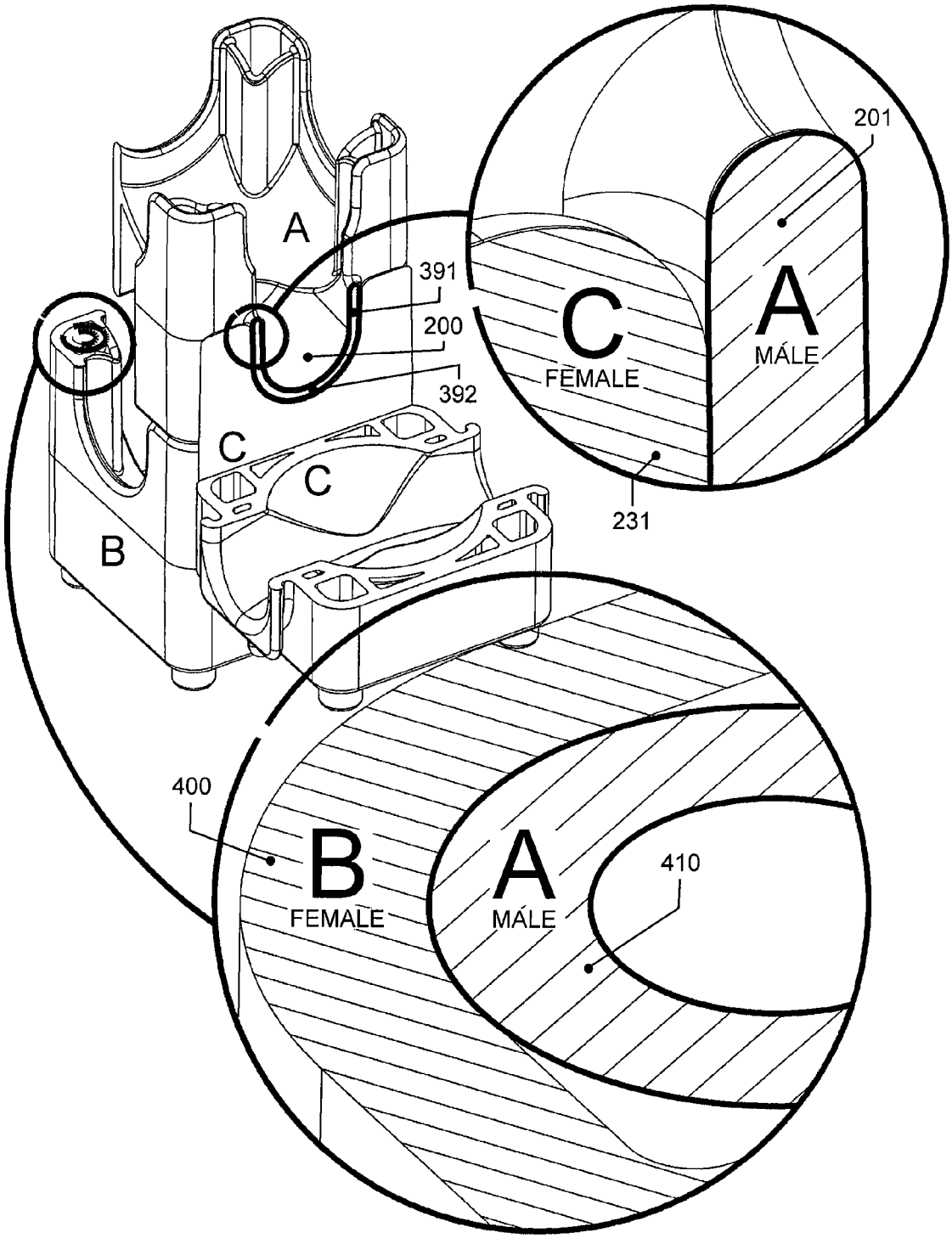
Figures 45A, 45B:
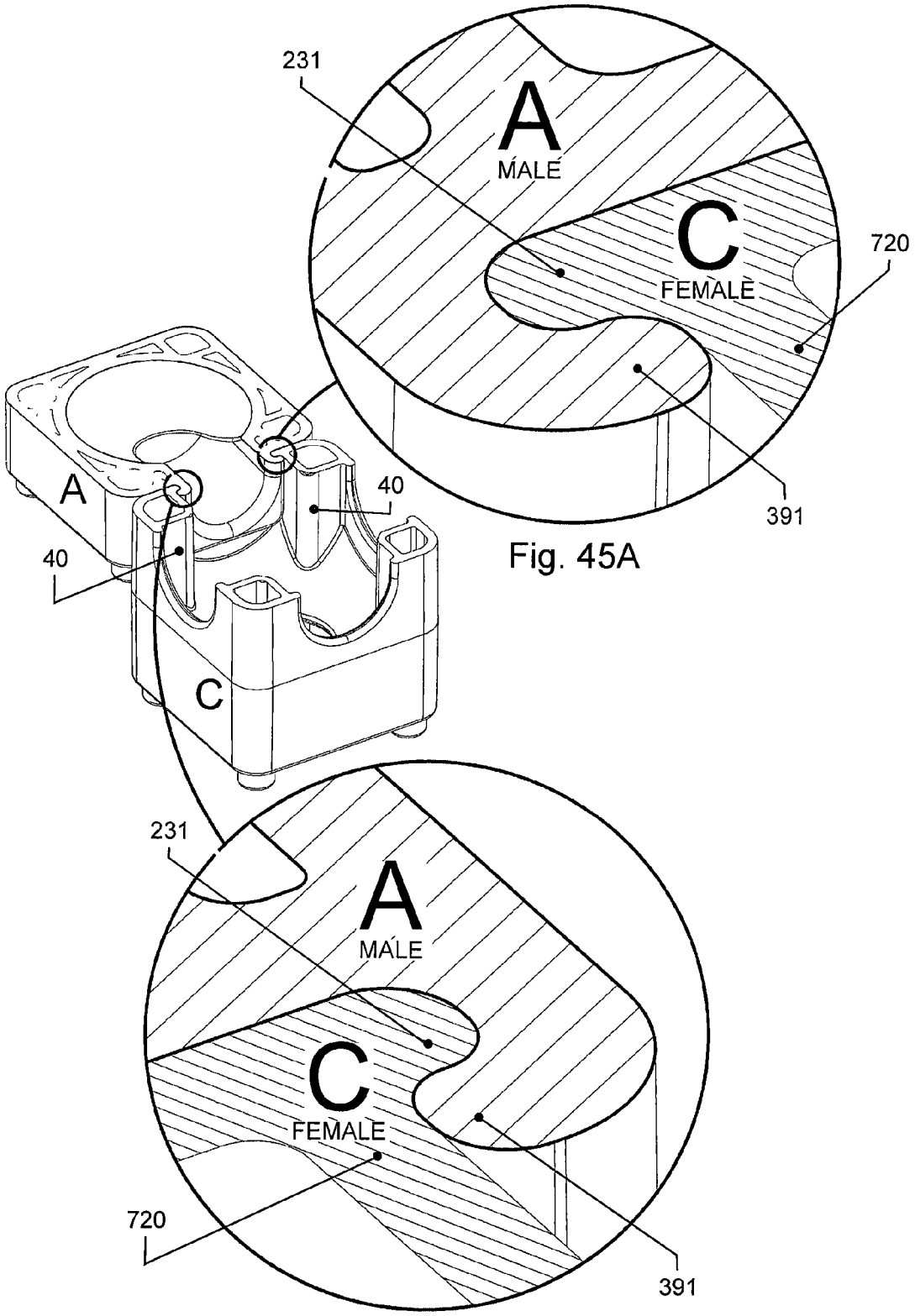
Figure 46:
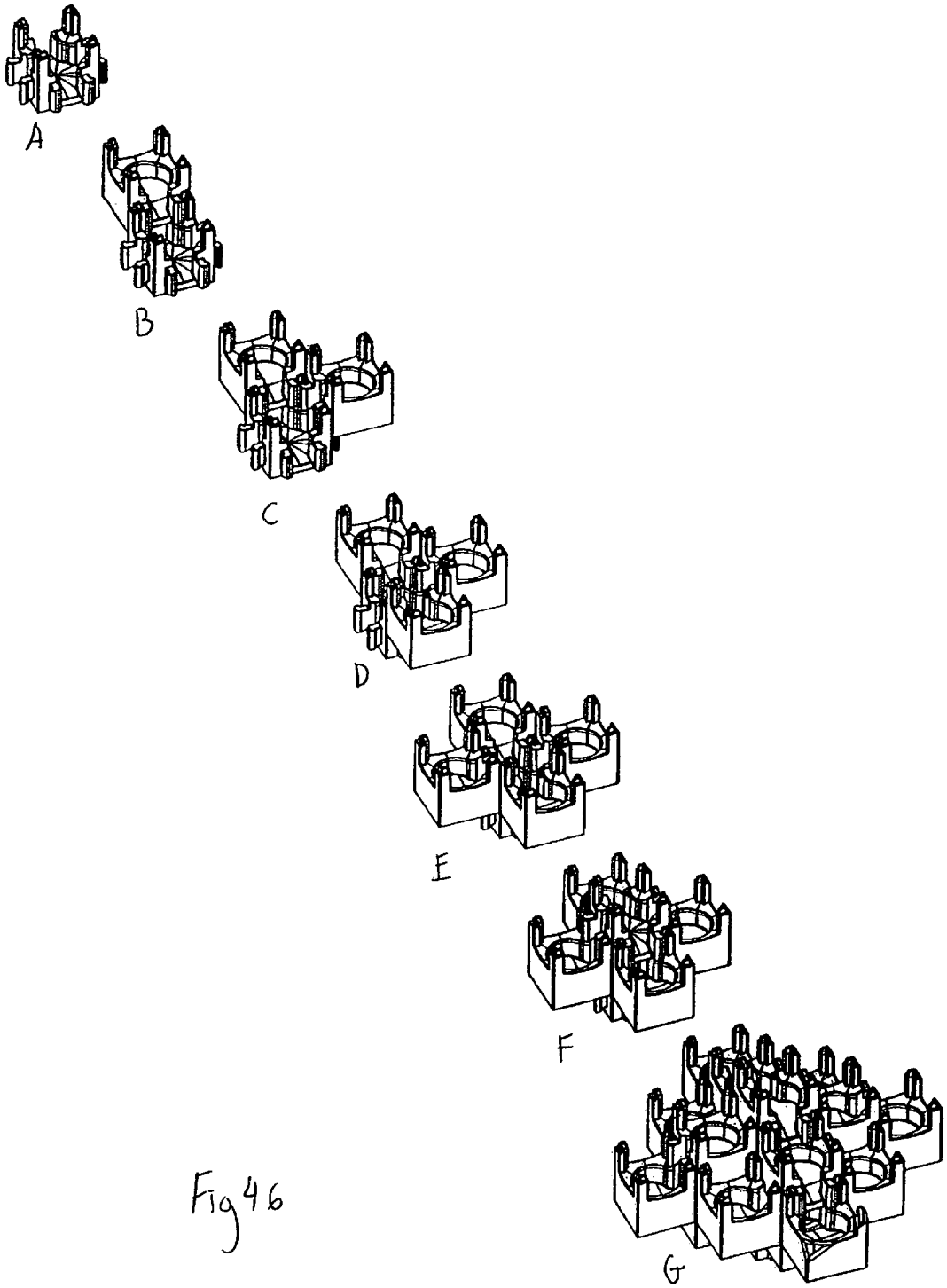
FIGS. 46A-46G are perspective views illustrating the assembly progression of cubical modular members.
Figure 61B:
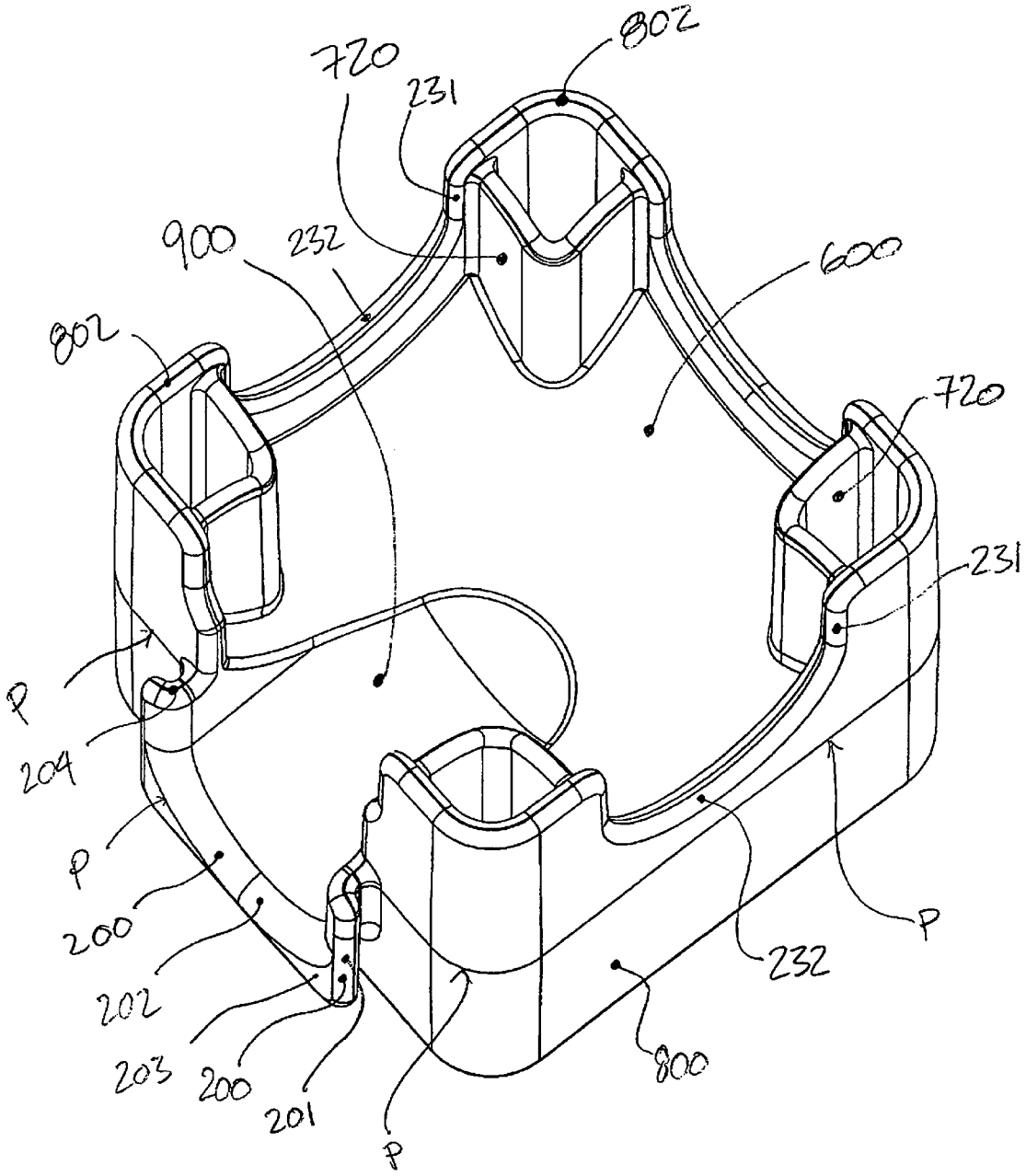
Figure 61C:
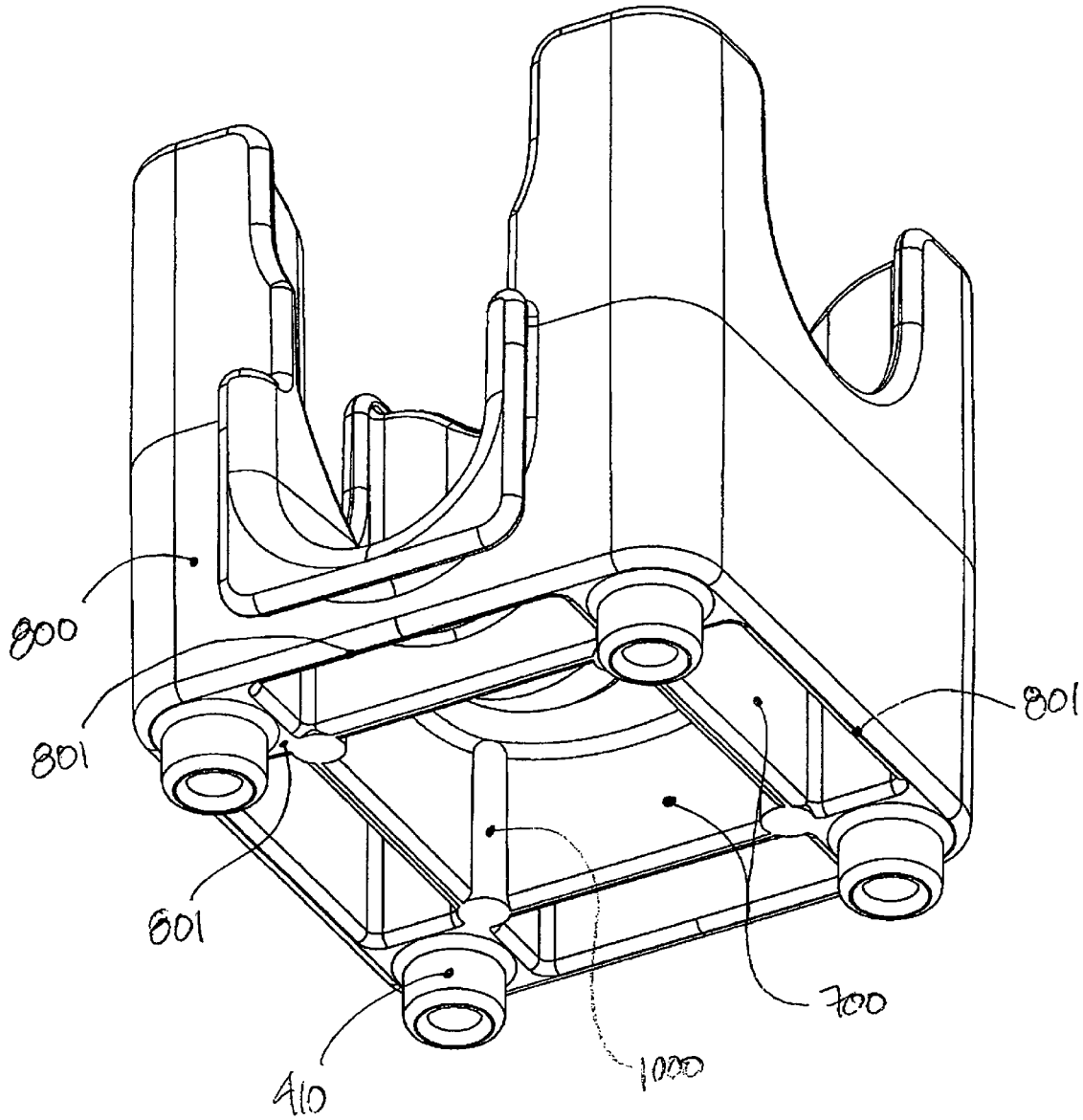

In U-joint embodiment shown in FIGS. 1A-1L, 2A-2L, 3A-3L, 4A-4L, and 32A-32F, the entire joinery also works together to secure together members and resist forces from a number of directions that may otherwise de-couple or loosen secured members. With reference to FIGS. 43 and 44, it is shown that a member A may be secured from below to a second member B by the members' vertical joinery (male vertical joint 410 and female vertical joint 400, respectively, shown in FIG. 44B), and simultaneously secure a third member C with the members' horizontal joinery. FIGS. 43-45 illustrate the lip 390 of member A's male U-joint 200, where the lip 390 includes both a vertically aligned portion 391, formed along the male joint's vertically aligned members 201, and a curved portion 392, formed along the male joint's curved portion 203. With particular reference to FIG. 43A, it is shown that the curved portion 392 of member A's male U-joint's 200 lip 390 secures over a complimentarily curving portion 232 of member C's female U-joint 230. FIG. 45 shows the vertically aligned portion 391 of the lip 390 of member A's male U-joint 200 secured around a complimentarily shaped vertical portion 231 of member C's female U-joint 230 (see FIGS. 45A and 45B). The lip 390 is a shared feature between the L-joint and the U-joint, which causes the two members to resist twisting forces. Whereas the lip 390 for male U-joints include both vertically aligned portions 391 and a connecting curved portion 392, the split U-joints include only the two vertically aligned portions 391. FIG. 44 illustrates the lip 390 on member A's male U-joint 200 securing snugly over member C's female U-joint 230 at member C's horizontal entrance and touching the vertical rib 720 (as seen in FIG. 43, where member C has two opposing horizontal exits. In this configuration, during assembly of member's A and C, member C's male U-joint 200 encounters the dimensionally complimentary female U-joint 230 of member C, such that member C's female U-joint 230, and the curved portion 232 in particular, serves as a "stop" for member A during assembly. As seen in FIG. 61, when a member defines both an entrance and an exit in the same vertical face, the entirety of the female U-joint's curved portion 232 may not be present, although the female joint may include remnants of the curved portion. In this case, it is the top of the male U-joint 204, seen in FIG. 61A, that serves as a stop for another member being secured thereto from above and encounters that members' underside 801, seen in FIG. 61C, which ends the downward movement of the block and sets the proper block alignment.

Because the U-joint is effectively a unified joint relative to the split joints, a number of advantageous features are achieved with the U-joint. For example, the curvature at the exit and the entrance create a stronger block by better distributing (rather than concentrating) stresses in the approximately 90 degree juncture of a vertical side element with a flat floor (as shown in FIGS. 30A-30D). The curvatures also reduce the risk of warpage of the part during cooling once it is released from the mold. The U-shaped exit joint, by having the continuity around the bottom of the exit pathway, provides additional structural rigidity resisting bending at this narrowest part of the block. All sides of the blocks have at least two tension receiving walls (the external wall and the parallel internal wall). The horizontal exits have a third additional tension member in the lip of the male U-joint at the bottom central portion of the square/U-shaped exit joint. Additionally, because the U-joint has a square-like lower portion, the square aspect of the horizontal joint exit resists rotation of assembled blocks. The sides of the square are held in place by the buttresses of the adjoined block. The curvature on the corners of the square help to guide blocks into place during assembly, and the U-shape matches the curvature of the blocks at the entrances. Moreover, water or other liquids can flow through blocks with the U-joint without leaking because of the "lip" of the horizontal exit U-joint.

The cylindrical male joints on the bottom of the blocks also match the curvature of the corners of the blocks. The matching curves of corner and joint increase the frictional surface area. The curvature of the corners of the blocks assists flow of the plastic through the mold and thus decreases cycle time during manufacturing. The curvature on the corners is ergonomic. Further, the accentuated curvatures of the U-shaped entrance and exit openings in the outside wall of the block bring added strength by spreading tearing stresses more widely than would be the case with squarer openings.

In another aspect, part of the underside of the male joint has an accentuated curvature which allows for inexact initial left-right alignment and guides the lower block into position as two members are interlinked.

D. Member Examples

In one embodiment of the present invention, shown in FIGS. 49A-59C, a "thick shell/thin interior" configuration is provided. Plan views of four blocks are shown in Drawing 49. These blocks include a vertical exit block (FIG. 49A, shown in more detail in FIG. 52 and FIGS. 56A-56C), a single exit block (FIG. 49B, shown in more detail in FIG. 53 and FIGS. 57A-57C), an opposing double exit block (FIG. 49C, shown in more detail in FIG. 54 and FIGS. 58A-58C), and a quadruple exit block (FIG. 49D, shown in more detail in FIG. 55 and FIGS. 59A-59C). The pathways for spheres traveling on and through the blocks in these four views can be described as a circle, an ellipse, an hourglass, and a cross, respectively.

Figure 50:
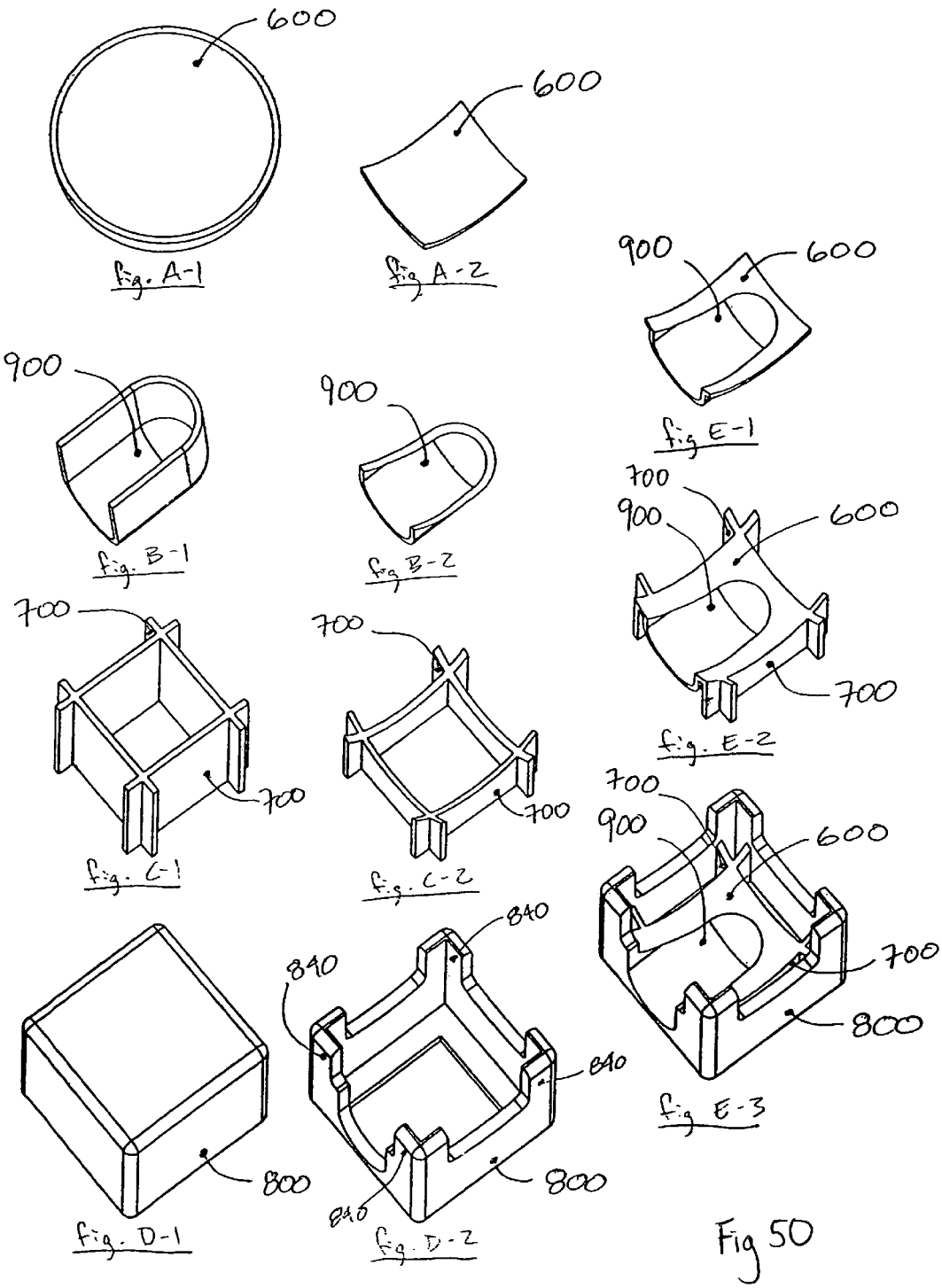
FIG. 50 is bird's eye views of the constituent elements of the 1-exit cubical modular member of FIG. 49B.
Figure 52:
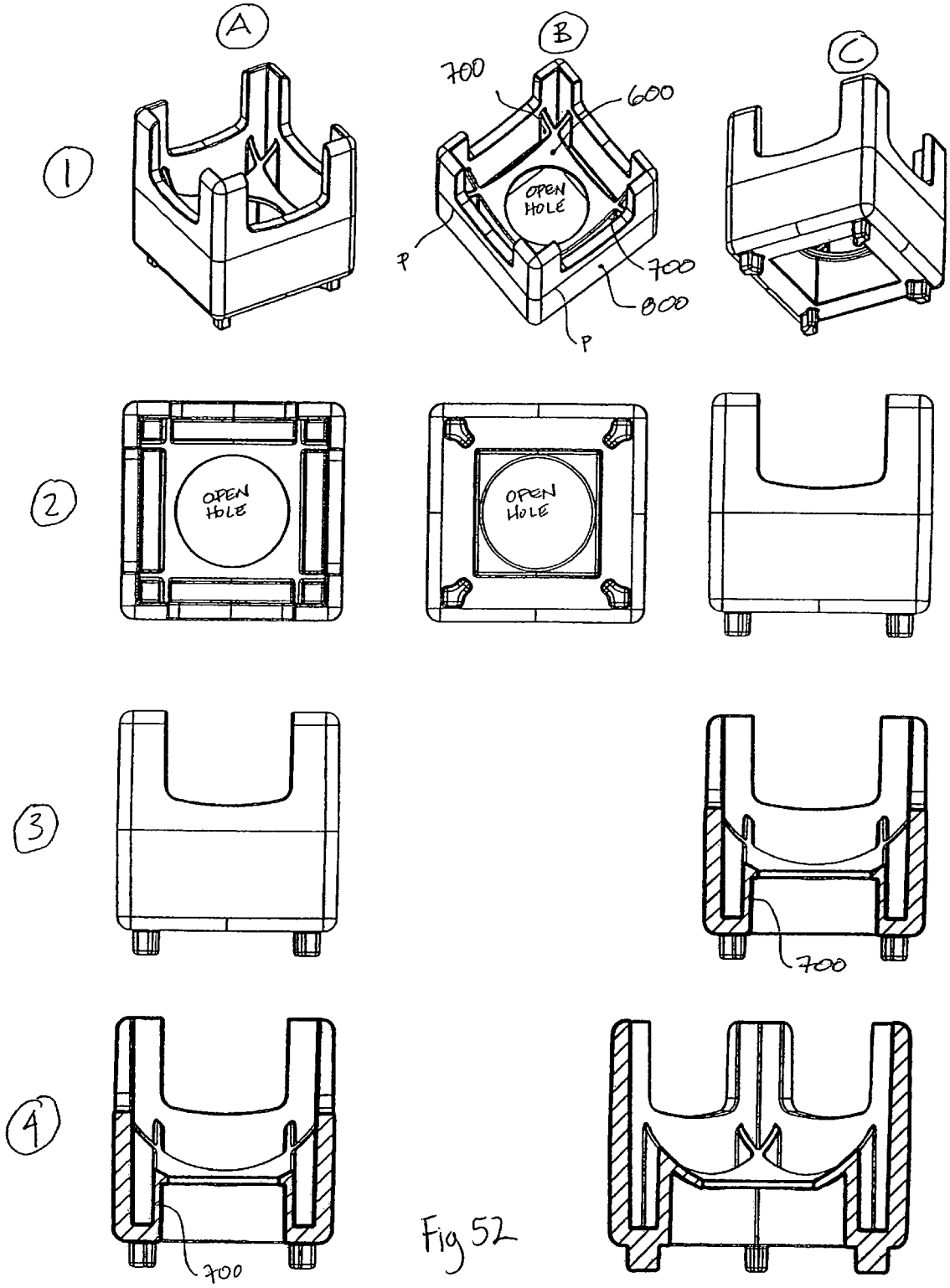
FIG. 52 is perspective, front, back, top, bottom, and side views of the vertical-exit thick/thin cubical modular member with flat bottom of FIG. 49A.
Figure 53:
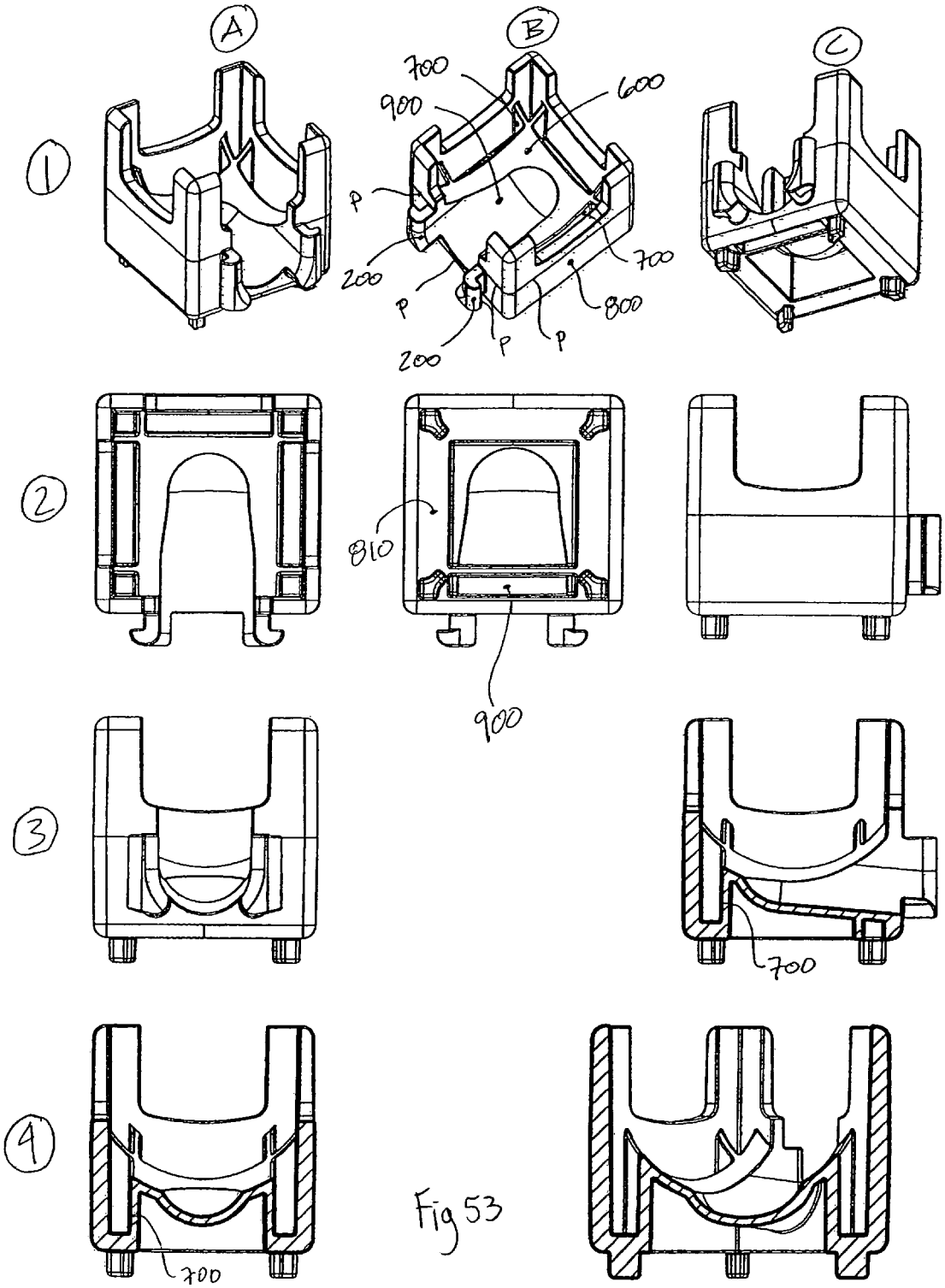
FIG. 53 is perspective, front, back, top, bottom, and side views of the 1-exit thick/thin cubical modular member with flat bottom of FIG. 49B.
Figure 54:
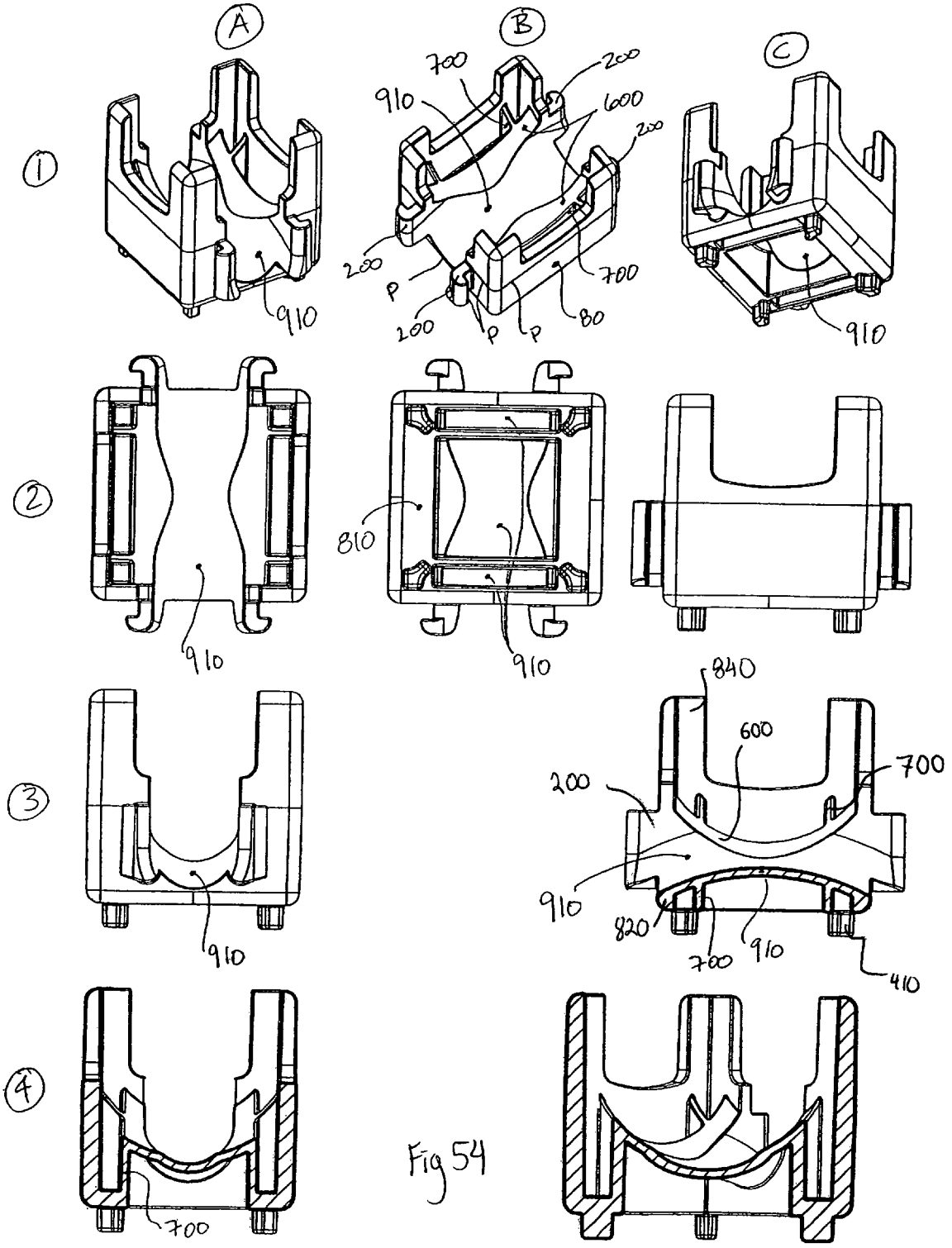
FIG. 54 is perspective, front, back, top, bottom, and side views of the 2-exit thick/thin cubical modular member with flat bottom of FIG. 49C.
Figure 55:
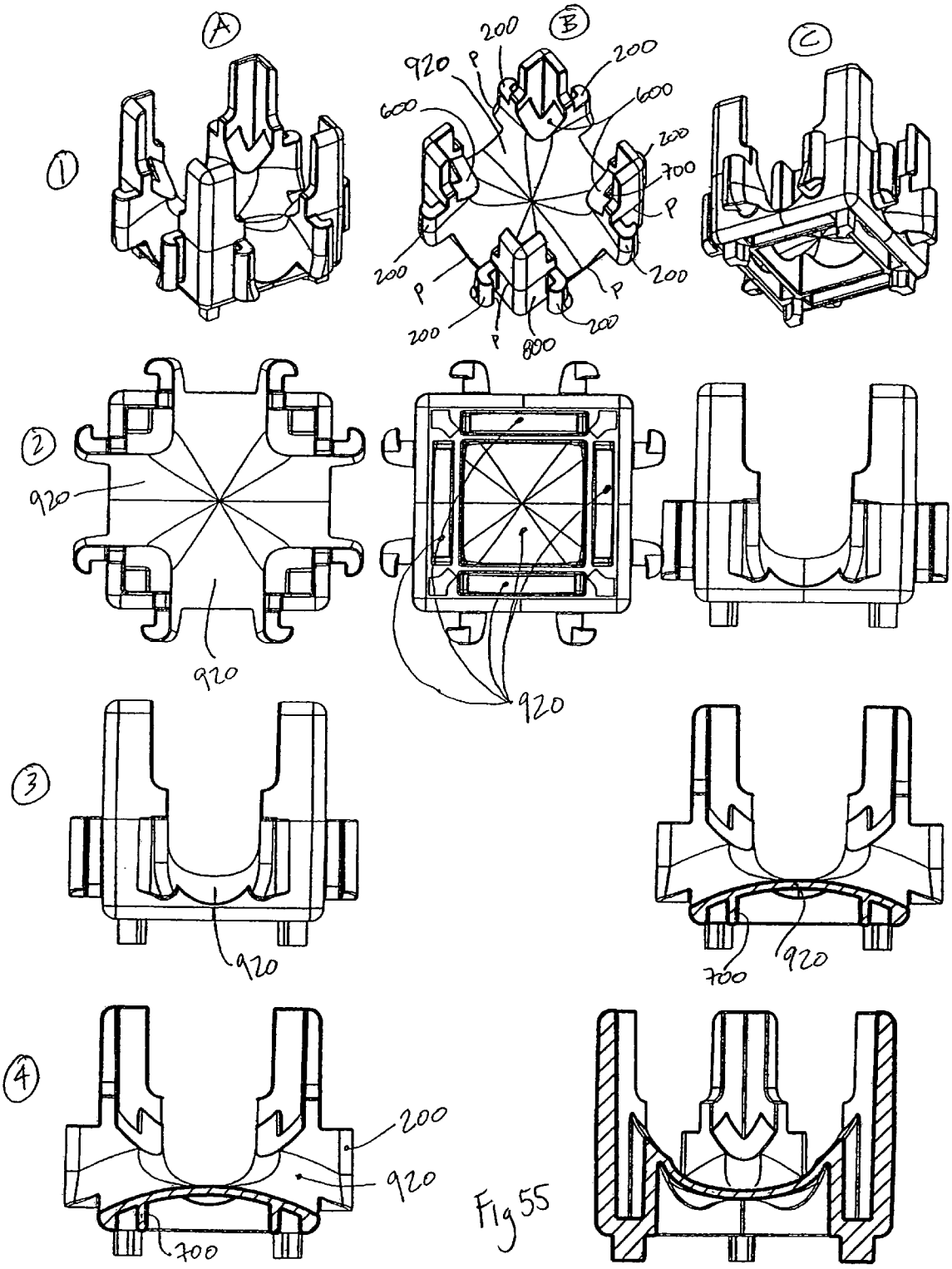
FIG. 55 is perspective, front, back, top, bottom, and side views of the 4-exit thick/thin cubical modular member with flat bottom of FIG. 49D.
Figure 56A:
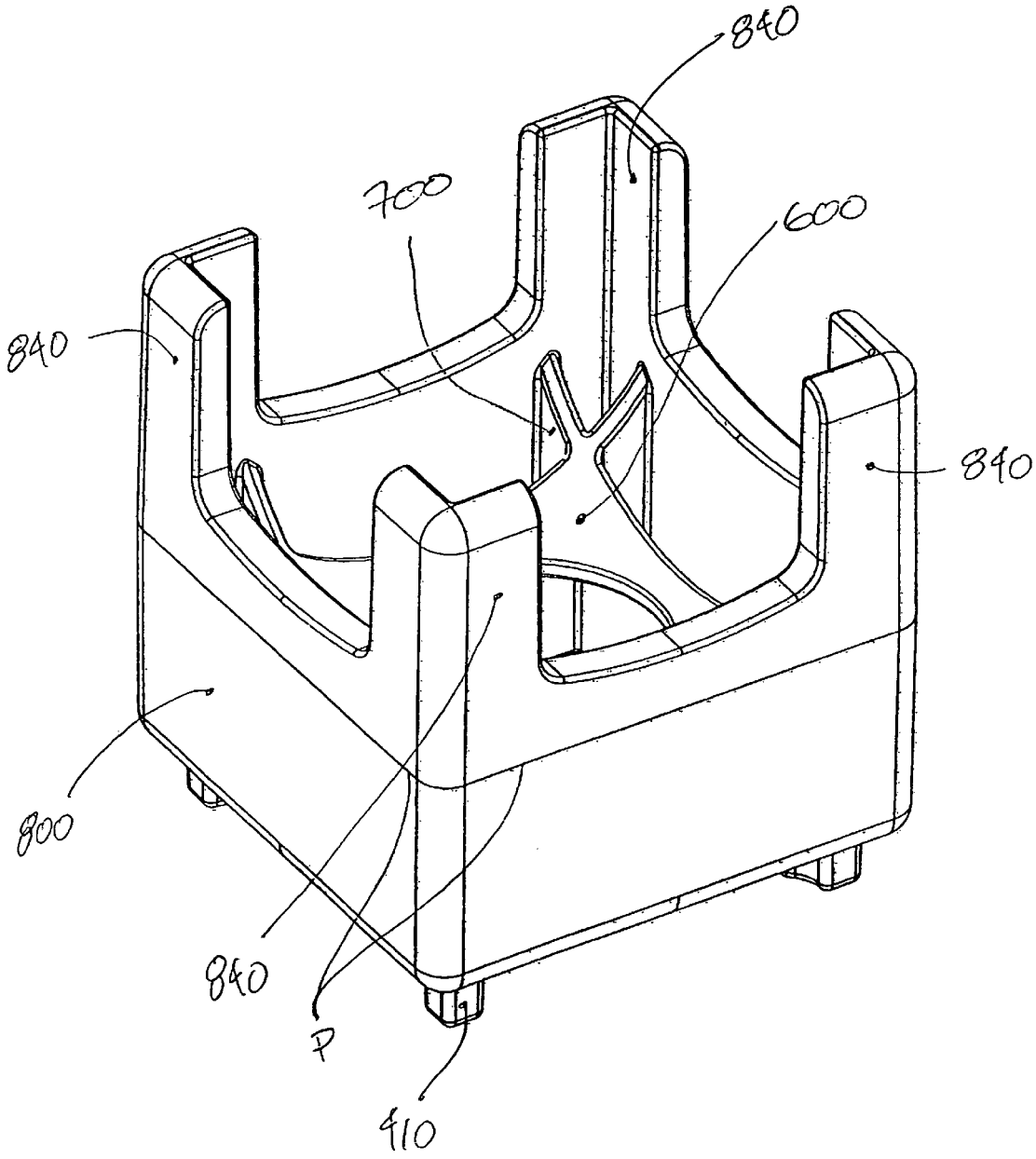
FIGS. 56A-56C are blow up views of FIGS. 52A-1, 52B-1, and 52C-1 respectively.
Figure 56B:
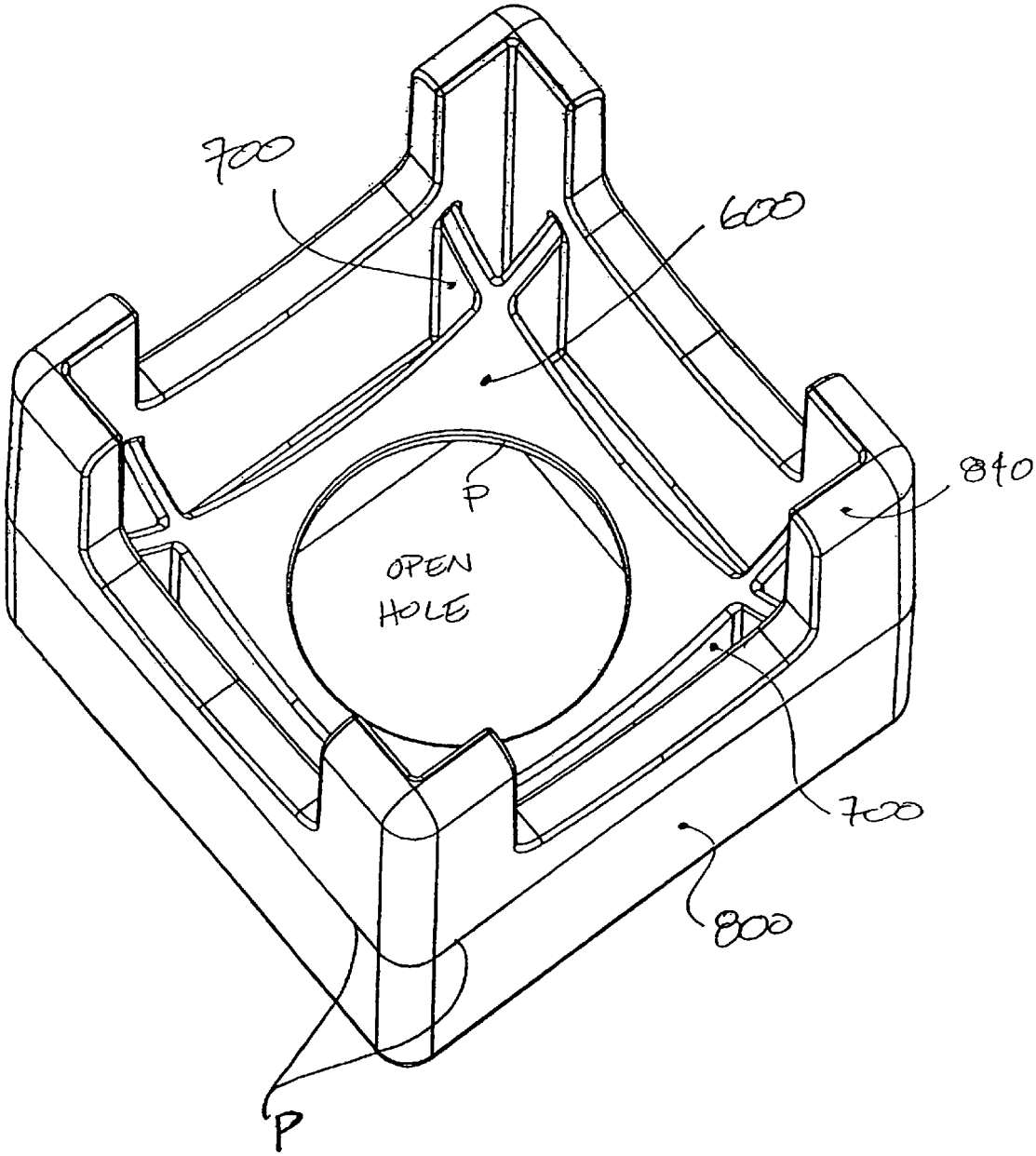
Figure 56C:
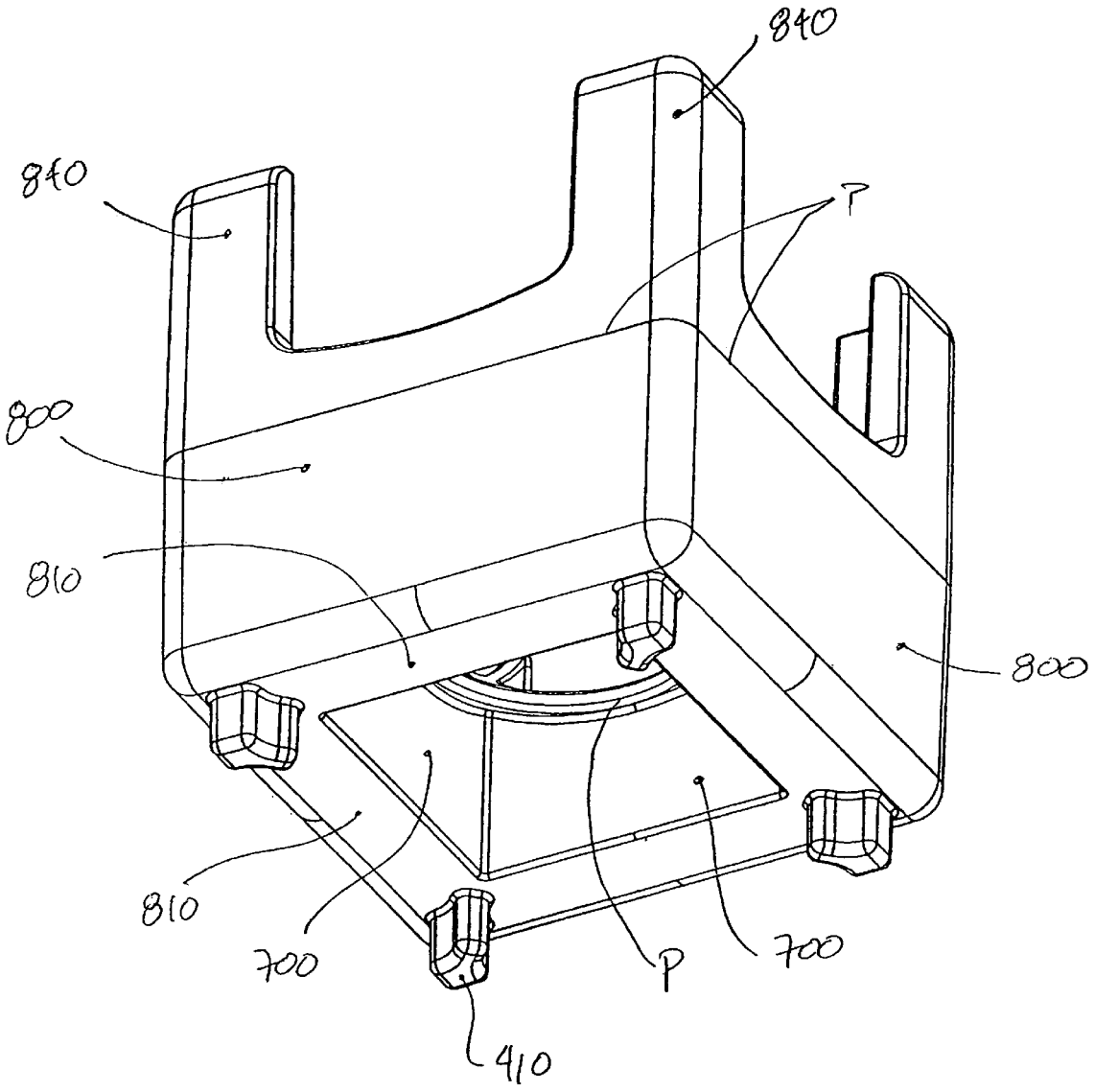
Figure 57A:
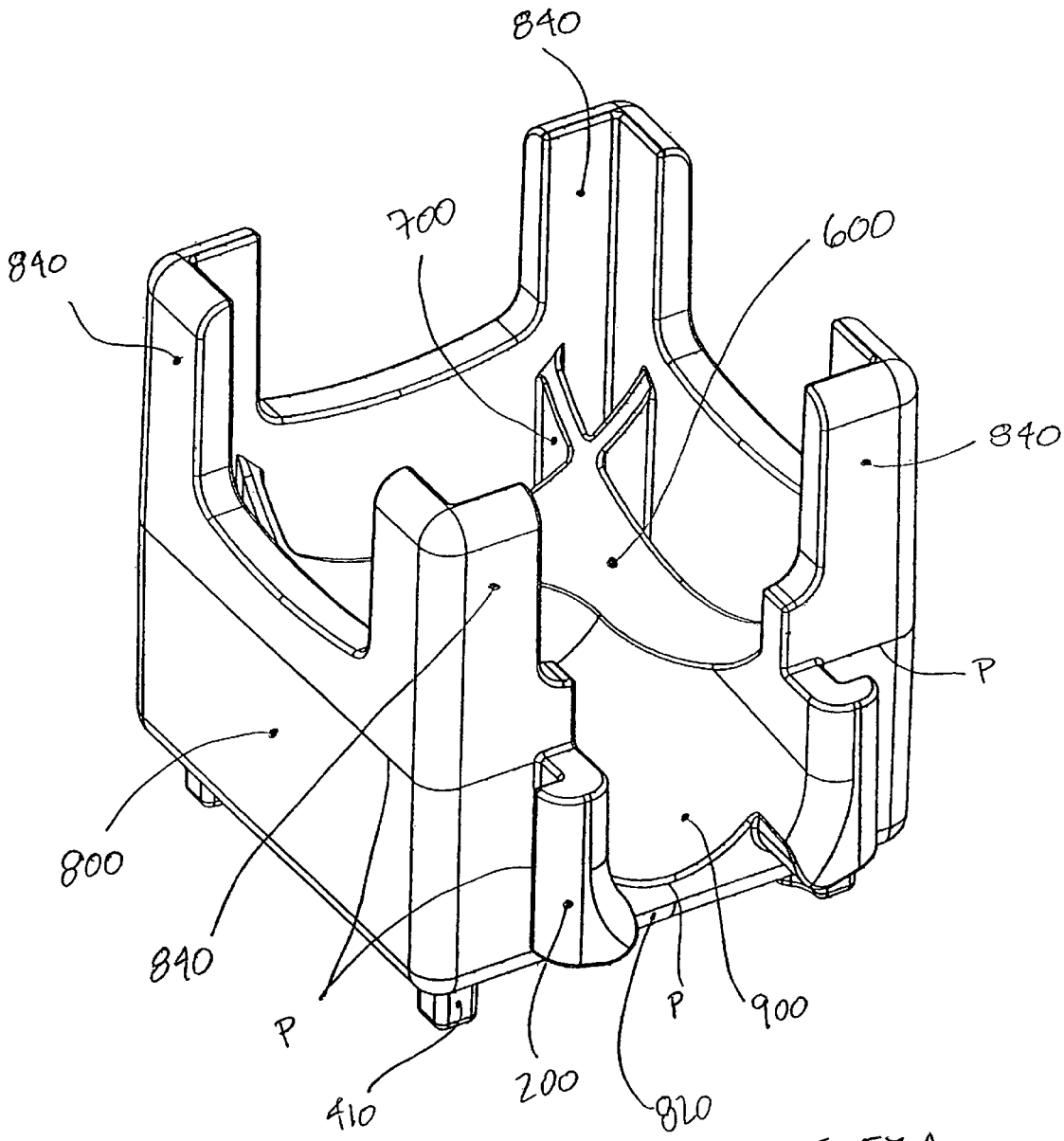
FIGS. 57A-57C are blow up views of FIGS. 53A-1, 53B-1, and 53C-1 respectively.
Figure 57B:
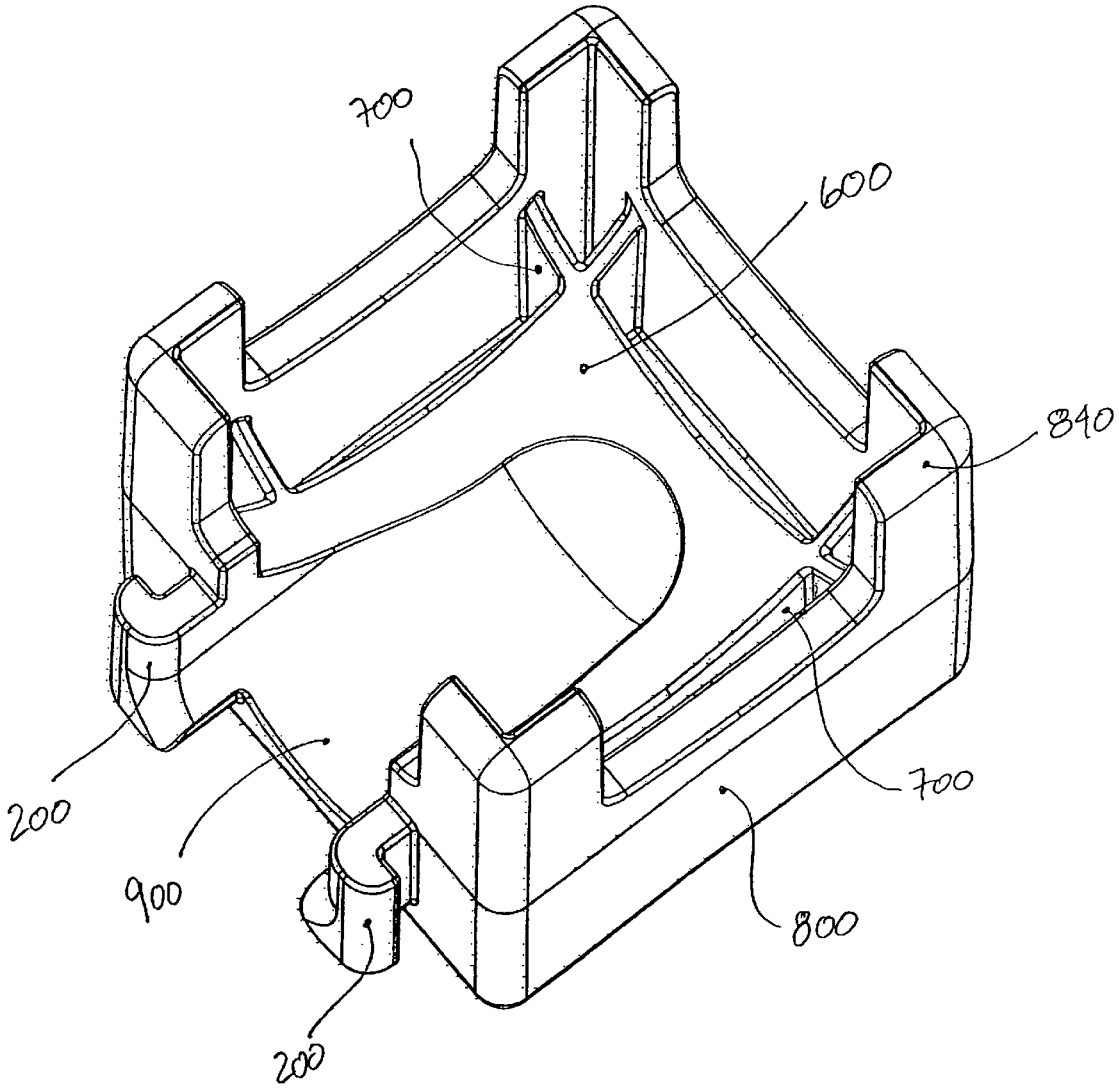
Figure 57C:
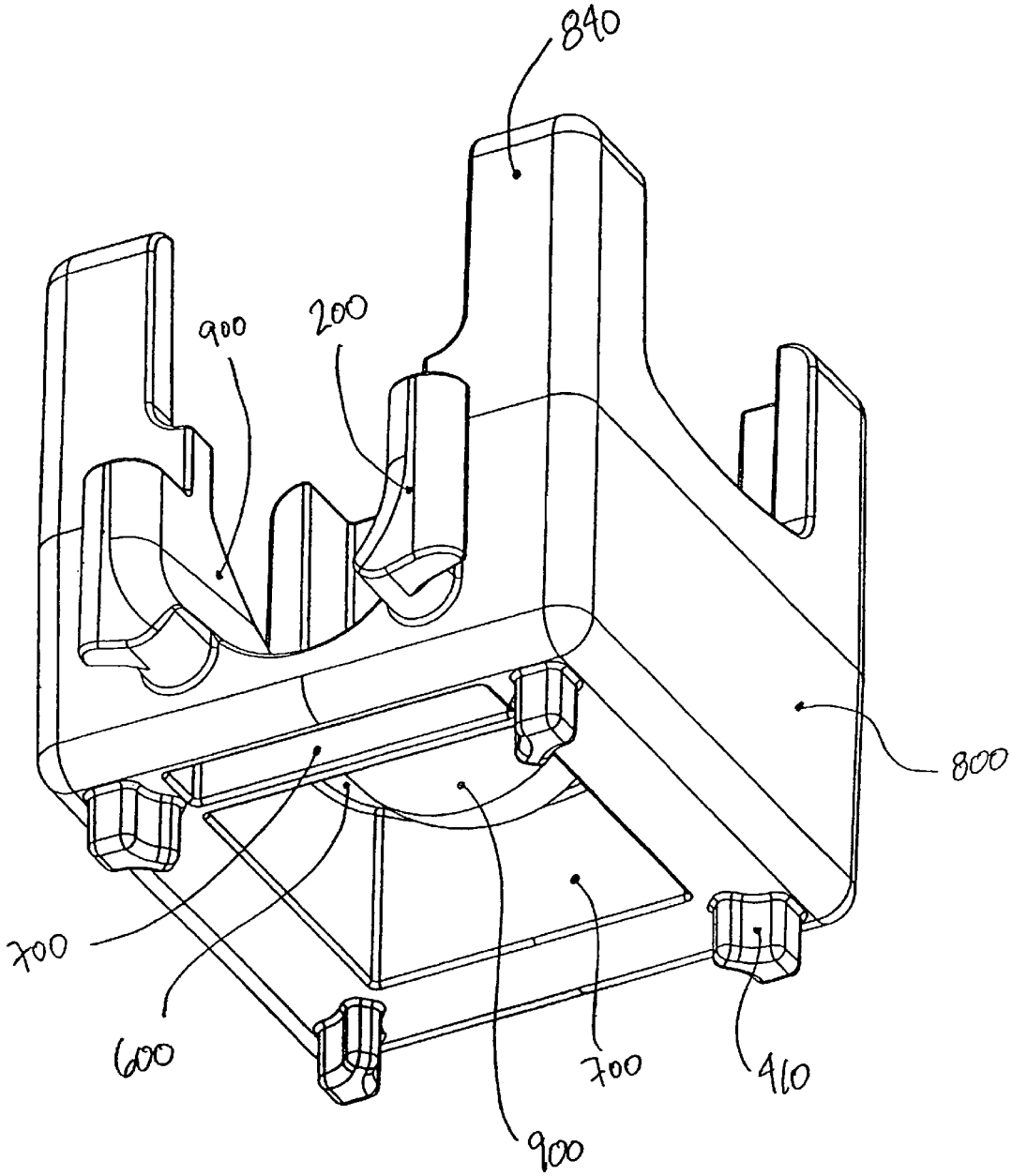
Figure 58A:
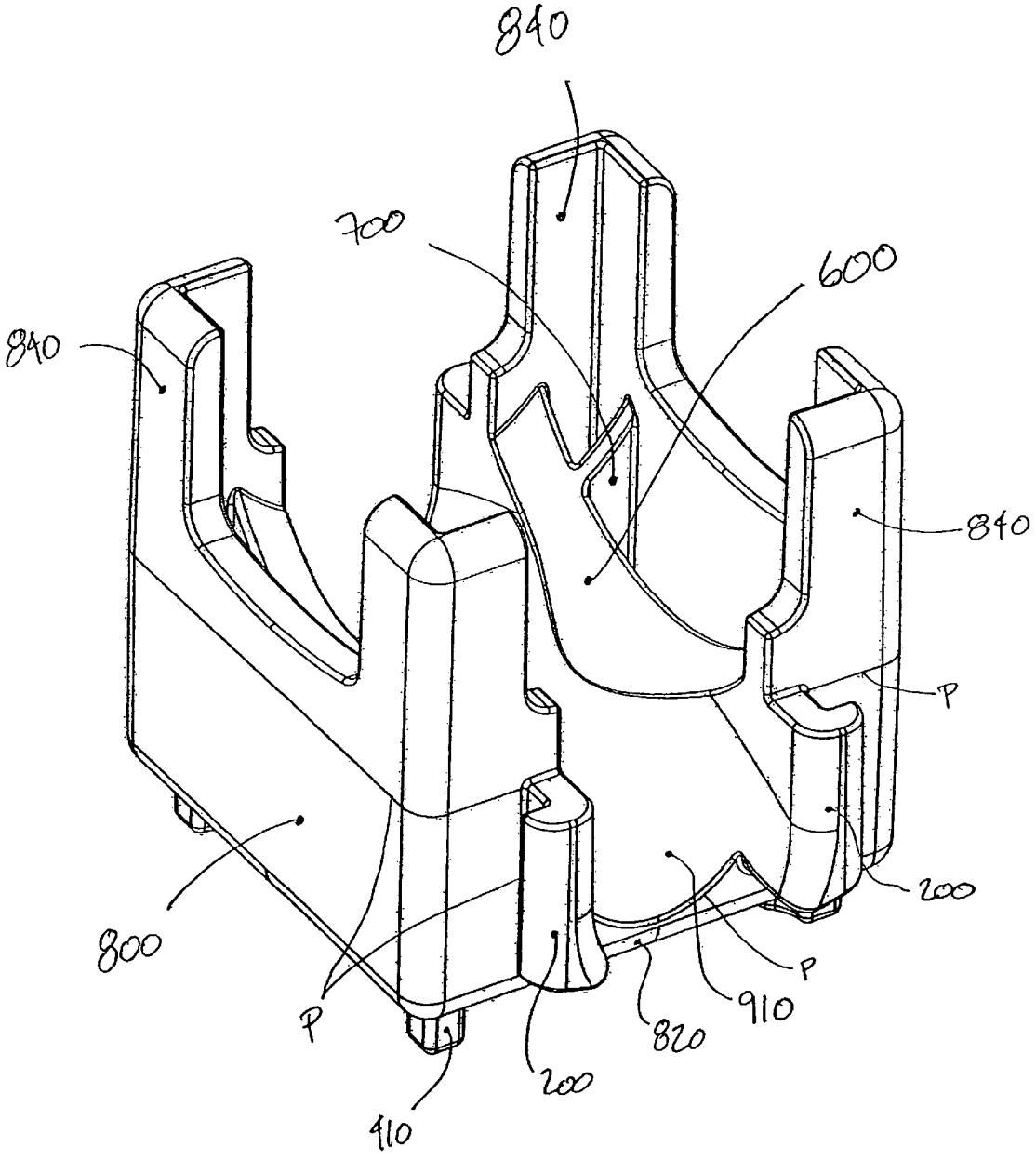
FIGS. 58A-58C are blow up views of FIGS. 54A-1, 54B-1, and 54C-1 respectively.
Figure 58B:
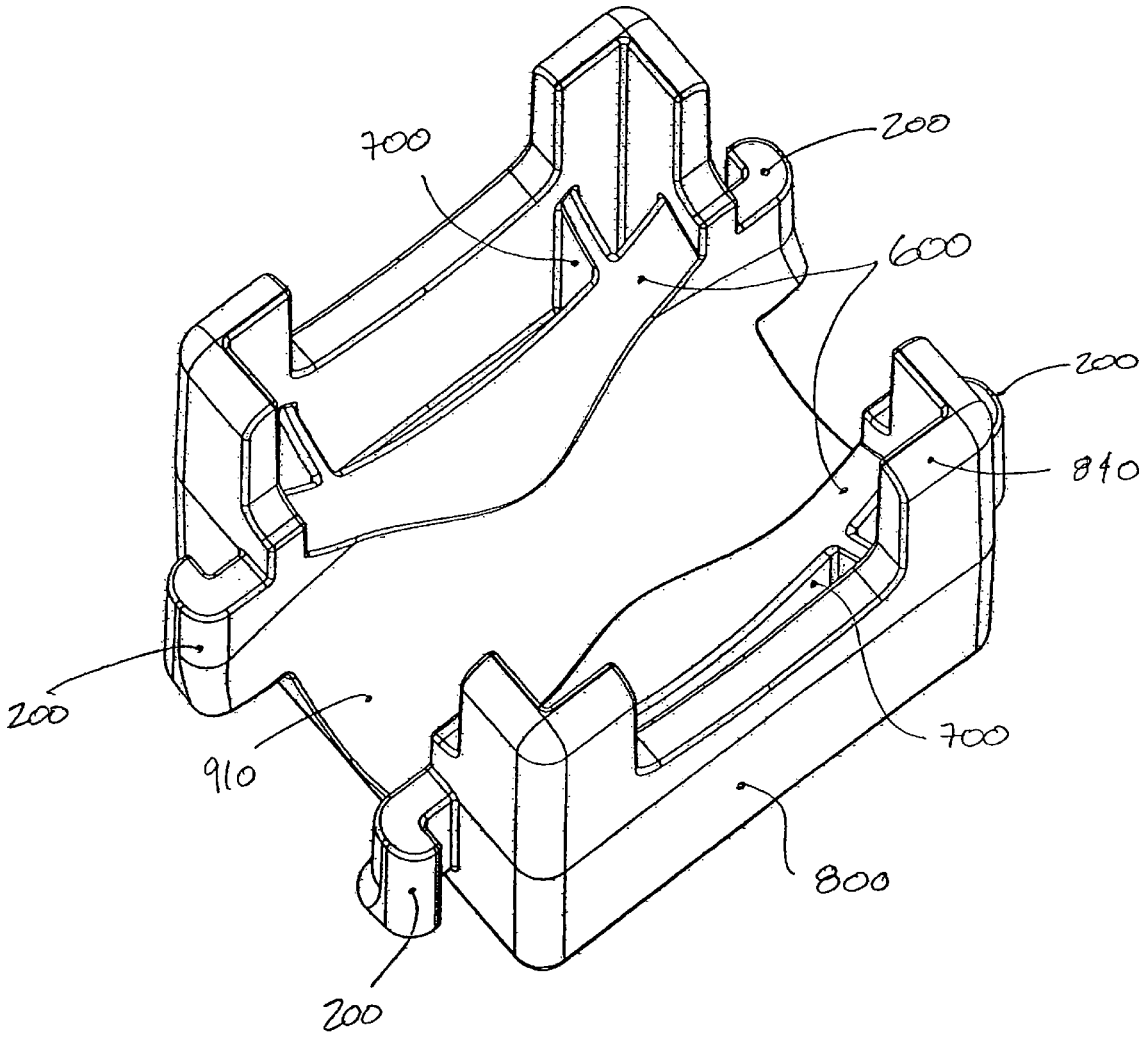
Figure 58C:
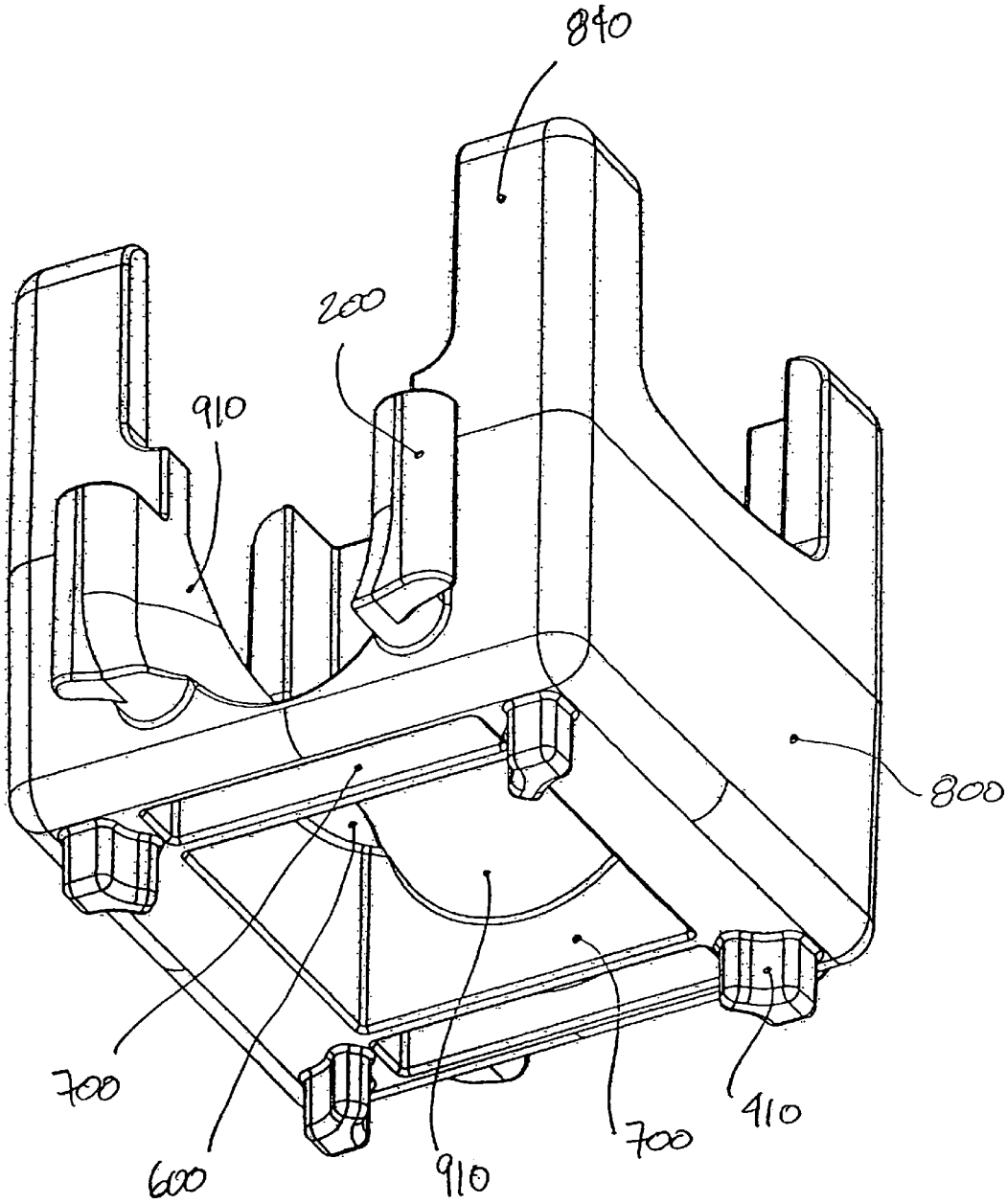
Figure 59A:
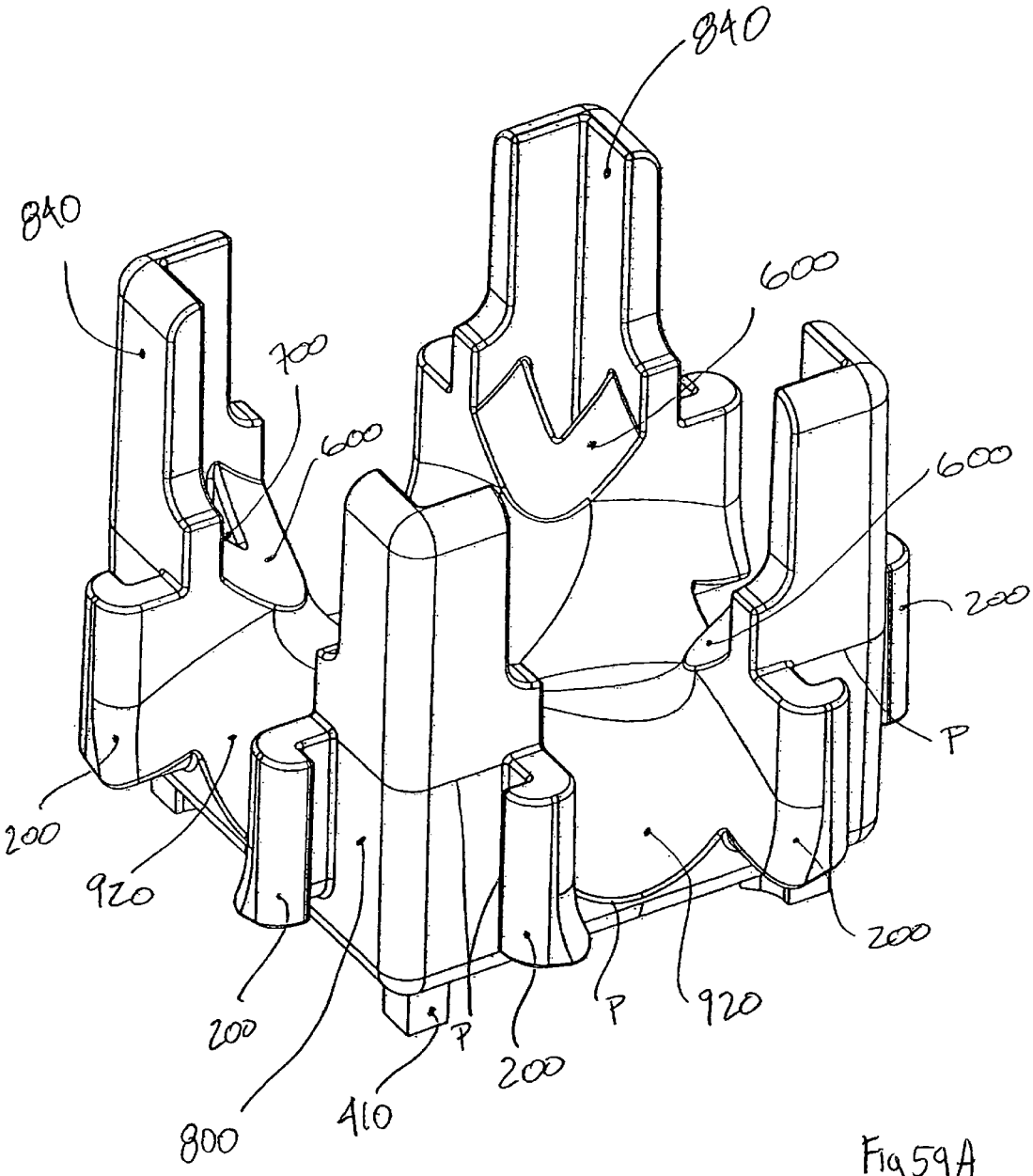
FIGS. 59A-59C are blow up views of FIGS. 55A-1, 55B-1, and 55C-1 respectively.
Figure 59B:
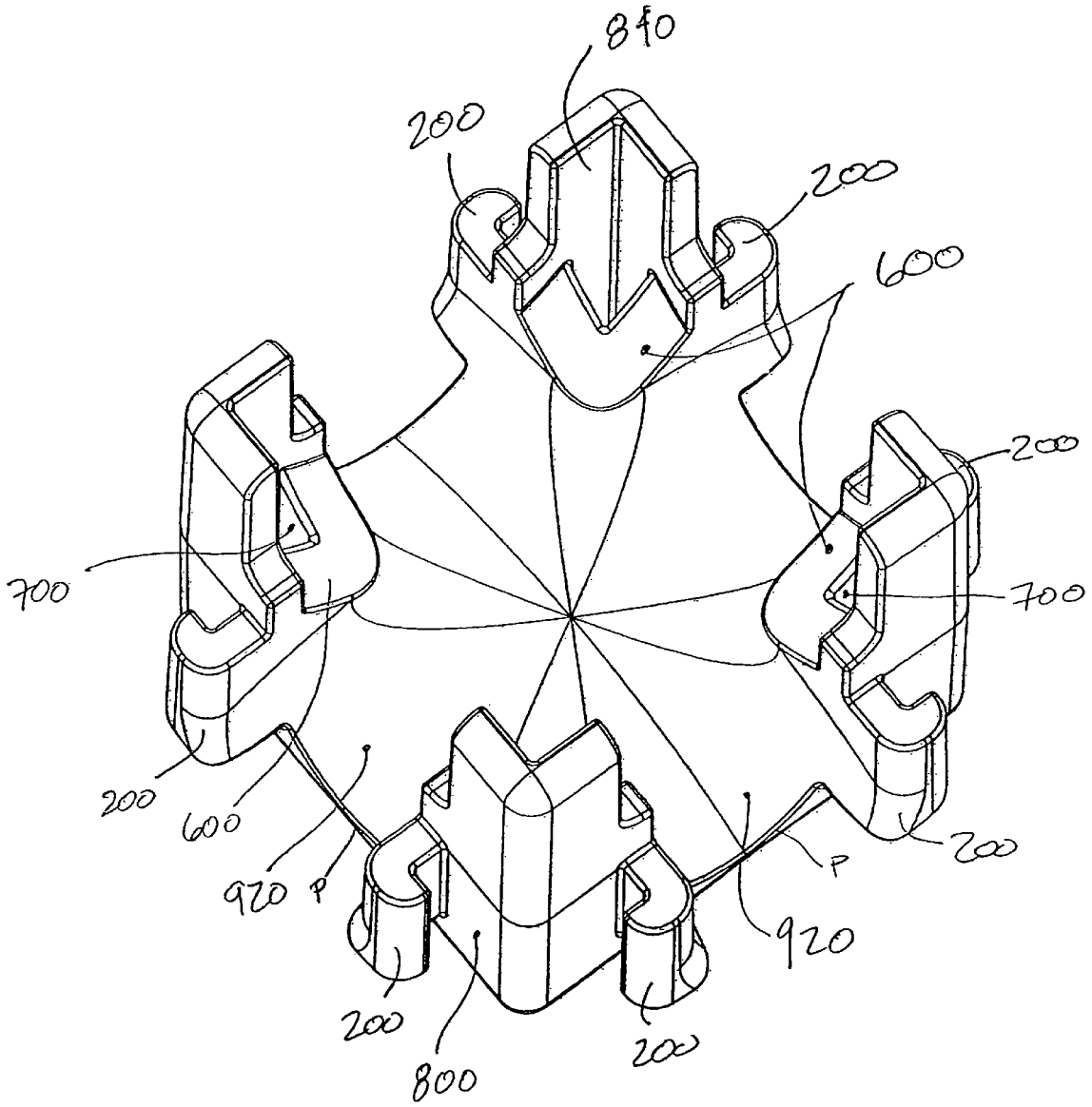
Figure 59C:
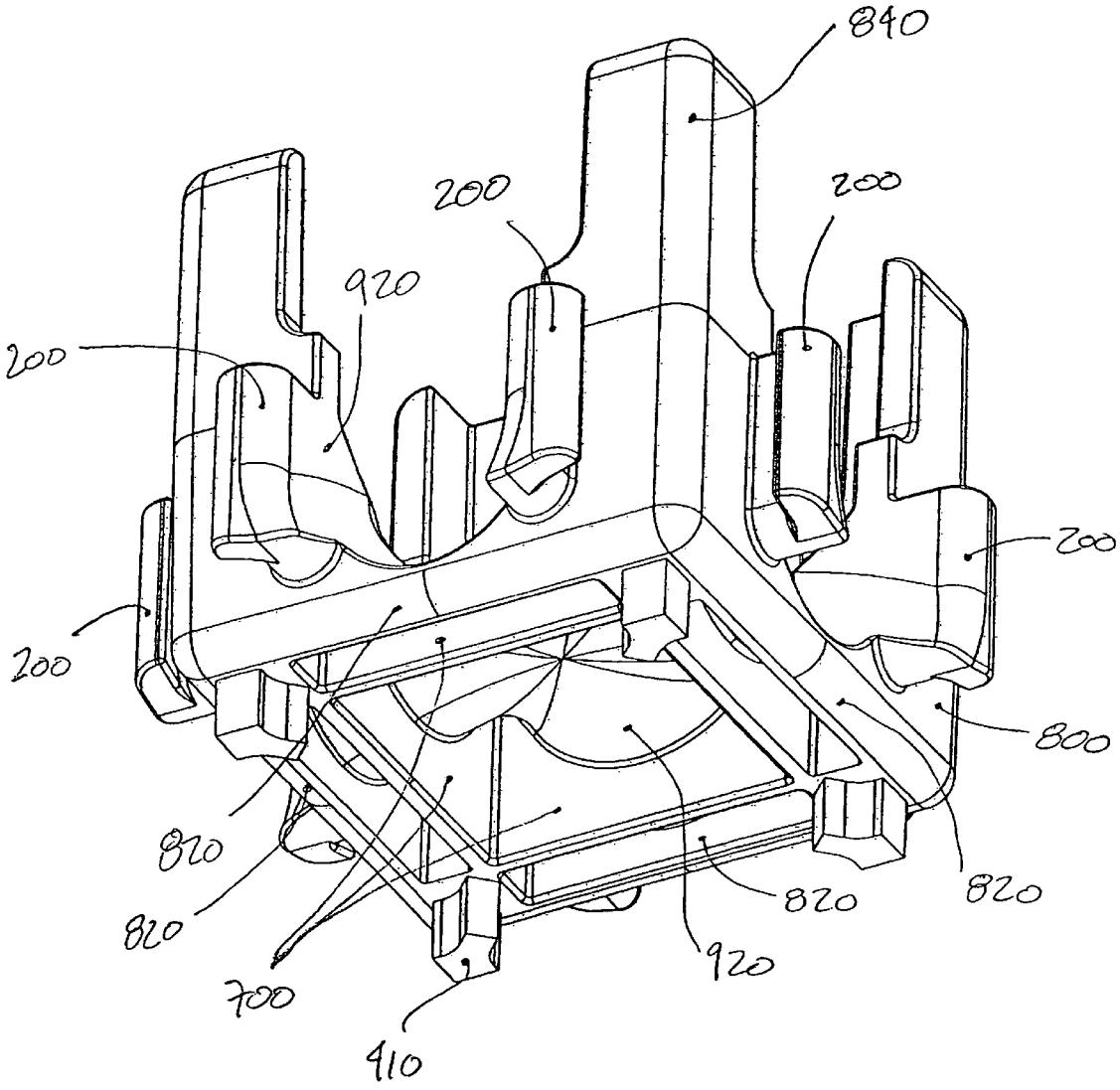

FIGS. 50 and 51 are isometric views from above and below of the same elements of the components of a single side exit block. FIG. 50A-2 and FIG. 51A-2, for example, show the same portion of a sphere from a different angle. FIGS. 50A-1, 50B-1, 50C-1, 50D-1, 51A-1, 51B-1, 51C-1, and 51D-1 show four elements of the block, portions of each of which contribute to the completed block.

FIGS. 50A-1 and 51A-1 show a hemisphere 600 with a 1/16 inch thickness. FIG. A-2 shows a rectangular slice cut from this hemisphere. This hemi-spherical shape is centered on the final cube. All of the four blocks shown in FIG. 49 are partially comprised of this hemisphere. The present portions of this hemisphere 600, receive rolling spheres (e.g. marbles), which land on these portions of a spherical shape and are guided by the force of gravity toward the low-point of the sphere and thus the middle of each block.

FIGS. 50B-1, 51B-1, and 53B-1 show a sphere/marble exit pathway 900 for a single side exit. FIG. 54B-5 shows an opposing double exit pathway 910, and FIG. 55B-1 shows a quadruple exit pathway 920. FIGS. 50B-2 and 51B-2 show pathway 900 from FIGS. 50B-1 and 51B-1 after it has been cut by sphere 600. FIGS. 50E-1 and 51E-E show the merging of FIGS. 50A-2 with FIG. 50B-2 and FIGS. 51A-2 with FIG. 51B-2 respectively, in which sphere 600 and pathway 900 are combined. The result is a concave-up floor with at least one exit pathway formed therein. For two-exit, three-exit, and four exit members, the concave-up floor has two, three, and four exit pathways, respectively, formed therein.

FIG. 50C-1 shows the internal bracing walls 700 for the blocks. These are four vertical intersecting walls. These walls may have a draft angle inward or outward depending on their relationship to the two parts of the mold. FIG. 50C-2 shows the bracing walls after they have been cut by sphere 600. FIG. 50E-2 shows the merging of FIGS. 50E-1 and 51C-2—or the merging of sphere, pathway and bracing walls. For the vertical exit block, the double exit block and the quadruple exit block, the difference in the shape of the pathway changes the result of the merging of these three parts. The bracing walls connect opposite faces of the block and thus transfer bending forces from one part of the block to another and get the various parts to "work together" to increase the overall strength of the whole. The spherical cut of the bracing walls allows them to engage the exterior walls as high as possible, for the greatest leverage, while not impeding sphere/marble flow through the blocks. This alignment of the sphere with the top of the joint also assists in the flow of molten plastic through the joint. In an alternative embodiment shown in FIG. 2B, additional buttresses 720 above the sphere provided strength to the exterior vertical support wall. The buttresses 720 also resists rotation of the lip of the vertical component of the male U-joint.

FIGS. 50D-1 and 51D-1 show a cube with ⅛ inch thick faces 800 and rounded vertices with 0.1" radii. FIGS. 50D-2 and 51D-2 show this same cube with a square hole in the top, four side entrances cut into the sides, a single exit cut into the side, and a hole cut in the bottom for the bottom mold half to access the underside of the marble pathway. Cutting the side entrances into the side walls 800 leaves four vertical "L-shaped" corners. These corners are labeled as component 840. Part 840 comprises the side of the "female" joint which allows the blocks to interlock.

FIGS. 50E-3 and 51E-3 show the thin interior parts of FIG. 50E-2 and the thick outer shell of FIG. 50D-2 merged. In other words, the block in FIG. E-3 is the combination of the "thin" 1/16 inch portions of the hemisphere, pathway, bracing, and the "thick" ⅛ inch cube, as seen in FIG. 50A-1, FIG. 50B-1, FIG. 50C-1, and FIG. 50D-1, respectively.

FIGS. 53B-1 and Drawing 53C-1 show the single exit block with the addition of the male joints 200. The male joints in all of the blocks seamlessly merge with the pathway forms 900, 910, and 920 of the single, double, and quadruple exit blocks. The parting line P, as in previous embodiments, travels horizontally around the approximate center of the cubic block and then follows down the tip of the male joint and across the low point of each exit.

FIG. 53B-2 shows a view of the bottom of a single side exit block. This same view of the block can be seen in greater detail blown up in FIG. 1063. The ⅛ inch thick bottom of the block is denoted by number 810. Under an exit the bottom of the block is carved away (as shown in 50D-2). Surface 810 is carved away in such places, revealing a view to surface 900 and two very small pieces of surface 600. The ⅛ inch thick remainder of the cube wall under the exit is denoted as 820. The bracing 700 is also revealed with the carving away of surface 810 under the exits.

FIG. 54C-3 is a section view through a double exit opposite block, where pathway surface 910 can be seen merging seamlessly with male joint 200. The intersection of surface 910 with the internal face of 800 is approximately horizontally aligned with the top of the male joint 200. Stresses and bending in the joint 200 are transferred deep into the rest of the block through this alignment. The curvatures throughout the design minimize stresses in use. These curvatures also minimize the stresses that can accompany injection molding. A part with sharp 90 degree corners will tend to warp during cooling and this tendency is reduced through the use of these curvatures.

The curvature of the pathway 910 seen in the section cut line of FIG. 1067 acts together with the exit wall 820 and the bracing 700 to create a beam which resists bending in the part. A similar geometry is also evident in the quadruple exit block.

Vertical male joint 410 allows for the vertical interconnection of the blocks.

Figure 60A:
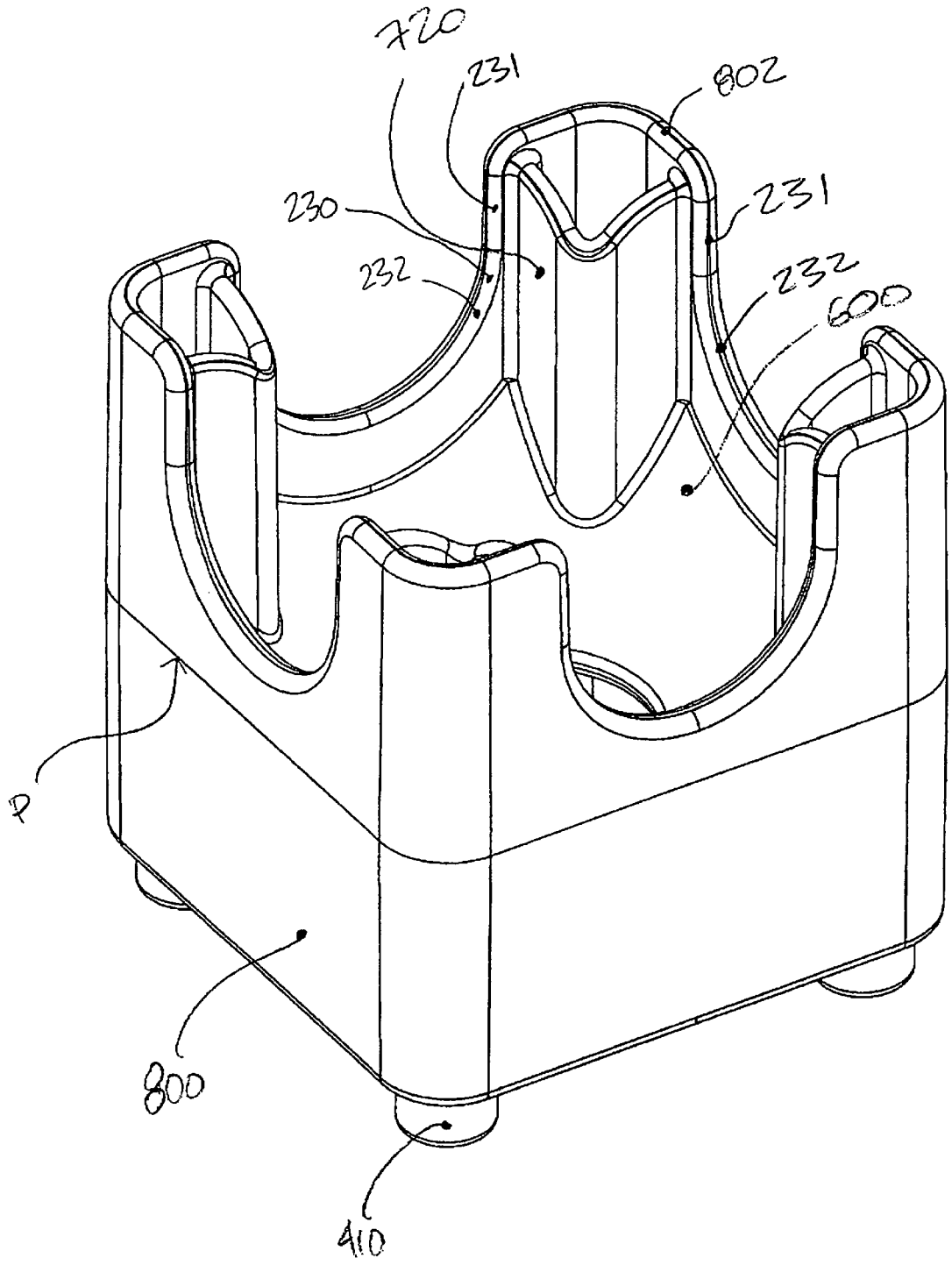
FIGS. 60A-63C are blow up views of a cubical modular member in accordance with another embodiment of the present invention.
Figure 60B:
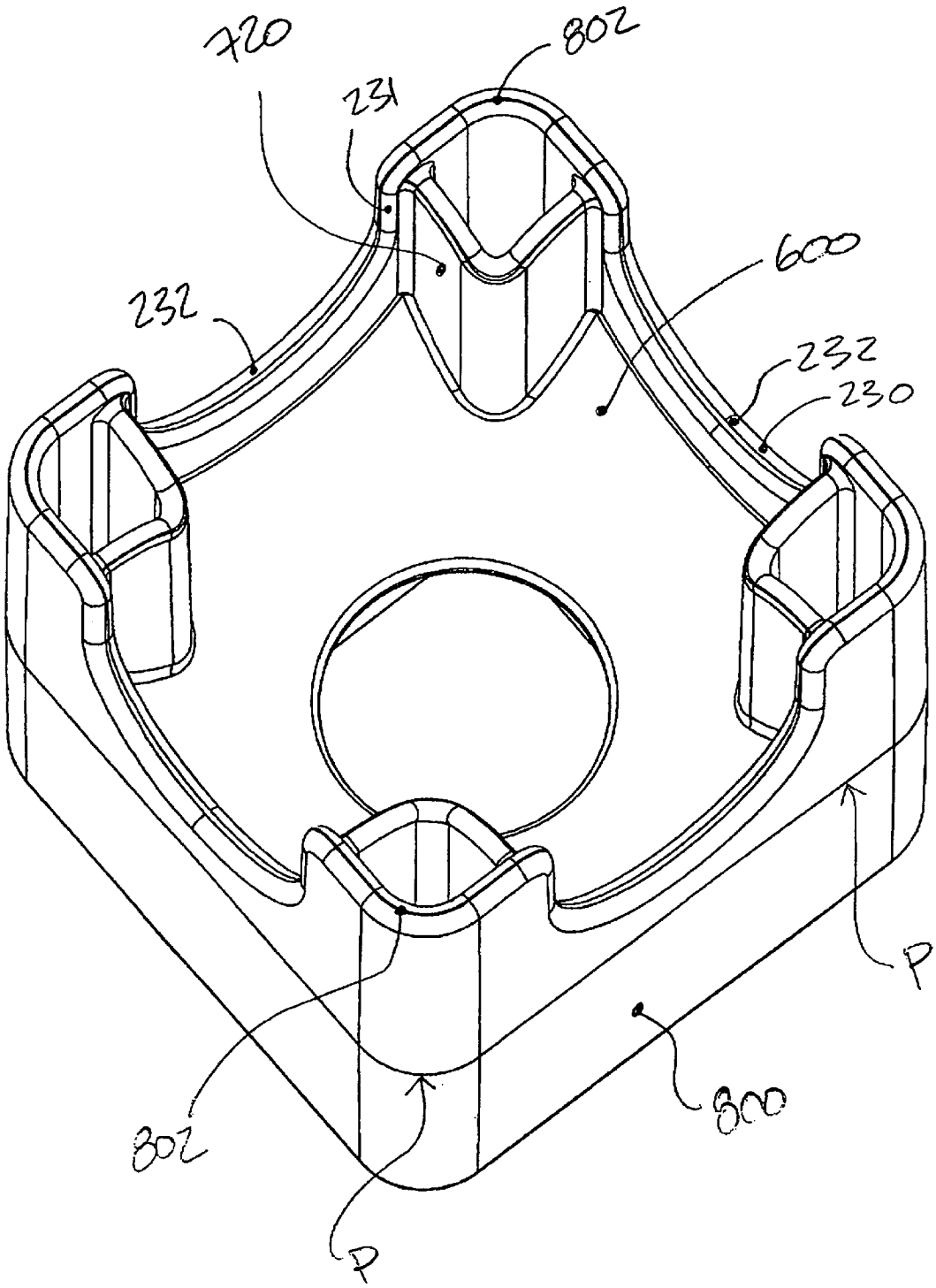
Figure 60C:
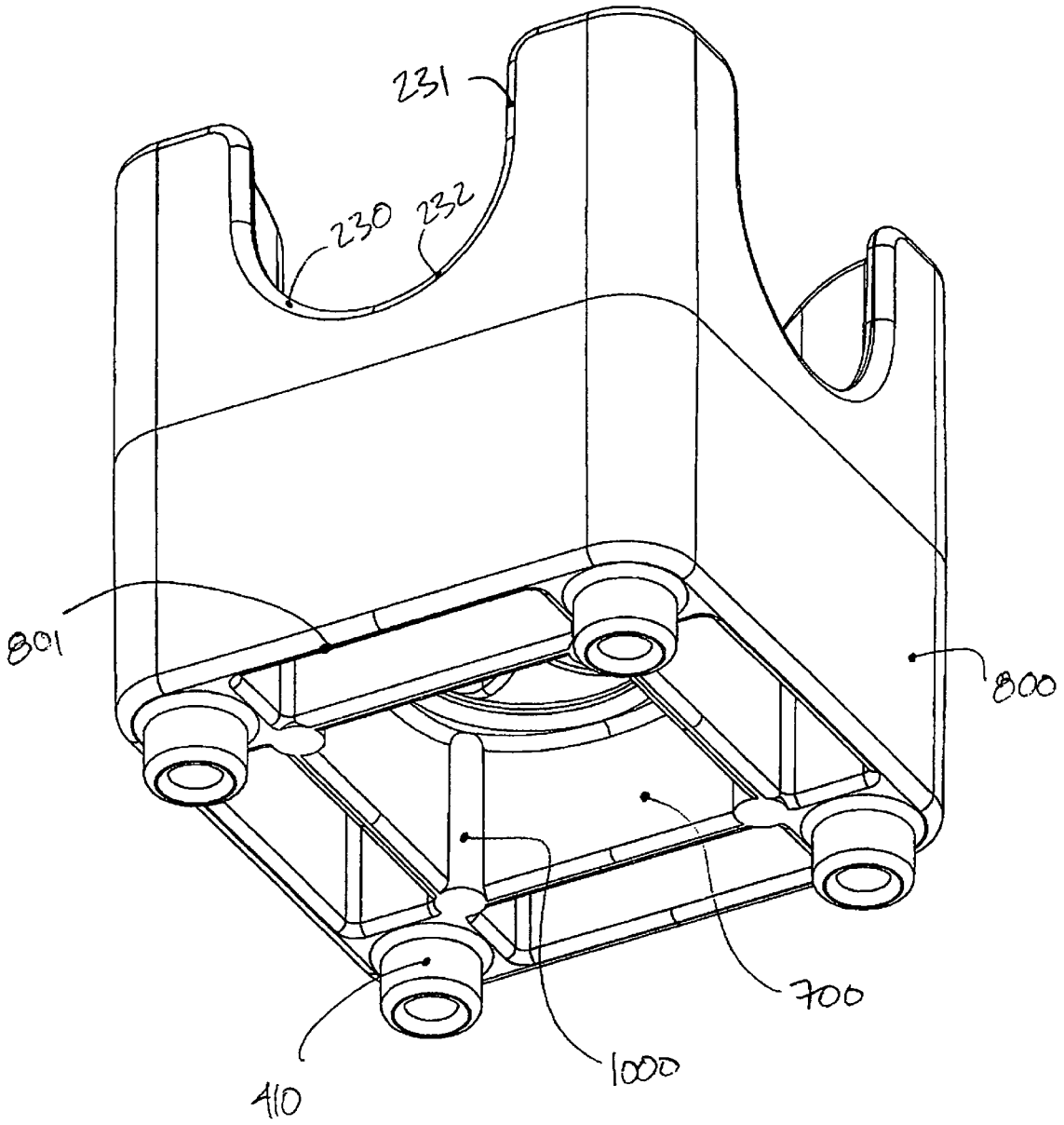
Figure 62A:
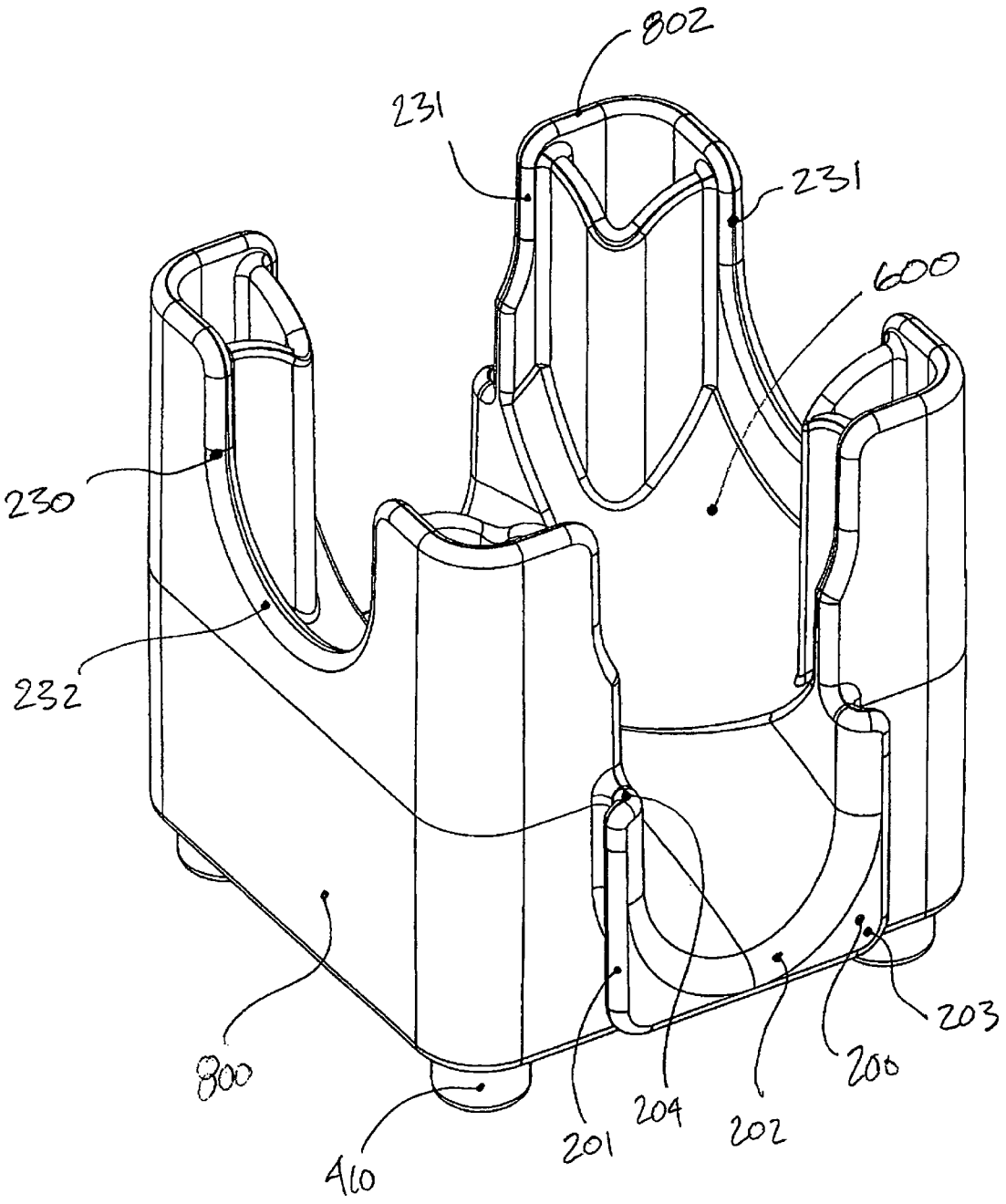
Figure 62B:
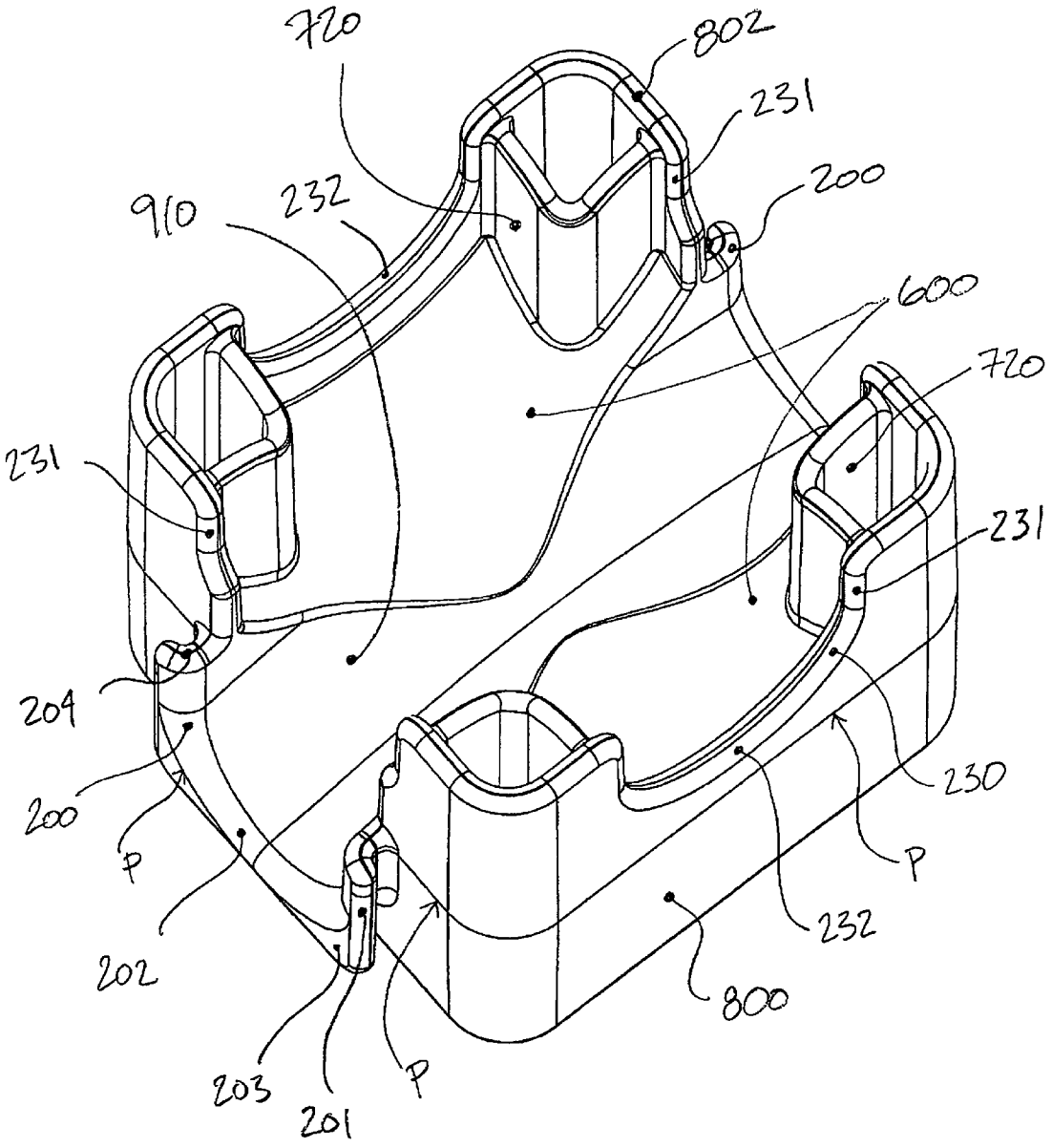
Figure 62C:
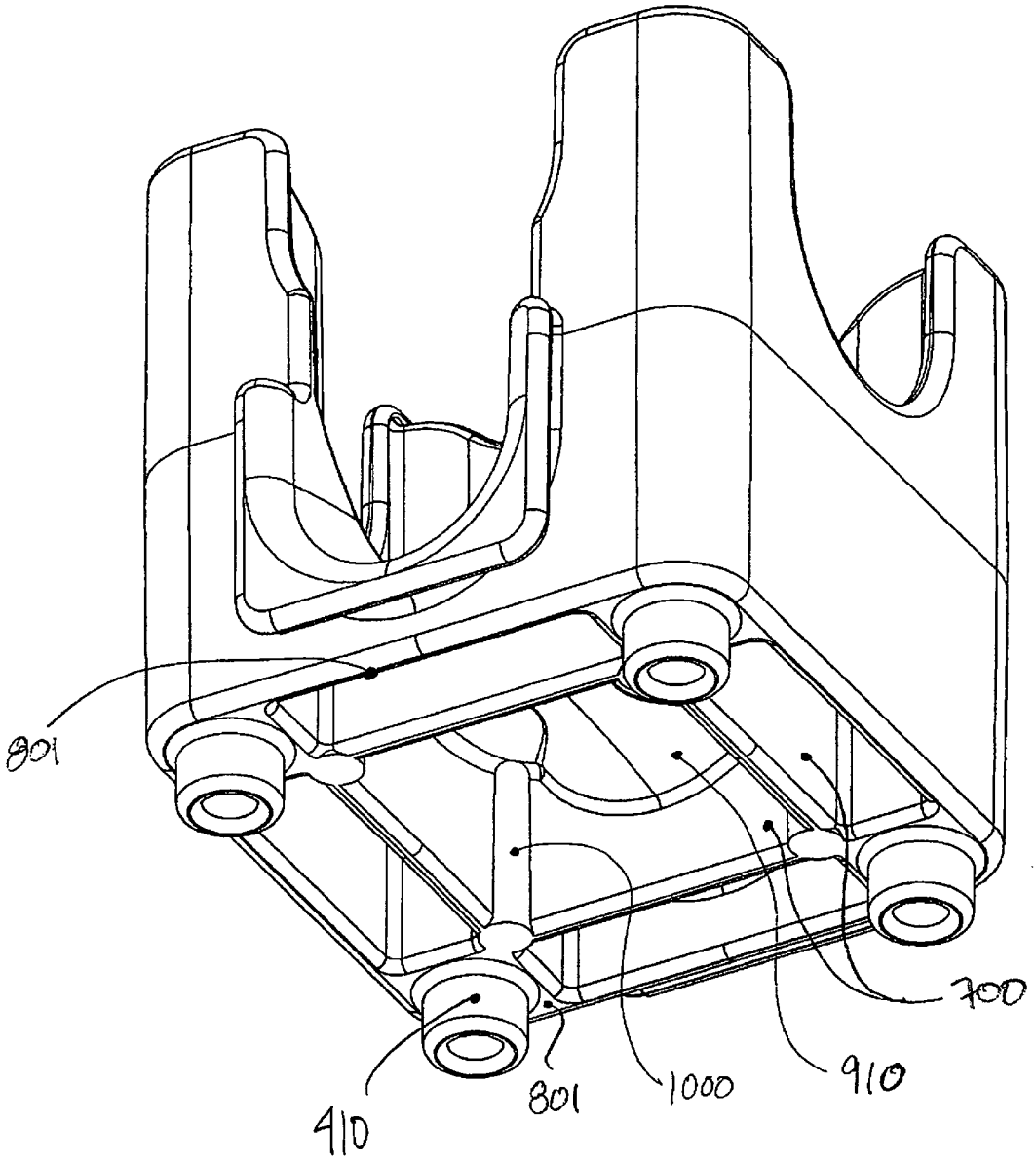
Figure 63A:
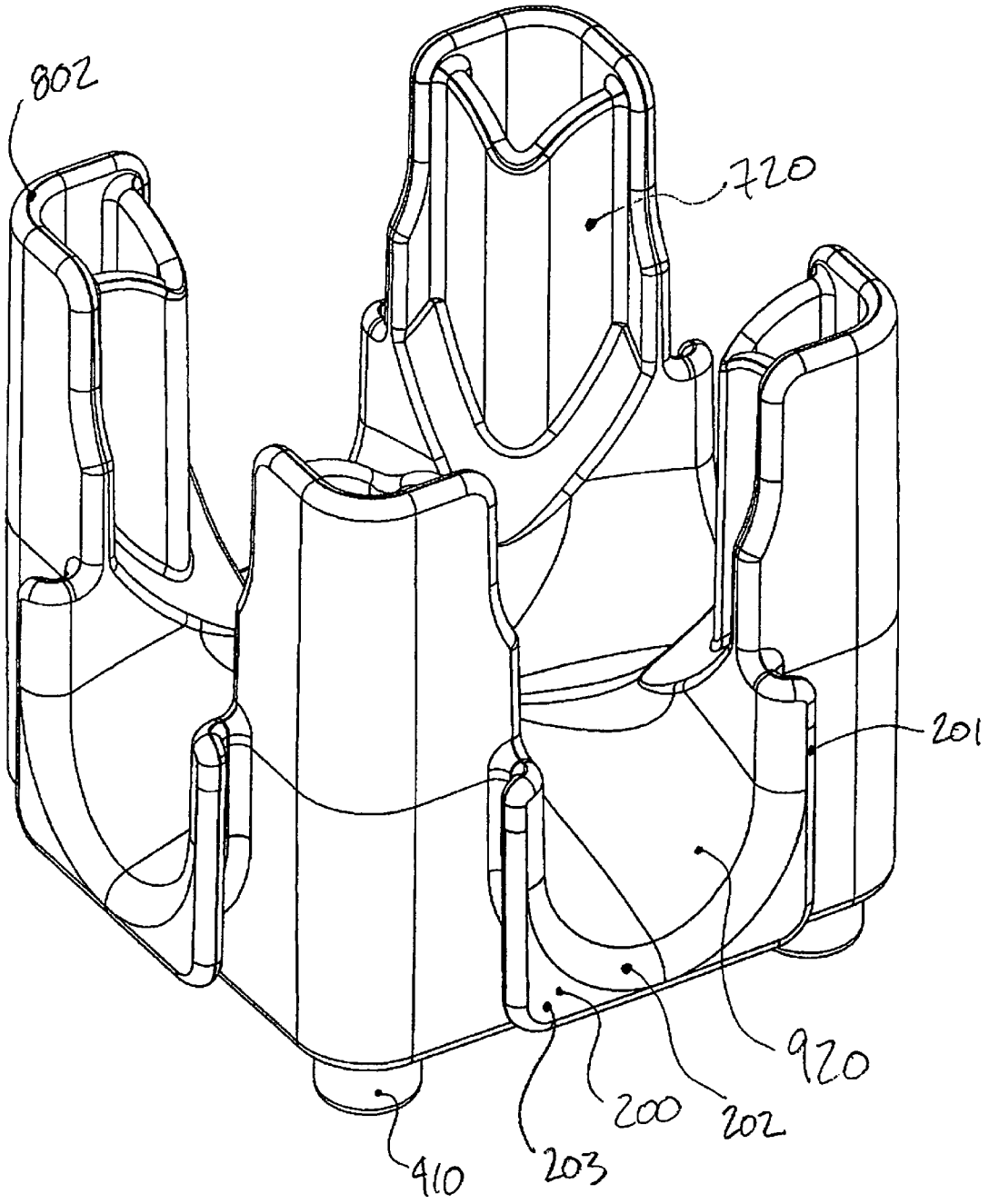
Figure 63B:
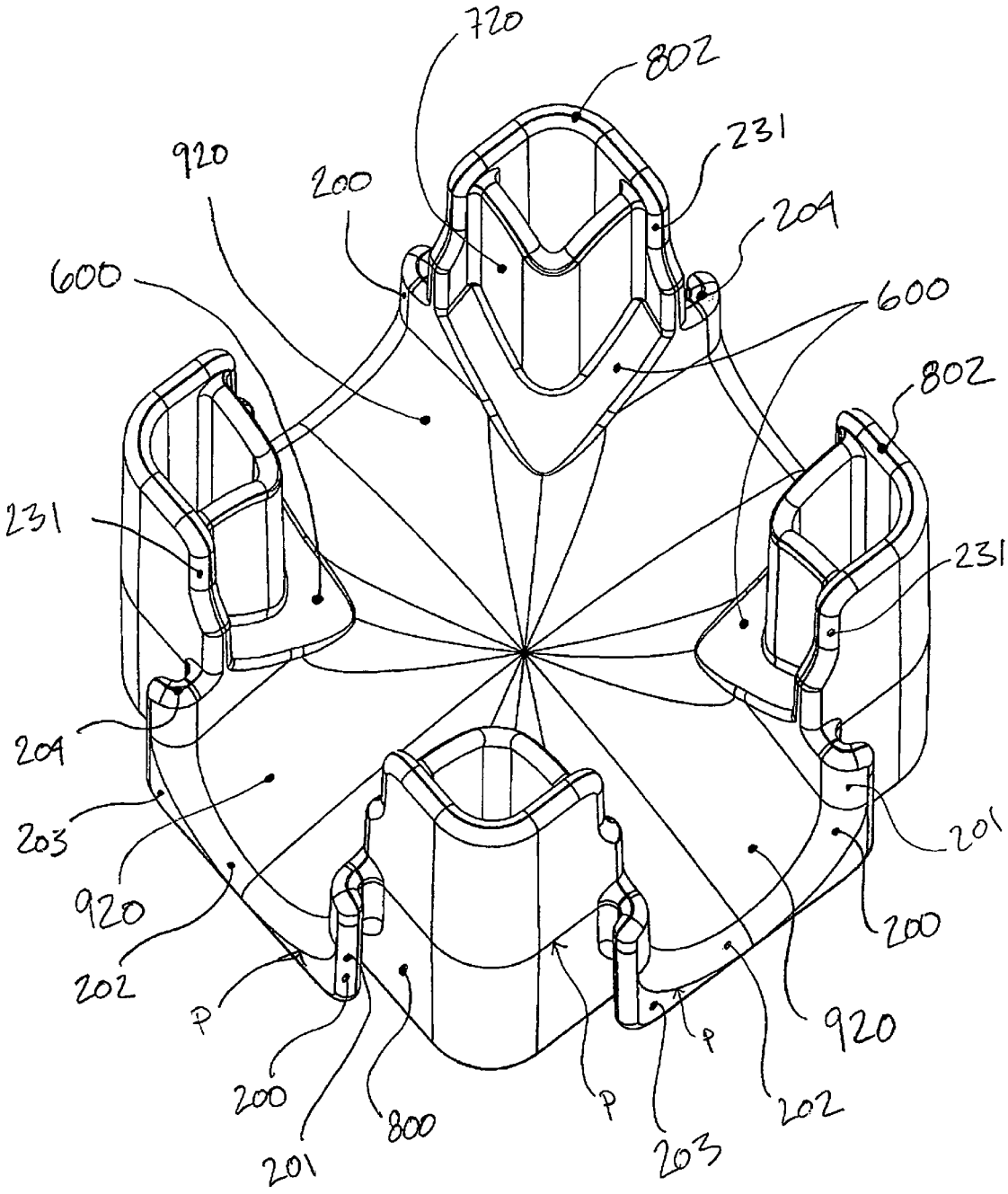
Figure 63C:
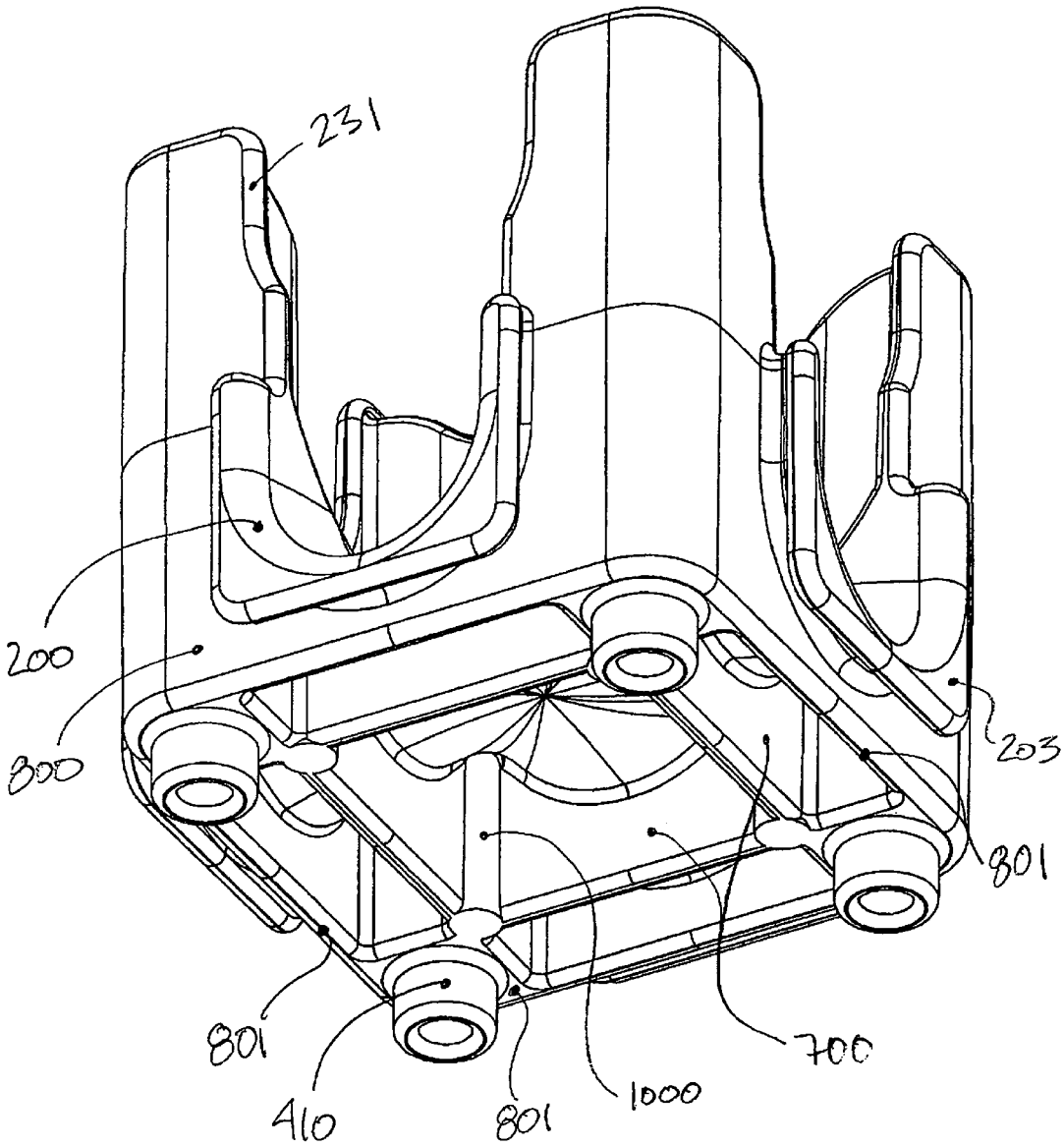

In another embodiment of the present invention, shown in FIGS. 1A-1L, 2A-2L, 3A-3L, 4A-4L, 60A-60C, 61A-61C, 62A-62C, and 63A-63C another "thick shell/thin interior" configuration is provided. As seen in these drawings, this embodiment shares many similarities with the previous "thick shell/thin interior" embodiment. However, the embodiment shown in FIGS. 60A-60C, 61A-61C, 62A-62C, and 63A-63C includes a U-joint at each horizontal exit, among other features. Views of the vertical exit block of this embodiment are shown in FIGS. 60A-60C and correspond to the vertical exit block views of the embodiment shown in FIGS. 56A-56C); views of the single exit block of this embodiment are shown in FIGS. 61A-61C and correspond to the single exit block views of the embodiment shown in FIGS. 57A-57C; views of the opposing double exit block of this embodiment are shown in FIGS. 62A-62C and correspond to the opposing double exit block views of the embodiment shown in FIGS. 58A-58C; and views of the quadruple exit block of this embodiment are shown in FIGS. 63A-63B and correspond to the quadruple exit block views of the embodiment shown in FIGS. 59A-59C.

Buttresses 720 stiffen and support the corners of the blocks, as seen in FIGS. 1B, 2B, 3B, and 4B. The curve at the top of each buttress 720 reduces likelihood of burnout from super-heated gases in the mold during manufacturing, provides comfort for the user when handling members, and guides the male vertical joint of an interlocking member into place.

Vertical tubes 410 run through each of the four corners, which allows lines, wires, rods, strings, or the like to pass through multiple blocks to assist in packaging or use of the product (e.g., making mobiles suspended from the ceiling).

The ejection pins are aligned with the intersections of the internal walls 1000 and thus the ejection force is evenly distributed across the geometry of the part. The exit pathway is also cantilevered out past the edges of the overall cubic form.

II. Marble Flow

Once multiple like modular members are assembled and appropriately aligned, either with or without a joinery system, pathways are defined wherever one member's exit(s) aligns with another member's entrance. This alignment creates either planned or unplanned pathway configurations, dependent upon whether the user is building in a strategic or haphazard manner. Because there is an exit from every block, there is never a dead end; haphazard or intuitive construction processes lead to pathways that may work as well as those in more carefully planned structures. Examples of basic pathway configurations are shown in FIGS. 18B, 19B, 20B, 21B, and 22B.

Because the exterior shape and dimensions of each modular member as well as each member's internal chamber, including floor and wall shapes, may vary greatly, the behavior of a sphere or other object traveling through a pathway system created by assembled members may differ substantially. Depending on the desired effect, appropriate shapes and dimensions of the member's internal chamber may be selected.

Figures 13A, 13B, 13C, 13D, 13E, 13F, 13G, 13H, 13I, 13J:
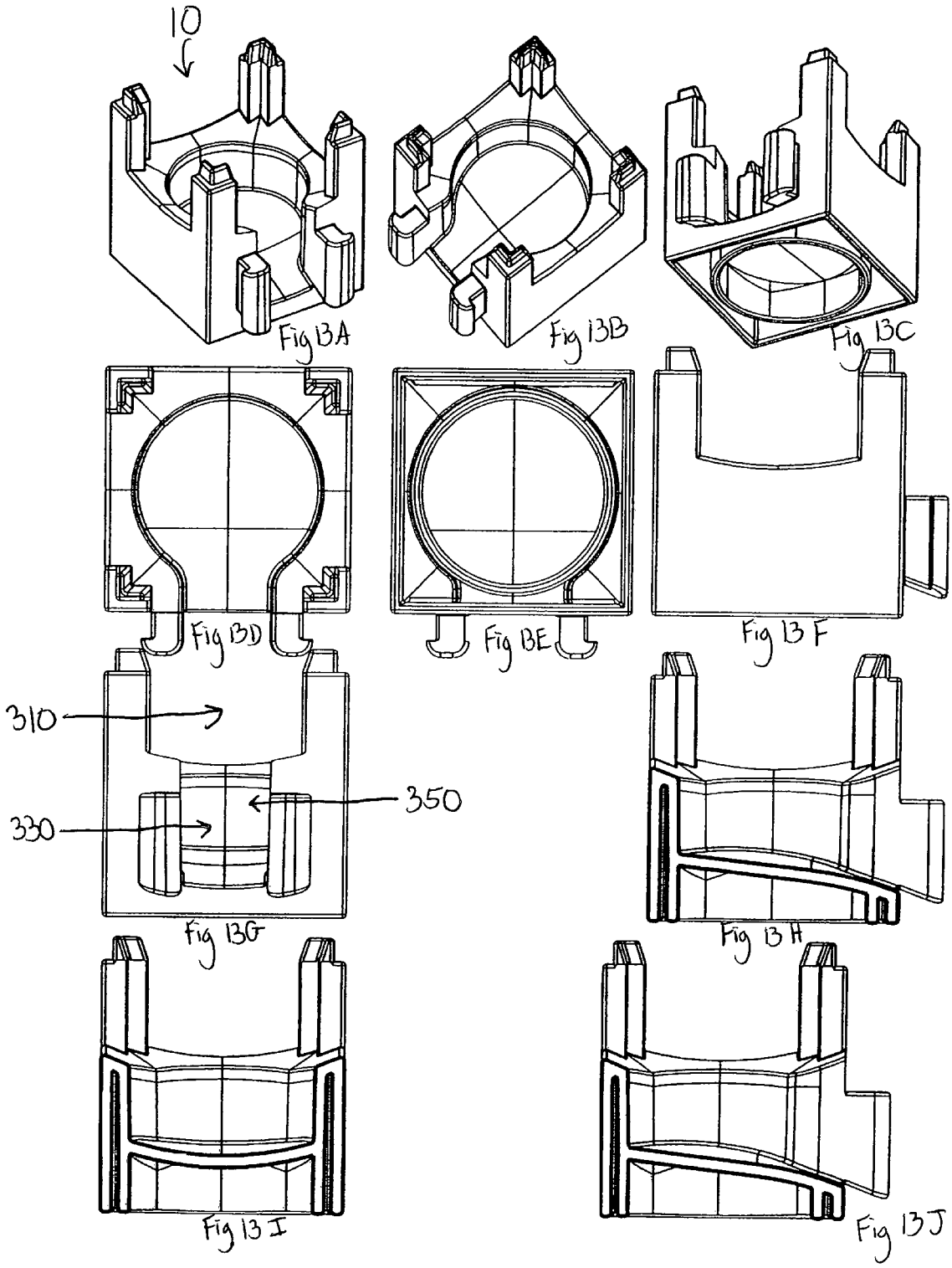
FIGS. 13A-13J are perspective, front, back, top, bottom, and side views of a cubical 1-exit interlinkable modular member with a cylindrical chamber and thin-shell bottom in accordance with one embodiment of the present invention.
Figure 18A:
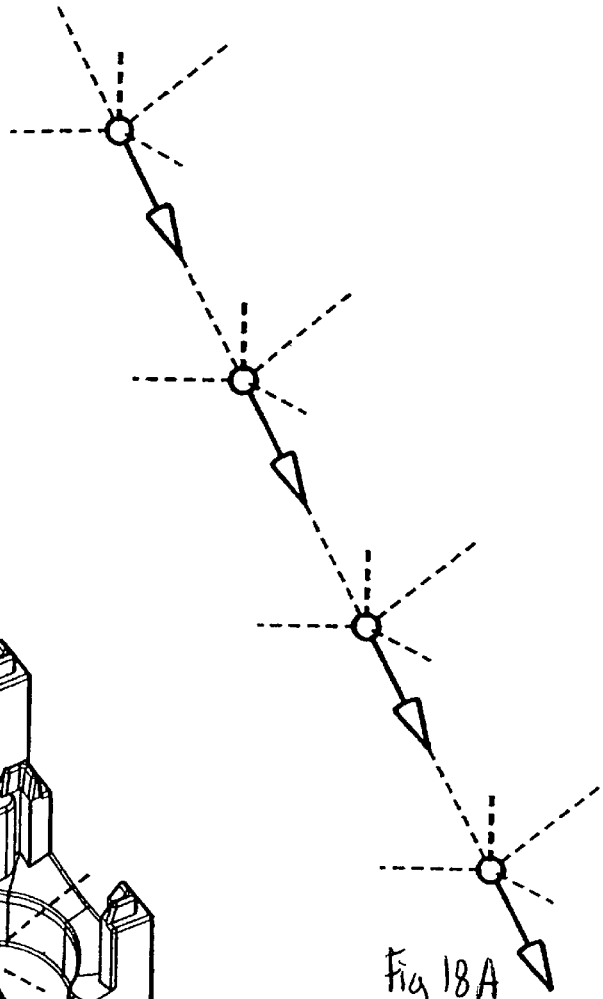
FIG. 18A is a perspective view of an entrance/exit configuration for a cascade pattern.
Figure 18B:
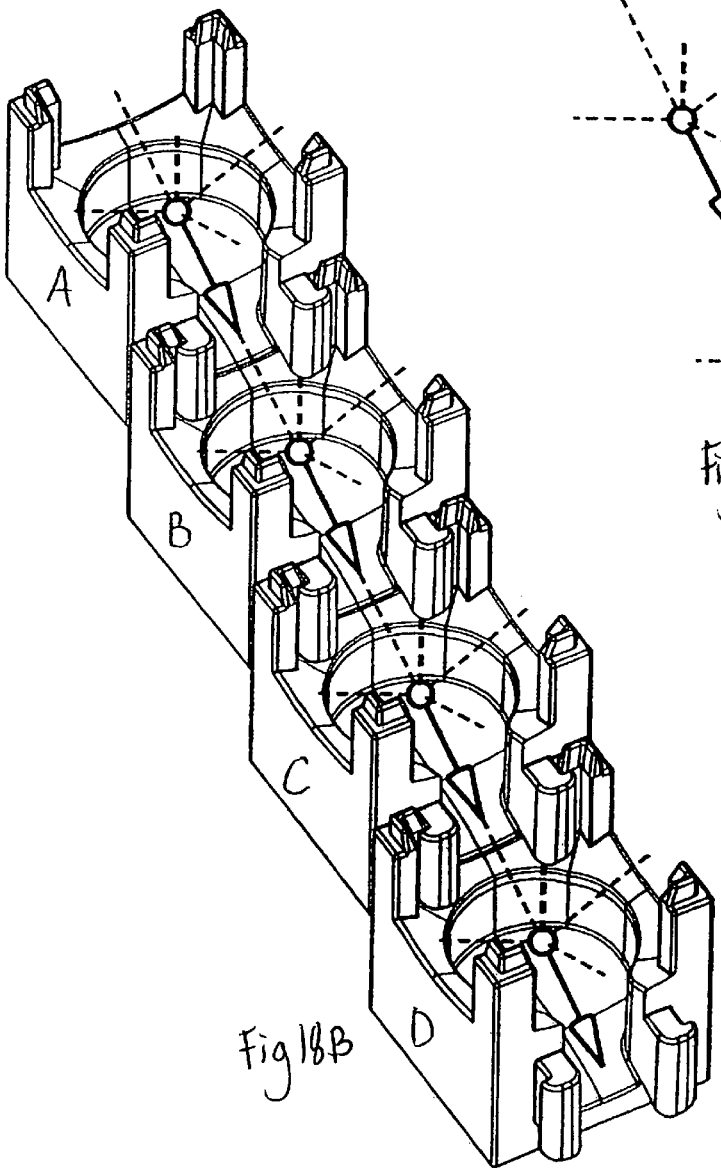
FIG. 18B is a perspective view of cubical interlinkable modular members arranged in the cascade pattern of FIG. 18A.

In one embodiment, shown in FIGS. 13A-13J, the member's internal chamber includes a substantially cylindrical wall (as seen in FIG. 13D) and a downwardly sloping floor (FIG. 13J) directed towards the member's horizontal exit. With reference to FIG. 18B, which shows a basic cascade configuration of the cubical member shown in FIGS. 13A-13J, a spherical object—such as a marble—that is placed or dropped in the topmost member A will begin to roll along the member's floor area towards the member's sole horizontal exit due to the slope of the floor area. In this example, the members are joined by a split joint, and the marble passes through the two sides of member A's male joint as it exits member A. The marble then enters a horizontal entrance of member B and drops down from the entrance into the floor area of member B. The drop ensues because each member's horizontal entrance is elevated above its floor area. Now, a combination of the horizontal component to the marble's velocity and the slope of member B's floor area cause the marble to continue rolling along member B's floor area towards the horizontal exit. The process will continue until the marble has reached the lowest member, member D, and exits.

Figure 19A:
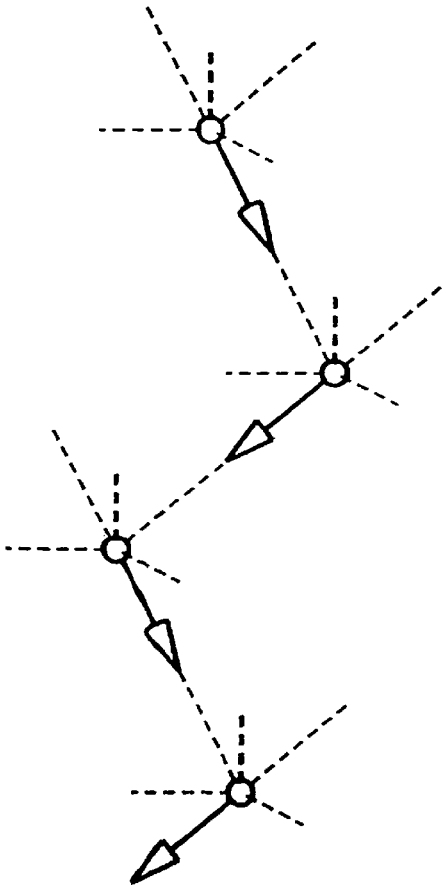
FIG. 19A is a perspective view of an entrance/exit configuration for a slalom pattern.
Figure 19B:
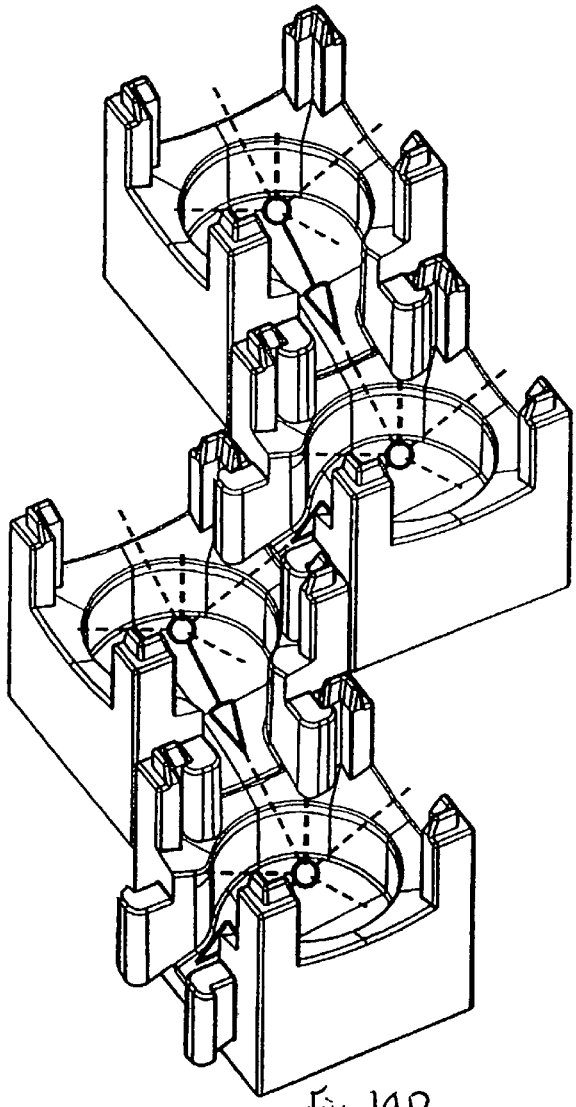
FIG. 19B is a perspective view of cubical interlinkable modular members arranged in the slalom pattern of FIG. 19A.

In the cascade configuration of FIG. 19A using the cubical member shown in FIGS. 13A-13J, the marble will accelerate as it travels from member to member. As described, a marble traveling through the configuration will follow a roll-drop-roll path as it rolls along one member, drops into the adjacent member, and begins to roll again towards the next member. This roll-drop-roll path has the advantage of controlling the speed at which the marble travels from the highest member to the lowest member. Specifically, the marble's speed is slowed by each vertical drop into another member. Accordingly, a greater vertical drop will provide a greater slowing effect to the extent that this drop induces greater bouncing off the floor and resultant bouncing within the chamber before the rolling sphere exits. Thus, an embodiment of the present invention where the modular members have an elongated vertical dimension, as seen in FIG. 65M, will control a marble's speed more than an embodiment of the present invention where the modular members have a truncated vertical dimension, as seen in FIG. 65N.

Another aspect of the present invention that controls the speed of the marble is the pathway configuration. For example, in the slalom configuration using the cubical member shown in FIGS. 13A-13J (e.g., FIG. 19B) or the zig-zag configuration (e.g., FIG. 22B), a marble that enters an adjacent member's horizontal entrance will drop down into the adjacent member's floor area and strike an interior wall ("striking wall") opposing the entrance taken by the marble. The marble then rolls along the floor towards the member's horizontal exit, which is either adjacent to the striking wall (slalom) or opposite the striking wall (zig-zig). The impact incurred on the marble when encountering the striking wall decreases and changes the marble's velocity, thereby controlling the marble's speed. Those skilled in the art will appreciate that different pathway configurations will achieve different speed control. For instance, the cascade configuration, shown in FIG. 18B, minimizes the speed control and maximizes marble speed (not including vertical exit members) because the marble never encounters a striking wall; the only speed control in the cascade configuration is provided by the roll-drop-roll and bouncing aspect described above. In contrast, other configurations, such as the slalom, helix, and zig-zag configurations, provide for greater speed control relative to the cascade configuration due to the repeated loss of horizontal velocity during impact with the internal side walls of the blocks.

In the "thick shell/thin interior" embodiments described above, the members' floor are substantially concave-up with at least one exit pathway formed in the floor. The concave up floor creates a rocking effect on a sphere traveling through these members, which serves as yet another device for slowing the flow of the marble through the pathway. For example, a marble entering into the internal chamber will fall to the floor, at which point the concave up floor directs the marble towards the center of the floor. In an opposing two-exit member, as seen in FIGS. 1A-1L, the marble typically is directed to the center of the floor where the shape of the concave up floor generates a rocking motion in the marble until eventually the marble drops down into the exit pathway, which is formed in the concave up floor, and travels towards one of the two exits.

The exit pathway in the 1-exit member, seen in FIG. 2A-2K, starts near the center of the concave-up sphere, which facilitates the rocking effect on the sphere particularly when a marble enters the 1-exit member perpendicular to the exit channel. The starting point of the exit pathway may be located as desired; for example, the exit pathway shown of the member shown in FIG. 532-A is further back relative to the exit pathway of the member shown in FIG. 2D.

The hourglass shape in the two-exit block, seen in FIG. 1D, can be better understood as the near-intersection of a torus and the concave-up sphere. A slight elevation of the sphere with respect to the torus is what make the torus shape "read" in the design as an hourglass. An infinite variety of other shapes could produce the same function of guiding marbles out one of the two exits randomly. The hourglass provides for specific effects: e.g., once a rolling marble slows in its rocking motion sufficiently, it is no longer on the bottom of the sphere, but instead on the top of the torus where it is in a highly unstable equilibrium. A marble rolling back and forth on the sphere and across the hourglass makes a subtle percussive sound as it hits the ridges of the hourglass form. The torus and the sphere curve in opposite directions and this double-curvature adds strength to the block.

A. Array Principles

As described above, a plurality of like-modular members (e.g., cubical, triangular, rectangular, spherical, cruciform, etc.) may be assembled into various configurations such as those shown in FIGS. 18B, 19B, 20B, 21B, and 22B. In addition to these fundamental or "foundational" configurations, more elaborate and geometrically complicated arrays may also be assembled. The underlying principles described above regarding the members' attributes and entrance/exit configurations also govern these arrays.

For instance, a ½ height vertical offset or stagger will exist between any two adjacent members. This achieves the high-low-high effect, which represents a three dimensional grid of "shifted Cartesian space." As seen in FIG. 64A, which is a top view of a set of cubical members configured in a solid construction, each "high" member (i.e., elevated) is immediately surrounded by a "low" member, where the difference in elevation between "high" members and "low" members is one half the members' vertical height. The resultant image, seen in FIG. 64A, resembles a checkerboard.

The "shifted Cartesian space" can be appreciated by comparing cubes arranged in Cartesian space, shown in FIGS. 65A-65C, with cubes arranged in "shifted Cartesian space," shown in FIGS. 65D-65F. The cubes in the latter are vertically shifted ½ the cubes' height. The cubes shown in FIGS. 65G-65I are arranged with a vertical shift of ⅔ the cubes' height. The members are shown in FIGS. 65J-65L are not cubes, but rather they are elongated, and they are vertically shifted ½ the cubes' height. As seen in FIGS. 65M and 65N, configuring such elongate members either vertically or horizontally does not prevent the vertical offset.

Figure 66A:
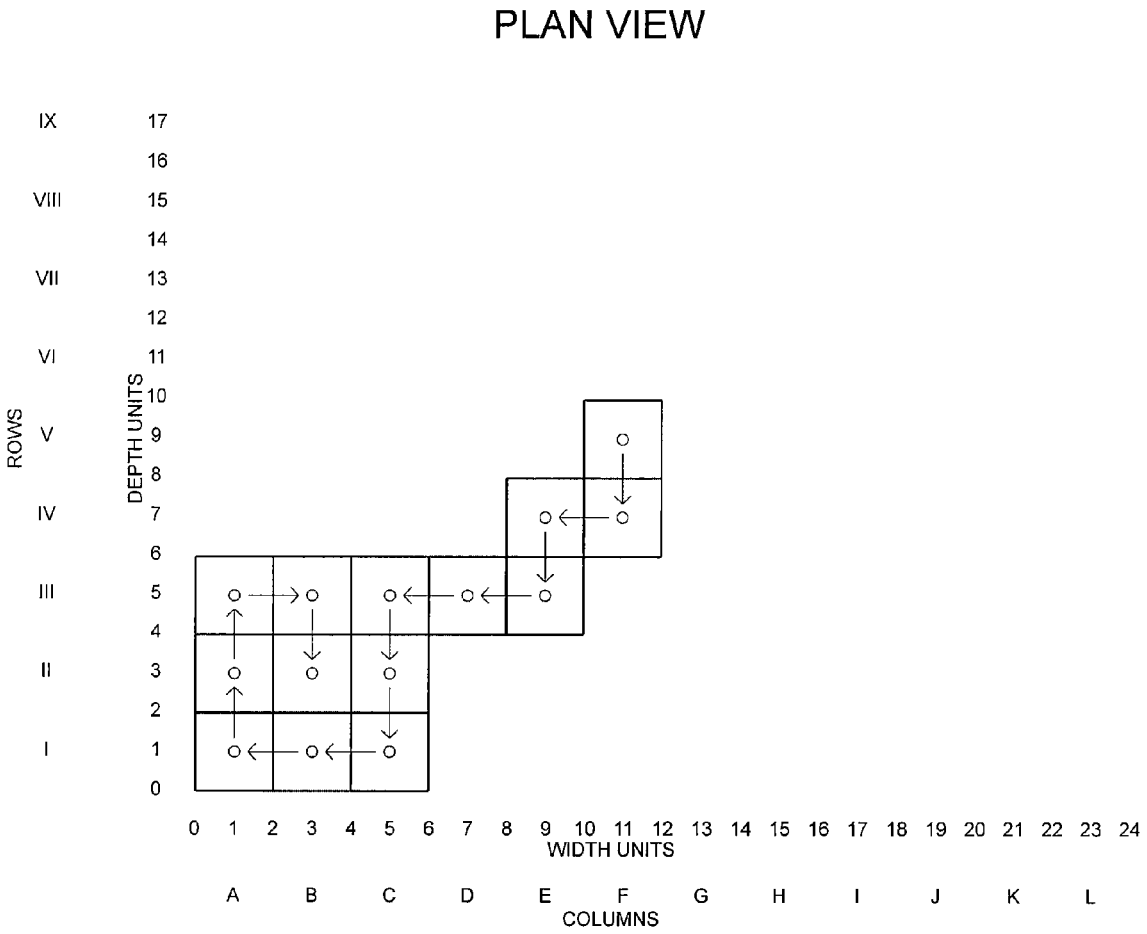
FIG. 66A is a top view grid plan configuration of members with pathway directional indicators.
Figure 66B:
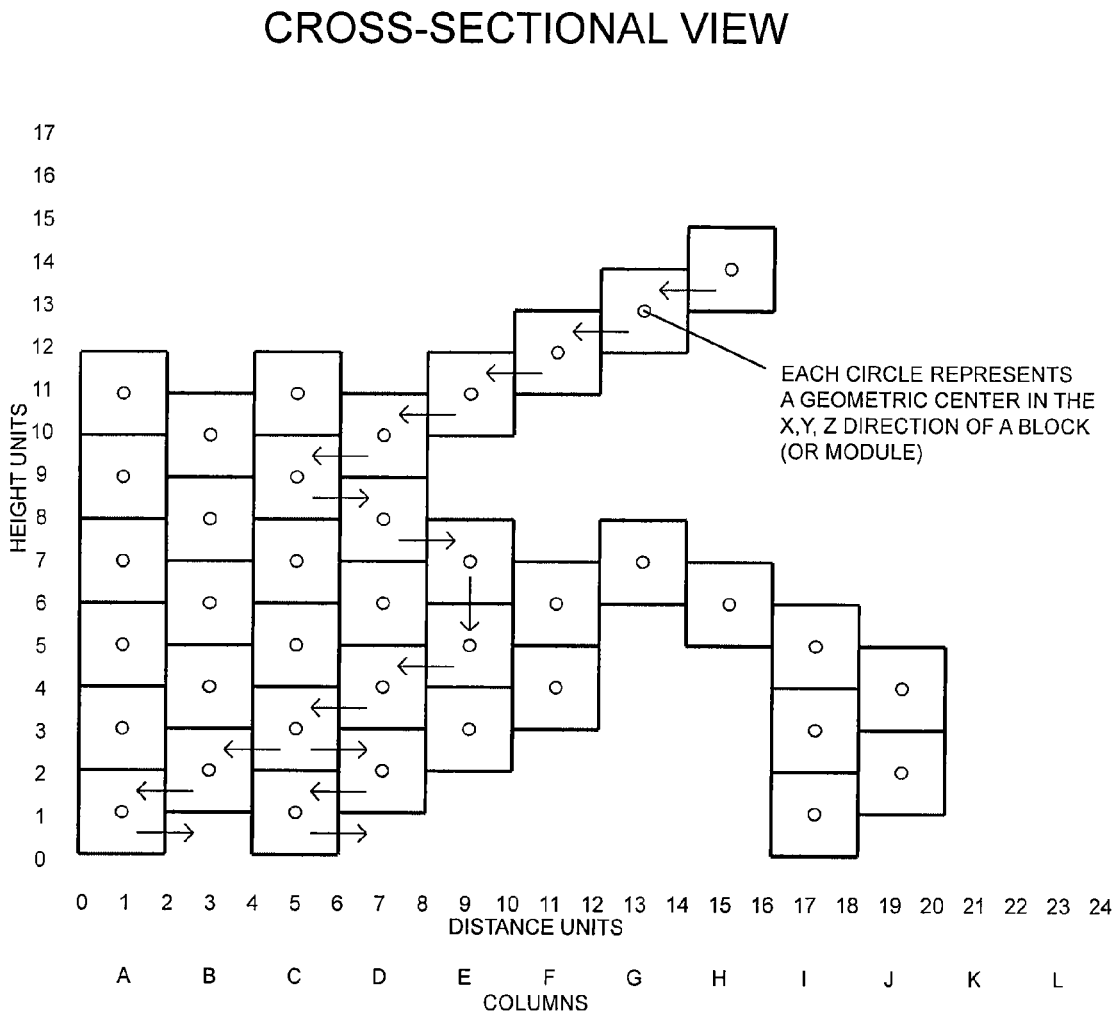
FIG. 66B is a front view grid section of a configuration of members with pathway directional indicators.
Figure 68:
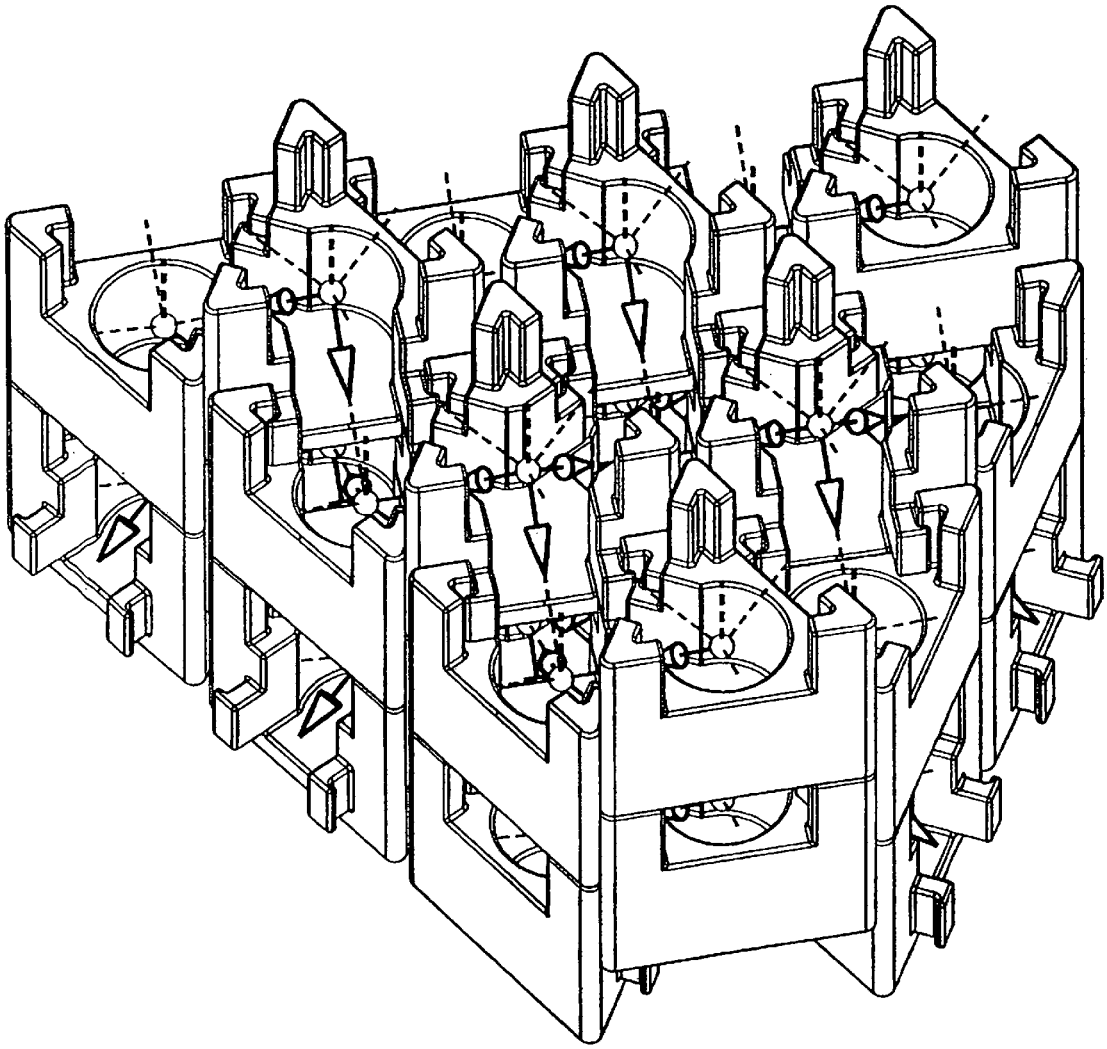
FIG. 68 is a perspective view of a triangular solid block construction.

A similar effect may be seen for triangular members (FIGS. 68 and 64B), hexagonal members (FIGS. 64C and 64D), octagonal members (FIG. 64E), and circular members (FIGS. 64F and 64G). The cubical embodiment (FIG. 64A), triangular embodiment (FIG. 64B), and one of the hexagonal embodiments (FIG. 64C), provide for a "solid" construction without voids. In contrast, another hexagonal embodiment (FIG. 64D), the octagonal embodiment (FIG. 64E), and the circular embodiments (FIGS. 64F and 64G) reveal a void in the construction as seen in the respective drawings. Additionally, as seen in FIG. 64D, one of the hexagonal embodiments may contain an underlying triangular geometry which follows from a hexagon comprising six triangles. Further, the octagonal embodiment (FIG. 64E) and one of the circular embodiments (FIG. 64F) may contain an underlying grid geometry, and another circular embodiment (FIG. 64G) may contain an underlying triangular geometry.

Where the modular members of a particular embodiment contain an underlying grid geometry—as with the cubical embodiment seen in FIG. 64A, the octagonal embodiment seen in FIG. 64E, and the circular embodiment seen in FIG. 64F—the members' geometric centers are substantially situated on a grid as well. For example, a set of cubical members may be configured as shown in FIG. 66A, which is a top view of an array and where each members' geometric center is represented by a dot. The members' geometric centers are aligned by columns (0, 1, 2, . . . ) and rows (I, II, III, . . . ), as seen in FIG. 66A. Additionally, a set of cubical members may be configured as shown in FIG. 66B, which is a cross-section view of an array. Here, members' geometric centers are vertically aligned with the geometric centers of the members in alternating columns (e.g., members in columns 1, 5, 9 are vertically aligned, and members in columns 3, 7, and 11 are vertically aligned), and members' geometric centers are midway vertically aligned with the geometric centers of members in adjacent columns (e.g., members in column 1 are midway vertically aligned with members in column 3, and members in column 3 are midway vertically aligned with members in column 5). The geometric centers of the members in the same column in FIG. 66B are all horizontally aligned.

As is apparent, the alignment of geometric centers shown in FIGS. 66A and 66B is described with reference to cubical members. However, the grid alignment of geometric centers described may also be applicable to other shapes, such as octagonal, circular, and cruciform embodiments. Similarly, the underlying triangular geometry described above yields a triangle alignment that may also be applicable to other embodiments such as the hexagonal and circular embodiments. Accordingly, members of different shapes and form may align in the same way, regardless of specific sculptural form.

Again with reference to FIG. 65A, interior cubes arranged in solid traditional Cartesian space configurations each have six full-face neighbors (exterior cubes in such solid configurations will have only three, four or five full-face neighbors). In contrast, with reference to FIG. 65D, interior cubes arranged in solid shifted Cartesian space configurations have two full face neighbors (above and below) and eight half face neighbors around the sides.

B. Basic Configurations

As previously described, basic configurations of like members include a tower (FIG. 40B), cascade (FIG. 18B), slalom (FIG. 19B), helix (FIG. 20B), double helix (FIG. 21B), and zig-zag (FIG. 22B), among others. As also described, although each of the referenced drawings represents these respective pathway configurations with a cubical member, the configurations are also achievable with members of a variety of other shapes. For example, FIG. 23B shows the slalom configuration formed by cruciform members.

C. Non-Limiting Construction Exemplars

A variety of array types may be assembled from a plurality of like-modular members. These different arrays may generally be categorized into four types: solid constructions, shell constructions, lattice constructions, and planar/intersecting planar constructions.

Figure 47A:
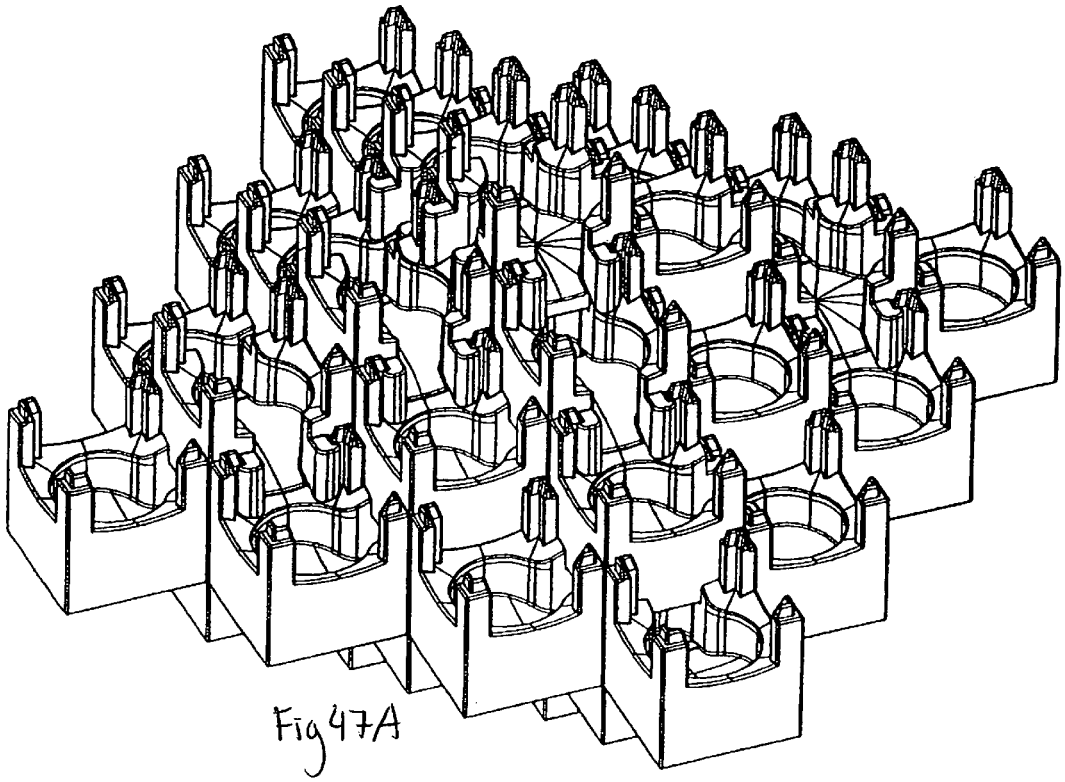
FIGS. 47A-47B are isometric and cross-sectional views of the solid construction assembly of FIG. 46G, with a further layer added thereto.
Figure 47B:
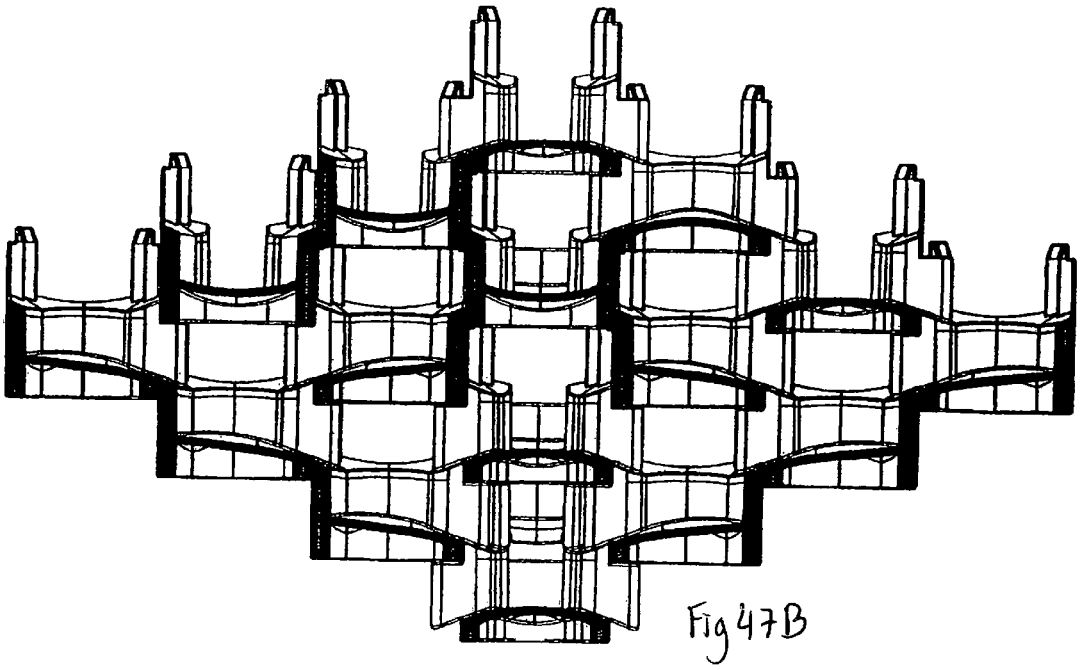
Figure 48A:
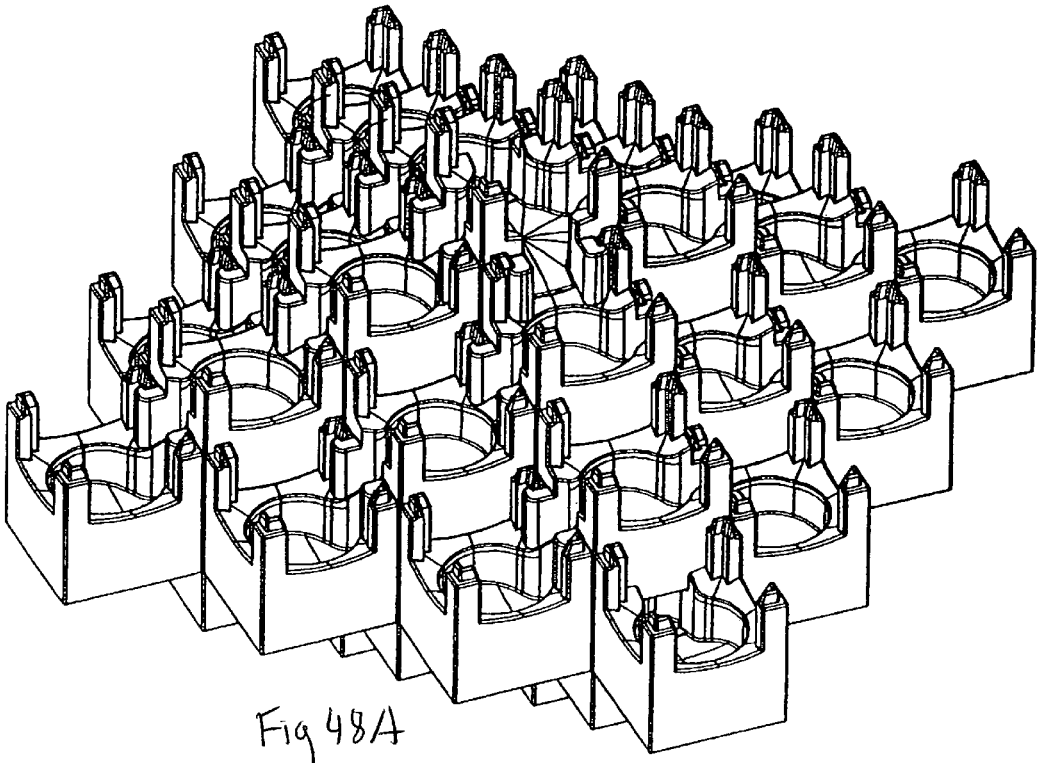
FIGS. 48A-48B are isometric and cross-sectional views of a shell version of the assembly of FIGS. 47A-47B, without a modular member in the center position.
Figure 48B:
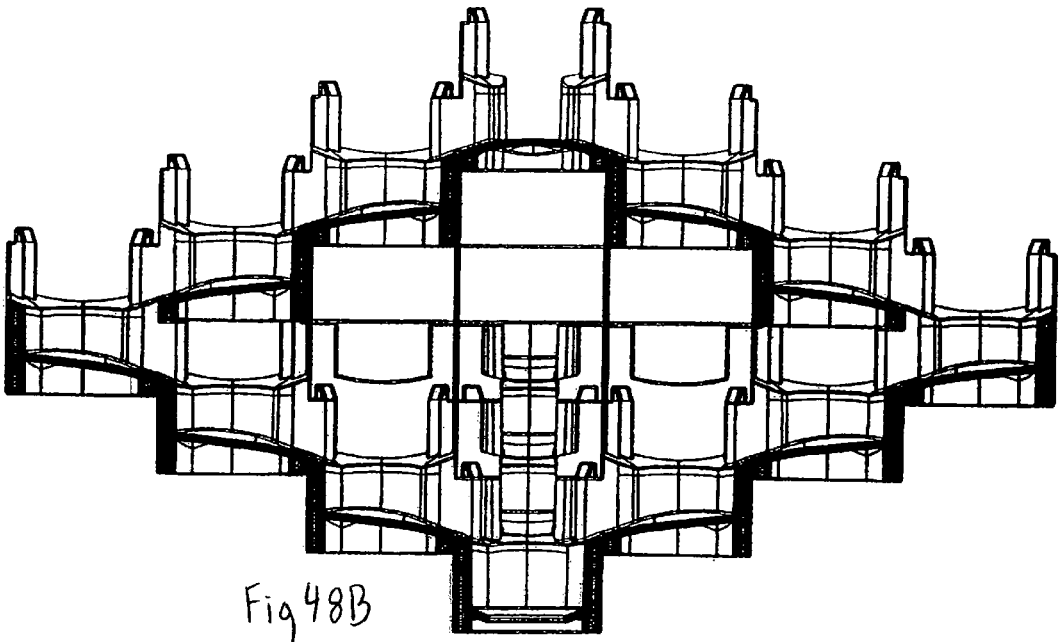
Figure 67:
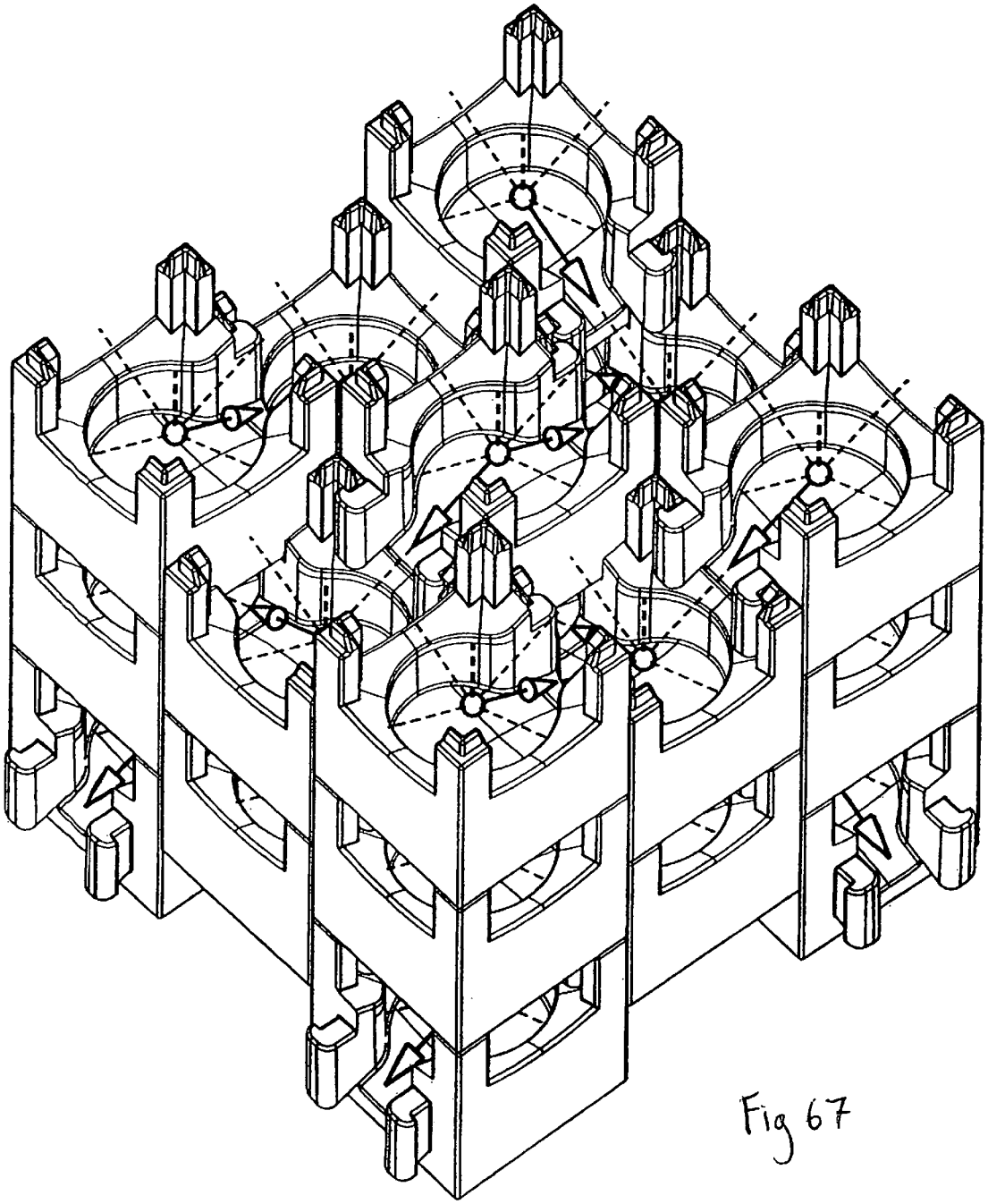
FIG. 67 is a perspective view of a cubic solid block construction.

By way of example, the solid constructions may include assemblies in the shape of a block, pyramid, or inverted pyramid. This construction type is characterized by an assembly of members without any voids on the interior of the construction; each member—except for members on the exterior of the construction—has a neighbor at each available position. The configuration shown in FIG. 67 is an example of a block configuration, and the configuration shown in FIGS. 47A and 47B is an example of an octahedron, a pyramid stacked atop an inverted pyramid. The configuration in FIGS. 48A and 48B is substantially similar to that in FIGS. 47A and 47B when viewed from the exterior; the difference is that there are no interior blocks in FIGS. 48A and 48B, thus creating a "shell" structure. The configuration shown in FIG. 68, which is substantially triangular, is also an example of a solid construction.

Figure 20A:
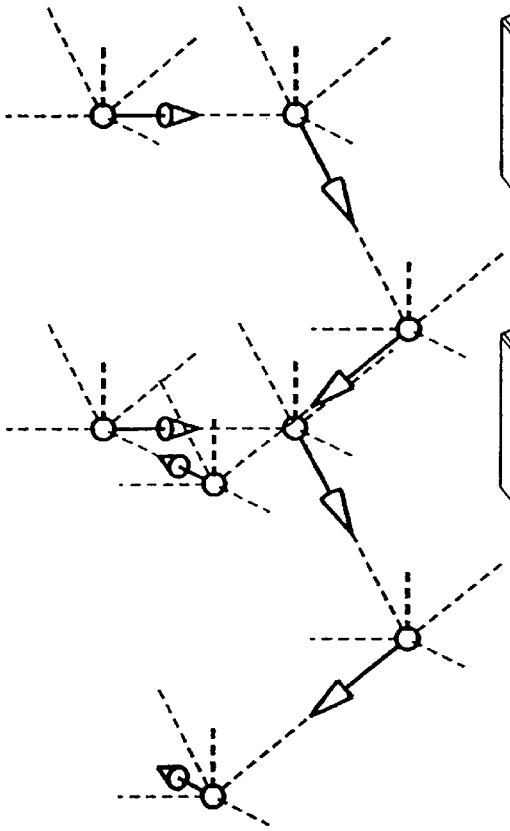
FIG. 20A is a perspective view of an entrance/exit configuration for a 2×2 helix pattern.
Figure 20B:
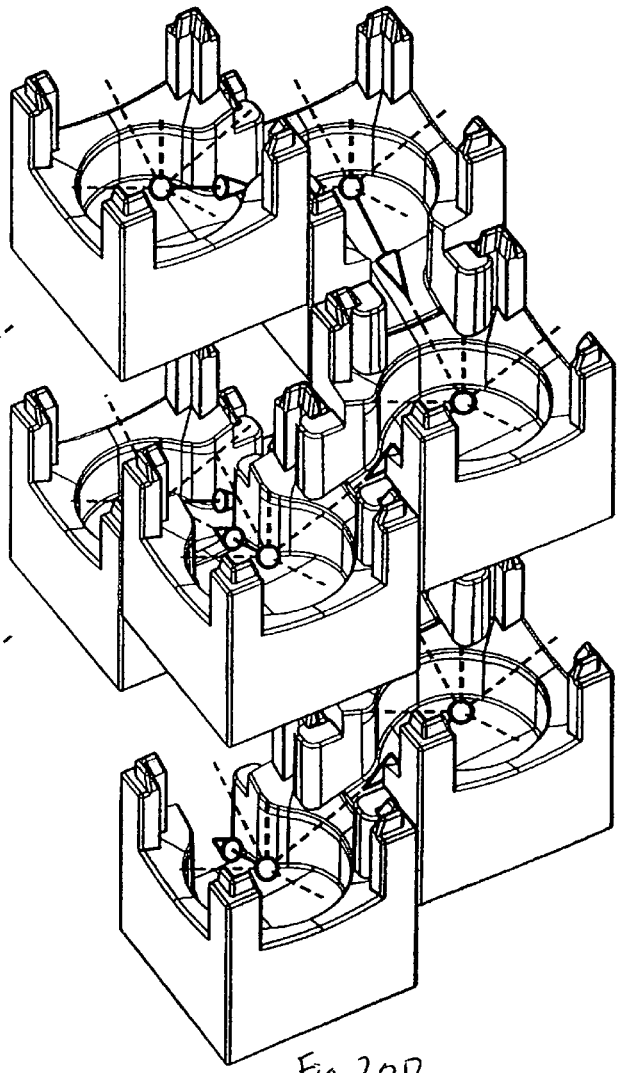
FIG. 20B is a perspective view of cubical interlinkable modular members arranged in the 2×2 helix pattern of FIG. 20A.
Figures 21A, 21B:
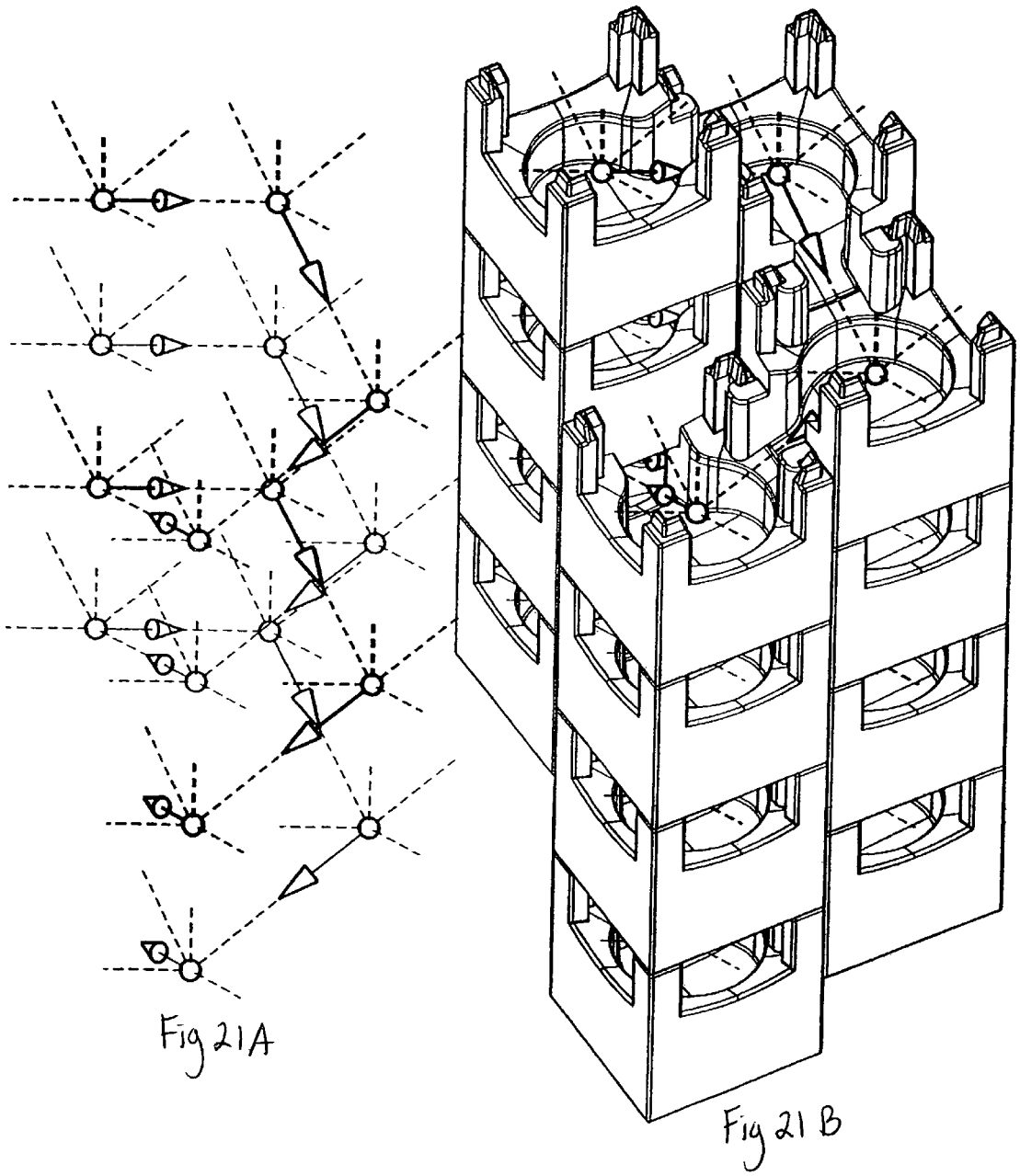
FIG. 21A is a perspective view of an entrance/exit configuration for a 2×2 double-helix pattern.
FIG. 21B is a perspective view of cubical interlinkable modular members arranged in the 2×2 double-helix pattern of FIG. 21A.
Figure 69A:
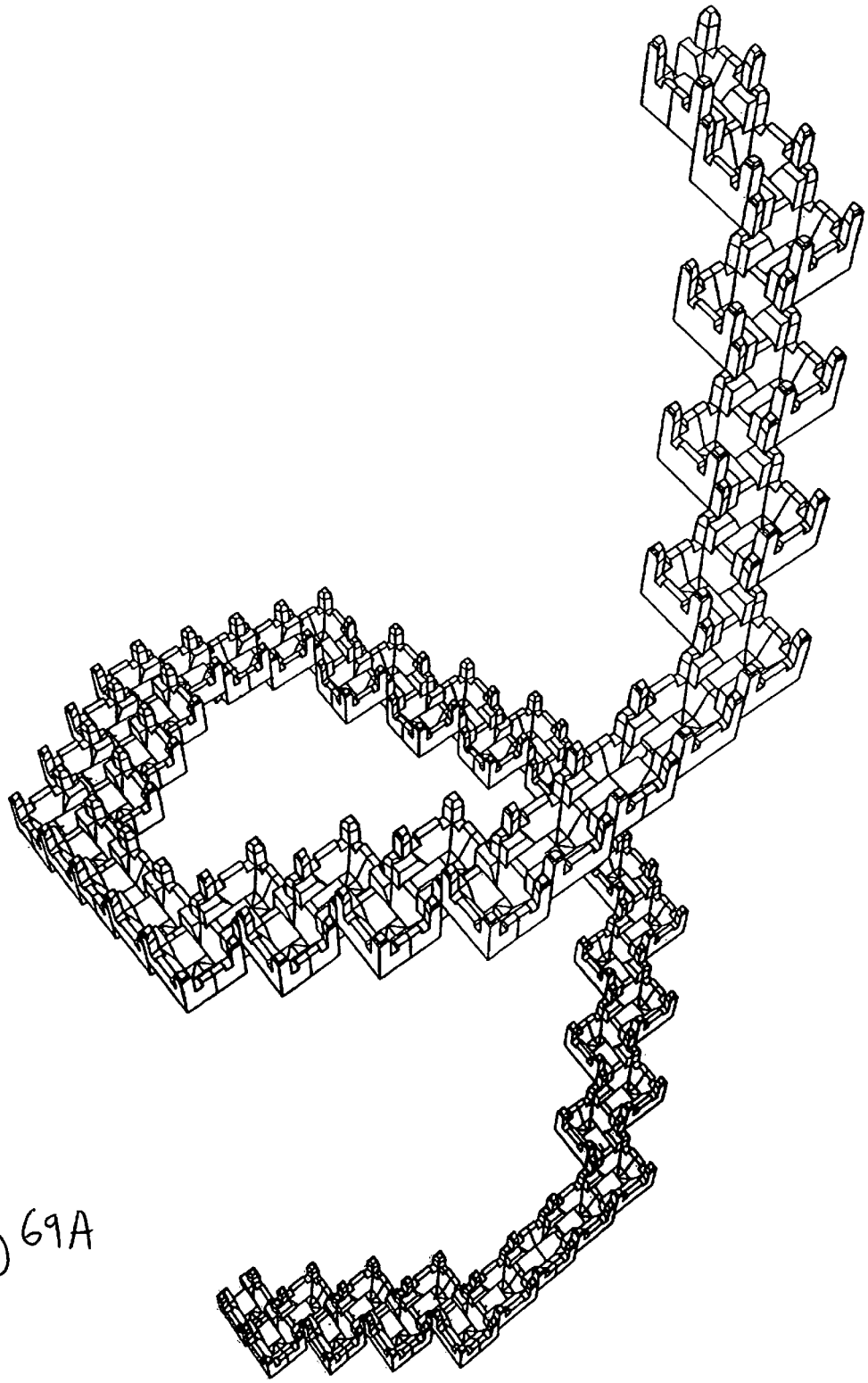
FIGS. 69A-69D are perspective views of cubical members in a various helical configurations.
Figure 69B:
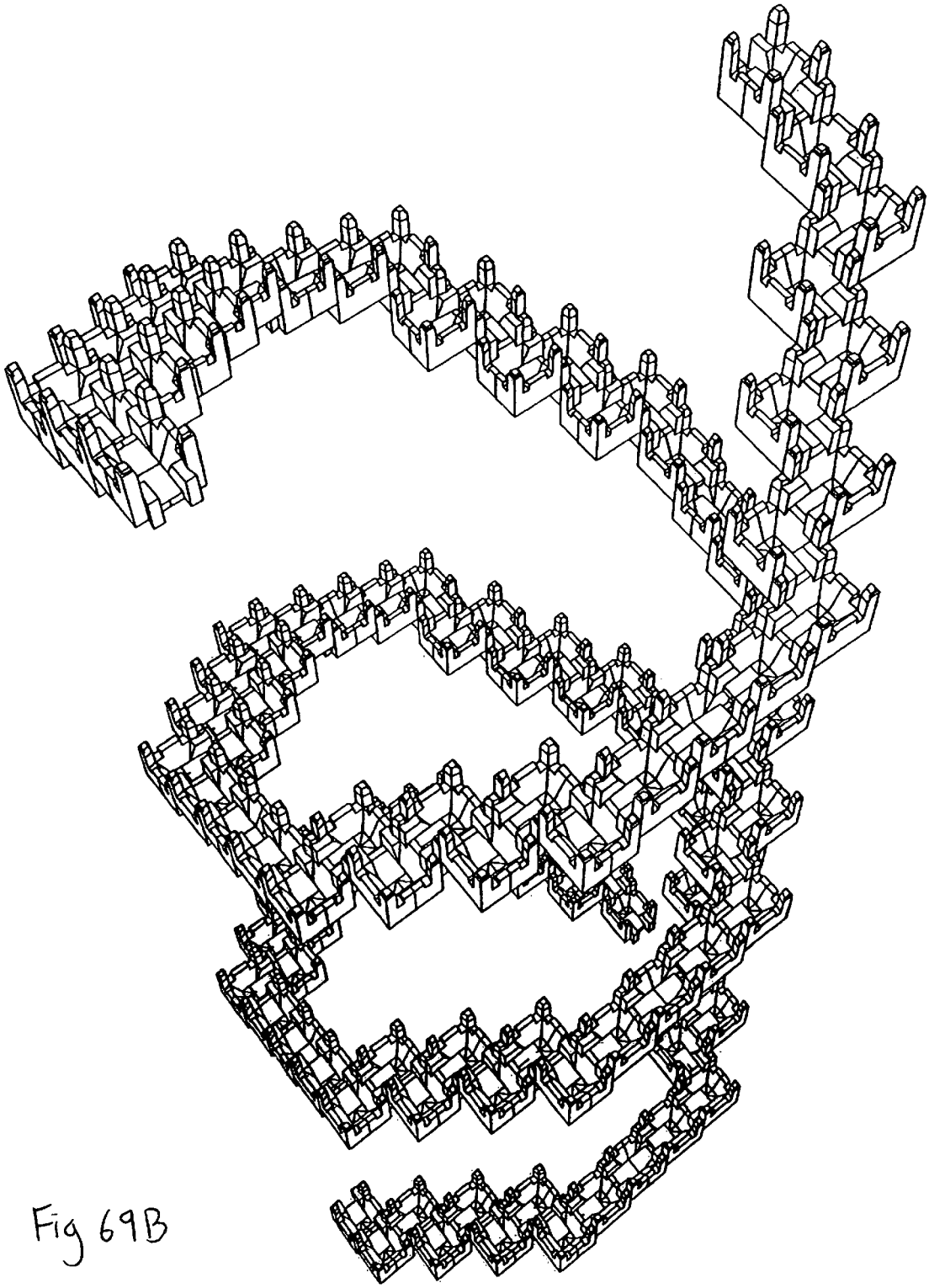
Figure 69C:
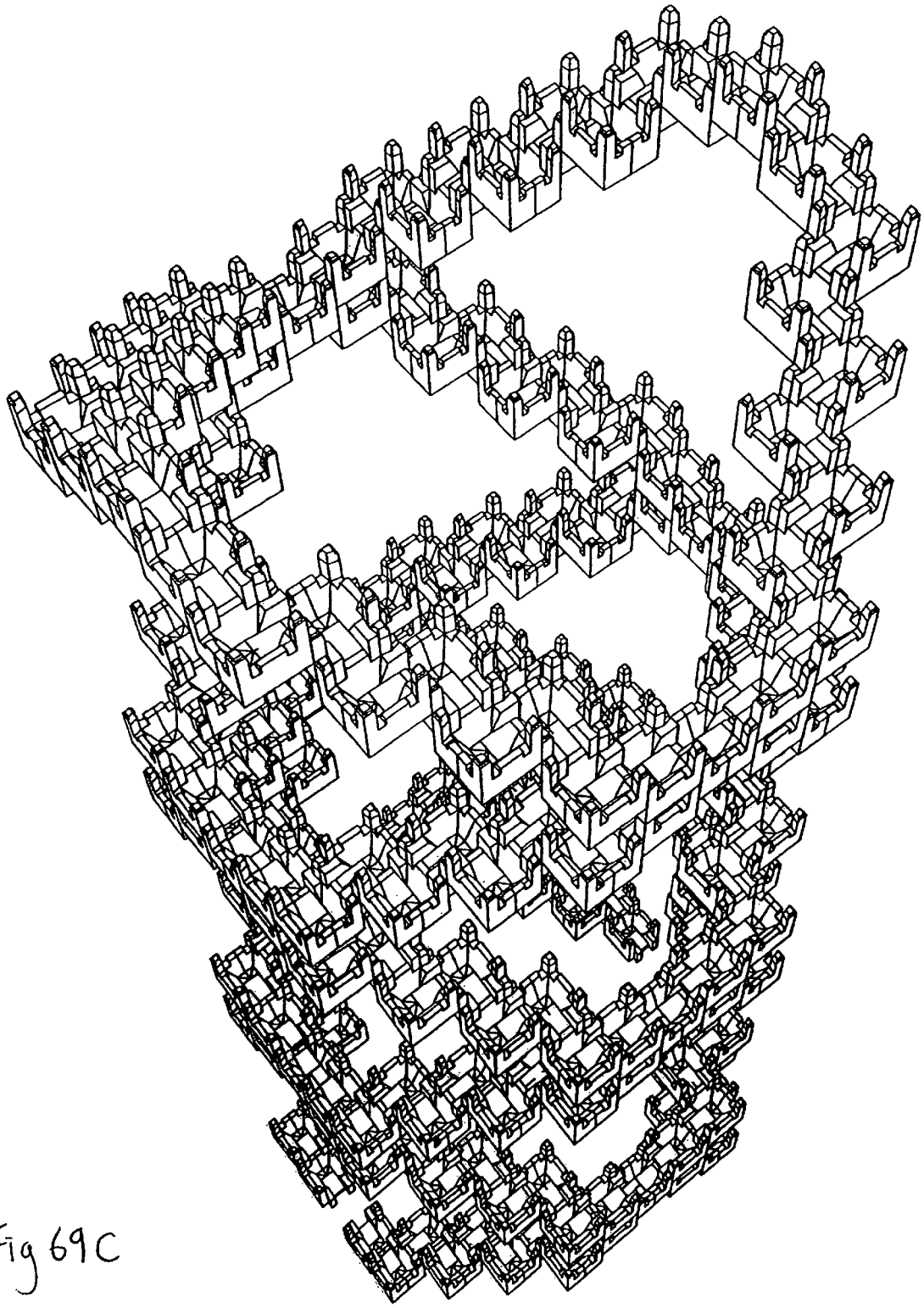
Figure 69D:
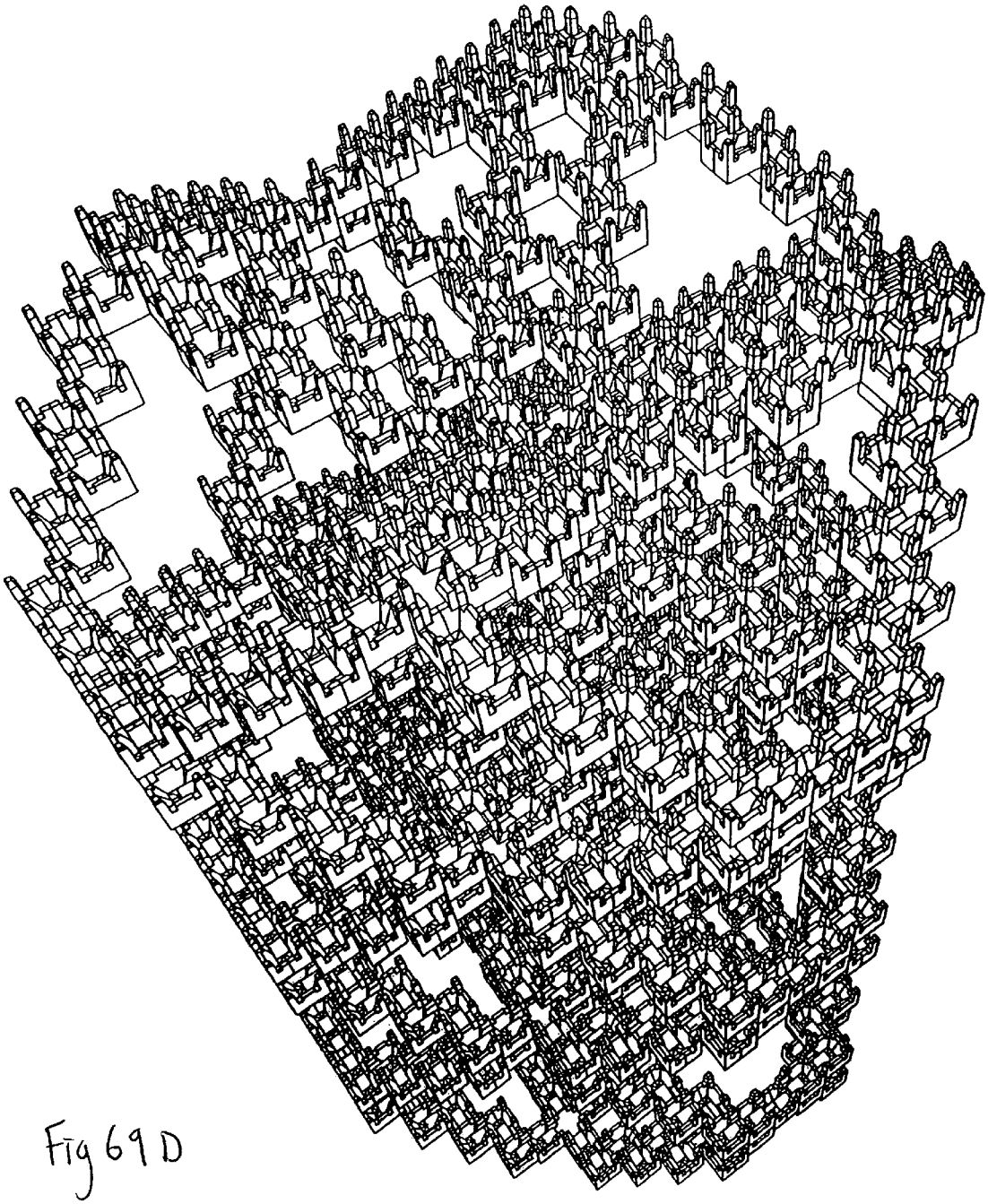
Figure 69E:
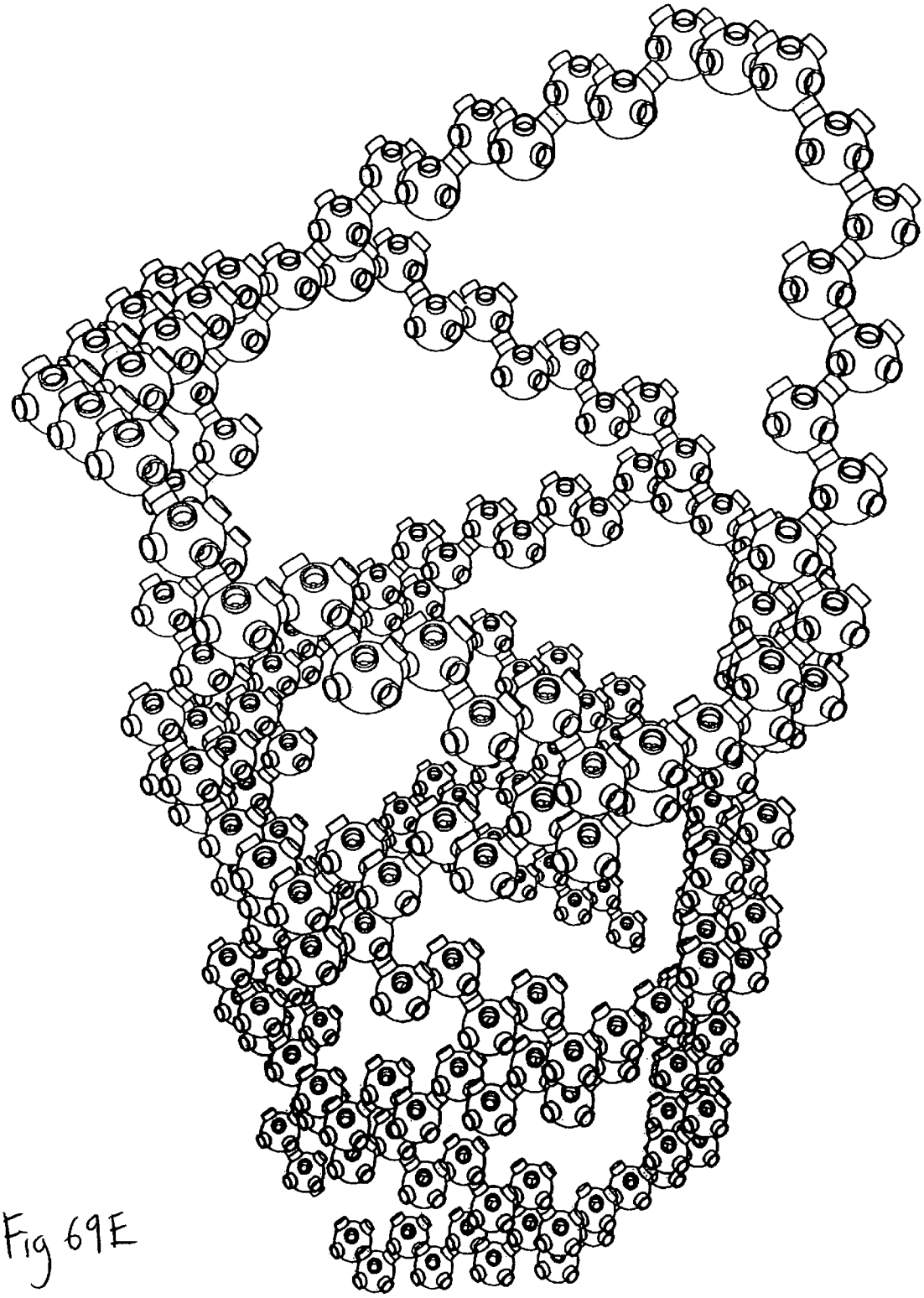
FIG. 69E is a perspective view illustrating the helical configuration of FIG. 69C achieved with spherical members.

Again by way of example, the lattice constructions may include assemblies in the shape of a helix or a double helix. This construction type is characterized by an open framework or pattern. As previously noted, the configuration shown in FIG. 20B is an example of a helix and the configuration shown in FIG. 21B is an example of a double helix. The configuration shown in FIG. 69A is an example of a larger helix, which is formed by combining a series of alternating cascade-slalom-cascade sub-constructions. In the configuration shown in FIG. 69A, each "cascade" and each "slalom" sub-construction includes five modular members. However, one skilled in the art will appreciate that each of these sub-constructions may include other numbers of members as well; the larger the number of members in each sub-construction, the greater the diameter of the helix. The configuration shown in FIG. 69B is a double helix, with each helix being identical to the helix shown in FIG. 69A. Again, each of these helixes is formed by combining a series of alternating cascade-slalom-cascade sub-constructions. The configuration shown in FIG. 69C includes two clockwise and two counter-clockwise helixes, intersecting at double-exit members at intersecting nodes. FIG. 69E shows the same configuration as shown in FIG. 69C using spherical members rather than cubical members. The configuration shown in FIG. 69D includes four of the constructions of FIG. 69C, partially overlapping and intersecting at quadruple-exit members at intersecting nodes.

Figure 70A:
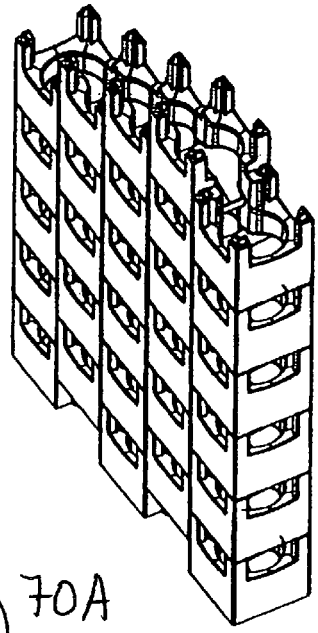
FIGS. 70A-70D are perspective views of planar and intersecting planar constructions, and the corresponding entrance/exit configurations.
Figure 70B:
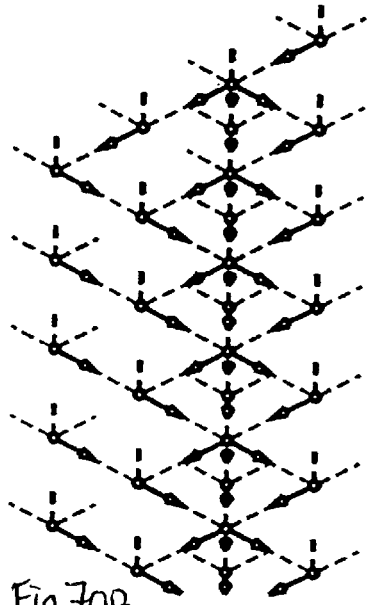
Figure 70C:
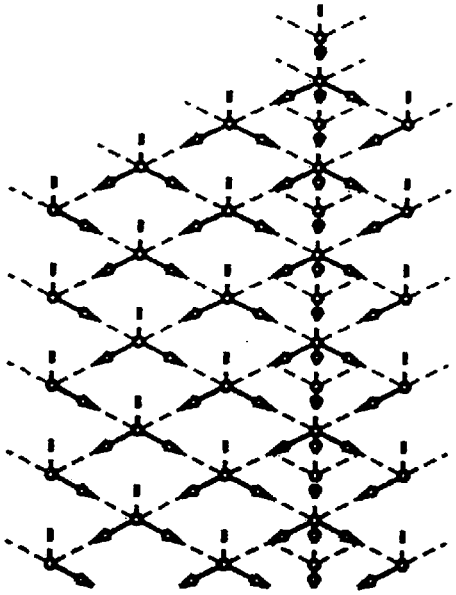
Figure 70D:
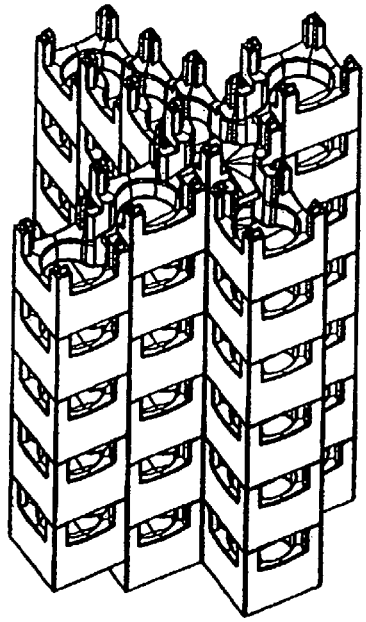

The planar and intersecting planar constructions may include assemblies in the shape of a plane or interesting planes. As seen in FIG. 70A, a solid plane may be formed from like members, with the corresponding entrance/exit configuration shown in FIG. 70B. With reference to FIG. 70D, a second solid plane may perpendicularly intersect the first plane, with the corresponding entrance/exit configuration shown in FIG. 70C. To form the intersecting planar construction from two planar constructions, at the points of intersection, four-exit members may be substituted for the two-exit members or two-exit members may be rotated 90 degrees to redirect spheres from one plane into the other.

Figure 71A:
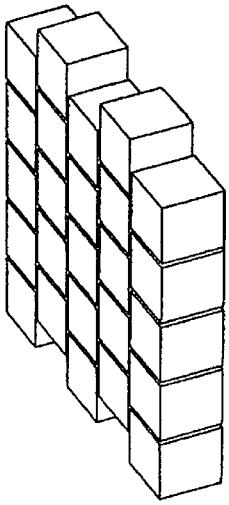
FIGS. 71A-71D perspective views of generic planar construction configurations.
Figure 71B:
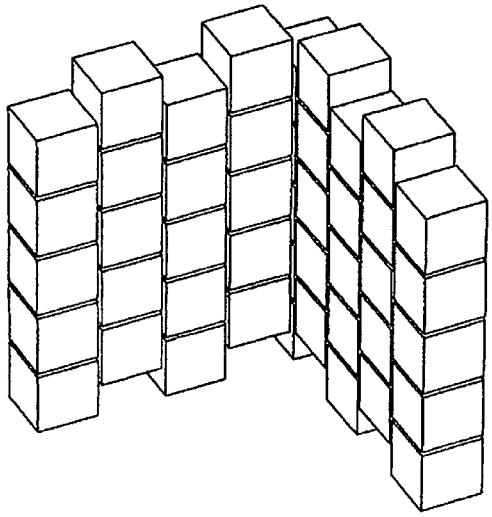
Figure 71C:
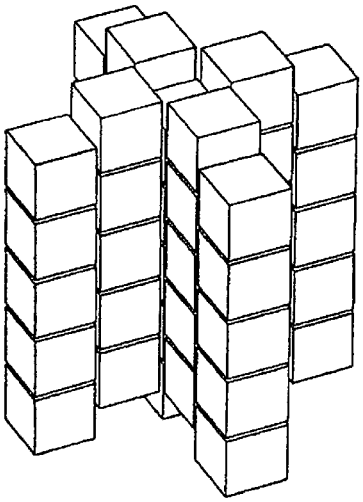
Figure 71D:
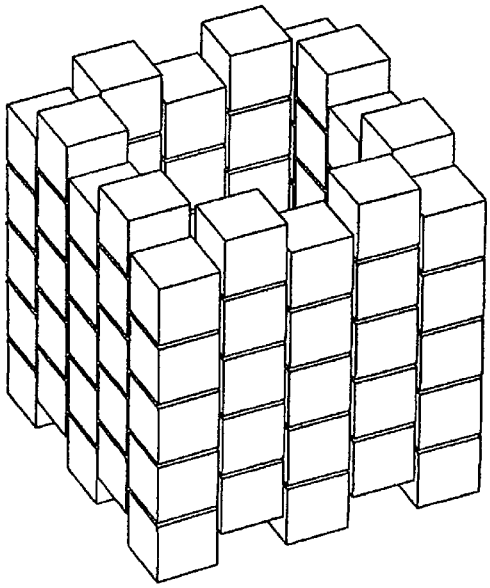
Figure 72A:
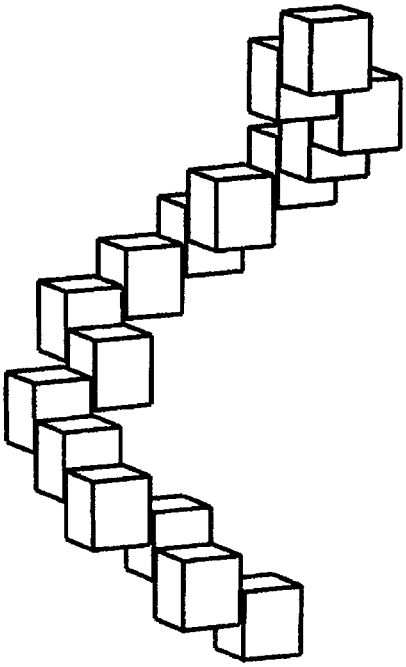
FIG. 72A is a perspective view of single counter-clockwise 5×5 helix of one complete revolution.
Figure 72B:
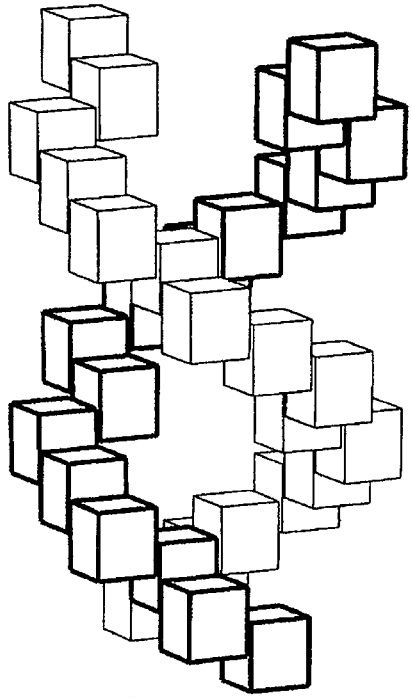
FIG. 72B is a perspective view of two independent, coaxial counter-clockwise 5×5 helixes.
Figure 72C:
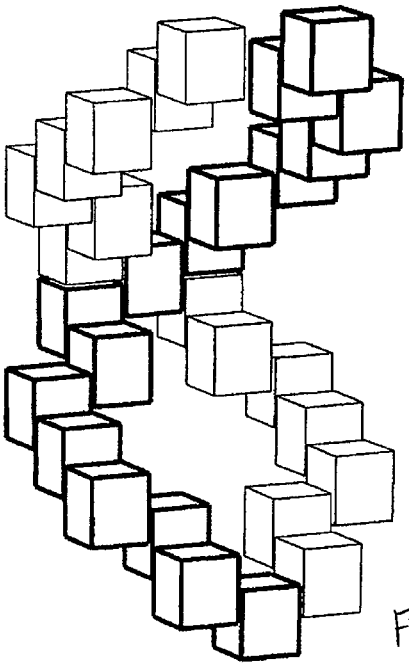
FIG. 72C is a perspective view of two interlocking, coaxial 5×5 helixes, one clockwise and one counter-clockwise.
Figure 72D:
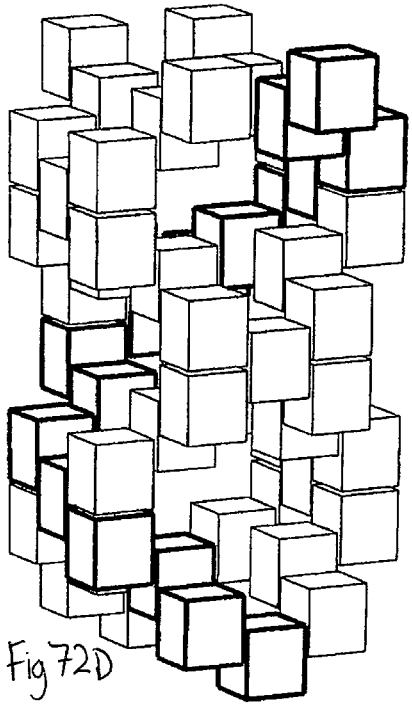
FIG. 72D is a perspective view of four 5×5 helixes, which is achieved with two structures of FIG. 72C with the second structure rotated 180 degrees.

With reference to FIGS. 71A and 71B, a planar construction and intersecting planar constructions are shown respectively. Rather than showing actual modular members, each member is represented by a cube in FIGS. 71A-71D, which is appropriate because the arrays and configurations formable by the modular members of the present invention do not depend on the particular member shape nor the joinery employed. The planes shown in FIG. 71B intersect at the ends of the planes rather than in the middle of the planes as in FIG. 71C. By intersecting at the planes' ends, a square shape may be formed as shown in FIG. 71. In each of FIGS. 71A-183D, adjacent members are vertically offset by ½ the members' height.

FIGS. 72A-72D show modular members represented by cubes in a helix, double helix, and quadruple helix respectively. Again, it can be appreciated from these Figures that regardless of the configuration achieved from assembling the modular members, the vertical offset is maintained.

Figure 73A:
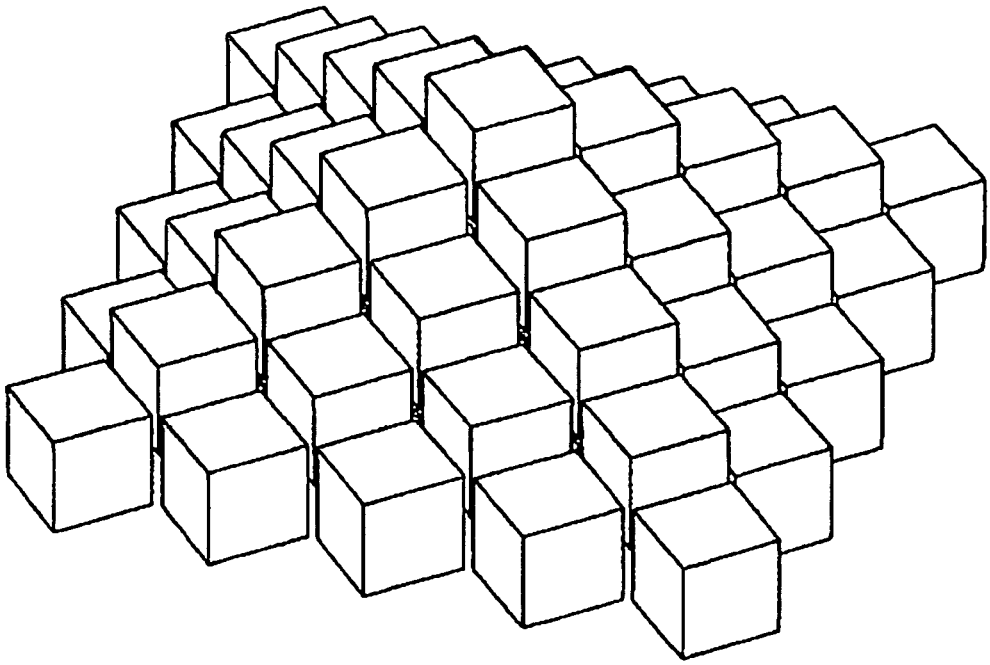
FIG. 73A is a perspective view of a generic pyramid.
Figure 73B:
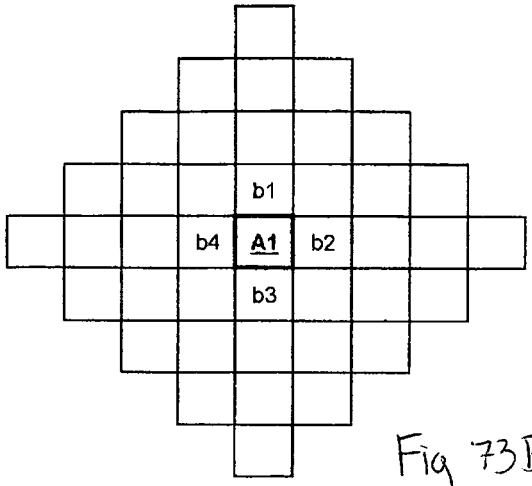
FIGS. 73B-73E are plan views of a pattern of blocks in a solid pyramid, layer by layer.
Figure 73C:
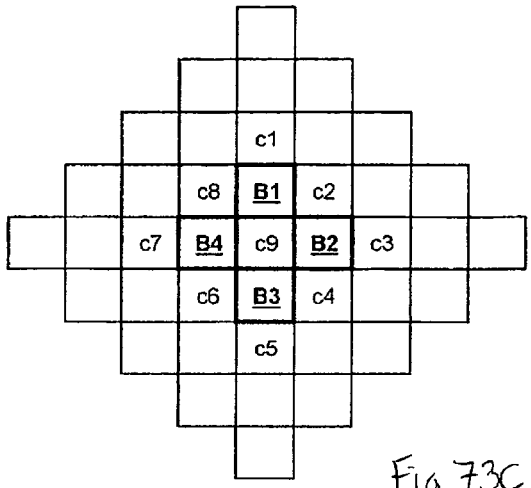
Figure 73D:
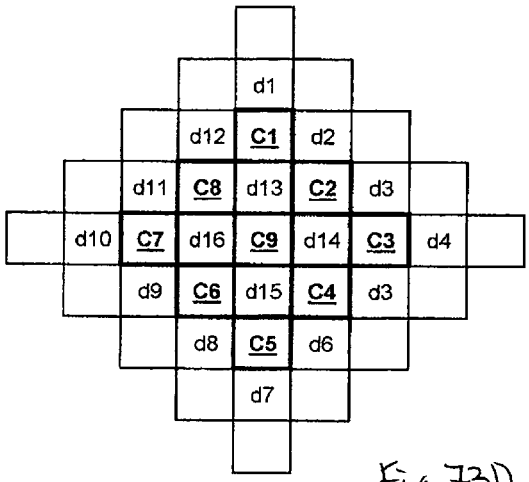
Figure 73E:
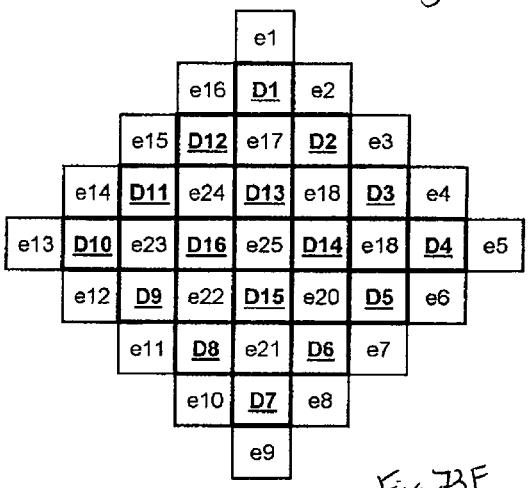
Figure 74A:
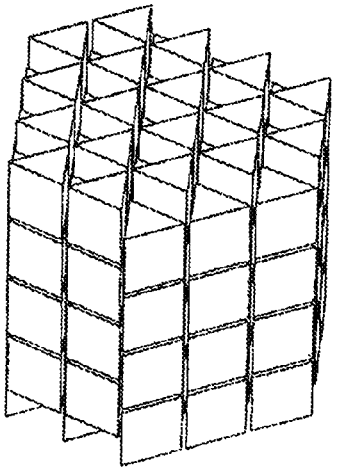
FIGS. 74A-74D are perspective and top views of various triangular constructions.
Figure 74B:
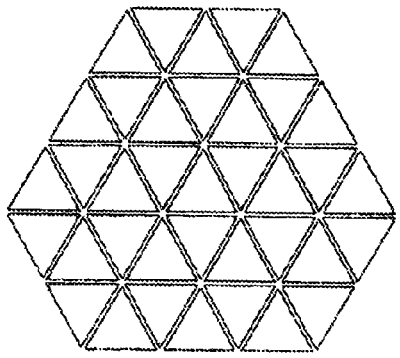
Figure 74C:
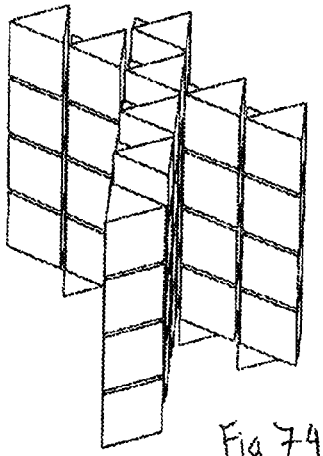
Figure 74D:
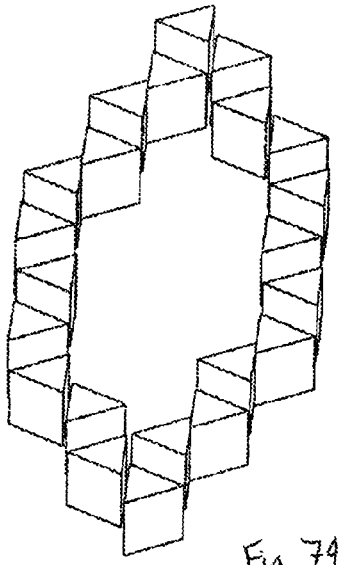

With reference to FIG. 73A, a pyramid configuration with five horizontal planes is shown with modular members represented by cubes. Again, it can be seen that the ½ step vertical offset is maintained. With reference to FIGS. 73B-73E, cross section top plan views of the pyramid of FIG. 73 are shown for four different horizontal planes. Specifically, FIG. 73B shows the topmost horizontal plane, which includes center-top member A1, which is surrounded by four additional members (b1-b4), which reside in the second horizontal plane, ½ step lower than A1 and the topmost vertical plane. FIG. 73C shows the next horizontal plane down, FIG. 73D shows the next plane down from there, and so forth.

FIGS. 74A-74D show modular members, represented by triangular members, in various configurations and arrangements. These arrangements are achievable with any number of shapes, as in FIGS. 15A-15L, and can have interlinking pathways among them as described by the entrance/exit configurations in FIGS. 15A, 15D, 15G, and 15J. As seen in FIGS. 74A-74D, the arrangements maintain the vertical offset.

Figure 75A:
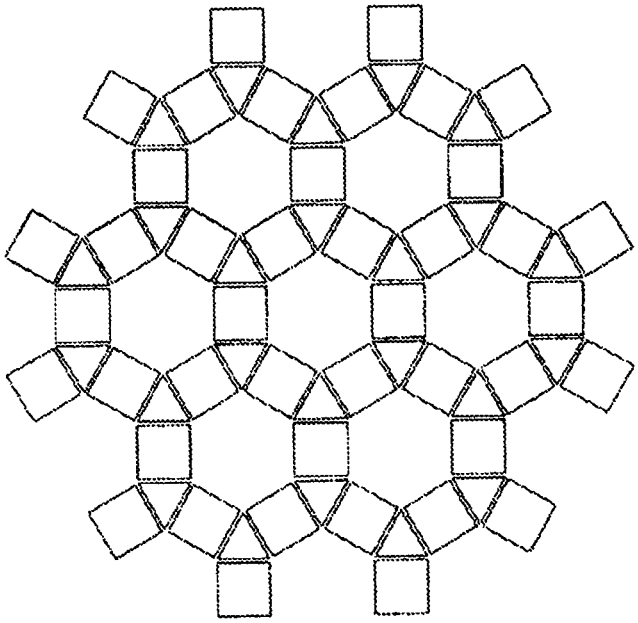
FIGS. 75A-75B are top and perspective views of mixed polygon tiling.
Figure 75B:
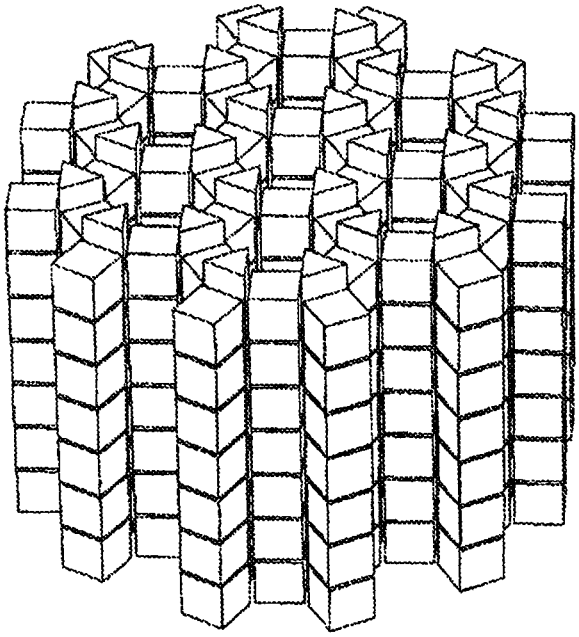
Figure 75C:
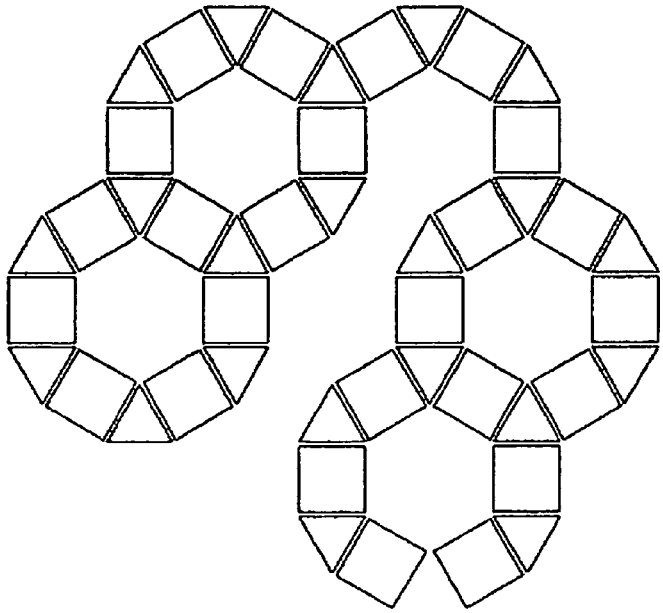
FIGS. 75C-75D are top and perspective views of mixed polygon tiling.
Figure 75D:
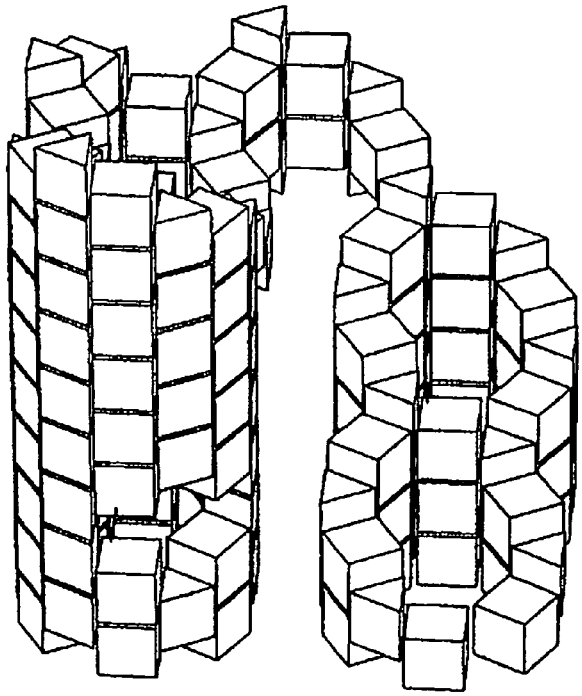

Because modular members of different shapes may have matching joineries, these differently shaped members may be joined, nonetheless, thereby allowing for mixed polygon tiling. With reference to FIGS. 75A-75D, modular members with two distinct shapes (cubes and triangles) are represented and shown being joined with one another in different configurations. FIG. 75A shows a top plan view of a configuration that creates circles with alternating cube-triangle members, and 75B shows a perspective view of the same configuration. The individual columns in FIGS. 75A and 75B can be achieved by vertically stacking similarly shaped members, as in FIG. 40B. FIG. 75C also shows a top plan view of a configuration that creates circles with alternating cube-triangle members, and FIG. 75D shows a perspective view of the same. From FIG. 75D, it can be seen that the columns forming the circles are characterized by vertical discontinuity, such that some of the members are supported from the horizontal joinery only and not their vertical joinery. This configuration results in some members being cantilevered from another column of members.

Accordingly, "dimensionally similar" members refers to members that substantially share external dimensions (discounting joinery, which may vary from "dimensionally similar" member to "dimensionally similar" member, and discounting internal shapes, such as the floor, walls, and other features of the internal chamber); e.g., two cubes with substantially the same height, width and depth, or two triangles with similar height and side dimensions. In contrast, "dimensionally dissimilar shapes" refers to any two members that do not substantially share external dimensions; e.g., the cube members and triangle members shown in FIGS. 75C and 75D represent dimensionally dissimilar shapes, and the cube shaped member shown in FIGS. 5A-5J is dimensionally dissimilar from the triangle shape shown in FIGS. 6A-6I.

The above constructions and construction types are merely illustrative of the sorts of assemblies that are possible. Other means for creating and building arrays are also available. For instance, arrays may be generated using a variety of algorithms, including constructions generated by computer-executed algorithms, whereby structures made with Cartesian shapes (e.g., cubes) in "shifted Cartesian space" are generated from a computer algorithm. Alternatively, a user may randomly create constructions that are solid, lattice, planar/intersecting planar, or some combination thereof. Alternatively, a user may create representational constructions fashioned to represent the likeness of other objects or animals, such as chair, a robot, a horse, etc.

Any lattice construction can be embedded within a solid construction by filling in the voids of the lattice. In this way, a solid mass of blocks may contain a set of interlocking helical or other types of pathways.

IV. Specialty Blocks

A variety of "specialty blocks" may be provided in accordance with the present invention. These blocks are generally configurable and useable with the members described above, and may conform to some but not all of the previously described principles.

One such specialty block includes a four-exit member, similar to the four-exit member described above. This block differs, however, by providing for removable stoppers or "blocking units" that may be inserted into the member thereby blocking any of the exits. Anywhere from zero to three stoppers may be inserted in the desired locations to block the desired exits. This allows for the creation of multiple block-exit configurations from a single base block design.

Figure 29:
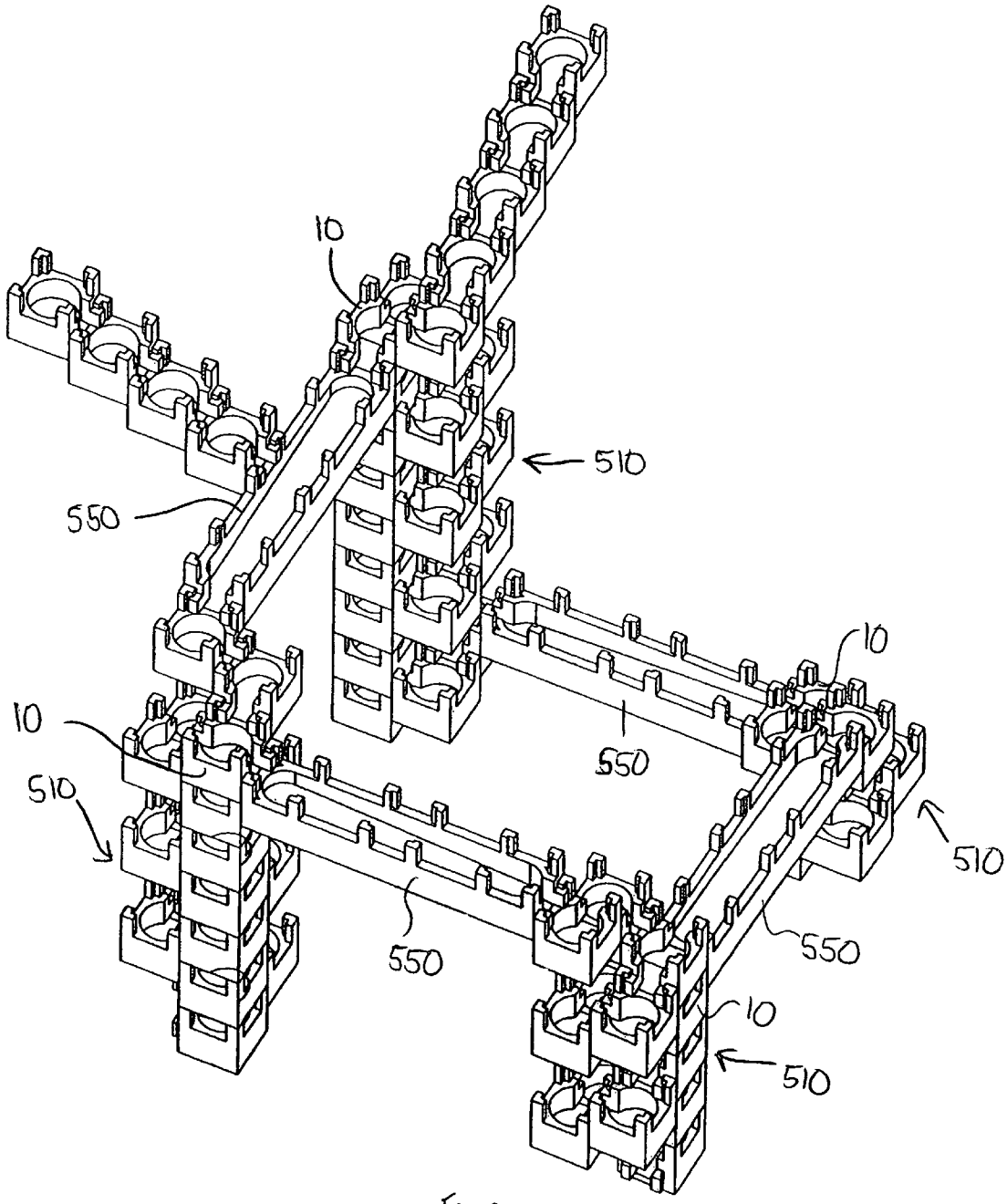
FIG. 29 is a perspective view of rectangular modular members arranged in a helix formation supported by cubical modular members arranged in helix formations as in FIG. 28, with additional vertical support members added into the cubical member helixes.
Figure 30B:
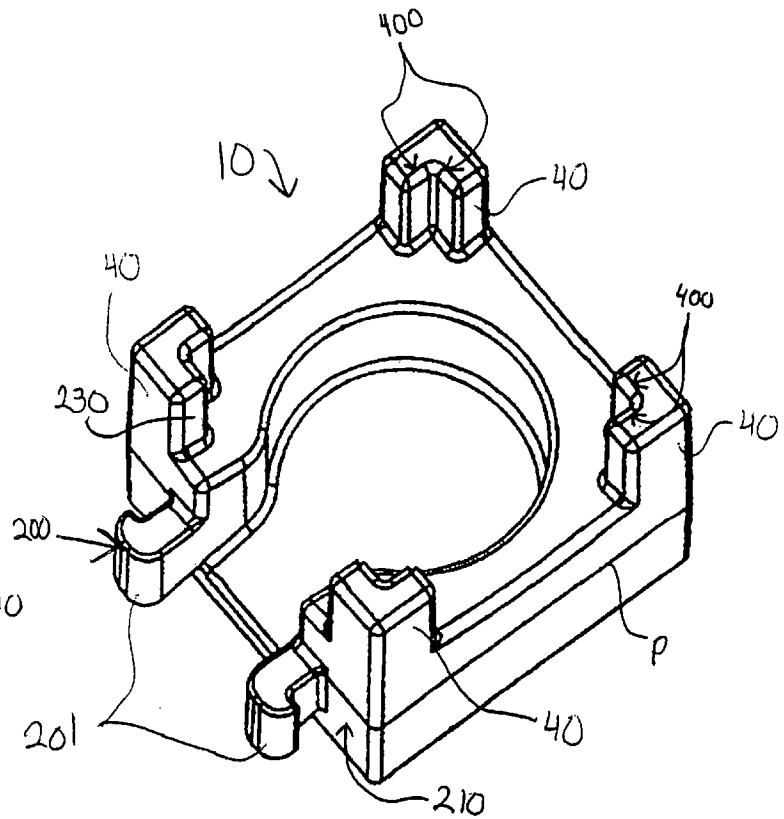
FIGS. 30A-30B are isometric views of a cubical 1-exit interlinkable modular member with a cylindrical chamber and solid bottom in accordance with one embodiment of the present invention.
Figure 30A:
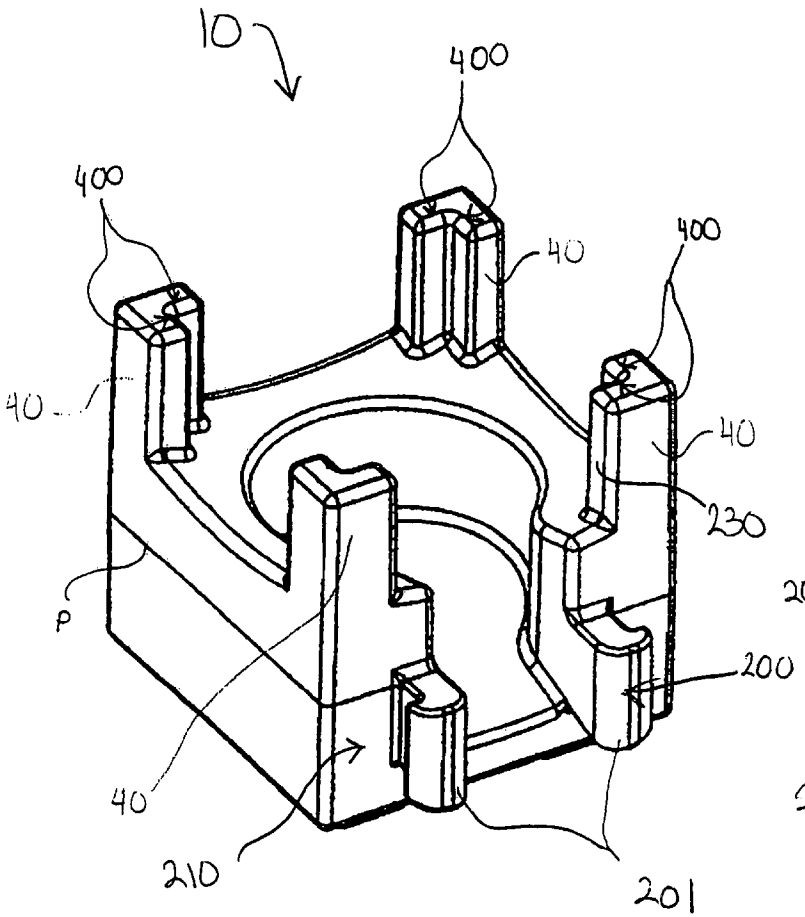
Figure 30D:
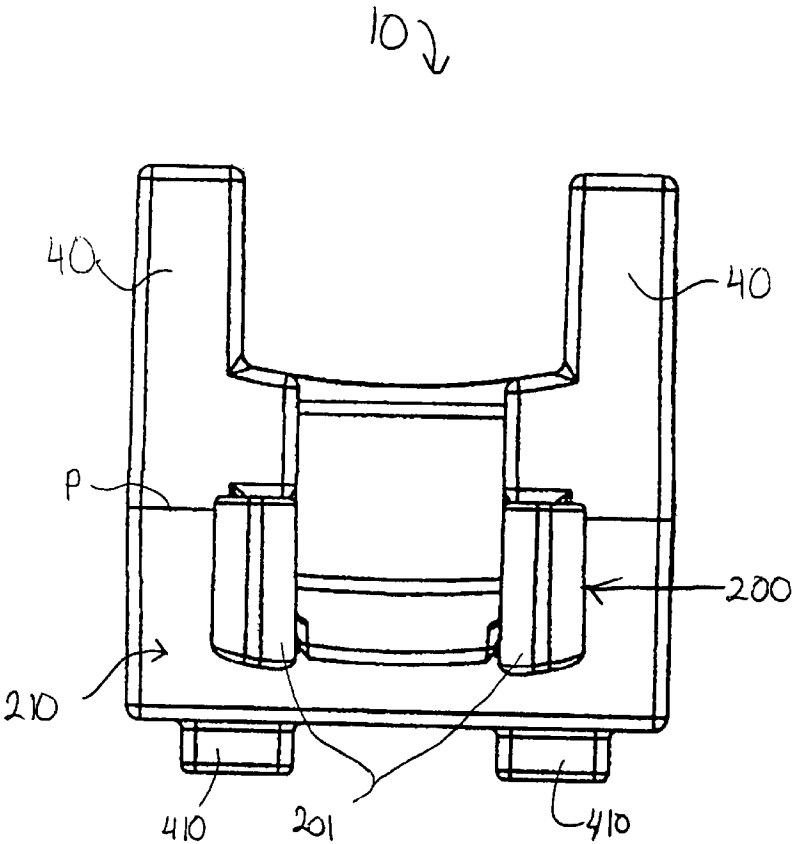
FIGS. 30C-30D are isometric wormseye and exit elevation views of the modular member of FIGS. 30A-30B.
Figure 30C:
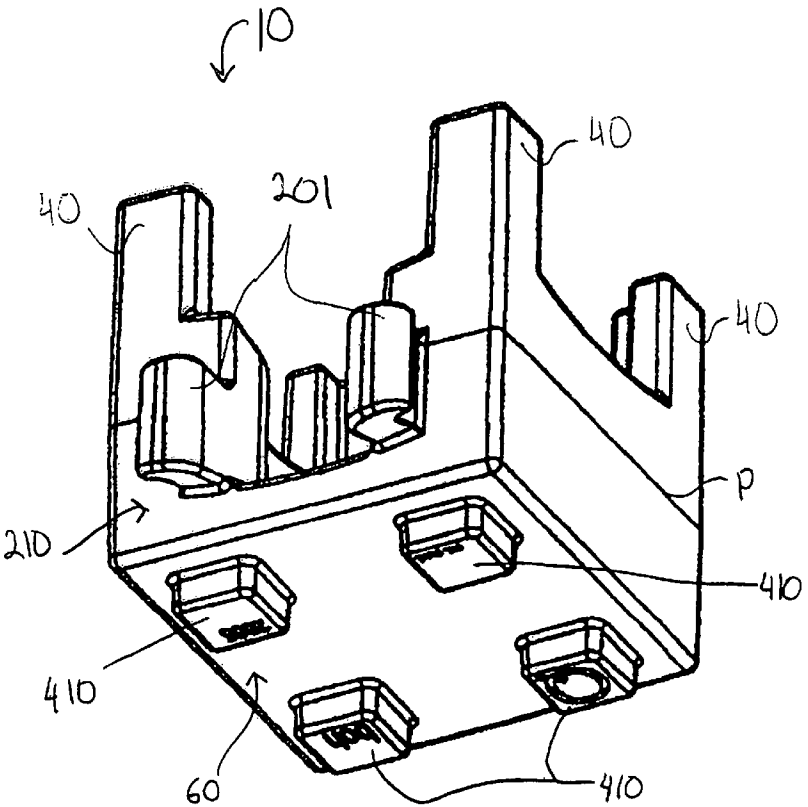
Figure 76A:
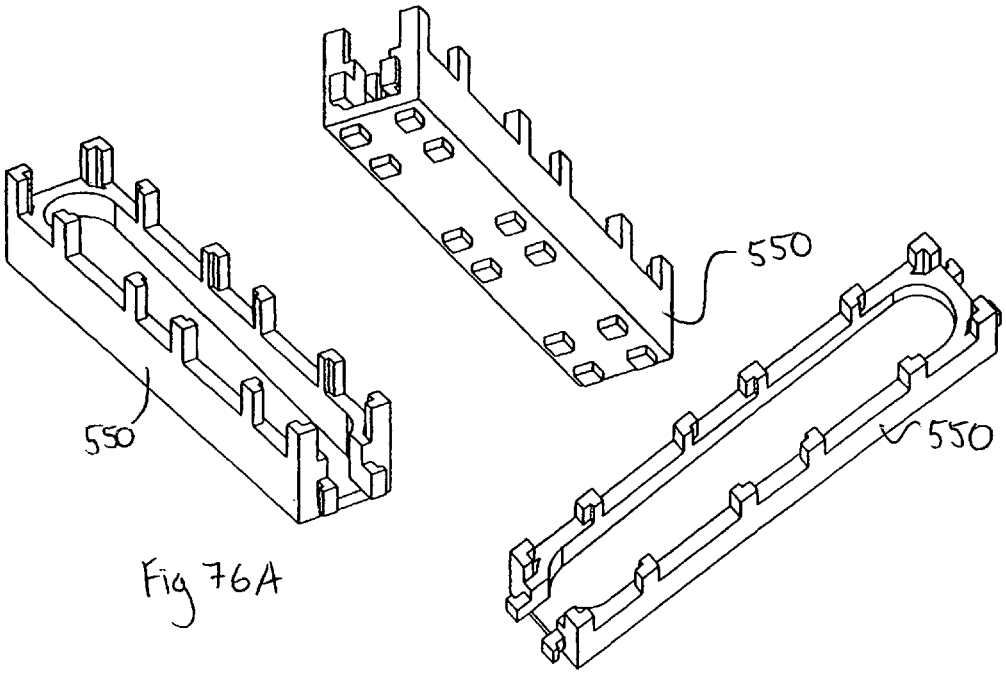
FIGS. 76A-76B are perspective, front, back, top, bottom, and side views of a rectangular modular member in accordance with one embodiment of the present invention.
Figure 76B:
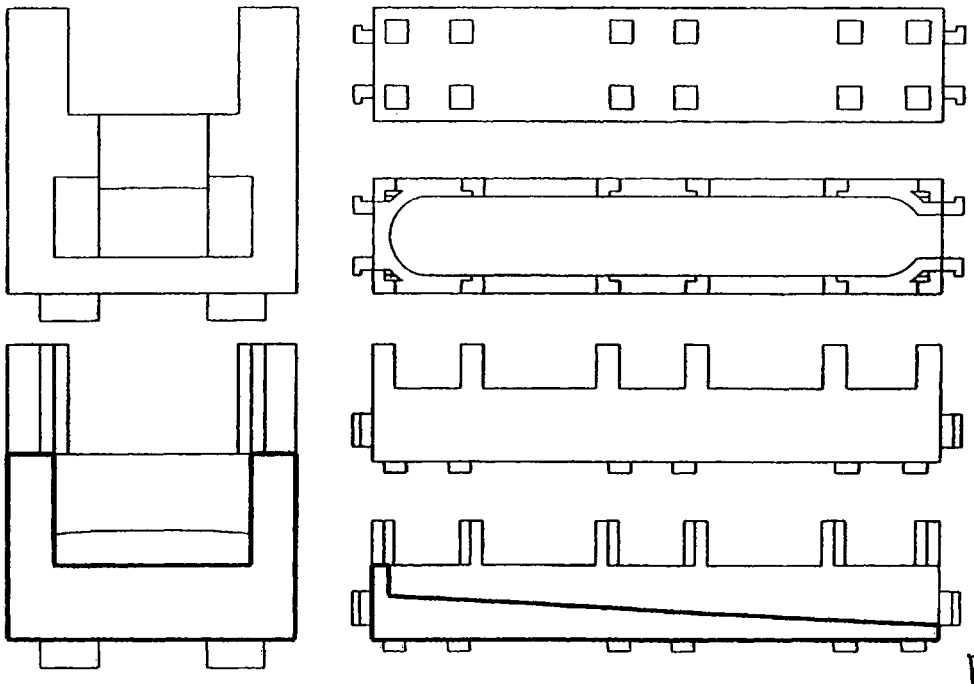

Another specialty block is the ramp rectangular block 550, shown in FIGS. 76A and 76B. This block shares some of the characteristics of the members described above, e.g., the ramp rectangular block shown in FIGS. 76A and 8B has the same height, width, and joineries as some of the cubical members previously described. However, as is evident from the illustrations in FIG. 76B, the ramp rectangular block has a greater length than the cubical members. The embodiment of the ramp rectangular block 550 shown in FIGS. 76A and 76B is one unit high and five units long and includes eight horizontal entrances (three along each side and one on each end). This embodiment also includes three sets of vertical male joints on its underside. As is apparent in FIGS. 76A and 76B, the member has an elongated floor along which a marble may roll. This member is useable with other non-ramp members, as shown in FIGS. 28 and 29. FIG. 28 shows four single helixes connected with four ramp rectangular blocks, and FIG. 29 shows a similar configuration where each of the four helixes includes additional support members. In these configurations, a marble entering a helix has a 50% chance of remaining in the helix and a 50% chance of leaving the helix in a ramp rectangular block.

A tube link is made using a compatible female entrance and a compatible male exit connected to one another by a rigid or flexible tube, with appropriate joinery, through which a sphere travels. A rigid tube may be a telescoping tube to allow for use in a wider range of configurations.

V. Materials, Manufacturing, and Scale

Figures 77A, 77B, 77C:
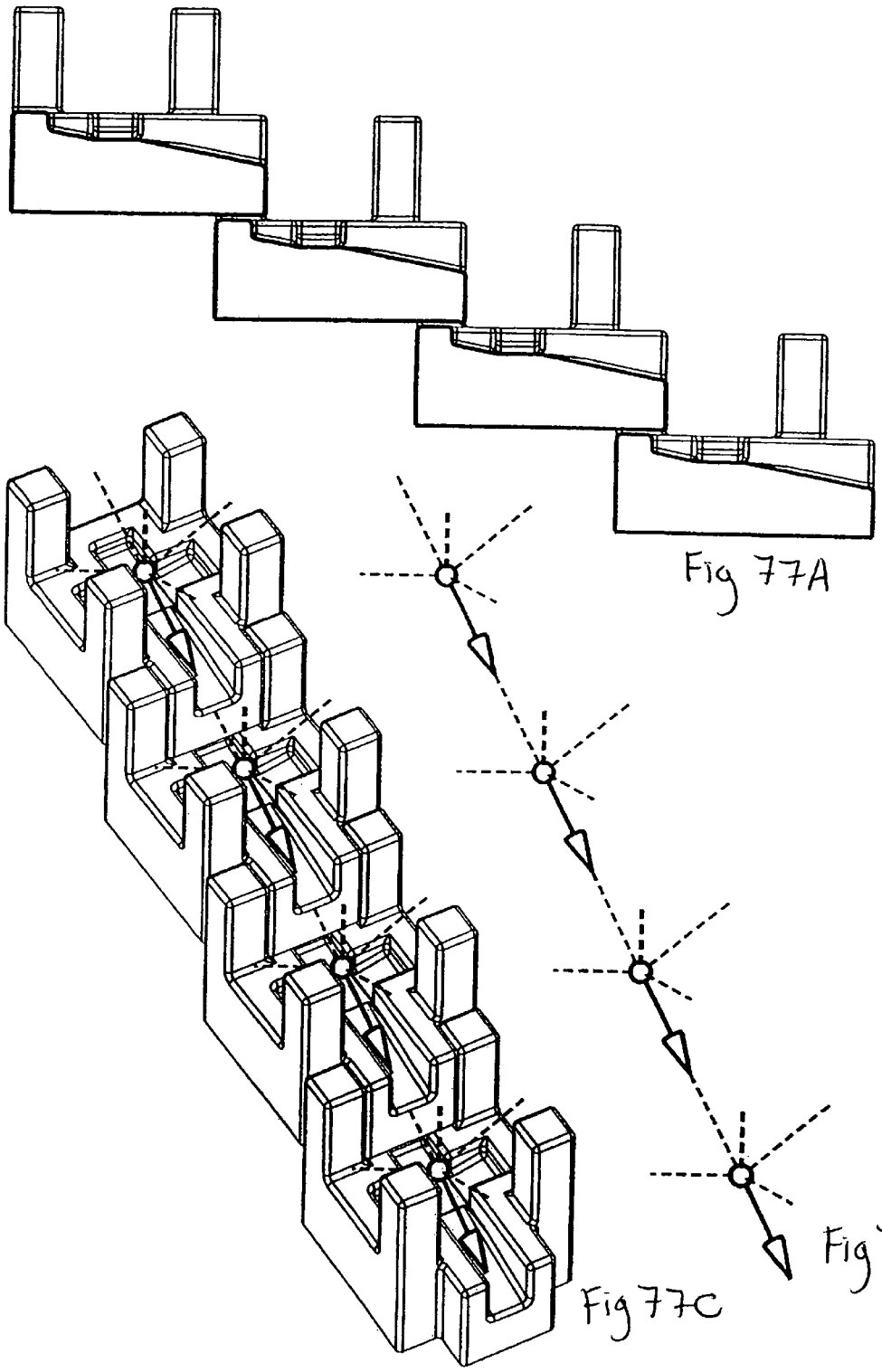
FIGS. 77A-77C are side and perspective views of ice blocks in cascade pattern, and the corresponding entrance/exit configuration in accordance with one embodiment of the present invention.

The modular members of the present invention may be constructed from a variety of suitable materials. In one embodiment the members are formed from a crystal clear polycarbonate, resin, or other plastic. The members may also be formed from a glass or metal material. Alternatively, the members may be made of foam to form larger shapes, such as 4-5" cubes, usable with larger spheres. This embodiment provides for modular members usable by children who are too young to have access to marbles without risk of choking. In yet another embodiment, the modular members may comprise inflatable plastic (i.e., filled with air), such that the pathways created are sufficiently wide to transport an even larger sphere, such as beach ball or volleyball. Other embodiments provide for constructing the modular members from wood, bamboo, or other carved materials. Alternatively, the modular members are formed of ice. In this embodiment, the joints may be a slushy substance capable of being manipulated and frozen, thereby adhering two members together. Accordingly, the example of ice members shown in FIGS. 12A-12J does not include any of the joineries shown in FIG. 33A-33B, 34A-34D, 35A-35C, 36A-36, 37A-37C, 38A-38C, or 39, nor the U-shaped joinery, but rather the slushy joinery is added to the members at construction. Additionally, the member shown in FIGS. 12A-12J is also suitable to transport a liquid in addition to a spherical object; the sole horizontal exit extends further than in the previously described cubical members to ensure that a liquid being transported thereby adequately crosses over the adjacent member's entrance and into the adjacent member's floor. When configured with other similar members, as seen in FIGS. 77A-77C, this member can transport a liquid along any desired pathway configuration.

A variety of manufacturing methods are also available for the modular members of the present invention. For modular members made of plastic, glass, or metal materials, injection molding, casting, or other known methods may be implemented. For modular members made of wood, bamboo, and similar materials, carving, routing, or other known methods may be implemented.

The modular members of the present invention may be created with a variety of sizes. For instance, cubical members of the present invention may have a length of 1½"-2", which may transport a ½"-1" sphere such as a marble or steel ball bearing. A reduced scale may entail cubical modular member with a length of ¾", which transports a ⅛"-½ sphere such as marble or bearing ball and is suitable for a travel set. A larger scale may entail cubical modular members with a length of >2", which may be suitable to transport larger spheres such as tennis balls, playground balls, or beach balls.

The materials, manufacturing methods, and scales described are merely illustrative. Those skilled in the art will appreciate that other suitable materials, manufacturing methods, and sizes may be implemented without departing from the spirit or scope of the present invention.

VI. Game Board

A game board may be used in conjunction with the modular members of the present invention to create a solitaire or group game. The game board may include an array of joints that align with the geometry of the particular members used for the game. For instance, the game board may provide a five by five grid of female joints constructed on a planar surface that forms the base for structures following the grid arrangement of geometric centers.

Figure 78:
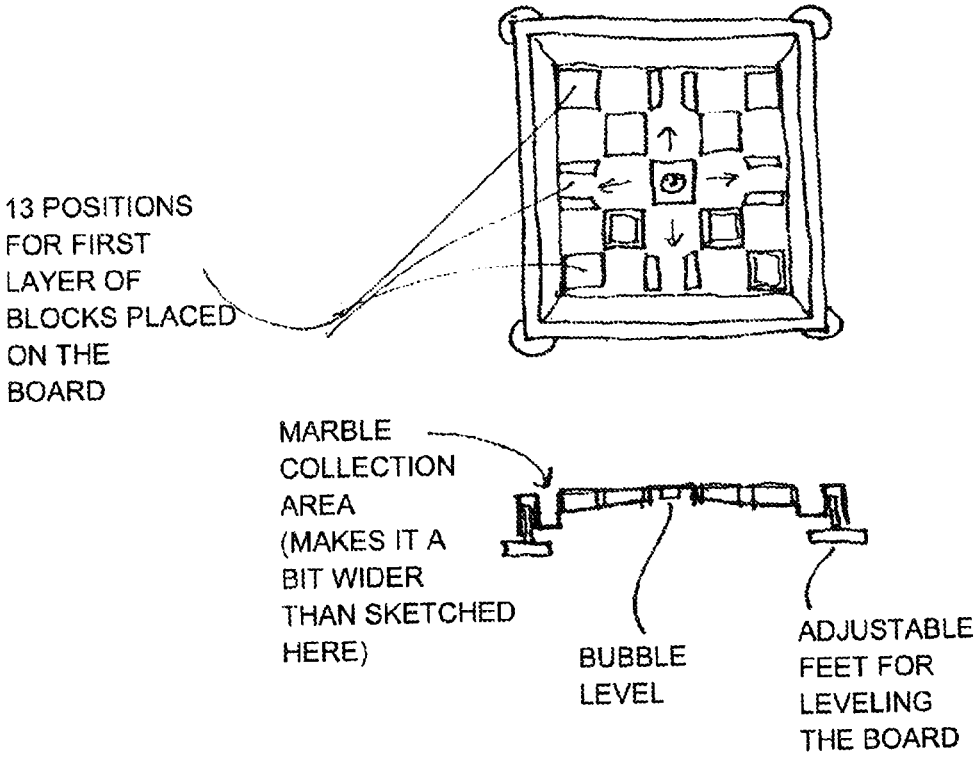
FIG. 78 is a top view of a gameboard in accordance with one embodiment of the present invention.

With reference to FIG. 78, the game board embodiment shown may be used in conjunction with cubical members. Similar game boards may be used with modular members of other shapes with underlying grid geometries, and those skilled in the art will appreciate that comparable game boards may be implemented with modular members with other underlying geometries as well.

The game board shown in FIG. 78 provides thirteen positions into which a first layer of modular members may be placed. These positions may provide for corresponding joineries for receiving and securing the modular members. During game play, players place modular members into the these positions, and, once a sufficient number of members are in place, players may build upon other modular members as well. Players may take sequential turns of introducing new members into play, with a goal of directing marbles towards a chosen side of the game board. The game board may include reservoirs which receive the spheres which drop out of structures of modular members created on top of the game board. The reservoirs provide a means of keeping score based on the number and kind of marbles that collect in the various reservoirs.

The rules for the game may be "open-source." The game board and the blocks, spheres, or other member types serve as the starting point and the players can determine their own rules. Games may be devised that are cooperative, competitive, or a combination of the two. Game boards, modular members, and marbles act as an "armature" for the creation of a plurality of future games. Part of the game play may include developing rule systems. Other variations and rules of game boards and game play may be implemented within the scope and spirit of the present invention.

The levelness of the game board is important for players who are particularly interested in the randomness of marble movement through constructed pathways. A bubble level (not shown) may be built into the game board together with adjustable feet so that the game board may be leveled before commencement of the game itself. Alternately a separate level may be placed on the game board for set-up and then removed prior to commencement of the game.

Although various representative embodiments of this invention have been described above with a certain degree of particularity, those skilled in the art could make numerous alterations to the disclosed embodiments without departing from the spirit or scope of the inventive subject matter set forth in the specification and claims.

What is claimed is:

1. A plurality of modular members arranged for assembly and disassembly, each of the plurality of modular members comprising:

a body structure having an internal chamber and defining a horizontal entrance to the internal chamber; and a substantially horizontal pathway surface arranged to transport an object from the internal chamber;

wherein:

the plurality of modular members are dimensionally similar; and the plurality of modular members comprises a coupling system having coupling components integral to the modular members for inter-securing the modular members, the coupling system defining structurally predetermined vertically offset coupled positions of coupled modular members wherein:

a first modular member connected and horizontally adjacent to a second modular member has a coupled position that is vertically offset from the second modular member;

a third modular member that is connected and horizontally adjacent to the second modular member has a coupled position that is vertically offset from the second modular member and selectively stackably arranged directly below the first modular member; and the respective substantially horizontal pathway surfaces of the first modular member and the second modular member are each aligned with the respective horizontal entrances of the second modular member and the third modular member to transport an object horizontally between respective modular members.

2. A plurality of modular members as recited in claim 1, wherein a top of each modular member is substantially open.

3. A plurality of modular members as recited in claim 1, wherein the horizontal pathway is suitable for transporting a sphere.

4. A plurality of modular members as recited in claim 3, wherein the horizontal pathway is suitable for transporting a marble.

5. A plurality of modular members as recited in claim 1, wherein the coupling system includes a male component and a female component, wherein, for the connection between the first modular member and that second modular, the first modular member contributes only the male component of the coupling system and the second modular member contributes only the female component of the coupling system.

6. A plurality of modular members as recited in claim 5, wherein the male component of the first modular member defines an exit therefrom.

7. A plurality of modular members as recited in claim 6, wherein the female component of the second modular member defines an opening into the second modular member and forming the horizontal entrance.

8. A plurality of modular members as recited in claim 7, wherein the coupled position of the first and second modular members is achieved whereby substantially vertical outer segments of the male component of the first modular member are wedged between substantially vertical inner segments of the female component of the second modular member and substantially vertical rib structures of the second modular member.

9. A plurality of modular members as recited in claim 8, wherein the substantially vertical outer segments of the male component of the first modular member and the substantially vertical segments of the female component of the second modular member have complimentary draft angles.

10. A plurality of modular members as recited in claim 7, wherein the coupled position of the first and second modular member is achieved whereby a vertical U-shaped segment of the male component of the first modular member is encountered by a dimensionally complimentary vertical U-shaped segment of the female component of the second modular member.

11. A plurality of modular members as recited in claim 7, wherein the coupled position of the first and second modular member is achieved whereby a bottom side of the first modular member is encountered by a male component of the second modular member.

12. A plurality of modular members as recited in claim 1, wherein the first modular member and the second modular member are vertically offset by ½ of the members' height when arranged in the coupled position.

13. A plurality of modular members as recited in claim 1, wherein coupled positions between coupled members comprises an aggregate slope between the members of 1:2.

14. A plurality of modular members as recited in claim 1, wherein each of the modular members comprises one of a finite number of standardized and dimensionally similar members that are joinable in a plurality of arrangements.

15. A plurality of modular members as recited in claim 14, wherein the finite number of standardized and dimensionally similar members are arranged to form a first vertically aligned column.

16. The plurality of modular members as recited in claim 15, wherein the finite number of standardized and dimensionally similar members are arranged to form a second vertically aligned column, wherein the first column is adjacently joined with the second column.

17. The plurality of modular members as recited in claim 16, wherein at least the first column or the second column is characterized by vertical discontinuity.

18. The plurality of modular members as recited in claim 17, wherein the vertical discontinuity is established by projecting at least a first member of the finite number of members over at least a second member of the finite number of members.

19. The plurality of modular members as recited in claim 16, wherein the finite number of standardized and dimensionally similar members defines a system of descending pathways between interlinked members.

20. The plurality of modular members as recited in claim 16, wherein the first column and the second column are vertically offset by ½ to ⅔ of the members' height.

21. The plurality of modular members as recited in claim 20, wherein the first column and the second column are vertically offset by ½ of the members' height.

22. The plurality of modular members as recited in claim 16, wherein the finite number of members are arranged to form, from a top view thereof, a rectilinear grid.

23. The plurality of modular members as recited in claim 1, each of the modular members comprising at least three openings in side surfaces thereof, each of the three openings defining a horizontal entrance configured to allow entry of a sphere in substantially the upper half of the respective modular member and at least one of the three openings further defining a horizontal exit configured to allow exit of a sphere from the lower half of the member.

24. The plurality of modular members as recited in claim 23, wherein a unified opening defines the horizontal exit and one of the horizontal entrances such that the one of the horizontal entrances is arranged above the horizontal exit.

25. The plurality of modular members as recited in claim 24, wherein the unified opening defines the horizontal exit and the one of the horizontal entrances contiguously.

26. The plurality of modular members as recited in claim 23, wherein one of the modular members defines two horizontal exits, the two horizontal exits being configured on opposing sides of modular member.

27. The plurality of modular members as recited in claim 23, wherein one of the modular members defines two horizontal exits, the two horizontal exits being configured on adjacent sides of modular member.

28. The plurality of modular members as recited in claim 23, wherein one of the modular members defines three horizontal exits.

29. The plurality of modular members as recited in claim 23, wherein one of the modular members defines four horizontal exits.

30. The plurality of modular members as recited in claim 23, wherein each of the modular members define an internal floor surface.

31. The plurality of modular members as recited in claim 30, wherein for each horizontal entrance the respective modular member defines an opening to the floor surface.

32. The plurality of modular members as recited in claim 30, wherein the substantially horizontal pathway surface is arranged along the floor surface and leads to the horizontal exit.

33. The plurality of modular members as recited in claim 31, whereby a rolling object entering one of the horizontal entrances drops down to the floor surface, rolls to the horizontal exit, and drops out the horizontal exit thereby exiting the internal chamber.

34. The plurality of modular members as recited in claim 23, wherein each of the modular members define a vertical entrance.

35. The plurality of modular members as recited in claim 30, wherein each of the modular members are substantially cubical.

36. The plurality of modular members as recited in claim 35, wherein each of the modular members define at least four horizontal entrances.

37. The plurality of modular members as recited in claim 35, wherein one of the modular members defines two horizontal exits, the two horizontal exits being configured on opposing sides of modular member.

38. The plurality of modular members as recited in claim 35, wherein one of the modular members defines two horizontal exits, the two horizontal exits being configured on adjacent sides of modular member.

39. The plurality of modular members as recited in claim 35, wherein one of the modular members defines three horizontal exits.

40. The plurality of modular members as recited in claim 35, wherein one of the modular members defines four horizontal exits.

41. The plurality of modular members as recited in claim 32, wherein the floor surface forms a concave-up shape with the substantially horizontal pathway surface formed therein and leading to the horizontal exit.

42. The plurality of modular members as recited in claim 41, wherein the modular member comprises two horizontal exits formed on opposing sides thereof.

43. The plurality of modular members as recited in claim 42, wherein the floor surface comprises the substantially horizontal pathway formed therein and another substantially horizontal pathway each pathway being sloped and leading to each of the horizontal exits.

44. The plurality of modular members as recited in claim 32, wherein the modular member comprises two horizontal exits formed on opposing sides thereof and the floor surface is an opposingly pitched shape that forms the substantially horizontal pathway and another substantially horizontal pathway each leading to each of the horizontal exits.

45. The plurality of modular members as recited in claim 1, each of the modular members defining a plurality of horizontal entrances defined in substantially the upper half of the modular member and at least one horizontal exit defined in substantially the lower half of the modular member.

46. The plurality of modular members as recited in claim 1, further comprising a vertical joinery system for securing the first modular member to the third modular member when the third modular member is arranged below the first modular member.

47. The plurality of modular members as recited in claim 46, wherein the vertical joinery system includes a male joint component and a female joint component.

48. The plurality of modular members as recited in claim 47, wherein male joint component is arranged at a bottom portion of the first modular member and the female joint component is arranged at a top portion of the third modular member.

49. The plurality of modular members as recited in claim 1, each of the modular members comprising:

a floor arranged in the chamber;

at least three horizontal entrances, each horizontal entrance defining an opening leading to the internal chamber; and at least one horizontal exit, wherein, the substantially horizontal pathway surface extends along the floor to an exterior side of the modular member, wherein the substantially horizontal pathway surface forms a downward outward sloping surface within the floor.

50. The plurality of modular members as recited in claim 43, wherein the substantially horizontal pathway creates an unstable equilibrium for a sphere-shaped object entering one of the horizontal entrances of the modular member.

51. The plurality of modular members as recited in claim 43, wherein a back-and-forth rocking motion in a sphere-shaped object entering one of the horizontal entrances is induced by the substantially concave up shape of the floor.

52. The plurality of modular members as recited in claim 51, wherein the back-and-forth rocking motion is perpendicular to the substantially horizontal pathway.

53. The plurality of modular members as recited in claim 49, wherein the floor forms a bias about the substantially horizontal pathway towards a center of the modular member.

54. The plurality of modular members as recited in claim 53, wherein the substantially horizontal pathway forms a bias towards the exterior side of the modular member.

55. The plurality of modular members as recited in claim 49, wherein a surface of the floor deflects objects moving thereover towards a center of the modular member.

56. The plurality of modular members as recited in claim 49, wherein the modular member defines two horizontal exits, each of the two horizontal exits defining a respective substantially horizontal pathway leading from the floor to an exterior side of the modular member, wherein each substantially horizontal pathway forms a downward outward sloping surface within the floor.

57. The plurality of modular members as recited in claim 49, wherein the modular member defines two horizontal exits, each of the two horizontal exits defining a respective substantially horizontal pathway leading from an interior of the modular member to an exterior of the modular member.

* * * * *